US009330825B2

(12) United States Patent
Sarai

(10) Patent No.: US 9,330,825 B2
(45) Date of Patent: May 3, 2016

(54) MAGNETIC CONFIGURATIONS

(76) Inventor: Mohammad Sarai, Baltimore, MD (US)

( * ) Notice: Subject to any disclaimer, the term of this patent is extended or adjusted under 35 U.S.C. 154(b) by 0 days.

(21) Appl. No.: 13/445,238

(22) Filed: Apr. 12, 2012

(65) Prior Publication Data

US 2012/0262261 A1 Oct. 18, 2012

Related U.S. Application Data

(60) Provisional application No. 61/457,498, filed on Apr. 12, 2011, provisional application No. 61/627,707, filed on Oct. 17, 2011, provisional application No. 61/685,159, filed on Mar. 13, 2012.

(51) Int. Cl.
*H01F 3/00* (2006.01)
*H01F 7/02* (2006.01)

(52) U.S. Cl.
CPC ..... *H01F 7/02* (2013.01)

(58) Field of Classification Search
CPC ..... B23Q 3/152; H01F 7/0278
USPC ..... 335/296, 306, 295, 287, 298
See application file for complete search history.

(56) References Cited

U.S. PATENT DOCUMENTS

| | | | | |
|---|---|---|---|---|
| 381,968 | A | 5/1888 | Tesla | |
| 493,858 | A | 3/1893 | Edison | |
| 687,292 | A | 11/1901 | Armstrong | |
| 996,933 | A | 7/1911 | Lindquist | |
| 1,171,351 | A | 2/1916 | Neuland | |
| 1,236,234 | A | 8/1917 | Troje | |
| 2,209,558 | A * | 7/1940 | Bing et al. | 335/295 |
| 2,243,555 | A | 5/1941 | Faus | |
| 2,346,193 | A * | 4/1944 | Simmons | 335/295 |
| 2,389,298 | A | 11/1945 | Ellis | |
| 2,438,231 | A | 3/1948 | Schultz | |
| 2,471,634 | A | 5/1949 | Vennice | |
| 2,570,625 | A | 10/1951 | Zimmerman et al. | |

(Continued)

FOREIGN PATENT DOCUMENTS

| | | |
|---|---|---|
| CN | 1615573 A | 5/2005 |
| DE | 2938782 A1 | 4/1981 |

(Continued)

OTHER PUBLICATIONS

Atallah, K., Calverley, S.D., D. Howe, 2004, "Design, analysis and realisation of a high-performance magnetic gear", IEE Proc.-Electr. Power Appl., vol. 151, No. 2, Mar. 2004.

(Continued)

*Primary Examiner* — Alexander Talpalatski

(57) ABSTRACT

A field system includes a first component having at least one first field source having opposite polarities and a second component having at least one second field source having opposite polarities. At least one of the first and second components has a movement relative to the other of the components to produce a field interaction therebetween. The at least one first and the at least one second field sources are oriented relative to each other such that in the field interaction the resulting repelling forces and attractive forces substantially cancel each other out and there is an increase and a decrease in the field strength of at least some of the field sources. Therefore, the field system, which can be a magnetic configuration system, provides a field strength change with a minimum energy input which can increase the efficiency of many machines such as MRI or electricity generators.

65 Claims, 85 Drawing Sheets

(56) References Cited

U.S. PATENT DOCUMENTS 2,722,617 A 11/1955 Cluwen et al.
2,932,545 A 4/1960 Foley
3,055,999 A 9/1962 Lucas
3,102,314 A 9/1963 Alderfer
3,208,296 A * 9/1965 Baermann ..... 474/142
3,227,931 A 1/1966 Adler
3,231,789 A * 1/1966 Engelsted ..... 335/295
3,238,399 A 3/1966 Johanees et al.
3,288,511 A 11/1966 Tavano
3,301,091 A 1/1967 Reese
3,325,758 A 6/1967 Cook
3,382,386 A 5/1968 Schlaeppi
3,397,439 A * 8/1968 Hanau ..... 19/258
3,408,104 A 10/1968 Raynes
3,468,576 A 9/1969 Beyer et al.
3,474,366 A 10/1969 Barney
3,521,216 A 7/1970 Tolegian
3,645,650 A 2/1972 Laing
3,668,670 A 6/1972 Andersen
3,684,992 A 8/1972 Huguet et al.
3,696,258 A 10/1972 Anderson et al.
3,768,054 A 10/1973 Neugebauer
3,790,197 A 2/1974 Parker
3,791,309 A 2/1974 Baermann
3,802,034 A 4/1974 Bookless
3,803,433 A 4/1974 Ingenito
3,808,577 A 4/1974 Mathauser
3,845,430 A 10/1974 Petkewicz et al.
3,893,059 A 7/1975 Nowak
3,906,268 A 9/1975 de Graffenried
4,055,824 A * 10/1977 Baermann ..... 335/288
4,079,558 A 3/1978 Gorham
4,117,431 A 9/1978 Eicher
4,128,280 A * 12/1978 Purtschert ..... 384/107
4,129,846 A 12/1978 Yablochnikov
4,206,749 A 6/1980 Bucalo
4,209,905 A 7/1980 Gillings
4,222,489 A 9/1980 Hutter
4,296,394 A 10/1981 Ragheb
4,352,960 A 10/1982 Dormer et al.
4,355,236 A * 10/1982 Holsinger ..... 250/396 ML
4,399,595 A 8/1983 Yoon et al.
4,401,960 A 8/1983 Uchikune et al.
4,416,127 A 11/1983 Gomez-Olea Naveda
4,453,294 A 6/1984 Morita
4,467,463 A 8/1984 Yano
4,535,278 A 8/1985 Asakawa
4,547,756 A 10/1985 Miller et al.
4,605,911 A 8/1986 Jin
4,614,930 A * 9/1986 Hickey et al. ..... 335/302
4,616,796 A * 10/1986 Inoue ..... 248/206.5
4,629,131 A 12/1986 Podell
4,645,283 A 2/1987 MacDonald et al.
4,680,494 A 7/1987 Grosjean
4,764,743 A 8/1988 Leupold et al.
4,837,539 A 6/1989 Baker
4,847,582 A 7/1989 Cardone et al.
4,849,749 A 7/1989 Fukamachi et al.
4,862,128 A * 8/1989 Leupold ..... 335/306
H693 H 10/1989 Leupold
4,893,103 A 1/1990 Leupold
4,896,754 A 1/1990 Carlson et al.
4,912,727 A 3/1990 Schubert
4,941,236 A 7/1990 Sherman et al.
4,956,625 A 9/1990 Cardone et al.
4,993,950 A 2/1991 Mensor, Jr.
4,994,778 A * 2/1991 Leupold ..... 335/306
4,996,457 A 2/1991 Hawsey et al.
5,013,949 A 5/1991 Mabe, Jr.
5,020,625 A 6/1991 Yamauchi et al.
5,050,276 A 9/1991 Pemberton
5,062,855 A 11/1991 Rincoe
5,123,843 A 6/1992 Van der Zel et al.
5,155,651 A 10/1992 Yoda et al.
5,179,307 A 1/1993 Porter
5,181,783 A * 1/1993 Sherman et al. ..... 384/114
5,213,307 A 5/1993 Perrillat-Amede
5,280,208 A * 1/1994 Komura et al. ..... 310/90
5,291,171 A 3/1994 Kobayashi et al.
5,302,929 A 4/1994 Kovacs
5,309,680 A 5/1994 Kiel
5,317,228 A 5/1994 Leupold
5,345,207 A 9/1994 Gebele
5,367,891 A 11/1994 Furuyama
5,382,935 A * 1/1995 Doyelle ..... 335/288
5,383,049 A 1/1995 Carr
5,394,132 A 2/1995 Poil
5,399,933 A 3/1995 Tsai
5,414,783 A * 5/1995 Bov et al. ..... 382/320
5,425,763 A 6/1995 Stemmann
5,426,338 A 6/1995 Leupold
5,440,997 A 8/1995 Crowley
5,441,453 A * 8/1995 Lach ..... 464/180
5,461,386 A 10/1995 Knebelkamp
5,492,572 A 2/1996 Schroeder et al.
5,495,221 A 2/1996 Post
5,506,459 A * 4/1996 Ritts ..... 310/90.5
5,512,732 A 4/1996 Yagnik et al.
5,570,084 A 10/1996 Ritter et al.
5,582,522 A 12/1996 Johnson
5,604,960 A 2/1997 Good
5,631,093 A 5/1997 Perry et al.
5,631,618 A * 5/1997 Trumper et al. ..... 335/299
5,633,555 A * 5/1997 Ackermann et al. ..... 310/75 D
5,635,889 A 6/1997 Stelter
5,637,972 A 6/1997 Randall et al.
5,730,155 A 3/1998 Allen
5,742,036 A 4/1998 Schramm, Jr. et al.
5,759,054 A 6/1998 Spadafore
5,788,493 A 8/1998 Tanaka et al.
5,838,304 A 11/1998 Hall
5,847,480 A * 12/1998 Post ..... 310/90.5
5,852,393 A 12/1998 Reznik et al.
5,935,155 A 8/1999 Humayun et al.
5,956,778 A 9/1999 Godoy
5,983,406 A 11/1999 Meyerrose
5,994,809 A * 11/1999 Ackermann ..... 310/103
6,039,759 A 3/2000 Carpentier et al.
6,047,456 A 4/2000 Yao et al.
6,072,251 A 6/2000 Markle
6,074,420 A 6/2000 Eaton
6,115,849 A 9/2000 Meyerrose
6,118,271 A 9/2000 Ely et al.
6,120,283 A 9/2000 Cousins
6,142,779 A 11/2000 Siegel et al.
6,170,131 B1 1/2001 Shin
6,187,041 B1 2/2001 Garonzik
6,205,012 B1 3/2001 Lear
6,210,033 B1 4/2001 Karkos, Jr. et al.
6,224,374 B1 5/2001 Mayo
6,234,772 B1 * 5/2001 Wampler et al. ..... 417/423.12
6,234,833 B1 5/2001 Tsai et al.
6,241,069 B1 6/2001 Mazur et al.
6,273,918 B1 8/2001 Yuhasz et al.
6,275,778 B1 8/2001 Shimada et al.
6,285,097 B1 9/2001 Hazelton et al.
6,304,163 B1 * 10/2001 Rippingale ..... 335/303
6,387,096 B1 5/2002 Hyde, Jr.
6,457,179 B1 10/2002 Prendergast
6,467,326 B1 10/2002 Garrigus
6,489,871 B1 12/2002 Barton
6,535,092 B1 3/2003 Hurley et al.
6,540,515 B1 4/2003 Tanaka
6,599,321 B2 7/2003 Hyde, Jr.
6,607,304 B1 8/2003 Lake et al.
6,641,378 B2 11/2003 Davis et al.
6,652,278 B2 11/2003 Honkura et al.
6,653,919 B2 11/2003 Shih-Chung et al.
6,684,794 B2 * 2/2004 Fiske et al. ..... 104/281
6,720,698 B2 4/2004 Galbraith
6,747,537 B1 6/2004 Mosteller
6,841,910 B2 1/2005 Gery
6,842,332 B1 1/2005 Rubenson et al.
6,847,134 B2 1/2005 Frissen et al.

(56) References Cited

U.S. PATENT DOCUMENTS

| | | | | |
|---|---|---|---|---|
| 6,850,139 | B1 | 2/2005 | Dettmann et al. | |
| 6,862,748 | B2 | 3/2005 | Prendergast | |
| 6,864,773 | B2 | 3/2005 | Perrin | |
| 6,876,284 | B2 | 4/2005 | Wright et al. | |
| 6,906,789 | B2 | 6/2005 | Carter et al. | |
| 6,913,471 | B2 | 7/2005 | Smith | |
| 6,927,657 | B1 | 8/2005 | Wu | |
| 6,954,968 | B1 | 10/2005 | Sitbon | |
| 6,971,147 | B2 | 12/2005 | Halstead | |
| 7,016,492 | B2 | 3/2006 | Pan et al. | |
| 7,031,160 | B2 | 4/2006 | Tillotson | |
| 7,033,400 | B2 | 4/2006 | Currier | |
| 7,038,565 | B1 * | 5/2006 | Chell | 335/229 |
| 7,065,860 | B2 | 6/2006 | Aoki et al. | |
| 7,066,739 | B2 | 6/2006 | McLeish | |
| 7,066,778 | B2 | 6/2006 | Kretzschmar | |
| 7,101,374 | B2 | 9/2006 | Hyde, Jr. | |
| 7,137,727 | B2 | 11/2006 | Joseph et al. | |
| 7,186,265 | B2 | 3/2007 | Sharkawy et al. | |
| 7,224,252 | B2 | 5/2007 | Meadow, Jr. et al. | |
| 7,264,479 | B1 | 9/2007 | Lee | |
| 7,265,470 | B1 * | 9/2007 | Paden et al. | 310/156.43 |
| 7,276,025 | B2 | 10/2007 | Roberts et al. | |
| 7,339,790 | B2 | 3/2008 | Baker et al. | |
| 7,354,021 | B1 * | 4/2008 | Leupold | 244/171.1 |
| 7,359,037 | B2 | 4/2008 | Carter et al. | |
| 7,362,018 | B1 | 4/2008 | Kulogo et al. | |
| 7,365,623 | B2 | 4/2008 | Xia | |
| 7,368,838 | B2 | 5/2008 | Binnard et al. | |
| 7,372,548 | B2 | 5/2008 | Carter et al. | |
| 7,381,181 | B2 | 6/2008 | Lau et al. | |
| 7,402,175 | B2 | 7/2008 | Azar | |
| 7,438,726 | B2 | 10/2008 | Erb | |
| 7,444,683 | B2 | 11/2008 | Prendergast et al. | |
| 7,453,341 | B1 | 11/2008 | Hildenbrand | |
| 7,498,914 | B2 | 3/2009 | Miyashita et al. | |
| 7,583,500 | B2 | 9/2009 | Ligtenberg et al. | |
| 7,598,646 | B2 | 10/2009 | Cleveland | |
| 7,715,890 | B2 | 5/2010 | Kim et al. | |
| 7,775,567 | B2 | 8/2010 | Ligtenberg et al. | |
| 7,796,002 | B2 | 9/2010 | Hashimoto et al. | |
| 7,808,349 | B2 | 10/2010 | Fullerton et al. | |
| 7,812,697 | B2 | 10/2010 | Fullerton et al. | |
| 7,817,004 | B2 | 10/2010 | Fullerton et al. | |
| 7,832,897 | B2 | 11/2010 | Ku | |
| 7,837,032 | B2 | 11/2010 | Smeltzer | |
| 7,839,246 | B2 | 11/2010 | Fullerton et al. | |
| 7,843,297 | B2 | 11/2010 | Fullerton et al. | |
| 7,868,721 | B2 | 1/2011 | Fullerton et al. | |
| 7,874,856 | B1 | 1/2011 | Schriefer et al. | |
| 7,889,037 | B2 | 2/2011 | Cho | |
| 7,903,397 | B2 | 3/2011 | McCoy | |
| 7,905,626 | B2 | 3/2011 | Shantha et al. | |
| 7,977,946 | B2 | 7/2011 | Teklemariam et al. | |
| 8,002,585 | B2 | 8/2011 | Zhou | |
| 8,099,964 | B2 | 1/2012 | Saito et al. | |
| 8,354,908 | B2 * | 1/2013 | Jeon et al. | 335/229 |
| 2002/0125977 | A1 | 9/2002 | VanZoest | |
| 2003/0057791 | A1 * | 3/2003 | Post | 310/191 |
| 2003/0099067 | A1 | 5/2003 | Farahat | |
| 2003/0136837 | A1 | 7/2003 | Amon et al. | |
| 2003/0170976 | A1 | 9/2003 | Molla et al. | |
| 2003/0179880 | A1 | 9/2003 | Pan et al. | |
| 2003/0187510 | A1 | 10/2003 | Hyde | |
| 2003/0217668 | A1 * | 11/2003 | Fiske et al. | 104/282 |
| 2004/0003487 | A1 | 1/2004 | Reiter | |
| 2004/0155748 | A1 | 8/2004 | Steingroever | |
| 2004/0244636 | A1 | 12/2004 | Meadow et al. | |
| 2004/0251759 | A1 | 12/2004 | Hirzel | |
| 2005/0102802 | A1 | 5/2005 | Sitbon et al. | |
| 2005/0196484 | A1 | 9/2005 | Khoshnevis | |
| 2005/0231046 | A1 | 10/2005 | Aoshima | |
| 2005/0240263 | A1 | 10/2005 | Fogarty et al. | |
| 2005/0263549 | A1 | 12/2005 | Scheiner | |
| 2005/0283839 | A1 | 12/2005 | Cowburn | |
| 2006/0066428 | A1 | 3/2006 | McCarthy et al. | |
| 2006/0189259 | A1 | 8/2006 | Park et al. | |
| 2006/0198047 | A1 | 9/2006 | Xue et al. | |
| 2006/0198998 | A1 | 9/2006 | Raksha et al. | |
| 2006/0214756 | A1 * | 9/2006 | Elliott et al. | 335/306 |
| 2006/0279391 | A1 | 12/2006 | Xia | |
| 2006/0290451 | A1 | 12/2006 | Prendergast et al. | |
| 2006/0293762 | A1 | 12/2006 | Schulman et al. | |
| 2007/0072476 | A1 | 3/2007 | Milan | |
| 2007/0075594 | A1 | 4/2007 | Sadler | |
| 2007/0089636 | A1 * | 4/2007 | Guardo, Jr. | 104/281 |
| 2007/0103266 | A1 | 5/2007 | Wang et al. | |
| 2007/0138806 | A1 | 6/2007 | Ligtenberg et al. | |
| 2007/0255400 | A1 | 11/2007 | Parravicini et al. | |
| 2008/0047753 | A1 | 2/2008 | Hall et al. | |
| 2008/0119250 | A1 | 5/2008 | Cho et al. | |
| 2008/0139261 | A1 | 6/2008 | Cho et al. | |
| 2008/0174392 | A1 | 7/2008 | Cho | |
| 2008/0181804 | A1 | 7/2008 | Tanigawa et al. | |
| 2008/0186683 | A1 | 8/2008 | Ligtenberg et al. | |
| 2008/0218299 | A1 | 9/2008 | Arnold | |
| 2008/0224806 | A1 | 9/2008 | Ogden et al. | |
| 2008/0272868 | A1 | 11/2008 | Prendergast et al. | |
| 2008/0282517 | A1 | 11/2008 | Claro | |
| 2009/0021333 | A1 | 1/2009 | Fiedler | |
| 2009/0209173 | A1 | 8/2009 | Arledge et al. | |
| 2009/0250576 | A1 | 10/2009 | Fullerton et al. | |
| 2009/0251256 | A1 | 10/2009 | Fullerton et al. | |
| 2009/0254196 | A1 | 10/2009 | Cox et al. | |
| 2009/0278642 | A1 | 11/2009 | Fullerton et al. | |
| 2009/0289090 | A1 | 11/2009 | Fullerton et al. | |
| 2009/0289749 | A1 | 11/2009 | Fullerton et al. | |
| 2009/0292371 | A1 | 11/2009 | Fullerton et al. | |
| 2010/0033280 | A1 | 2/2010 | Bird et al. | |
| 2010/0126857 | A1 | 5/2010 | Polwart et al. | |
| 2010/0167576 | A1 | 7/2010 | Zhou | |
| 2010/0219918 | A1 * | 9/2010 | Higuchi | 335/219 |
| 2011/0012440 | A1 * | 1/2011 | Toyota et al. | 310/12.24 |
| 2011/0026203 | A1 | 2/2011 | Ligtenberg et al. | |
| 2011/0074231 | A1 * | 3/2011 | Soderberg | 310/44 |
| 2011/0085157 | A1 | 4/2011 | Bloss et al. | |
| 2011/0090033 | A1 | 4/2011 | Sankar | |
| 2011/0101088 | A1 | 5/2011 | Marguerettaz et al. | |
| 2011/0210636 | A1 | 9/2011 | Kuhlmann-Wilsdorf | |
| 2011/0234343 | A1 * | 9/2011 | Jeon et al. | 335/291 |
| 2011/0234344 | A1 | 9/2011 | Fullerton et al. | |
| 2011/0248806 | A1 | 10/2011 | Michael | |
| 2011/0279206 | A1 | 11/2011 | Fullerton et al. | |
| 2012/0064309 | A1 | 3/2012 | Kwon et al. | |
| 2012/0092103 | A1 * | 4/2012 | Roberts et al. | 335/295 |

FOREIGN PATENT DOCUMENTS

| | | | |
|---|---|---|---|
| EP | 0 345 554 | A1 | 12/1989 |
| EP | 0 545 737 | A1 | 6/1993 |
| FR | 823395 | A | 1/1938 |
| GB | 1 495 677 | A | 12/1977 |
| JP | S57-55908 | U | 4/1982 |
| JP | S57-189423 | U | 12/1982 |
| JP | 60-091011 | U | 6/1985 |
| JP | 60-221238 | A | 11/1985 |
| JP | 64-30444 | A | 2/1989 |
| JP | 2001-328483 | A | 11/2001 |
| JP | 2008035676 | A | 2/2008 |
| JP | 2008165974 | A | 7/2008 |
| JP | 05-038123 | B2 | 10/2012 |
| WO | WO-02/31945 | A2 | 4/2002 |
| WO | WO-2007/081830 | A2 | 7/2007 |
| WO | WO-2009/124030 | A1 | 10/2009 |
| WO | WO-2010/141324 | A1 | 12/2010 |

OTHER PUBLICATIONS

Atallah, K., Howe, D. 2001, "A Novel High-Performance Magnetic Gear", IEEE Transactions on Magnetics, vol. 37, No. 4, Jul. 2001, p. 2844-46.

Bassani, R., 2007, "Dynamic Stability of Passive Magnetic Bearings", Nonlinear Dynamics, V. 50, p. 161-68.

(56) References Cited

OTHER PUBLICATIONS

BNS 33 Range, Magnetic safety sensors, Rectangular design, http://www.farnell.com/datasheets/36449.pdf, 3 pages, date unknown.
Boston Gear 221S-4, One-stage Helical Gearbox, http://www.bostongear.com/pdf/product_sections/200_series_helical.pdf, referenced Jun. 2010.
Charpentier et al., 2001, "Mechanical Behavior of Axially Magnetized Permanent-Magnet Gears", IEEE Transactions on Magnetics, vol. 37, No. 3, May 2001, p. 1110-17.
Chau et al., 2008, "Transient Analysis of Coaxial Magnetic Gears Using Finite Element Comodeling", Journal of Applied Physics, vol. 103.
Choi et al., 2010, "Optimization of Magnetization Directions in a 3-D Magnetic Structure", IEEE Transactions on Magnetics, vol. 46, No. 6, Jun. 2010, p. 1603-06.
Correlated Magnetics Research, 2009, Online Video, "Innovative Magnetics Research in Huntsville", http://www.youtube.com/watch?v=m4m81JjZCJo.
Correlated Magnetics Research, 2009, Online Video, "Non-Contact Attachment Utilizing Permanent Magnets", http://www.youtube.com/watch?v=3xUm25CNNgQ.
Correlated Magnetics Research, 2010, Company Website, http://www.correlatedmagnetics.com.
Furlani 1996, "Analysis and optimization of synchronous magnetic couplings", J. Appl. Phys., vol. 79, No. 8, p. 4692.
Furlani 2001, "Permanent Magnet and Electromechanical Devices", Academic Press, San Diego.
Furlani, E.P., 2000, "Analytical analysis of magnetically coupled multipole cylinders", J. Phys. D: Appl. Phys., vol. 33, No. 1, p. 28-33.
General Electric DP 2.7 Wind Turbine Gearbox, http://www.gedrivetrain.com/insideDP27.cfm, referenced Jun. 2010.
Ha et al., 2002, "Design and Characteristic Analysis of Non-Contact Magnet Gear for Conveyor by Using Permanent Magnet", Conf. Record of the 2002 IEEE Industry Applications Conference, p. 1922-27.
Huang et al., 2008, "Development of a Magnetic Planetary Gearbox", IEEE Transactions on Magnetics, vol. 44, No. 3, p. 403-12.
International Search Report and Written Opinion dated Jun. 1, 2009, directed to counterpart application No. PCT/US2009/002027. (10 pages).
International Search Report and Written Opinion of the International Searching Authority issued in Application No. PCT/US12/61938 dated Feb. 26, 2013.
International Search Report and Written Opinion of the International Searching Authority issued in Application No. PCT/US2013/028095 dated May 13, 2013.
International Search Report and Written Opinion of the International Searching Authority issued in Application No. PCT/US2013/047986 dated Nov. 21, 2013.
International Search Report and Written Opinion, dated Apr. 8, 2011 issued in related International Application No. PCT/US2010/049410.
International Search Report and Written Opinion, dated Aug. 18, 2010, issued in related International Application No. PCT/US2010/036443.
International Search Report and Written Opinion, dated Jul. 13, 2010, issued in related International Application No. PCT/US2010/021612.
International Search Report and Written Opinion, dated May 14, 2009, issued in related International Application No. PCT/US2009/038925.
Jian et al., "Comparison of Coaxial Magnetic Gears With Different Topologies", IEEE Transactions on Magnetics, vol. 45, No. 10, Oct. 2009, p. 4526-29.
Jian, L., Chau, K.T., 2010, "A Coaxial Magnetic Gear With Halbach Permanent-Magnet Arrays", IEEE Transactions on Energy Conversion, vol. 25, NO. 2, Jun. 2010, p. 319-28.
Jørgensen et al., "The Cycloid Permanent Magnetic Gear", IEEE Transactions on Industry Applications, vol. 44, No. 6, Nov./Dec. 2008, p. 1659-65.
Jørgensen et al., 2005, "Two dimensional model of a permanent magnet spur gear", Conf. Record of the 2005 IEEE Industry Applications Conference, p. 261-5.
Kim, "A future cost trends of magnetizer systems in Korea", Industrial Electronics, Control, and Instrumentation, 1996, vol. 2, Aug. 5, 1996, pp. 991-996.
Krasil'nikov et al., 2008, "Calculation of the Shear Force of Highly Coercive Permanent Magnets in Magnetic Systems With Consideration of Affiliation to a Certain Group Based on Residual Induction", Chemical and Petroleum Engineering, vol. 44, Nos. 7-8, p. 362-65.
Krasil'nikov et al., 2009, "Torque Determination for a Cylindrical Magnetic Clutch", Russian Engineering Research, vol. 29, No. 6, pp. 544-47.
Liu et al., 2009, "Design and Analysis of Interior-magnet Outer-rotor Concentric Magnetic Gears", Journal of Applied Physics, vol. 105.
Lorimer, W., Hartman, A., 1997, "Magnetization Pattern for Increased Coupling in Magnetic Clutches", IEEE Transactions on Magnetics, vol. 33, No. 5, Sep. 1997.
Mezani, S., Atallah, K., Howe, D. , 2006, "A high-performance axial-field magnetic gear", Journal of Applied Physics vol. 99.
Mi, "Magnetreater/Charger Model 580" Magnetic Instruments Inc. Product specification, May 4, 2009, http://web.archive.org/web/20090504064511/http://www.maginst.com/specifications/580_magnetreater.htm, 2 pages.
Neugart PLE-160, One-Stage Planetary Gearbox, http://www.neugartusa.com/ple_160_gb.pdf, referenced Jun. 2010.
Series BNS, Compatible Series AES Safety Controllers, http://www.schmersalusa.com/safety_controllers/drawings/aes.pdf, pp. 159-175, date unknown.
Series BNS-B20, Coded-Magnet Sensorr Safety Door Handle, http://www.schmersalusa.com/catalog_pdfs/BNS_B20.pdf, 2pages, date unknown.
Series BNS333, Coded-Magnet Sensors with Integral Safety Control Module, http://www.schmersalusa.com/machine_guarding/coded_magnet/drawings/bns333.pdf, 2 pages, date unknown.
Tsurumoto 1992, "Basic Analysis on Transmitted Force of Magnetic Gear Using Permanent Magnet", IEEE Translation Journal on Magnetics in Japan, Vo 7, No. 6, Jun. 1992, p. 447-52.
United States Office Action issued in U.S. Appl. No. 13/104,393 dated Apr. 4, 2013.
United States Office Action issued in U.S. Appl. No. 13/236,413 dated Jun. 6, 2013.
United States Office Action issued in U.S. Appl. No. 13/246,584 dated May 16, 2013.
United States Office Action issued in U.S. Appl. No. 13/246,584 dated Oct. 15, 2013.
United States Office Action issued in U.S. Appl. No. 13/374,074 dated Feb. 21, 2013.
United States Office Action issued in U.S. Appl. No. 13/430,219 dated Aug. 13, 2013.
United States Office Action issued in U.S. Appl. No. 13/470,994 dated Aug. 8, 2013.
United States Office Action issued in U.S. Appl. No. 13/470,994 dated Jan. 7, 2013.
United States Office Action issued in U.S. Appl. No. 13/470,994 dated Nov. 8, 2013.
United States Office Action issued in U.S. Appl. No. 13/529,520 dated Sep. 28, 2012.
United States Office Action issued in U.S. Appl. No. 13/530,893 dated Mar. 22, 2013.
United States Office Action issued in U.S. Appl. No. 13/530,893 dated Oct. 29, 2013.
United States Office Action issued in U.S. Appl. No. 13/687,819 dated Apr. 29, 2014.
United States Office Action issued in U.S. Appl. No. 13/718,839 dated Dec. 16, 2013.
United States Office Action issued in U.S. Appl. No. 13/855,519 dated Jul. 17, 2013.
United States Office Action issued in U.S. Appl. No. 13/928,126 dated Oct. 11, 2013.
United States Office Action, dated Aug. 26, 2011, issued in counterpart U.S. Appl. No. 12/206,270.

(56) References Cited

OTHER PUBLICATIONS

United States Office Action, dated Feb. 2, 2011, issued in counterpart U.S. Appl. No. 12/476,952.
United States Office Action, dated Mar. 12, 2012, issued in counterpart U.S. Appl. No. 12/206,270.
United States Office Action, dated Mar. 9, 2012, issued in counterpart U.S. Appl. No. 13/371,280.
United States Office Action, dated Oct. 12, 2011, issued in counterpart U.S. Appl. No. 12/476,952.
Wikipedia, "Barker Code", Web article, last modified Aug. 2, 2008, 2 pages.
Wikipedia, "Bitter Electromagnet", Web article, last modified Aug. 2011, 1 page.
Wikipedia, "Costas Array", Web article, last modified Oct. 7, 2008, 4 pages.
Wikipedia, "Gold Code", Web article, last modified Jul. 27, 2008, 1 page.
Wikipedia, "Golomb Ruler", Web article, last modified Nov. 4, 2008, 3 page.
Wikipedia, "Kasami Code", Web article, last modified Jun. 11, 2008, 1 page.
Wikipedia, "Linear feedback shift register", Web article, last modified Nov. 11, 2008, 6 pages.
Wikipedia, "Walsh Code", Web article, last modified Sep. 17, 2008, 2 pages.

* cited by examiner

MAGNETIC CONFIGURATIONS

CROSS-REFERENCE TO RELATED APPLICATIONS

This application claims priority to U.S. Provisional Application No. 61/457,498 filed Apr. 12, 2011, U.S. Provisional Application No. 61/627,707 filed Oct. 17, 2011, and U.S. Provisional Application No. 61/685,159, filed Mar. 13, 2012, the entire contents of all of which are hereby incorporated by reference.

FIELD OF THE INVENTION

The present invention generally relates to the field of sources that generate field, such as magnetic fields, and more particularly to a field system, such as a magnetic configuration system, in which the field strength of the system can be changed with a minimum energy input.

BACKGROUND

A magnet is a field source that produces a magnetic field (also called flux density or magnetic B field). The magnetic field of a field source at a given point in space is a vector field specified by two properties: direction and strength (also called magnitude). In SI units, the strength of the magnetic field is given in teslas.

The magnetic field is responsible for a force that attracts or repels other magnets. Each magnet has north and south magnetic polarities (or poles) at its ends. The magnetic field lines of a magnet are considered by convention to emerge from the magnet's north polarity and reenter at the south polarity. Opposite polarities of two magnets attract each other, while the same polarities repel each other.

A field system (also called a field configuration system) is a system that comprises at least two components having corresponding field sources. For example, the two components could be two magnets with corresponding magnetic fields. When the two components are brought sufficiently close to each other, their fields causes a field interaction. The strengths of the fields may change due to field interactions. Depending on orientation of the polarities of the magnets relative to each other, repelling or attracting force may be associated with changes in the field strengths.

A variety of field interactions have been studied and put into practical use in a wide variety of applications. However, there still remains a need to make efficient use of field interactions. This disclosure intends to provide a field system, such as a magnetic configuration system, in which the strength of the field of the configuration can be changed, and particularly provide a configuration in which a minimum energy input is required to achieve such purpose. Some examples of the applications of such system include increasing the efficiency of the field or energy generating means such as electrical energy generators. Since the invention of energy generators, there has been a need for increasing the efficiency of the generators. The field system of this disclosure provides an environmentally friendly solution for this historical need. Some other examples of applications include magnetic refrigeration, lifting devices, and medical devices such as MRI.

SUMMARY OF THE INVENTION

Briefly, according to one embodiment of the present invention, a field system includes a first component having one or more first field sources, each having opposite polarities. The field system further includes a second component having one or more second field sources, each also having opposite polarities. At least one of the first and second components are adapted to be capable of having a movement relative to the other components. This relative movement produces a field interaction therebetween. In the field system the one or more first and one or more second field sources are oriented relative to the other such that repelling forces associated with the same polarities of the one or more first field sources and the one or more second field sources and attractive forces associated with the opposite polarities of the one or more first field source and the one or more second field source substantially cancel each other out in respect to the field interaction between the first and second components. The field interaction produces an increase in one field of fields associated with the polarities of the first and second field sources and a decrease in another field of the fields. This arrangement allows for efficient use of the field system in a wide variety of applications.

According to some of the more detailed features of the invention, the field interaction increases a field associated with at least one of the polarities of the one or more first field sources and decreases a field associated with another one of the polarities of the one or more first field sources.

According to other more detailed features of the invention, the one or more first and the one or more second field sources have at least a partial complementary shape relation relative to one another. The at least partial complementary shape relation is a substantial reverse geometrical shape relation between at least a portion of the one or more first field source and at least a portion of the one or more second field source such that one portion can be substantially fitted into or received by the other portion. The at least partial complementary shape relation may define a mating relation. In the mating relation, the one or more first field source defines at least one opening to substantially receive at least a portion of the at least partial complementary shaped field source of the one or more second field source.

According to still other more detailed features of the invention, the one or more first field source of the first component includes field sources forming a Halbach array. The Halbach array may have at least a partial complementary shape relation relative to the at least one second field source, or may have a mating relation relative to the at least one second field source, or define openings for a mating relation with the at least one second field source of the second component.

According to yet more detailed features of the invention, the first component includes a first pair of corresponding members of the one or more first field sources and the second component includes a second pair of corresponding members of the one or more second field source. The corresponding members of the first and second pairs may be spaced apart in a symmetry relation at a separation distance to substantially prevent a field interaction therebetween.

The symmetry relation may include a bilateral symmetry where the corresponding members of at least the first pair and second pair are mirror images of one another relative to a mirror plane which is perpendicularly bisecting the separation distance. The symmetry relation may also include a translational symmetry where the corresponding members of at least the first pair and second pair can be coincided to one another after a linear translation equal to the separation distance. The symmetry relation may further include a rotational symmetry where the corresponding members of at least the first pair and second pair can be coincided to one another after a rotation of less than 360 degrees relative to an axis of rotation.

According to more detailed features of the invention, each of the first pair of corresponding members may have a mating relation relative to a respective corresponding member in the second pair of corresponding members.

According to other detailed features of the invention, at least one of the first or second pairs of corresponding members may define a pair of Halbach arrays. The pair of Halbach arrays may define one or more pairs of corresponding openings for a mating relation with the second pair of corresponding members. The corresponding members of the first and second pairs may respectively form a first and a second pair of Halbach arrays. The first pair of Halbach arrays may have at least partial complementary shape relations relative to the corresponding members of the second pair. The first pair of Halbach arrays may have mating relations relative to the corresponding members of the second pair. The corresponding members in at least one of the first pair of corresponding members or the second pair of corresponding members may have a reverse polarity relation relative to one another, and the corresponding members in the other of the first pair of corresponding members or the second pair of corresponding members have an identical polarity relation relative to one another.

According to some of the more detailed features of the invention, the relative movement includes at least one of a reciprocating movement, an oscillatory movement, a rotary movement, a spinning movement, a revolving movement, or a rolling movement.

According to some of the more detailed features of the invention, the first and second components defining a static relation relative to one another.

According to some further detailed features of the invention, at least one of the first and second field sources includes at least one of a permanent magnet, an electromagnet, an electret, a magnetized ferromagnetic material, a soft magnetic material, or a superconductive magnetic material.

According to more detailed features of the invention, the field system may further include a third component having third field sources each having opposite polarities. A relative movement of the third component with respect to the first and second components may produce a field interaction with the first and second components. The third field sources may be oriented relative to the one or more first and the one or more second field sources such that the field interaction produces a net repulsive force experienced by, and causing a motion of, the third component between a first and a second position.

According to another embodiment of the present invention, a field system includes a first component having one or more field source having opposite polarities and a second component having one or more second field source having opposite polarities. At least one of the first and second components has a movement relative to the other of the components to produce a field interaction therebetween. The field interaction produces interaction forces which may result in torques such that both the interaction forces and the resulting torques act upon the movable component. The one or more first and the one or more second field sources are oriented relative to each other such that the field interaction satisfies the following requirements. At least one of a sum of the interaction forces or a sum of the resulting torques is substantially zero, and the field interaction produces an increase in a first field of fields associated with the polarities of the one or more first and one or more second field sources and a decrease in a second field of the fields.

According to yet another embodiment of the present invention, a method of changing a field strength of at least a portion of one or more field source includes arranging a first component having one or more first field sources having opposite polarities relative to a second component having one or more second field sources having opposite polarities. The arrangement is such that a movement of at least one of the first and second components relative to the other of the components produces a field interaction therebetween. The method further includes orienting the one or more first and the one or more second field sources relative to each other such that the field interaction between the first and second components generates repelling forces associated with the same polarities of the one or more first field sources and the one or more second field sources and attractive forces associated with the opposite polarities of the one or more first field sources and the one or more second field sources substantially cancel each other out in respect to the field interaction between the first and second components. The field interaction produces an increase in a first field of fields associated with the polarities of the one or more first and one or more second field sources and a decrease in a second field of the fields.

DETAILED DESCRIPTION OF THE INVENTION

General Remarks and Conventions

Figure 1A:
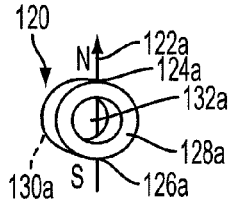
FIGS. 1A-1L show several examples of shapes of some of magnetic elements according to an embodiment of the present invention.

Initially, some general remarks and conventions are presented which apply to the description of the exemplary configurations in the disclosure. These general remarks and conventions are merely for ease of the description and are not intended to limit the scope of the overall inventive concept in any way.

The field systems (such as magnetic configurations) that are described throughout this disclosure generally are comprised of at least two components: a primary and a secondary component (also called a first and a second component). Each component is comprised of at least one field source. The field sources of the primary and secondary component can be identified as a first and a second field source, respectively. For simplicity and clarity, magnetic configurations, as non-limiting examples of the field systems, are described in this disclosure. In a magnetic configuration the field sources may comprise magnetic elements. The magnetic elements of the primary or secondary components can be identified as the primary or secondary magnetic elements, respectively. The primary or secondary magnetic elements may comprise any type of magnetic field sources known in the magnetic arts such as, for example but not limited to, rare earth magnetic materials.

In general, in the field systems or in the magnetic configurations that are described throughout this disclosure, the primary and/or secondary components are movable relative to each other, e.g., the first component may move, the second component may move, or both the first and second component may move. However in the exemplary embodiments described in this disclosure, for ease of description, the primary and secondary components preferably considered stationary and movable, respectively. As a result, in an interchangeable manner, the primary and secondary components are identified by stationary and moving (or movable) components, respectively. Likewise, the primary and secondary magnetic elements are also identified by stationary and moving (or movable) magnetic elements, respectively.

The stationary and moving components are supported by a stationary and a moving support means, respectively. These supporting means are generally, unless otherwise indicated, preferably are made from a rigid non-magnetic material such as, for example, aluminum, certain stainless steels, composite plastic materials, and other rigid materials which are not attracted to or affected by magnet or magnetic field. The supporting means can be any known means in the art. For the sake of brevity, the details of these supporting means are not described or shown in the drawings. Generally, magnetic elements or other structural parts of a component are connected to each other by a connection means to form a unitary one-piece structure of the component. In general, all connection means in the configurations described in this disclosure are made preferably from a rigid non-magnetic material described in the above. The movable component is generally connected to an energy source which is able to provide a driving force for the motion of the component. The energy source, and all its parts such as braking means, is not described or shown in the drawings of this disclosure.

For fixing and securing of the magnetic elements in various positions relative to each other, any appropriate means well known in the art can be used such as for example, but not limited to, adhesive and bonding materials, or mechanical securing means.

Polar ends of each primary and/or secondary magnetic element may have different magnetic strengths. However, unless otherwise indicated, for ease of description both polar ends of each primary magnetic element have substantially an identical magnetic strength which can be characterized by a first predetermined magnitude.

In a similar fashion, both polar ends of each secondary magnetic element have substantially an identical magnetic strength which can be characterized by a second predetermined magnitude. The magnitude of the first and second predetermined magnetic strength can be substantially identical or different. However, preferably the magnitude of the second predetermined magnetic strength can be higher than the magnitude of the first predetermined magnetic strength.

The description below describes some configurations including two neighboring components each having one or more field sources arranged in a manner that a positional change of one component relative to the other component produces a plurality of field forces resulting from interactions between the field sources of two components such that there is at least a partial cancellation of the field forces and a change in the strength of at least one field sources of one component.

In other words and in a more detail, some configurations (which also can be referred to as "systems") for changing the strength of field sources include at least two components (also can be referred to as "field emission structures" or as "primary and secondary components" or as "first and second components" or sometimes as "stationery and moving components"), The components are preferably separated by a predetermined gap allowing a positional change of at least one component relative to the other component. Each component comprising at least one or more field sources (also can be referred to as "field emission sources") having polarities and field strengths and are arranged in a predetermined arrangement pattern. The pattern of arrangements and the size of the gap are such that a positional change of one component relative to other component can cause a plurality of field interactions producing a plurality of field forces in a manner that these field forces at least partially cancel each other and simultaneously can change the field strength of at least one of the field sources of at least one component.

Some field configurations may include a first component having at least one first field source having opposite polarities and a second component having at least one second field source having opposite polarities. At least one of the first and second components has a movement relative to the other of the components to produce a field interaction therebetween. The at least one first and the at least one second field sources are oriented relative to each other such that repelling forces associated with the same polarities of the first field source and the second field source and attractive forces associated with the opposite polarities of the first field source and the second field source substantially cancel each other out in respect to the field interaction between the first and second components. The field interaction produces an increase in at least a first field of a plurality of fields associated with the polarities of the at least one first and at least one second field sources and a decrease in at least a second field of the plurality of fields. The field interaction may increase a field associated with at least one of the polarities of the at least one first field source and decrease a field associated with at least another one of the polarities of the first field source.

Field systems may include a first component having at least one field source having opposite polarities and a second component having at least one second field source having opposite polarities. At least one of the first and second components has a movement relative to the other of the components to produce a field interaction therebetween. The field interaction produces a plurality of interaction forces which may result in a plurality of torques such that both the interaction forces and the resulting torques act upon the movable component. The at least one first and the at least one second field sources are oriented relative to each other such that the field interaction satisfies requirements that: at least one of a sum of the interaction forces or a sum of the resulting torques is substantially zero, and the field interaction produces an increase in a first field of a plurality of fields associated with the polarities of the at least one first and at least one second field sources and a decrease in a second field of the plurality of fields.

Field systems may be used in a method of changing a field strength of at least a portion of at least one field source. The method includes arranging a first component having at least one first field source having opposite polarities relative to a second component having at least one second field source having opposite polarities. The arrangement is such that a movement of at least one of the first and second components relative to the other of the components produces a field interaction therebetween. The method further includes orienting the at least one first and the at least one second field sources relative to each other such that the field interaction between the first and second components to generate repelling forces associated with the same polarities of the first field source and the second field source and attractive forces associated with the opposite polarities of the first field source and the second field source substantially cancel each other out in respect to the field interaction between the first and second components. The field interaction produces an increase in a first field of a plurality of fields associated with the polarities of the at least one first and at least one second field sources and a decrease in a second field of the plurality of fields.

The field sources can be at least a portion of one of, or a combination of at least a portion of one or more of, the following: a permanent magnet, an electromagnet, an electret, a magnetized ferromagnetic material, a soft magnetic material, a superconductive magnetic material. Furthermore, any new materials or variations of these field sources (or any field producing means) which are currently in the process of improvement or development, or expected to be improved/developed, may also be used in the configuration.

The positional change of a component relative to the other component can be achieved through a motion in which the motion may comprise at least one of the following: a reciprocating movement, an oscillatory movement, a rotary movement, a spinning movement, a revolving movement, a rolling movement, or any combinations of these movements.

In some configurations there can be no positional change of the components. In other words, in a configuration it is possible that the relation of the components relative to each other be static (stationary). In general, the velocity of the relative movement of a component relative to the other component can range from substantially zero to a predetermined value in which such value (or magnitude) can be based on the application needs.

The figures are not drawn to scale and in the interest of clarity and conciseness some features may be exaggerated, minimized, or sometimes not shown in order to demonstrate the details of some particular parts. The following figure conventions are used in all figures. Dashed line represents a path of motion. Double lined arrow represents a direction of movement. Dotted line represents a portion of the configuration that exists but for clarity of illustration is not shown.

One or more of the following marking methods are used to show the polarity arrangements of the magnetic elements in the figures: (1) using an "N" or an "S" to represent respectively a north or a south polar end of a magnetic element; (2) a solid line with an arrow in which the direction of the arrow or its tail part points toward the north and south polar end of a magnetic element, respectively; if the arrow and its tail are within the magnetic element body, then the arrow and the tail part point toward the north and south polar end of the magnetic body, respectively; if the arrow leaving the magnetic element body, such as 122*b* in the perspective view of FIG. 1B, then the external region of the magnetic body associated with the entering and leaving line of the arrow are considered south and north polar ends of the magnetic element, respectively; (3) a marking of an "O" (with a dot in its center) or an "X", on the surface of a magnetic element, represents the north and south polar end area of the magnetic element, respectively. It should be noted that the selection of symbols "N" and "S" or other marking methods described in the above should not be construed as a limitation because, as will be described later in the disclosure, exemplary configurations may comprise other field sources such as electrets.

Magnetic Field Sources

Magnetic elements (also referred to as "magnetic field sources) forming the structure of the stationary or moving components may include a variety of shapes and materials. For ease of discussion and without limitation some simplified forms of magnetic elements and arrays which are used in the structure of some of the exemplary configurations are presented here.

FIGS. 1A-1L show several examples of the shapes of some of magnetic elements used in the description of the exemplary configurations. These magnetic elements may comprise any type of magnetic field sources known in the magnetic arts such as, for example but not limited to, rare earth magnetic materials. These magnetic elements share some common features such as each magnetic element comprises: a first and a second opposite polar end portions, an intermediate portion extended between the polar end portions, a magnetization direction extending between the first and second polar end portions, and both polar end portions have a predetermined identical magnetic field strengths. In FIGS. 1A-1L the same reference numbers, with different suffixes, are used to indicate corresponding similar parts and features of different magnetic elements.

FIG. 1A shows a flat magnetic ring 120 which is transversely (diametrically) magnetized. The magnetization direction (also referred as "magnetic orientation") 122*a* passes through both opposite polar ends 124*a* and 126*a* on the upper and lower exterior parts of the ring 120, respectively. The intermediate portion extends between the polar ends 124*a* and 126*a* and includes two parallel faces 128*a* and 130*a*. A through circular opening 132*a* passing through the central part of both faces 128*a* and 130*a* of the magnet. The thickness of the ring is uniform such that a cross section cut perpendicular to the face of the ring along a diameter of the ring is substantially a rectangular shape.

Figure 1B:
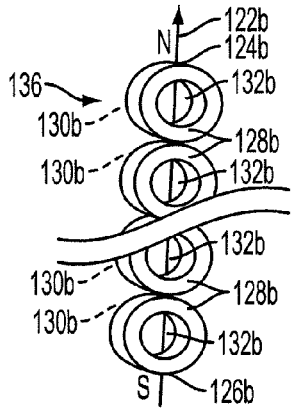

FIG. 1B shows a magnetic element 136 which is comprised of multiple identical flat rings. Each ring structurally and magnetically is similar to the ring 120 shown in FIG. 1A. These rings are connected from their opposite polar ends in a serial manner to form an elongated chain shaped magnet (hereinafter "chain") with a longitudinal axis. The chain 136 has two opposite polar end portions 124*b* and 126*b* located at the uppermost and the lowermost exterior parts of the opposite longitudinal ends of the magnet. A magnetization direction 122*b* passing through both polar ends 124*b* and 126*b*. The magnetization direction 122*b* is coincident with the longitudinal axis of the chain 136. The intermediate portion which is located between polar ends 124*b* and 126*b* includes two parallel flat faces 128*b* and 130*b*. Each faces comprising multiple openings 132*b*. Each opening is a through circular hole passing through both faces 128*b* and 130*b* of the chain. A lengthwise midpoint divides the rings of the chain into the upper and lower rings of the chain.

Figure 1C:
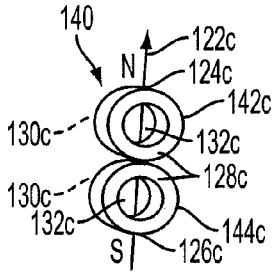

FIG. 1C shows a two-ring chain magnet 140 which is similar to the chain magnet 136 but it has only an upper 142*c* and a lower 144*c* ring. The rings 142*c* and 144*c* together make the shape of a FIG. 8 to form an 8-shaped magnetic element (hereinafter "8-shaped").

Figure 1D:
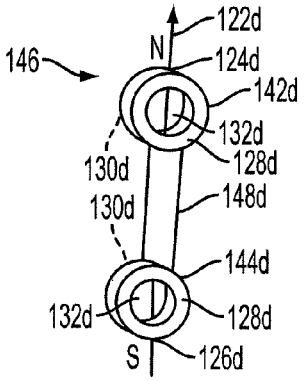

FIG. 1D shows a magnetic element 146, which is another form of the two-ring chain magnet 140, comprising an upper ring 142*d* and a lower ring 144*d* and a cylinder-like magnet 148*d*. The magnetic cylinder 148*d* is longitudinally magnetized. The magnetic element 146 can be formed as a one piece structure, or can be made by connecting each opposite polar end of the cylinder magnet 148*d* to the opposite polar ends of the upper ring 142*d* and the lower ring 144*d* respectively, to form an elongated dumbbell shaped magnetic element (hereinafter "dumbbell shaped"). The dumbbell shaped magnet 146 has two opposite polar ends 124*d* and 126*d*.

Figure 1E:
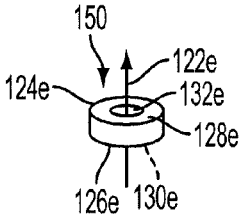

FIG. 1E shows a ring shaped magnetic element 150 with a structure which is similar to magnetic ring 120 in FIG. 1A, however, the ring 150 is axially magnetized such that its circular flat faces of 128*e* and 130*e* are opposite polar end areas 124*e* and 126*e* of the magnet, respectively. The magnetic ring 150 will be called "axially magnetized ring" to differentiate it from the magnetic ring 120.

Figure 1F:
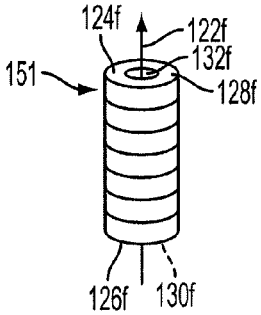
Figure 1G:
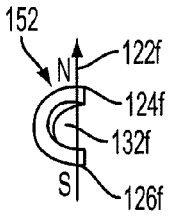
Figure 1H:
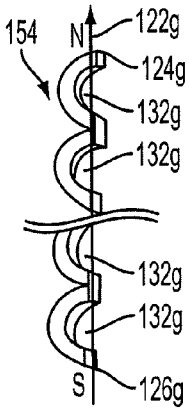
Figure 1I:
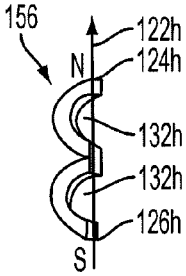
Figure 1J:
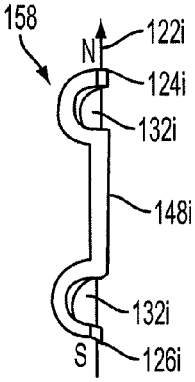
Figure 1K:
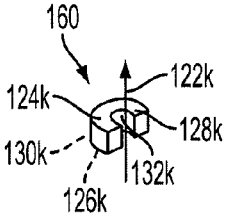

FIG. 1F shows a magnetic element 151 which is comprised of multiple identical flat rings. Each ring structurally and magnetically is similar to the ring 150 shown in FIG. 1E. These rings are stacked, their opposite polar ends facing each other in an aligned manner, to form a right annular cylinder structure (hereinafter "annular cylinder"). The annular cylinder 151 has two opposite polar end portions 124*f* and 126*f* extending between the uppermost and the lowermost exterior parts of the opposite longitudinal ends of the magnet. A magnetization direction 122*f* passing through opposed polar ends of 124*f* and 126*f*. The magnetization direction 122*f* is coaxial with the longitudinal central axis of the annular cylinder.

Alternatively, each of the magnetic elements 136, 140, 146, and 151 shown respectively in FIGS. 1B, 1C, 1D, and 1F, can be made integrally as a one-piece magnetic element.

Figure 1L:
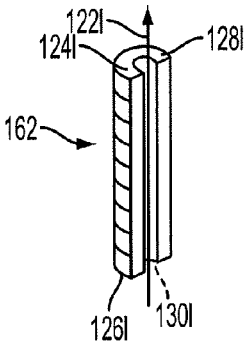

One may cut each of the magnetic elements shown in FIGS. 1A-1F by an imaginary cutting plane, which is perpendicular to the flat faces of the rings of the magnets and passing through the magnetization direction of each magnetic element, to produce substantially two identical halves from each magnet. The shapes of each half of the magnetic elements resulting from the cutting are shown in FIGS. 1G-1L. To identify the shape of each magnetic element either a name similar to the name of the magnet before cutting is used or another name related to the shape of the magnet is selected. The names of the magnetic elements, that are used hereinafter, are: half-ring (FIG. 1G), half-chain (FIG. 1H), E-shaped (FIG. 1I), half-dumbbell (FIG. 1J), axially magnetized half ring (FIG. 1K), and semi-annular cylinder (FIG. 1L). These magnetic elements have a magnetization direction and a location of polar ends that is substantially similar to the original magnetic elements before cutting.

A magnetic element that is used in the structure of many moving components of the exemplary configurations is a cylindrical shaped magnet which is not shown in FIGS. 1A-1L. Although the magnetic elements of the moving component of the exemplary configurations described in this disclosure can have various shapes. However, for ease of description and without limitation one or more identical magnetic cylinders are selected as the magnetic elements in most moving components. In general, unless otherwise indicated, each magnetic cylinder is axially magnetized such that the magnetization direction and the longitudinal axis of the cylinder are coincident.

Magnetic elements can be used as a structural unit to form a magnetic array structure. There are many variables involved in the structure of an array which are outlined in the following: in the formation of an array, the magnetic elements can be positioned relative to each other in an abutting manner or at magnetic interaction distances. The angular relation between the magnetization directions of succeeding magnetic elements in an array can be the same or variable. Magnetic elements of an array may have identical or different shapes and sizes. The number of magnetic element in an array can be varied, and depending on the number of magnetic elements, the array formation can be extended in a linear or non-linear in more than one dimension to form diverse structures including planar, closed looped, or curved surface array structures. The array structures may have different number of poles ranging from dipolar to multi-polars.

Various combinations and permutations of the above-mentioned variables involved in the formation of arrays can produce a universe of possibilities and an infinite-like number of arrays. For purpose of illustration, and without limitation, the selection of arrays in the exemplary configurations in this disclosure is based on the following simplifications: only arrays comprising magnetic elements with simple shapes such as the shapes of the magnetic elements shown in FIGS. 1A-1L are considered. Also for simplification, only arrays having a Halbach structure are considered.

Figure 2A:
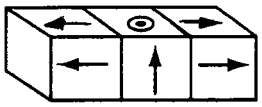
FIG. 2A PRIOR ART
FIGS. 2A-2B show basic structures of a linear form of Halbach arrays according to prior art.
Figure 2B:
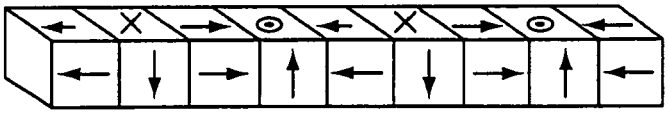
FIG. 2B PRIOR ART

FIGS. 2A-2B show the basic structures of a linear form of the Halbach arrays. In some embodiments, at least one first field source of the first component includes a plurality of field sources forming a Halbach array. The array comprises of a series of touching or closely spaced magnetic elements, having generally a square cross-section, arranged linearly such that the magnetization directions of each two neighboring magnets have an orthogonal relation. As a result of these magnetic arrangements, the arrays generally exhibit a higher magnetic field strength in one polar side of the arrays while minimizing the magnetic field strength in the opposite side.

Generally, in a Halbach array, the magnetization direction of each magnetic element is rotated relative to its neighboring element by a selected angle. This angular relation and the direction of rotation of the angle generally remain the same for each two neighboring elements. This angular relation determines the strong and weak sides of the magnetic field of an array. In the Halbach array shown in FIG. 2A, moving in the longitudinal extension of the array from left to right, when magnetization direction of the succeeding magnetic elements rotates in a clockwise direction, then the strong magnetic field of the array is on the bottom side of the array. In a counter-clockwise rotation of the magnetization direction such as in the array shown in FIG. 2B, the strong side is on the top side of the array. The stronger magnetic field of an array is generally stronger than the magnetic field of the magnetic elements used in the formation of the array.

In a configuration, there are different possibilities for positioning the magnetic interaction area of a stationary array relative to a moving component. Therefore, it should be noted that selection of any magnetic interaction side, such as for example a weak or a strong side of a stationary array, for a magnetic interaction with a corresponding moving component in the described configurations of this disclosure is only for illustration purpose and should not be construed as a limitation.

Figure 3A:
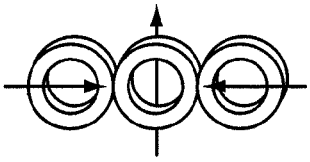
FIGS. 3A-3O show examples of arrays in which the magnetic elements shown in FIGS. 1A-1L are arranged to form Halbach-type structures according to an embodiment of the present invention.
Figure 3B:
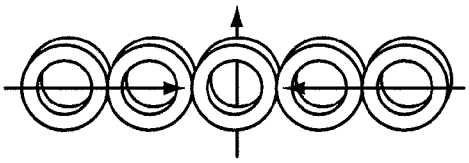
FIGS. 3P-3Q show types of ring-shaped magnetic elements according to an embodiment of the present invention.
FIG. 3R shows an array which is similar in structure to an annular cylinder array according to an embodiment of the present invention.
FIG. 3S shows an array formed by cutting the array of FIG. 3R by a plane passing through the longitudinal axis of the array according to an embodiment of the present invention.
Figure 3C:
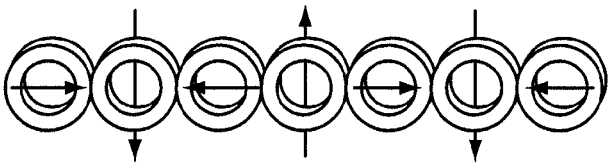
Figure 3D:
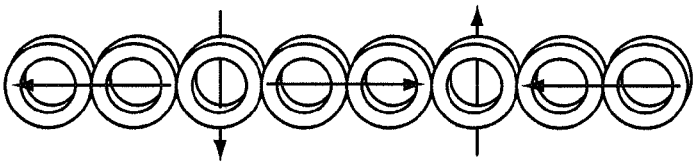
Figure 3E:
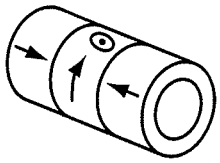
Figure 3F:
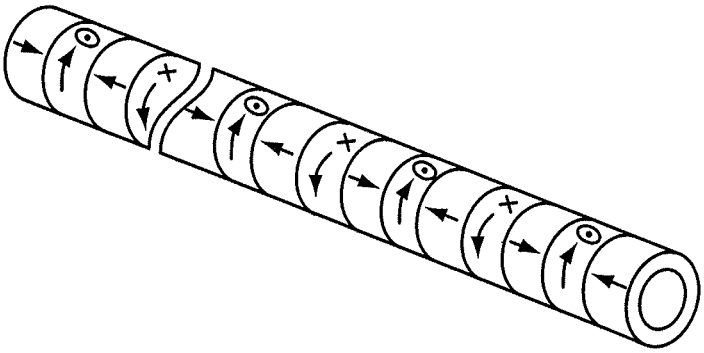
Figure 3G:
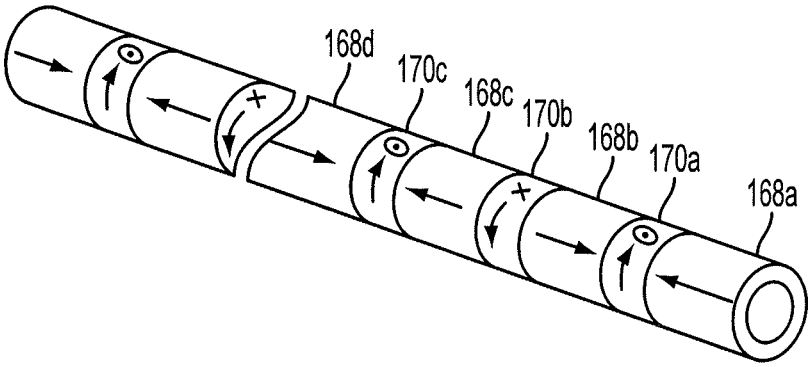
Figure 3H:
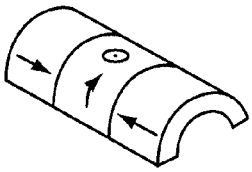
Figure 3I:
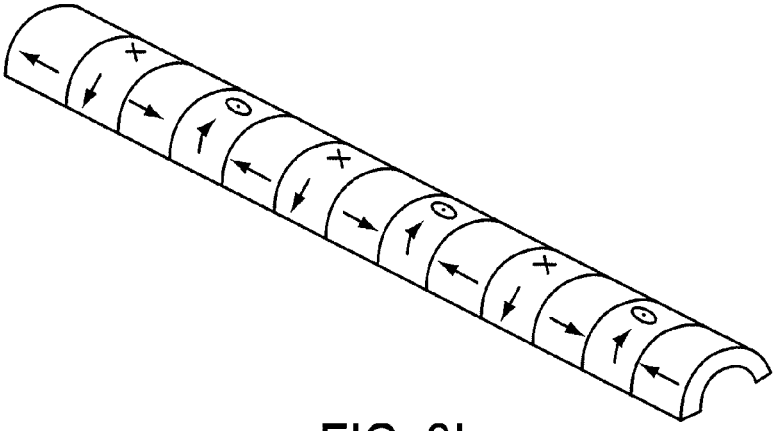
Figure 3J:
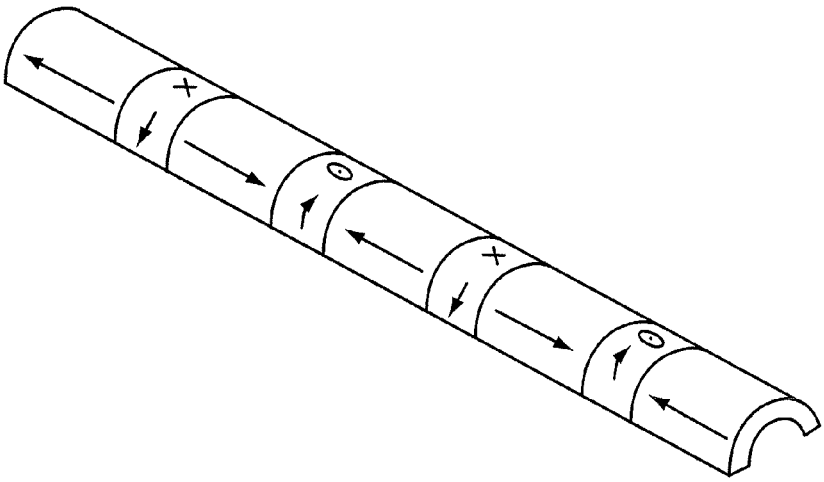
Figure 3K:
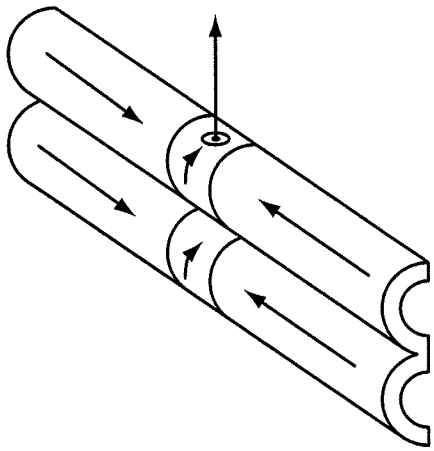
Figure 3L:
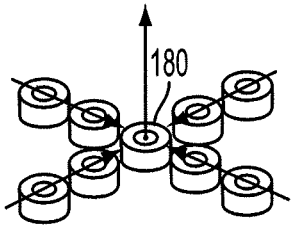
Figure 3M:
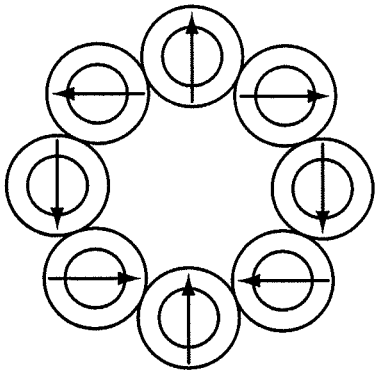
Figure 3N:
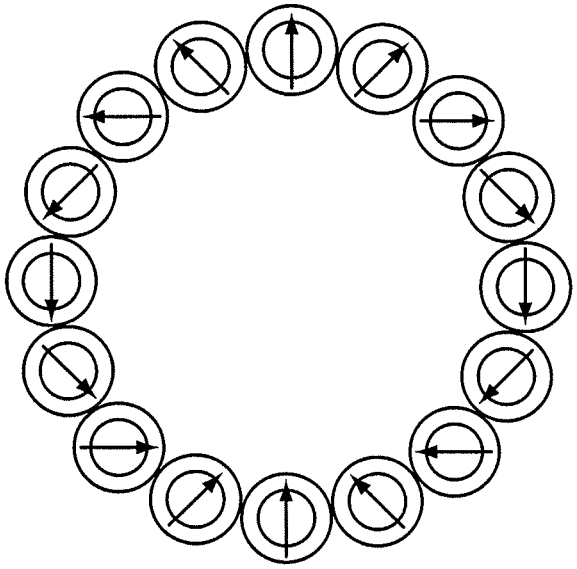
Figure 3O:
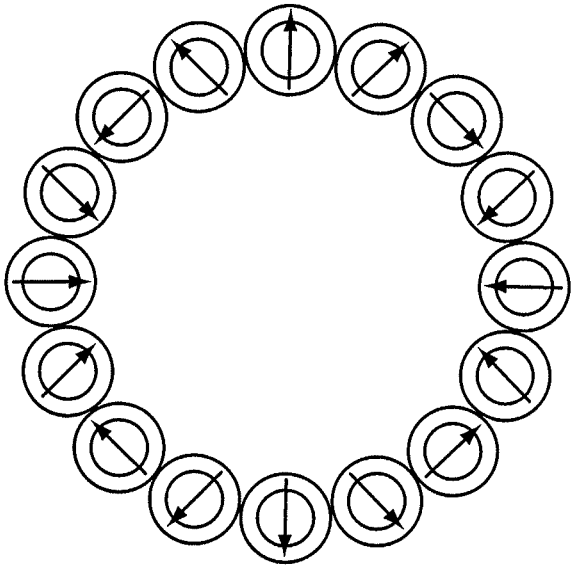

FIGS. 3A-3O show examples of the arrays in which the magnetic elements shown in FIGS. 1A-1L are arranged to form Halbach-type structures. The selected arrays are generally linear or circular structures formed in a spatially periodic manner. For example, as can be seen in FIGS. 3A-3O, these arrays comprise of a periodic arrangement of the magnetic elements. The distance from start of one period to the beginning of the next is referred to as period length (or spatial period) of the array. The period length is the length of the total number of succeeding magnetic element in an array for a rotation of the magnetization direction of the magnetic elements by 360 degrees. Each period length of an array (either on the strong or the weak sides of a length period), includes two opposite poles which interchangeably called polar ends, or polar areas, or polar region, or sometimes polar bands of the array.

To identify the arrays, the name of the general shape of the array is used. The names of the magnetic arrays that are used hereinafter are: chain array (FIGS. 3A-3D), annular cylinder array (FIGS. 3E-3G), semi-annular cylinder array (FIGS. 3H-3J), and E-shaped array (FIG. 3*k*).

Generally, each array can be extended along the respective longitudinal axis of the array for any desired length. Some arrays are not shown in extended form. FIG. 3G shows an example of the sequence of magnetic elements in the first period length of the array which includes (from right to left of the longitudinal direction of the array) an annular magnetic cylinder 168*a*, a magnetic ring 170*a*, an annular magnetic cylinder 168*b*, and a magnetic ring 170*b*.

FIG. 3L shows a crossed shaped array. In the center of the array, there is an axially magnetized ring 180 which is surrounded by four identical 8-shaped magnets. Generally, the structure shown in FIG. 3L can be like a daisy type of structure in which the central ring 180 can be surrounded by multiplicities of 8-shaped or other types of magnets such as chain magnets to form a symmetrical daisy-like array (hereinafter "daisy-like array"). The central ring magnet 180 can be any axially magnetized magnetic elements which may have various shapes such as a sphere, cylinder, disk, cone, and many other shape possibilities which will be described later in the disclosure.

FIGS. 3M-3O show axial cross-sectional view of some non-limiting examples of closed-looped multi-polar arrays. FIGS. 3M and 3N are examples of dipolar circular type of arrays. In FIG. 3M the dipolar structure includes eight identical magnetic ring circularly positioned relative to each other such that incremental angular rotation of each two adjacent magnetic ring is 90 degrees. Another word, the magnetization direction of each magnetic ring rotates 90 degrees relative to magnetization direction of the adjacent ring. The incremental angular rotation in the dipolar array of FIG. 3N is 45 degrees. FIG. 3O is an example of a four-polar circular array. In a similar manner of FIGS. 3M-3O, many other structures of closed-loop multi-polar arrays can be formed which may have any geometric patterns and any number of poles in the array.

FIGS. 3M-3O show closed looped arrays having magnetic elements with identical shapes and angular rotations; these simplified arrays are selected only for illustration purpose. However, it should be understood that a closed-looped arrays may be formed by magnetic elements which are different in shapes, numbers and angular rotations. For example, a closed looped array may include two different types of magnetic elements having different shapes. These shapes for example may have trapezoidal and rectangular cross sections. These shapes may be arranged in an alternate manner along the circumference of the closed-loop array to form a symmetrical array (not shown). Furthermore, the structural geometry of the array can be any closed-looped geometry such as curved surfaces or multisided geometric figures such as square, octagon, and the like.

Figure 3P:
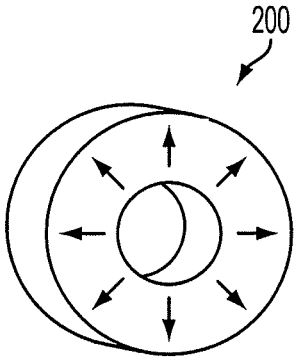
Figure 3Q:
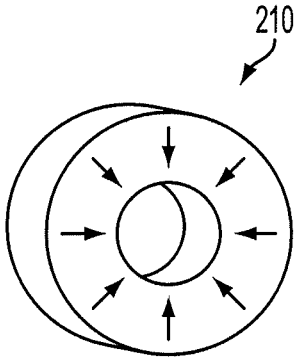

FIGS. 3P-3Q show another type of ring-shaped magnetic elements 200, 210, each having a structure which is similar to magnetic ring 120 in FIG. 1A; however, the rings (200, 210) are radially magnetized such that the circular inner and outer surfaces of the ring are the opposite polar areas of the magnet. If magnetization direction is extended radially outward, such as ring 200 shown in FIG. 3P, then the circular inner and outer surfaces of the ring respectively defines the south and north poles of the ring. In contrast, if the magnetization direction is extended radially inward, such as ring 210 shown in FIG. 3Q, then the circular inner and outer surfaces of the ring respectively defines the north and south poles of the ring. The structure of each radially magnetized ring of 200 or 210 can be formed as one-piece ring or may comprise of identical segments to form a ring.

The magnetic ring 200 or 210 will be called "radially magnetized ring" to differentiate it from the magnetic rings 120 or 150.

Figure 3R:
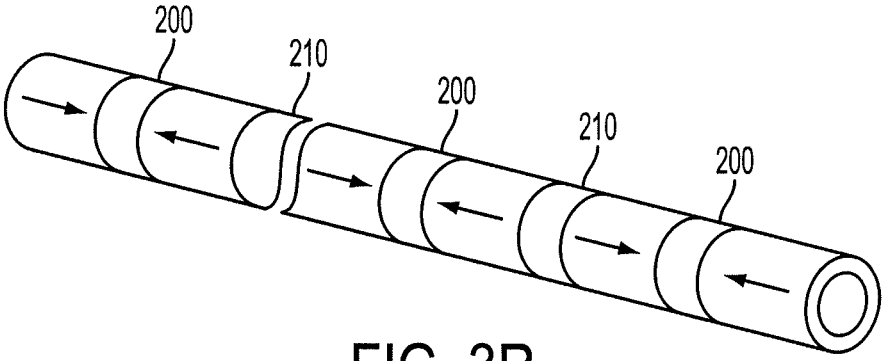

Similar to other magnetic elements, radially magnetized rings can be used in the formation of various magnetic arrays. For example and without limitation, FIG. 3R shows an array which is similar in structure to an annular cylinder array such as array of FIG. 3G, in which the successive magnetic rings (170*a*, 170*b*, 170*c*, . . . ) of the array of FIG. 3G are replaced with radially magnetized rings. In the array of FIG. 3R the successive poles of the array alternate between an outwardly and inwardly magnetized ring similar to rings 200 and 210, respectively. In the array of FIG. 3R each radially magnetized ring forms a circular band-like polar area for the array. In FIG. 3R, the polar areas of the array are indicated by the reference numbers 200 and 210 indicating an inwardly and outwardly magnetized ring similar to rings 200 and 210, respectively.

Figure 3S:
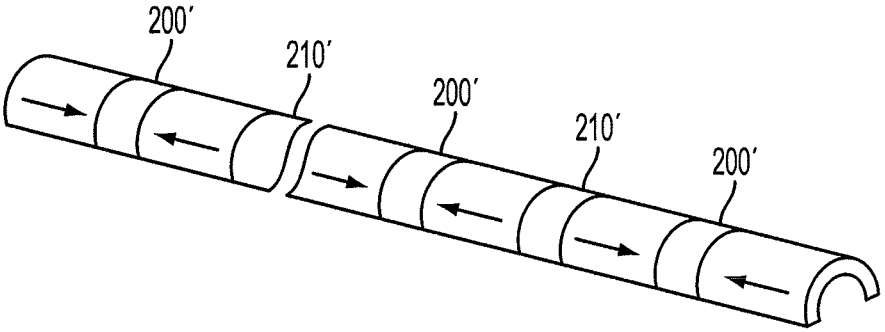

FIG. 3S shows an array formed by cutting the array of FIG. 3R by a plane passing through the longitudinal axis of the array. In the array of FIG. 3S, polar band areas of the array are indicated by the reference numbers 200' and 210' which are the cut away of the polar bands of 200 and 210 of the array of FIG. 3R, respectively.

Exemplary Embodiments Having Reciprocating Motion

Figure 4:
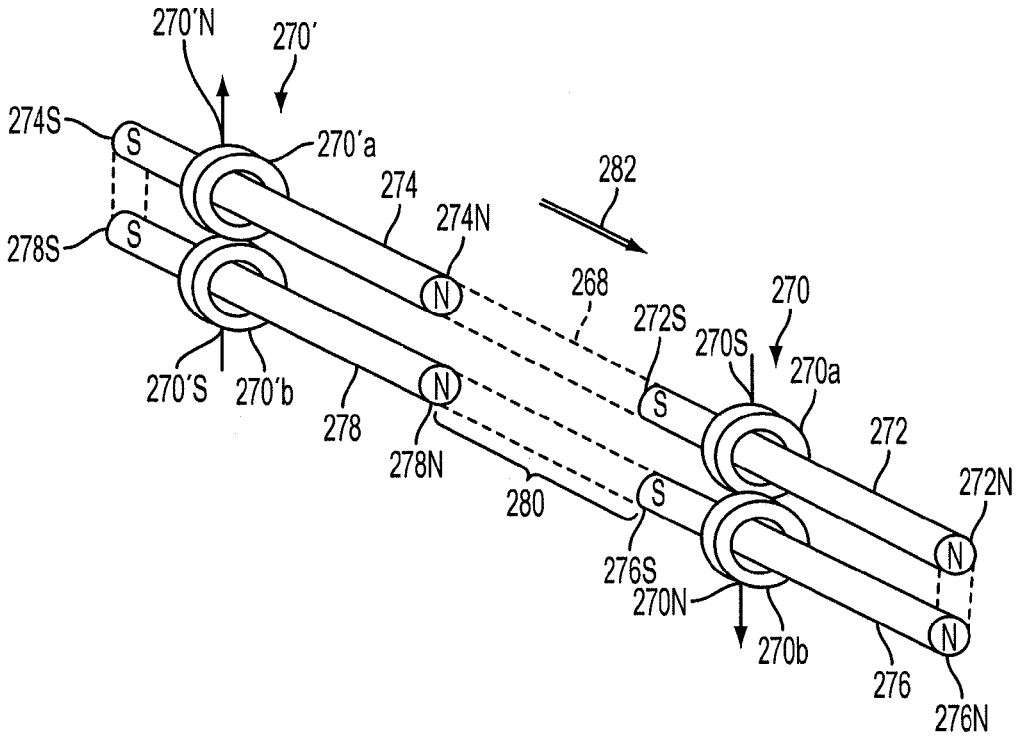
FIG. 4 illustrates an exemplary embodiment of a magnetic configuration for reciprocating motion according to an embodiment of the present invention.
Figure 5A:
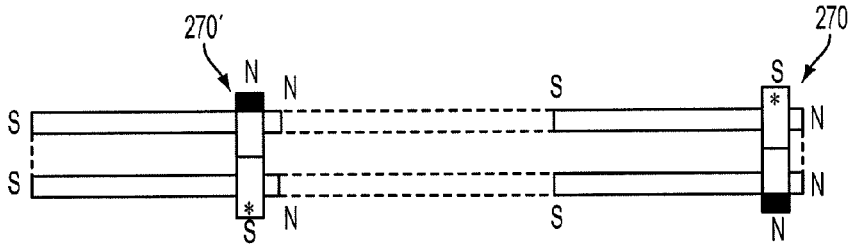
FIGS. 5A-5E show the front views of the magnetic configuration shown in FIG. 4 during a forward and backward reciprocal movement of the magnetic cylinders according to an embodiment of the present invention.
Figure 5B:
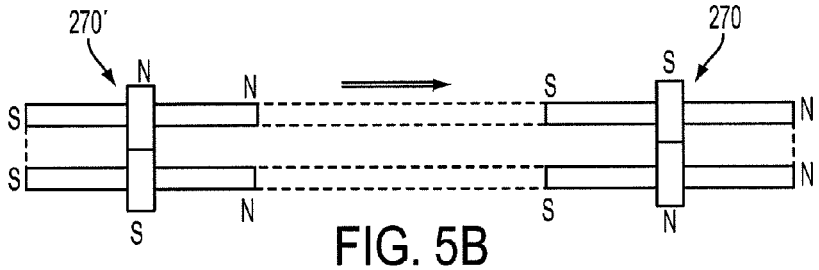
Figure 5C:
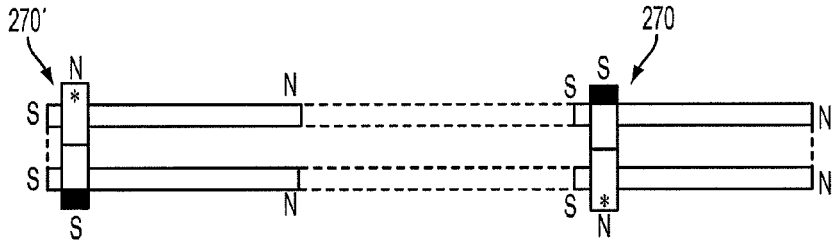
Figure 5D:
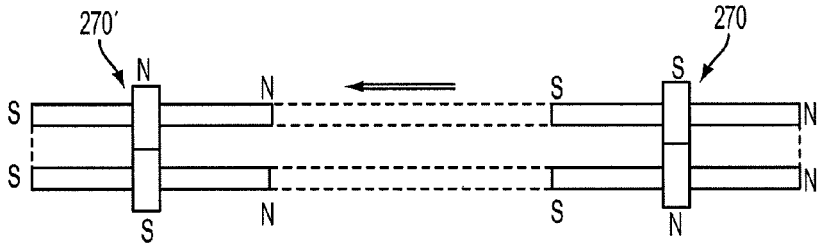
Figure 5E:
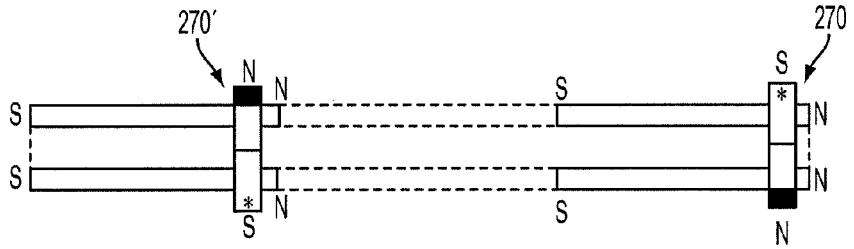

FIG. 4 illustrates an exemplary embodiment of a magnetic configuration for reciprocating motion. The magnetic configuration is comprised of a primary component (a first component which is preferably a stationary component) and a secondary component (a second component which is preferably a moving, or movable, component) capable of a translational positional change by a reciprocal motion.

The stationary component is comprised of two substantially identical 8-shaped magnetic elements 270 and 270', first field sources, which are mounted spaced apart in an aligned and mirror image fashion on a stationary supporting means such as a stationary frame (not shown). Each 8-shaped magnet has an upper and a lower circular ring (270*a*, 270*b*; 270'*a*, 270'*b*). The alignment of the 8-shaped magnets is such that the central axes of the upper rings (270*a* and 270'*a*) are coincident and forming a common central axis line for the upper rings; similarly, the central axes of the lower rings (270*b* and 270'*b*) are coincident and forming a common central axis line for the lower rings such that both common central axis lines of upper and lower rings are parallel. Each 8-shaped magnet has two opposite polar ends and all polar ends (270S, 270N; 270'S, 270'N) have a first predetermined magnetic field strength which is substantially identical for all of these polar ends. The magnetization directions of both 8-shaped magnets are parallel and in opposite direction. The separation distance between the two 8-shaped magnets is a length that minimizes or preferably prevents the magnetic interaction between the 8-shaped magnets.

The moving component is comprised of four identical cylindrical shaped magnetic elements (272, 274, 276, 278), second field sources, each having a longitudinal axis. Each magnetic cylinder is magnetized through its longitudinal axis such that the end portions of each cylinder defines the first and second opposite polar ends of each magnetic cylinder (272N, 272S; 274N, 274S; 276N, 276S; 278N, 278S). All magnetic cylinder polar ends have a second predetermined magnetic field strength which is substantially identical for all of polar ends of the magnetic cylinders.

Diameter of the magnetic cylinders is selected such that each cylinder can be positioned coaxially within, and separated by a uniform gap from, the ring opening. The coaxial position is such that the longitudinal axis of the cylinder and the central axis of the ring are coincident. The size of the uniform gap is preferably small enough so that allowing a reciprocal motion of the cylinder, in a mating manner, within the opening of, and along the central axis direction of, the ring. The ratio of external diameter size of each ring to the diameter of each cylinder is a number which is more than one, preferably about two. All cylinders have substantially identical spatial positions relative to the respective associated rings. An identical distance 280 separates the magnetic cylinders in longitudinal direction to prevent magnetic interaction between unlike neighboring polar ends of the magnetic cylinders.

All cylinders are connected to each other (shown in dotted lines 268) through rigid non-magnetic materials to form a one piece unitary magnetic structure. This unitary structure is mounted on a driving support means (not shown) for a reciprocal motion within the openings of (and along the common central axis of) the rings of the 8-shaped magnets.

The driving support means may comprise a non-magnetic motion guiding means such as antifriction guiding means for example linear bearing means or a thin tubular sliding means (not shown) which can be positioned coaxially and preferably in contact with the internal surface of the ring openings. The material of the tubular sliding means can be selected from antifriction materials such as Teflon.

Movement of the first component relative to the second component produces a field interaction therebetween. Specifically, the reciprocal movement brings the polar ends of each cylinder to a magnetically interactive distance of its associated ring for a magnetic interaction. Preferably, the length of the cylinder is selected such that when a first polar end of a cylinder having a magnetic interaction with its associated ring, the second polar end of the cylinder is at a distance from the associated ring such that having a minimum magnetic influence on the magnetic interaction of the first polar end. The stroke length of the reciprocating motion is preferably less than the length of each cylinder such that during each stroke each cylinder remains within its associated ring. The field interaction produces an increase in at least a first field of a plurality of fields associated with the polarities of the first and second field sources and a decrease in at least a second field of the plurality of fields. Specifically, the magnetic interaction produces a change in the magnetic field strength of the polar ends of the 8-shaped magnet involved in the magnetic interaction. The change is a function of the distance between the cylinder polar end involved in the magnetic interaction and its associated ring. The closer this distance the stronger is the change.

In the embodiment shown in FIG. 4, as a result of the motion of cylinders in the direction of double lined arrow (282), the polar end 272S and 276S are closer to the rings 270*a* and 270*b*, respectively. Similarly, the polar ends 274S and 278S are closer to the rings 270'*a* and 270'*b*, respectively. Consequently, the field interaction increases a field associated with at least one of the polarities of the first field sources and decreases a field associated with at least another one of the polarities of the first field sources. Specifically, the magnetic field strength of the polar ends 270S and 270'S are increased and the magnetic field strength of the polar ends 270N and 270'N is decreased. It should be noted that in this disclosure an increase and a decrease in the field of a field source are interchangeably described as an increase and a decrease in the field strength, respectively; or sometimes simply described as changes of magnetic strength.

The movement of the moving component relative to the stationary component can be achieved with a minimum driving force necessary, and this is because of the cancellation of attractive and repulsive forces. The first and second field sources are oriented relative to each other such that repelling forces associated with the same polarities of the first field sources and the second field sources and attractive forces associated with the opposite polarities of the first field sources and the second field sources substantially cancel each other out in respect to the field interaction between the first and second components. For example, in FIG. 4, during the motion of cylinders in the direction of the double lined arrow 282, at magnetically interactive distances the following forces can be identified:

TABLE 1

| Cylinder Polar End | Associated Ring | Interaction Force |
|---|---|---|
| 272S | 270a | repulsive |
| 274S | 270'a | attractive |
| 276S | 270b | attractive |
| 278S | 270'b | repulsive |

These forces are substantially equal in magnitude and cancel each other. Consequently, the magnetic field strength of the polar ends of the 8-shaped magnets can be readily changed with a minimum driving force.

Accordingly, the magnetic configuration in FIG. 4 may be used in a method of changing a field strength of at least a portion of at least one field source. The method includes arranging a first component having at least one first field source having opposite polarities relative to a second component having at least one second field source having opposite polarities. The arrangement is such that a movement of at least one of the first and second components relative to the other of the components produces a field interaction therebetween. The method further includes orienting the at least one first and the at least one second field sources relative to each other such that the field interaction between the first and second components to generate repelling forces associated with the same polarities of the first field source and the second field source and attractive forces associated with the opposite polarities of the first field source and the second field source substantially cancel each other out in respect to the field interaction between the first and second components. The field interaction produces an increase in a first field of a plurality of fields associated with the polarities of the at least one first and at least one second field sources and a decrease in a second field of the plurality of fields.

Alternatively, the field interaction may produce a plurality of interaction forces which may result in a plurality of torques such that both the interaction forces and the resulting torques act upon the movable component. The at least one first and the at least one second field sources may be oriented relative to each other such that the field interaction satisfies requirements that: at least one of a sum of the interaction forces or a sum of the resulting torques is substantially zero, and the field interaction produces an increase in a first field of a plurality of fields associated with the polarities of the at least one first and at least one second field sources and a decrease in a second field of the plurality of fields.

FIGS. 5A-5E show the front views of the magnetic configuration shown in FIG. 4 during a forward and backward reciprocal movement of the magnetic cylinders. FIGS. 5A-5E also show the change in the magnetic field strength of the polar ends of the 8-shaped magnet during the reciprocal motion. The areas marked with a solid black and a star sign (*) represent a polar end having an increase or a decrease in its magnetic field strength, respectively. The double lined arrows show the direction of the motion. For clarity purpose, the connection means are indicated with dotted lines.

Figure 6:
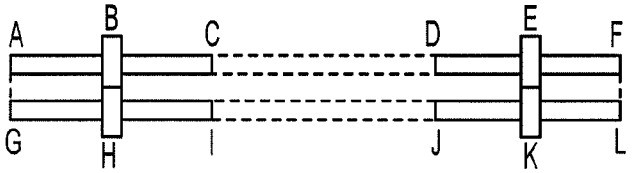
FIG. 6 is a front view of the configuration shown in FIG. 4 according to an embodiment of the present invention.

There are many different ways for arranging the polarity types of the polar ends of cylinders and 8-shaped magnets such that during movement of cylinders the repulsive and attractive forces can be cancelled. An example of the various polarity type arrangements for the configuration shown in FIG. 4 can be seen in FIG. 6 and Table 2. FIG. 6 is a front view of the configuration shown in FIG. 4. The polarity types of the polar ends of the magnetic elements are represented by alphabetical letters. Table 2 provides examples of alternative polarity type arrangements. The heading at the top of each column in the Table 2 represents the same alphabetical letter shown in FIG. 6. The letter N and S represent north and south polarity type, respectively. Each numbered row of the Table 2 represents one possible alternative for polarity type arrangement. For example, the row #1 corresponds to the same polarity arrangement for the configuration shown in FIG. 4. As can be seen in Table 2, there are many possibilities for arrangement of polarity types in an embodiment. Although in the description of other embodiments that follow, for the sake of brevity and without limitation, only one example of the polarity type arrangement for each configuration is provided, it should be understood that for each exemplary embodiment in this disclosure there are other possibilities for arrangement of the polarity types to achieve the cancellation of the repulsive and attractive forces during any type of motion of the moving component.

In some of the polarity arrangements shown in Table 2 there are cases when polarity types of the neighboring magnetic elements of the stationary or moving components are unlike poles which may cause undesirable magnetic interactions. In these cases, to minimize the undesirable magnetic interactions, preferably the magnetic elements with unlike poles should be spaced from one another. For example, in the arrangement of row #3 of the Table 2, polar ends of A and G (and similarly polar ends of C and I; D and J; F and L) of the parallel magnetic cylinders have unlike poles. In this case the distance between two parallel magnetic cylinders should be preferably long enough to minimize the attractive magnetic interaction between the unlike polar ends. This can be done by using other magnetic elements instead of 8-shaped magnets, such as dumbbell shaped magnetic elements.

It should be noted that the shape relation between the polar ends of the cylinders and the opening of the rings in the configuration of FIG. 4 can preferably be any type of complementary shape relation so that cylinders can reciprocate in a mating relationship manner within the openings of the associated rings.

TABLE 2

| No. | A | B | C | D | E | F | G | H | I | J | K | L |
|---|---|---|---|---|---|---|---|---|---|---|---|---|
| 1 | S | N | N | S | S | N | S | S | N | S | N | N |
| 2 | N | N | S | S | S | N | N | S | S | S | N | N |
| 3 | N | N | S | N | S | S | S | S | N | S | N | N |
| 4 | N | N | S | N | S | S | N | S | S | N | N | S |
| 5 | S | N | N | N | S | S | S | S | N | N | N | S |
| 6 | S | N | N | S | S | N | N | S | S | N | N | S |
| 7 | N | N | S | S | N | N | N | S | S | S | S | N |
| 8 | S | N | N | S | N | N | S | S | N | S | S | N |

TABLE 2-continued

| No. | A | B | C | D | E | F | G | H | I | J | K | L |
|---|---|---|---|---|---|---|---|---|---|---|---|---|
| 9 | S | N | N | N | N | S | N | S | S | S | S | N |
| 10 | S | N | N | N | N | S | S | S | N | N | S | S |
| 11 | N | N | S | N | N | S | N | S | S | N | S | S |
| 12 | N | N | S | S | N | N | S | S | N | N | S | S |
| 13 | S | S | N | S | S | N | S | N | N | S | N | N |
| 14 | N | S | S | S | S | N | N | N | S | S | N | N |
| 15 | S | S | N | N | S | S | N | N | S | S | N | N |
| 16 | N | S | S | S | S | N | S | N | N | N | N | S |
| 17 | N | S | S | N | S | S | N | N | S | N | N | S |
| 18 | S | S | N | N | S | S | S | N | N | N | N | S |
| 19 | N | S | S | S | N | N | N | N | S | S | S | N |
| 20 | S | S | N | S | N | N | S | N | N | S | S | N |
| 21 | N | S | S | N | N | S | S | N | N | S | S | N |
| 22 | S | S | N | N | N | S | S | N | N | N | S | S |
| 23 | N | S | S | N | N | S | N | N | S | N | S | S |
| 24 | S | S | N | S | N | N | N | N | S | N | S | S |

Figure 7:
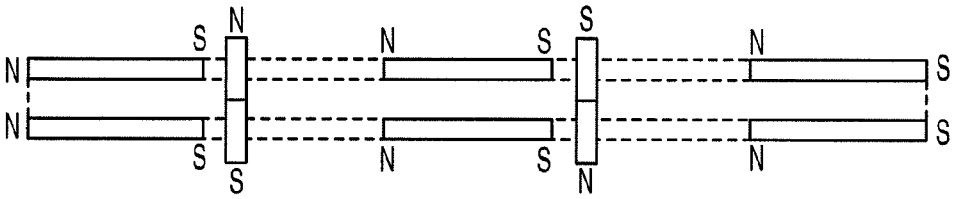
FIG. 7 shows a front view of a modified configuration for a reciprocal movement in which three successive pairs of cylinders are used according to an embodiment of the present invention.

FIG. 7 shows a front view of a modified configuration for a reciprocal movement in which three successive pairs of cylinders are used. The configuration of the magnetic elements is similar to the configuration described in connection to FIG. 4. However, it differs from the configuration shown in FIG. 4 in that the reciprocation of cylinders is outside the ring openings of the 8-shaped magnets.

In a similar fashion of the configurations shown in FIG. 4 or 7, other pairs of identical magnetic elements or arrays can be used instead of 8-shaped magnets of the stationary component. Other magnetic elements or arrays that can be used as the stationary component may include, but not limited to, any magnetic chain elements or arrays, daisy-like arrays, or any pair of identical circular dipoles or multi-polar circular arrays such as those shown in FIGS. 3M, 3N, and 3O. When using these alternative magnetic elements or arrays, a number of identical magnetic cylinders can be used and positioned relative to the rings of the magnetic elements or arrays in the same fashion shown in the configuration of FIG. 4 or 7.

Figure 8:
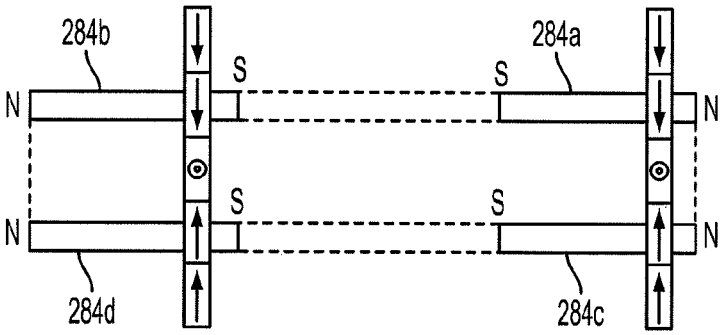
FIG. 8 shows a front view of a configuration in which the spatial relation of its components is similar to the components in the configuration of FIG. 4 according to an embodiment of the present invention.

For example, FIG. 8 shows a front view of a configuration in which the spatial relation of its components is similar to the components in the configuration of FIG. 4. Stationary component of the configuration of the FIG. 8 comprises a pair of linear chain arrays similar to the array of FIG. 3B. The moving component includes four identical magnetic cylinders. More or less number of magnetic cylinders can be used, for example, only a pair of identical cylinders (284*a* and 284*b*) can be used or more cylinders such as 10 identical cylinders can be used so that each ring of the chain arrays can be associated with a magnetic cylinder.

Figure 9:
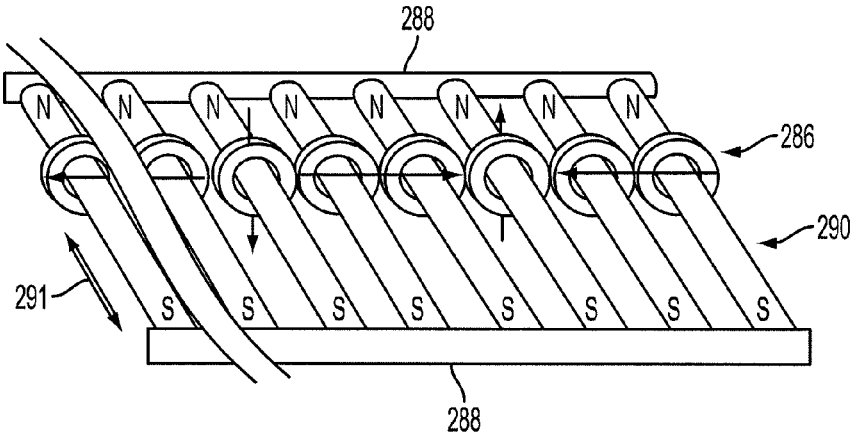
FIG. 9 shows another example of a configuration for a reciprocal motion in which a stationary component includes a magnetic chain array according to an embodiment of the present invention.

FIG. 9 shows another example of a configuration for a reciprocal motion in which the stationary component comprises of a magnetic chain array 286. In some embodiments such as this embodiment, a Halbach array defines a plurality of openings for a mating relation with at least one second field source of a second component. The moving component comprised of identical magnetic cylinders which are axially magnetized. Each ring of the array is associated with a magnetic cylinder in the same spatial manner shown in the configuration of FIG. 4. All magnetic cylinders are connected to each other by a connection means 288 (using rigid non-magnetic materials) to form a unitary set 290 of identical cylinders having the same polarity type in each opposite side of the set 290. A reciprocal motion of the cylinders in the direction of movement 291 produces a change in the strength of the magnetic field pattern of the polar ends of the array. The configuration may be extended to any desired length. However, a preferable extension length should include an even number of the full period length of the array 286. In this preferable length, the interactive forces which may influence the motion of the moving component can be substantially cancelled. As a result, the moving component can be achieved with a minimum energy requirement.

The configuration of FIG. 9 may be extended two dimensionally to provide a planar matrix structures of the arrays (not shown) in which the configuration of each row of the matrix is similar to the configuration shown in FIG. 9, and all rows of the matrix can be positioned relative to each other in a mirror image relation.

Figure 10:
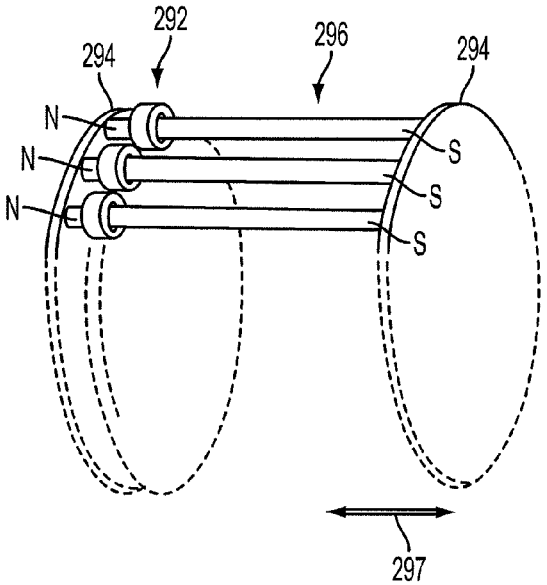
FIG. 10 shows another example of a reciprocal configuration in which magnetic elements of a stationary component can be arranged in a non-linear form according to an embodiment of the present invention.

Alternatively, in the configuration of FIG. 9 the magnetic elements of the stationary component 286 can be arranged in a non-linear form such as a closed-loop arrangement of a multi-polar circular array. An example of this type of reciprocal configuration is shown in FIG. 10. The stationary component 292 comprises of a four polar circular array similar to the circular array shown in FIG. 3O. For clarity purpose, in FIG. 10 only a portion of the magnetic rings of the circular array of FIG. 3O is shown, also the magnetization direction of the succeeding rings as shown in FIG. 3O is not shown here. Preferably each magnetic ring of the circular array can be associated with a magnetic cylinder in a similar spatial manner shown in the configuration of FIG. 9. All magnetic cylinders are connected to each other by a connection means 294 (using rigid non-magnetic materials) to form a unitary set 296 of identical cylinders having the same polarity type in each opposite side of the set 296.

Alternatively, in configurations of FIG. 9 or 10, the cylinder set (290, or 296) instead of reciprocating within the rings of the array can reciprocate at the outer side of the array along the extension of its motion path within the rings of the array. For example, in the configuration of FIG. 10 the unitary moving set 296 can be positioned, along the extension of its movement path, on the exterior flat circular face of the stationary component 292 for a reciprocating motion (not shown). The reciprocation is a motion toward and away from magnetic interaction proximity of the flat circular face of the stationary component 292. In this type of modification, preferably the unitary magnetic cylinders set of the moving components can be replaced by a one-piece magnetic element. For example, in configuration of FIG. 10 a hollow magnetic cylinder (not shown) which is axially magnetized can replace the cylinder set 296. The hollow magnetic cylinder can have a similar spatial and magnetic characteristic as of the unitary set 296.

Figure 11A:
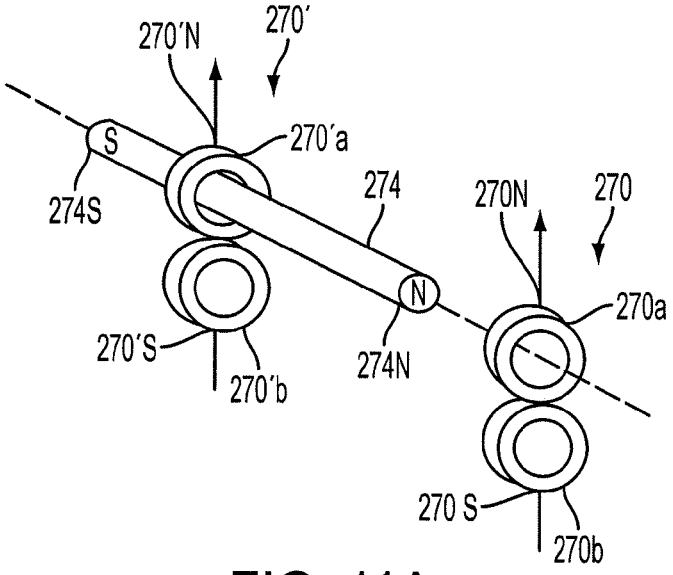
FIG. 11A shows a simplified configuration in which a stationary component can include two identical 8-shaped magnets and a moving component can include one magnetic cylinder according to an embodiment of the present invention.

It should be noted that in the configuration of FIG. 4 the length of the magnetic cylinders may be selected such that being equal to the separation distance between centers (or vertical center lines, or the like) of the two 8-shaped magnets (270, 270'). This will create a simplified configuration in which the stationary component can comprise of two identical 8-shaped magnets and the moving component can comprise one magnetic cylinder as shown in FIG. 11A. The spatial relation of the magnetic cylinder and the rings of the 8-shaped magnets are similar to that of shown in FIG. 4; therefore, the same reference numbers as that of FIG. 4 are used for the magnetic elements of FIG. 11A. The magnetization direction of the 8-shaped magnets (270, 270') are identical and in the same direction. Magnetic cylinder 274 can move within the one of the opening of the rings of the 8-shaped magnets such as 270'*a*, in that case the magnetic cylinder 274 can move on and along the common central axis line of the rings (270*a*, 270'*a*). Preferably stroke length of the magnetic cylinder can be about half of its length. A reciprocal motion of the magnetic cylinder 274 bring its polar ends to equal magnetic interaction distance from the rings 270*a*, and 270'*a* to produces opposite magnetic forces that substantially cancel one another such that there is a change in the magnetic field strength of the upper rings (270*a*, 270'*a*). Alternatively, in the configuration of FIG. 11A the pair of 8-shaped magnets (270, 270') can be replaced by a pair of other magnetic elements such as a pair of radially magnetized rings.

Figure 11B:
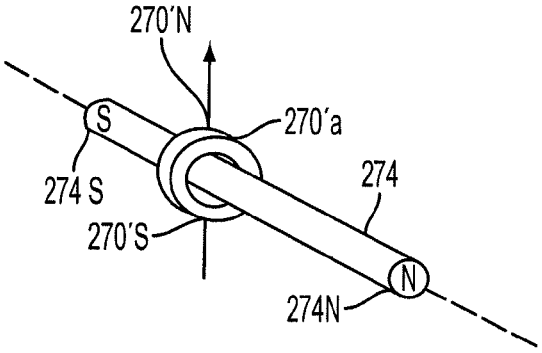
FIG. 11B shows another simplified configuration according to an embodiment of the present invention.

As a further simplification, a configuration may comprise only of a ring and a cylinder of the configuration of FIG. 4, such as for example ring 270'*a* and its associated cylinder 274 which are shown in FIG. 11B. The ring 270'*a* and magnetic cylinder 274 (having the same spatial relation as that of shown in FIG. 4) forming a simplified configuration. As magnetic cylinder moves on and along the central axis of the ring 270'*a*, at a magnetic interaction distance (when one polar end of the magnetic cylinder 274 is closer to the to the ring than the other polar end of the magnetic cylinder) there is a magnetic interaction between the closer polar end of the cylinder and the polar ends of the ring such that generates a repulsive and an attractive force which substantially cancel one another while there is an increase and decrease in the respective magnetic strength of the polar ends of the ring.

As a modification of the simplified configuration of FIG. 11B the position of cylinder 274 can be outside of the opening of the ring 270'*a* such that the cylinder can move on and along the central axis of and at the outside of the ring 270'*a* (not shown). The magnetic interaction behavior of the cylinder and the ring, at a magnetic interaction distance, can be similar to that of the configuration of FIG. 11B.

The simple configuration of FIG. 11B (or its modification described in the above) indicates that in a basic form of a configuration (for changing the strength of magnetic field while requiring minimum energy input) each of the stationary and moving components of the configuration may comprise only one magnetic element.

Figure 12:
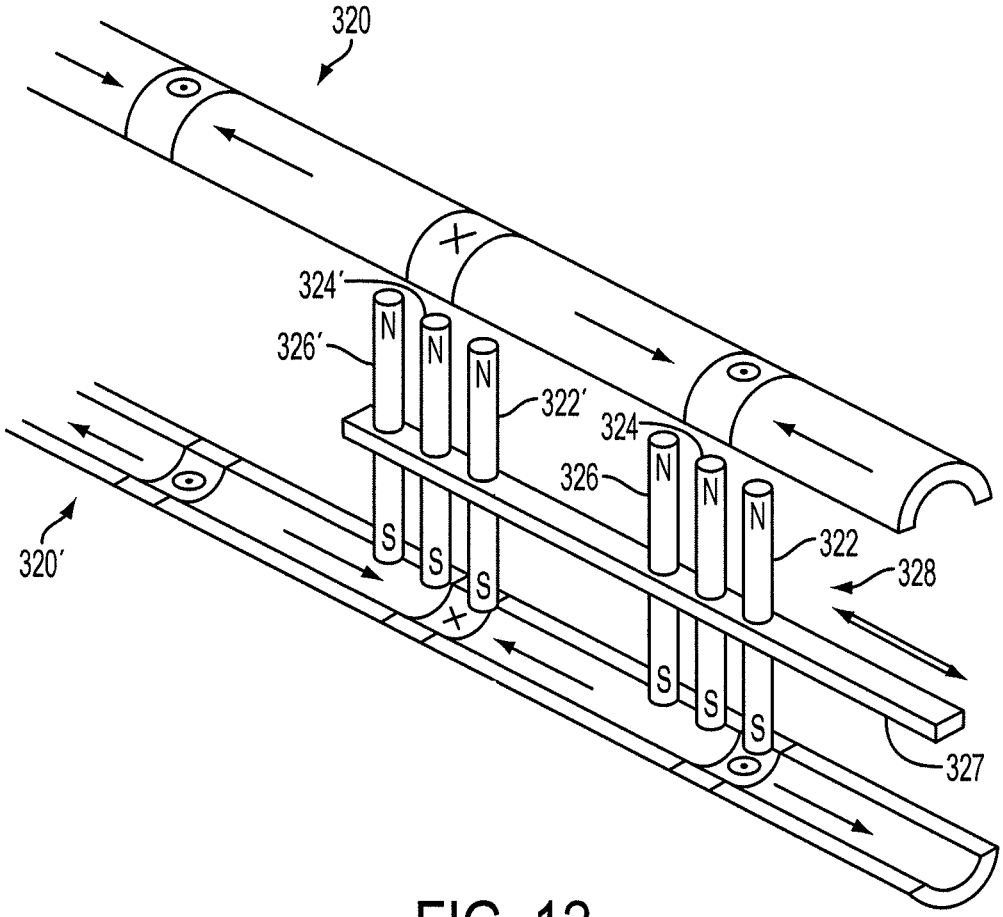
FIG. 12 shows another example of a configuration for reciprocal motion in which stationary and moving component comprises of a pair of identical linear arrays and six identical magnetic cylinders, respectively, according to an embodiment of the present invention.

FIG. 12 shows another example of a configuration for reciprocal motion in which stationary and moving component comprises of a pair of identical linear arrays (320, 320') and six identical magnetic cylinders (322, 324, 326; 322', 324', 326'), respectively.

The identical linear arrays (320, 320') are similar to the array of FIG. 3J, and are facing each other with the respective recessed portions in a spaced apart, parallel, aligned, and mirror image manner. The magnetization directions of each corresponding mirror-imaged polar ends of the arrays extend on a common axis and in the same direction, and the other corresponding mirror-imaged magnetic elements having an anti-parallel relation relative to each other.

All magnetic cylinders are parallel, transversely aligned, coplanar, and all their magnetization directions oriented in the same direction. The magnetic cylinders comprise of two groups, each group having three equidistance successive cylinders (first group: 322, 324, 326; and second group: 322', 324', 326').

The cylinders are sandwiched between the pair of arrays (320, 320') in a symmetrical manner. The spatial position of cylinders relative to the polar ends of the arrays are such that the middle magnets 324, 324' of the first and second group of cylinders positioned equidistantly and in an aligned manner relative to the respective succeeding mirror-imaged polar ends of arrays such that the longitudinal axis of the middle cylinders (324, 324') are coincident with the respective common axis of a corresponding polar ends of the arrays. The diameter of the magnetic cylinders is preferably smaller than the internal diameter of recessed the arrays (320, 320'). Preferably, the end portions of the cylinders are sized and shaped such that the polar end portion of each magnetic cylinder having a complementary shape relation relative to the curved recessed surface of the arrays (320, 320'). All cylinders are connected to each other by a connection means 327 (using rigid non-magnetic materials) to form a unitary cylinder set 328.

The extend of the magnetic interaction area between the polar ends of each group of magnetic cylinders and the respective polar area of each array can be any identical areas on the longitudinal extension of the arrays such that producing opposite magnetic interaction forces that can cancel one another.

The unitary cylinder set 328 can reciprocate parallel to and equidistantly from the faces of, and along the longitudinal axis of, the linear arrays (320, 320'). The size of the separation distance between the polar ends of cylinders and the face of the arrays are selected such that not only allows a free, preferably non-contact, motion of cylinders, but also allows magnetic interaction with the arrays to provide a change in the magnetic field strength of the arrays polar ends which are involved in the magnetic interaction with the respective cylinders. The length of each stroke can be any desired length along the longitudinal extension of the stationary component, although typically, the length is approximately equal to the distance between central axes of cylinders 324 and 324'.

The reciprocal motion of cylinder set 328 can produce magnetic interaction between the moving and stationary component resulting in a change in the magnetic field strength of the stationary arrays (320, 320') at the interaction areas and at the same time the magnetic forces influencing the motion of the moving component substantially can be cancelled.

It should be noted that in the configuration of FIG. 12 the selected number of magnetic cylinder in the each group of cylinders is for illustration purpose and a more or less number of cylinders can be used in the moving component. For example, instead of two groups of cylinders, only two cylinders (such as middle cylinders 324 and 324') can be used in the configuration.

Figure 13:
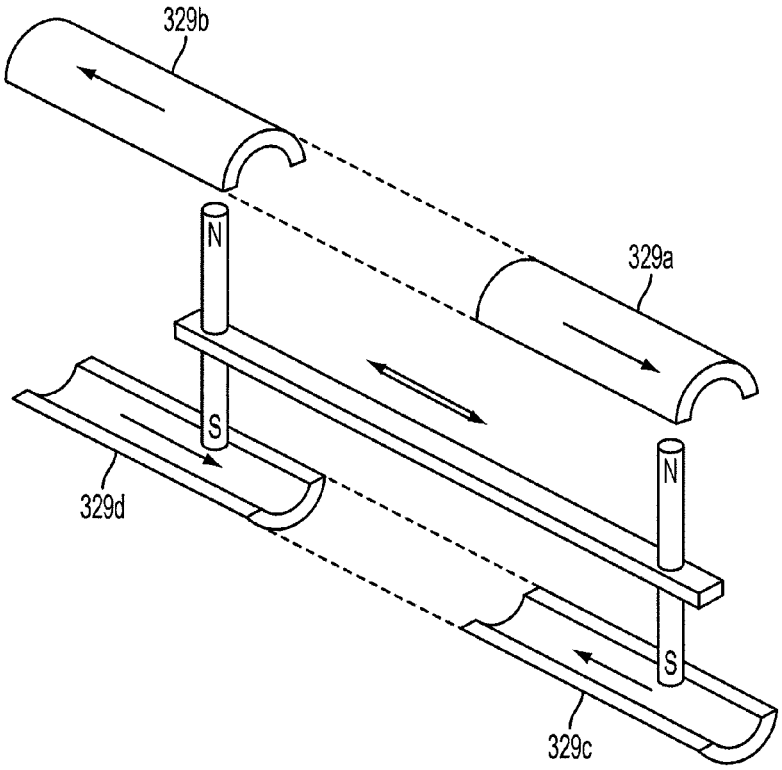
FIG. 13 shows an example of a configuration in which the spatial arrangement of the configuration is similar to the configuration of FIG. 12 according to an embodiment of the present invention.

Alternatively, in the configuration of FIG. 12, the arrays of the stationary components can be replaced by simple magnetic elements. FIG. 13 shows an example of this type of configuration in which the spatial arrangement of the configuration is similar to the configuration of FIG. 12. However, in the configuration of FIG. 13 four identical semi-annular cylinder shells 329*a*, 329*b*, 329*c*, and 329*d* (similar to the magnetic element shown in FIG. 1L) are used in the stationary component structure. The length of each stroke can be any desired length along the longitudinal extension of the stationary component, although typically, the length is approximately about the length of a semi-annular cylinder shell.

Figure 14:
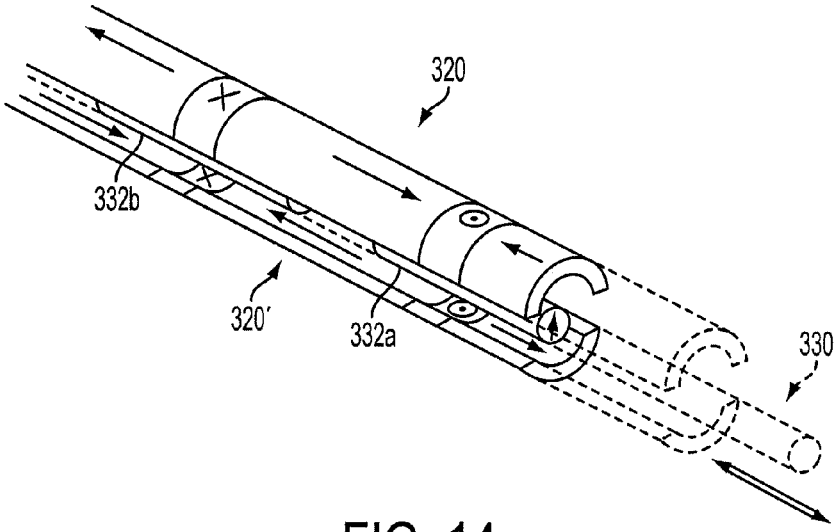
FIG. 14 is a modification of the configuration shown in FIG. 12 according to an embodiment of the present invention.

FIG. 14 is a modification of the configuration shown in FIG. 12 in which two group of magnetic cylinders of the unitary set 328 is replaced by a set 330 which includes a pair of magnetic cylinders (332*a*, 332*b*) that are diametrically magnetized and positioned relative to the arrays (320, 320') in a similar spatial and magnetic relation as that of each group of cylinders of the set 328 in FIG. 12.

Figure 15:
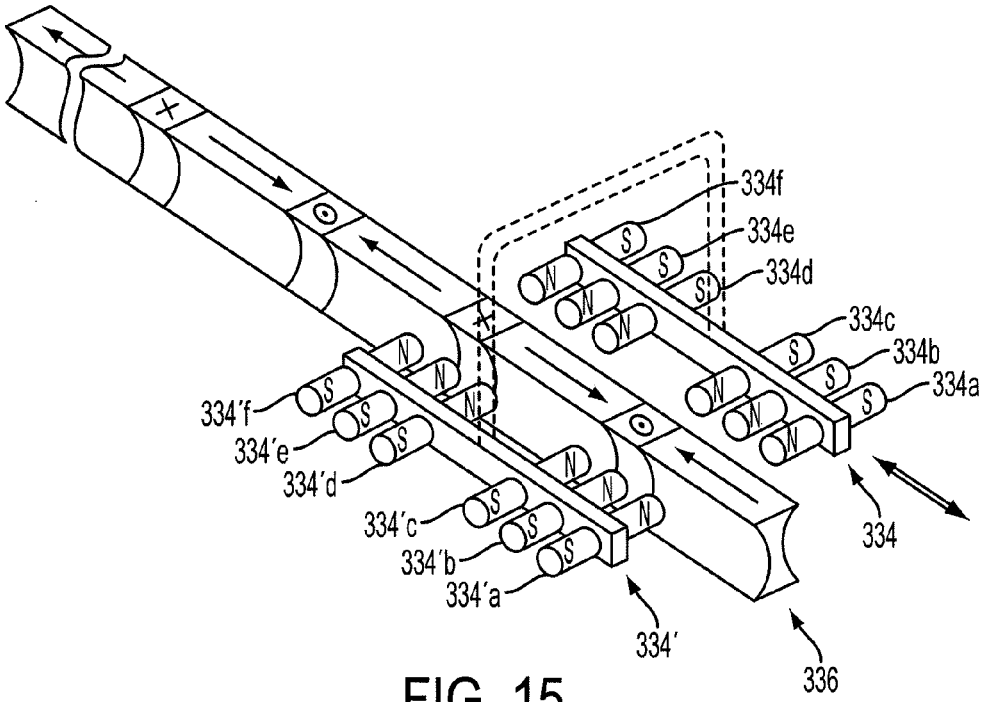
FIG. 15 provides an example of a configuration in which a stationary component may be sandwiched by a moving component in a symmetrical manner according to an embodiment of the present invention.

In contrast to the configuration shown in FIGS. 12-14 in which the moving component is sandwiched symmetrically between a pair of the arrays of the stationary component, there are other configurations in which this structural pattern can be reversed such that the stationary component may be sandwiched by the moving component in a symmetrical manner. FIG. 15 provides an example of this type of configurations. As can be seen in FIG. 15, the stationary component includes a longitudinally extended linear array 336 which is sandwiched between two cylinder sets (334, 334'). The linear array 336 comprises of a series of magnetic elements, each having a rectangular parallelepiped type of geometrical shapes (as will be discussed later in the disclosure, the magnetic elements of a configuration may have a wide variety of shapes) extending in series to form a multi-polar longitudinal array 336. The array 336 having two identical and symmetric recessed portions longitudinally extended on the opposed surfaces of the array. The polarity pattern of the array is similar to that of a chain array (for example see FIG. 3C).

The cylinder sets (334, 334') are aligned in a mirror image manner such that facing preferably a period length of the array 336. The cylinder sets are spaced by a uniform distance from the opposite recessed faces of the array 336. The identical uniform distance separating the polar ends of each opposing cylinder set (334, 334') from the respective recessed side of the array 336 is a magnetically interactive distance allowing magnetic interaction between polar ends of each cylinder set (334, 334') and the recessed portion of the array 336. The paralleled polar ends of cylinders (334, 334') which are facing opposite recessed faces of the array 336 have identical polarities. All cylinders in each set, and also both sets of cylinders (334, 334') are connected to each other through non-magnetic materials to form a unitary magnetic body which is capable of a reciprocal motion in a similar manner of the moving components of the configurations of FIGS. 11 and 12. A reciprocal motion of the unitary cylinder sets along the longitudinal axis of the array can produce a similar magnetic behavior described in connection with the reciprocating configurations of FIGS. 11 and 12.

Figure 16:
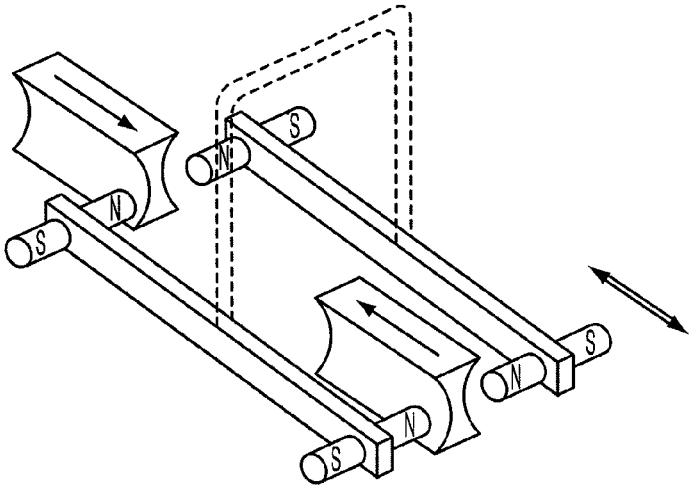
FIG. 16 shows another example of a configuration in which the spatial arrangement of the configuration is similar to the configuration of FIG. 15 according to an embodiment of the present invention.

Alternatively, in the configuration of FIG. 15, the arrays of the stationary components can be replaced by identical magnetic elements. FIG. 16 shows an example of this type of configuration in which the spatial arrangement of the configuration is similar to the configuration of FIG. 15. However, in the configuration of FIG. 16 two identical magnetic elements are used in the stationary component structure. The length of each stroke can be any desired length along the longitudinal extension of the stationary component, although typically, the length is approximately about the length of one magnetic element of the stationary component.

Figure 17:
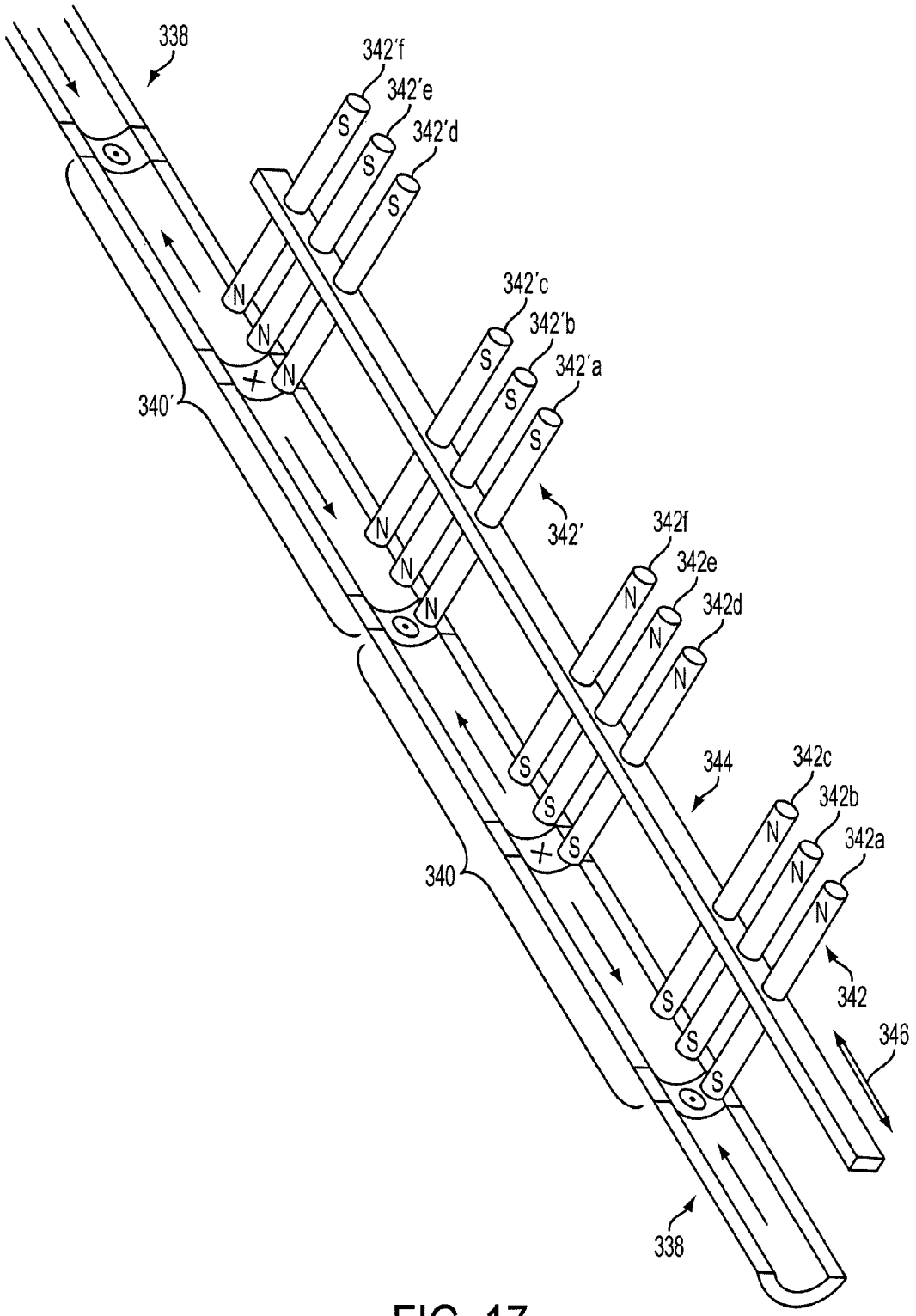
FIG. 17 shows a moving component includes 12 identical magnetic cylinders forming two groups of magnetic cylinders interacting with one side of a stationary array according to an embodiment of the present invention.

In the exemplary configurations shown in FIGS. 11-16, the moving component moves parallel to the interaction surfaces of the stationary component. The interaction surfaces comprised of two opposed surfaces, each surface exposed to magnetic elements of the moving component. However, there are other families of configurations in which only one interacting surface of the stationary component may be exposed to the magnetic elements of the moving component. FIG. 17 provides an example for this type of configurations.

In FIG. 17 the moving component 344 comprises of 12 identical magnetic cylinders forming two groups of magnetic cylinders (342, 342') interacting with one side of the stationary array 338. The preferable complementary shape relation of each magnetic cylinder, and the spatial position of each group of magnetic cylinders (342, 342') relative to the array 338 in FIG. 17 is similar to the corresponding cylinders and arrays in the configuration shown in FIG. 12 and is not repeated here. First and second magnetic cylinder groups (342, 342') have opposite polarities such that each cylinder group (facing a successive period length of the array) having a different polarity. As can be seen in FIG. 17, when a period length 340 of the array 338 exposes to the polar ends of the first group of cylinders 342 having identical polarity, then the next successive period length 340' of the array 338 exposes to a second group of cylinders 342' having a polarity that is opposite to the polarity of the first group, and so on. In other words, polarities of successive group of cylinders alternate for each successive period length of the array.

The size of the arrays and magnetic cylinders are selected such that the distance between the neighboring cylinders (342*f* and 342'*a*) with opposite polarities being such that the selected distance minimizes or preferably prevents the magnetic interaction between the neighboring cylinders with opposite polarities (342*f* and 342'*a*). The cylinder set can move reciprocally in a similar manner described for the configuration of FIG. 12 such that the polar ends of cylinders move in a direction parallel to the longitudinal recessed faces of the arrays. The size of the selected distance between the polar ends of cylinders and the face of the arrays is a magnetically interactive distance such that not only allows a free, preferably non-contact, motion of cylinders, but also allows magnetic interactions with the arrays to provide a change in the magnetic field strength of the arrays poles. The reciprocating movement of the cylinder set can be achieved with a minimum energy requirement since the selected polarity arrangement is such that the magnetic forces influencing the motion of cylinders can be substantially cancelled.

It should be noted that in the configuration of FIG. 17 the selected number of magnetic cylinders is for illustration purpose and a more or less number of cylinders can be used in the stationary component. For example, the stationary component may comprise of four magnetic cylinders (such as 342*a*, 342*d*, 342'*a*, 342'*d*).

Figure 18:
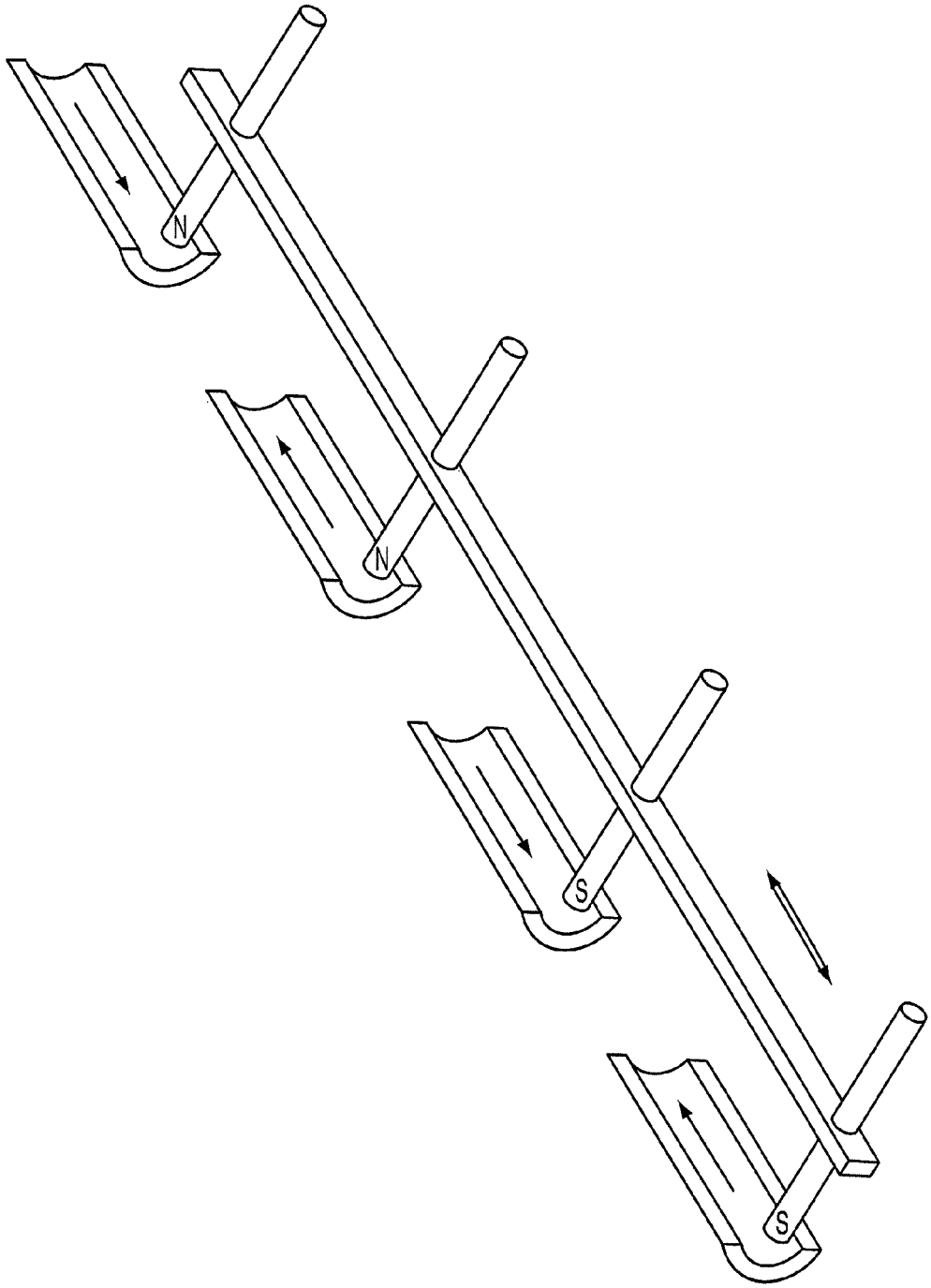
FIG. 18 shows an example of a configuration in which the spatial arrangement of the configuration is similar to the configuration of FIG. 17 according to an embodiment of the present invention.

Alternatively, in the configuration of FIG. 17, the arrays of the stationary components can be replaced by magnetic elements. FIG. 18 shows an example of this type of configuration in which the spatial arrangement of the configuration is similar to the configuration of FIG. 17. However, in the configuration of FIG. 18 four identical magnetic elements (such as semi-annular cylinder shown in FIG. 1L) are used in the stationary component structure. The length of each stroke can be any desired length along the longitudinal extension of the stationary component, although typically, the length is approximately about the length of one magnetic element of the stationary component.

Figure 19:
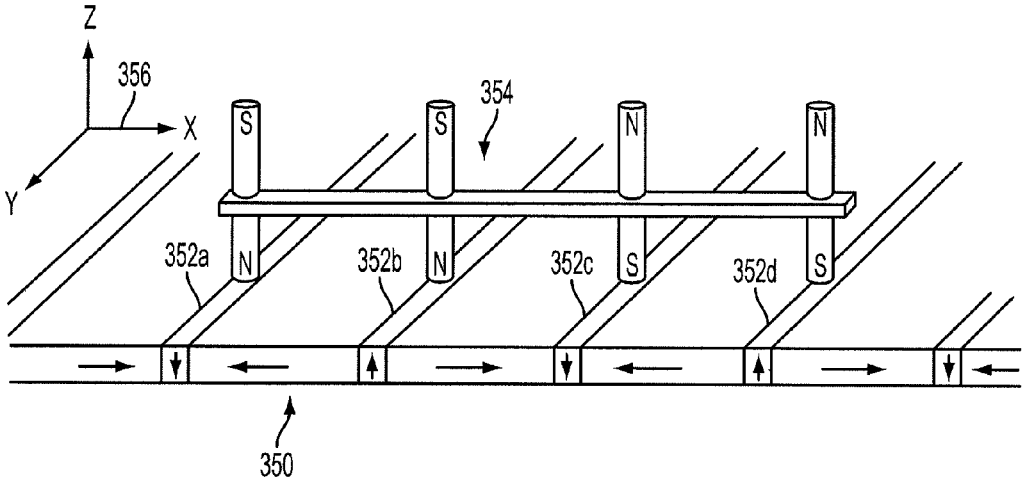
FIG. 19 provides an example for a configuration in which a stationary and/or moving component is extended two-dimensionally to produce a configuration where at least one of its components can be a two-dimensional structure according to an embodiment of the present invention.

The stationary and/or the moving component in a configuration can be extended two-dimensionally to produce a configuration where at least one of its components can be a two-dimensional structure. FIG. 19 provides an example for this type of configuration.

The configuration shown in FIG. 19 is a planar extension of the stationary component of the configuration described in connection to FIG. 17. As can be seen in FIG. 19, the stationary component comprises of a planar array 350 extended two-dimensionally along the X and Y axes of a Cartesian coordination system 356 to form an X-Y plane such that the polar areas of the array extends in multiple band-like polar rows (352*a*, 352*b*, 352*c*, 352*d*, . . . ) parallel to the Y-axis.

The moving component comprises of four equidistance magnetic cylinders positioned such that the longitudinal axes of cylinders are parallel to Z-axis. The cylinders extending in the X-axis direction to form a plane that is parallel to X-Z plane. Selected interaction distance and polarity arrangement of the cylinder polar ends relative to the polar rows (352*a*, 352*b*, 352*c*, 352*d*, . . . ) are such that when looking along X-axis direction one can see a spatial and polarity arrangement between the stationary and moving component that is similar to the respective arrangement described in the configuration of FIG. 17.

The magnetic cylinders are connected to each other through a non-magnetic connection means to create an elongated unitary cylinder set 354 having a longitudinal axis parallel to the X-axis. At a uniform interaction distance from X-Y plane, the cylinder set 354 may move in the X-Y plane in any direction as long as the longitudinal axis of cylinder set 354 remains parallel to the X-axis.

It should be noted that there are many possibilities for the patterns of the magnetic field distribution in a planar magnetic structure. The selected non-limiting planar structure in FIG. 19 is for illustration, and in a similar manner the spatial pattern of the moving component of FIG. 19 can be extended to other planar structures having a repetitive pattern of magnetic field distribution including Halbach-like planar magnetic field patterns.

It should be noted that in the configuration of FIG. 19, at a given position of the moving component, there are four confronting interaction areas between the polar area of cylinders and the corresponding interaction areas of the planar magnetic surfaces. Magnetic interaction in each interaction area produces a resultant force which can be either an attractive force (hereinafter "A") or a repulsive forces (hereinafter a"). The spatial distribution of these resultant forces in the linear extension of the moving component should be preferably such that providing an equilibrium condition for the moving component. For example the sequence of these forces that are equidistant and having identical magnitudes can be preferably either R-A-A-R or A-R-R-A. In another word, these equal forces should have a positional relation relative to one another such that do not create a torque (moment) of forces impacting negatively the motion of the moving component. Furthermore, identical cylinders of the moving component can be replaced by any other type of identical magnetic elements having any type of identical cross section as long as the above condition regarding the distribution and sequence of resultant forces described in the above can be met. The above general statement can be applied equally to the moving component of other related configurations having generally four interaction areas such as the configuration of FIG. 17.

Figure 20:
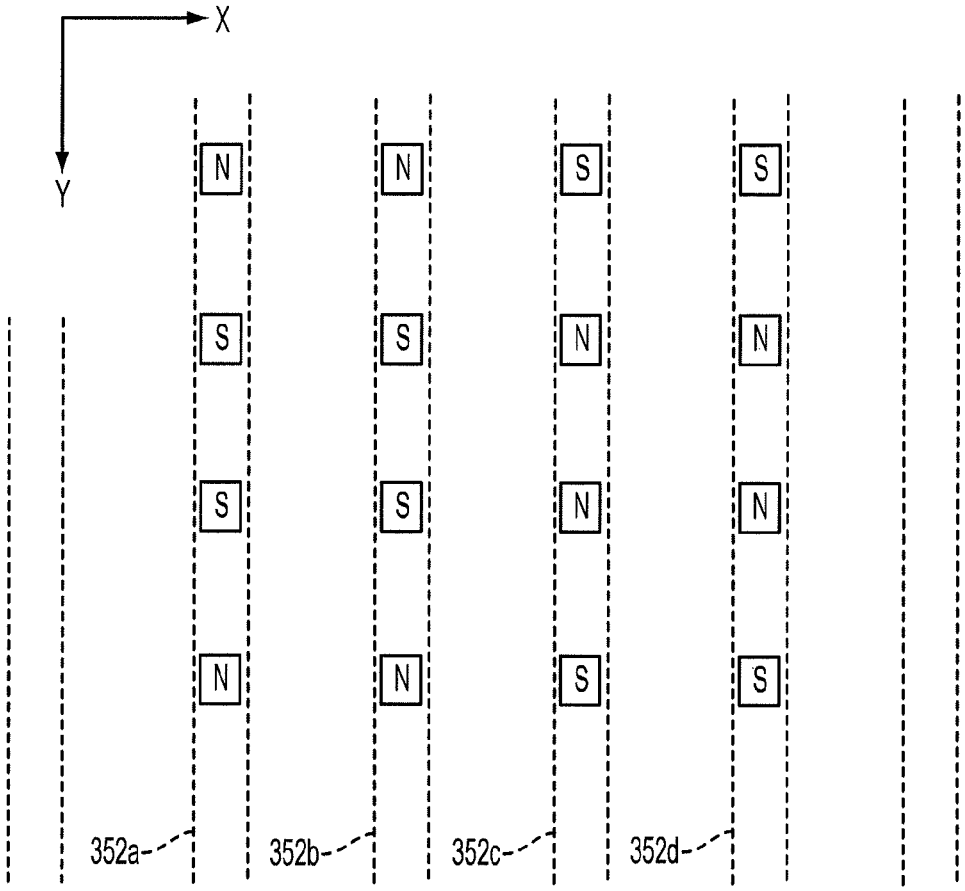
FIG. 20 provides a view of the polarities of the magnetic cylinders at a magnetically interaction distance from the X-Y plane according to an embodiment of the present invention.

In the configuration of FIG. 19, the moving component may also be extended two-dimensionally. FIG. 20 provides a view of the polarities of the magnetic cylinders at a magnetically interaction distance from the X-Y plane. The polar rows of the X-Y plane of the array are shown in the dotted lines. Polarities of the polar rows are the same as those shown in the X-Y plane of FIG. 19.

In the exemplary configurations of FIGS. 19 and 20 a positional change of the moving component at a uniform magnetic interaction proximity of, and parallel to the plane of, the stationary component exposes the arrays of the stationary component to a variation of magnetic field which produces a change in the strength of the magnetic field distribution of the array of the stationary component and simultaneously provides a substantial cancellation of magnetic forces inhibiting the motion of the moving component.

It should be noted that in the configuration for the reciprocal motion described thus far, for ease of description and to show the spatial and polarity arrangement of the moving and stationary components, generally magnetic cylinders are used in the structure of the moving component. However it should be realized that other magnetic shapes also can be used in the structure of the moving component. Particularly, in configurations in which the positional change of the moving component is on the exterior side of the stationary component, it is possible to replace a group of magnetic cylinders (in which these cylinders having the same polarity type at the polar ends when are facing a period length of the stationary array) by a one-piece magnetic element. In the following, first an example of the shape of a selected magnetic element (to replace the group of magnetic cylinders) is provided, and then two non-limiting examples of replacing groups of the magnetic cylinders by the selected magnetic element are presented.

A non-limiting example for the shape of the selected magnetic element can be a block of rectangular parallelepiped-like magnet. The block has a length, width, and thickness. The block is magnetized along the width dimension such that two parallel faces perpendicular to the magnetization direction forming the pole faces of the block. Each pole face defines an opposite polarity of the magnetic block. Preferably, the width and thickness of the block can have a similar size as of the length and diameter of the magnetic cylinders, respectively. Each block can be positioned relative to a length period of an array in a similar spatial and polarity arrangement of the respected group of to-be-replaced cylinders.

Figure 21:
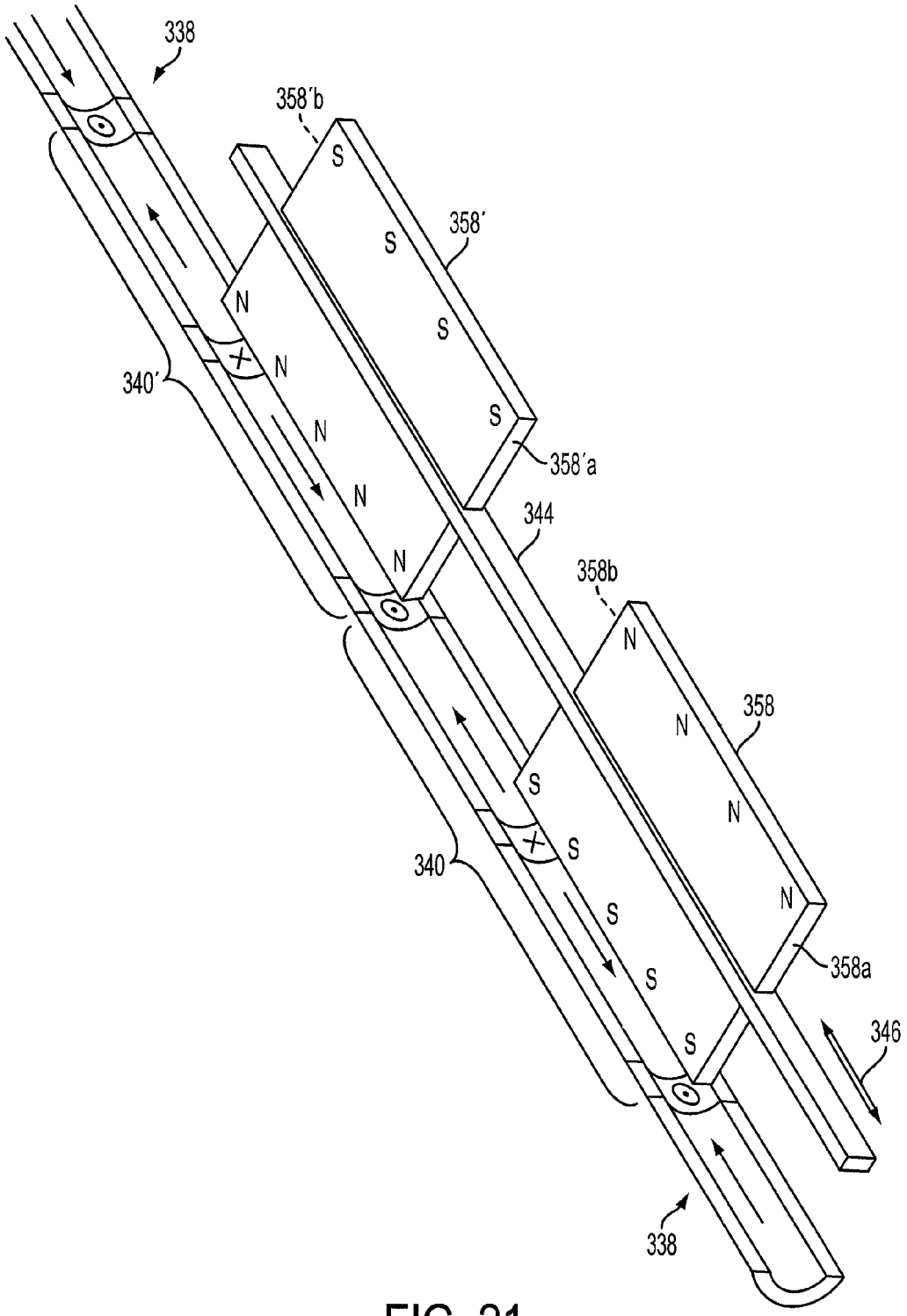
FIG. 21 shows a configuration similar to the configuration of FIG. 17 in which the group of magnetic cylinders is replaced by a pair of identical magnetic blocks, respectively, according to an embodiment of the present invention.

As a non-limiting example FIG. 21 shows a configuration similar to the configuration of FIG. 17 in which the group of magnetic cylinders 342 and 342' are replaced by a pair of identical magnetic blocks 358 and 358', respectively. The spatial and magnetic polarity relation of the blocks (358 and 358') and the array 338 in the configuration of FIG. 21 is similar to the spatial and magnetic polarity relation of the respective groups of cylinders (342 and 342') and the array 338 in the configuration of FIG. 17. The separation distance between succeeding side faces 358*b* and 358'*a* of the succeeding blocks 358 and 358' is a distance minimizing or preventing magnetic interaction between the succeeding blocks (358 and 358').

Figure 22:
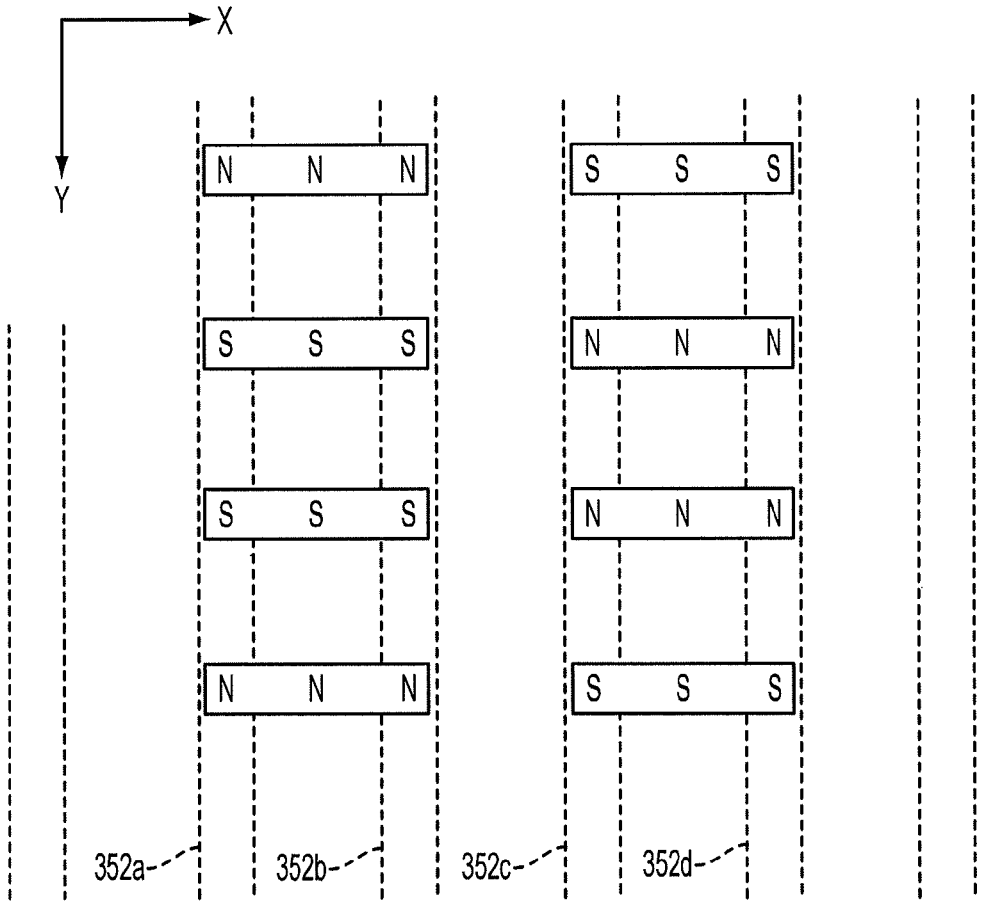
FIG. 22 provides another example of a configuration in which groups of magnetic cylinders are replaced with magnetic blocks according to an embodiment of the present invention.

FIG. 22 provides another example of a configuration in which groups of magnetic cylinders are replaced with magnetic blocks. FIG. 22 is a view that is similar to the view shown in FIG. 20; however, it differs from the view of FIG. 20 in that identical magnetic blocks are used to replace identical groups of magnetic cylinders. FIG. 22 shows the polarities of the magnetic blocks at the interaction distance from the X-Y plane of the stationary array 350 of the configuration of FIG. 20.

Figure 23:
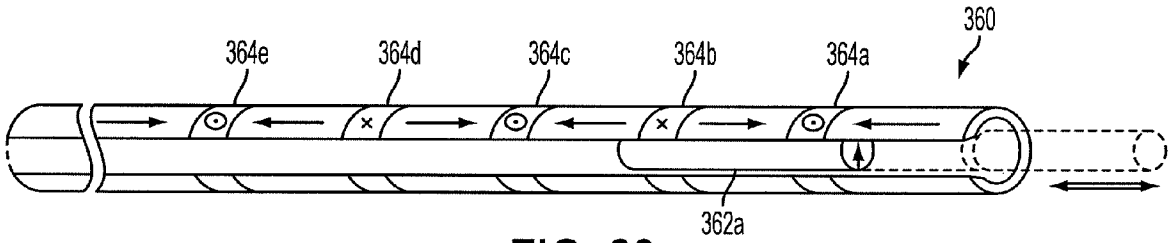
FIG. 23 is a partial perspective view of another configuration for reciprocation movement in which a stationary component include a hollow tubular array which is similar to the array shown in FIG. 3G, and the moving component includes a first magnetic element according to an embodiment of the present invention.

FIG. 23 is a partial perspective view of another configuration for reciprocation movement in which the stationary component comprise of a hollow tubular array 360 which is similar to the array shown in FIG. 3G. The moving component is a transversely magnetized magnetic cylinder 362*a* which is positioned coaxially within, and separated from, the tubular array 360 by a uniform annular gap. The gap size is such that allowing a reciprocal motion of the cylinder 362*a*, and also a magnetic interaction between the magnetic cylinder 362*a* and the tubular array 360. The magnetization direction of the magnetic cylinder 362*a* is parallel to the magnetization direction of the poles 364*a*, 364*b* of the array 360. The length of the magnetic cylinder 362*a* can be about one or more period length of the array. For purpose of illustration a preferable length is considered to be one period of the array 360. Generally, the selected length of the magnetic cylinder can be such that enable the magnetic cylinder 362*a* to face poles 364*a*, 364*b* of the array in a symmetric manner.

A reciprocal position change of the moving component 362*a* causes magnetic interactions with the array 360 which produces magnetic forces such that there is a change in the strength of the magnetic field pattern of the stationary component and simultaneously the magnetic forces resulting from the interactions at least partially cancel each other.

It should be noted that in many of the configurations for reciprocating motion described thus far, for ease of description only a simplified spatial arrangement of the magnetic elements of the moving component was shown for illustration purpose. Generally, in these configurations, the magnetic interaction forces (resulting from magnetic interactions between the stationary and moving component) cancel each other (i.e., having a sum that is substantially zero). However, the torques (moments) resulting from these forces preferably should also cancel one another such that allowing a smooth motion of the moving component. The torques can be eliminated by using the following approach:

In general, one may consider the illustrated portion of the moving component in the figures of the reciprocating configurations as a first moving structure. One may add a second moving structure along the moving path of the first structure such that satisfying the following three conditions.

First, the second structure should be positioned relative to the stationary component in a spatial relation that is substantially identical to that of the first structure such that the first and second structures can be considered the members of a pair of corresponding structures. Second, the second structure can be located at a separation distance from the first structure such that the selected distance preferably prevents a magnetic interaction between the magnetic elements of the first and second structures. Third, the magnetic relation between either the corresponding magnetic members of the two structures or the corresponding magnetic interaction areas of the stationary components (that are magnetically confronting the corresponding magnetic elements of the two structures) being such that having a reversed polarity relation relative to each other. The first and second moving structures can be connected to one another to form a unitary moving component of the configuration.

Stating differently, the above manner of the extension of the moving component is such that the first and second moving structures having a translational symmetry relation in which the structures having a reversed polarity relation relative to one another. The above symmetrical manner of extension of the moving component is also a general approach to satisfy the equilibrium conditions of the magnetic interaction forces which will be discussed in more details later in the disclosure when discussing the equilibrium condition requirements in a configuration.

For example, in the configuration of FIG. 17, the magnetic cylinder sets of 342 and 342' can be considered the first and second moving structures which have a reversed magnetic relation, and are positioned in a symmetric manner and at a non-magnetic interaction distance, relative to one another such that satisfying the above conditions for the extension of a moving component.

It should be noted that the above described symmetric extension manner can be used for extension and addition of more structures to a moving component (which can be needed because of a particular application purpose). For the sake of clarification and as a non-limiting example, in the following an extension of the moving structure 362*a* in the configuration of FIG. 23 is described.

Figure 24A:
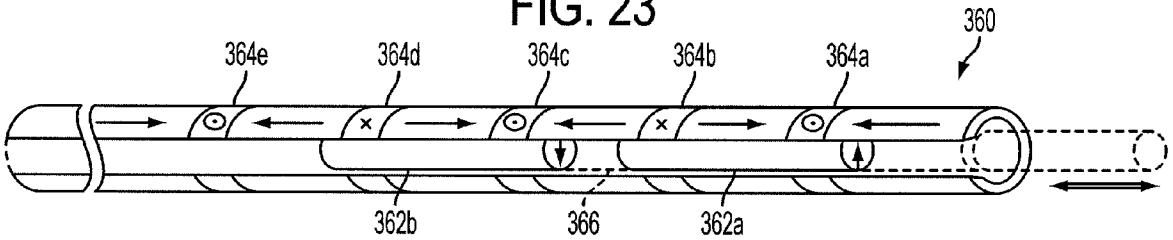
FIGS. 24A-24B show the addition of a second magnetic element in the configuration of FIG. 23 which is identical to a first magnetic element at a location on the path of movement of the magnetic element according to an embodiment of the present invention.
Figure 24B:
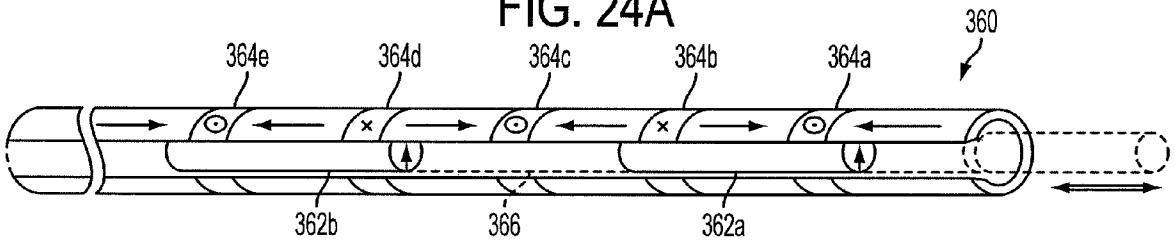

In the configuration of FIG. 23, the moving component includes a first magnetic element 362*a*. As shown in FIGS. 24A-24B, one may add a second magnetic element 362*b* which is identical to the first magnetic element 362*a* at any location on the path of movement of the magnetic element 362*a* based on the above described symmetric extension conditions.

First condition, the spatial relation of the first and second magnetic element relative to the stationary component should be identical. In FIG. 24A the second magnetic element 362*b* is facing two consecutive poles (364*c* and 364*d*) of the array 360, in a similar spatial manner as of the first magnetic element 362*a*.

Second condition, a separation distance (in the longitudinal direction of the array) between the first and second magnetic element (for example the separation distance 366 extended between the magnetic elements 362*a* and 362*b* in FIG. 24A or FIG. 24B) should be a sufficient separation distance such that to minimize or preferably prevent the magnetic interaction of the immediate neighboring polarities of the first and second magnet.

Third condition, if the first and second magnetic element facing the same sequence of polarity types of the array poles of the stationary component (in a given direction on the longitudinal extension of the array, such as right to left), then the magnetization direction of the first and second magnetic elements should be an anti-parallel relation; and in contrast, if the first and second magnetic element facing a reverse sequence of polarity types of the array poles of the stationary component (in a given direction on the longitudinal extension of the array, such as right to left), then the magnetization direction of the first and second magnetic elements relative to one another should be a parallel and in the same direction.

As can be seen in FIG. 24A the first and second magnetic elements 362*a* and 362*b* are facing respectively (from right to left on the longitudinal direction of the array 360) a reverse sequence of poles (magnetic element 362*a* is facing "S and N" of the poles 364*a* and 364*b*, respectively; and magnetic element 362*b* is facing "N and S" of poles 364*c* and 364*d*, respectively), as a result, the magnetization direction of the first and second magnets (362*a* and 362*b*) are anti-parallel relative to one another. In contrast, FIG. 24B shows that the first and second magnetic elements 362*a* and 362*b* are facing (from right to left on longitudinal direction of the array 360) the same sequence of poles (magnetic element 362*a* is facing "S and N" of the poles 364*a* and 364*b*, respectively; and magnetic element 362*b* is facing "S and N" of poles 364*c* and 364*d*, respectively), as a result, the magnetization direction of the first and second magnet 362*a* and 362*b* are parallel and in the same direction relative to one another.

The first and second magnetic elements (362*a*, 362*b*) can be connected to one another by a rigid non-magnetic connection means 366 such that provides a unitary moving component.

It should be noted that in the configuration of FIGS. 24A and 24B the magnetic cylinders 362*a* and 362*b* can be replaced by a pair of diametrically magnetized magnetic disks (not shown) such that the disks having a similar spatial and magnetic relation relative to the stationary component 360 as that of the respective magnetic cylinders 362*a* and 362*b*. The thickness of the disks can be such that each disk preferably confronts one of the polar bands (364*a*, 364*b*, 364*c*, . . . ) of the stationary component 360. The location of the disks can be based on the above described conditions. As a non-limiting example in FIG. 24A, the pair of disks can be positioned such that confronting polar bands 364*a* and 364*c*; or similarly in FIG. 24B the disks can be positioned such that confronting the polar band areas of 364*a* and 364*d*.

Figure 25:
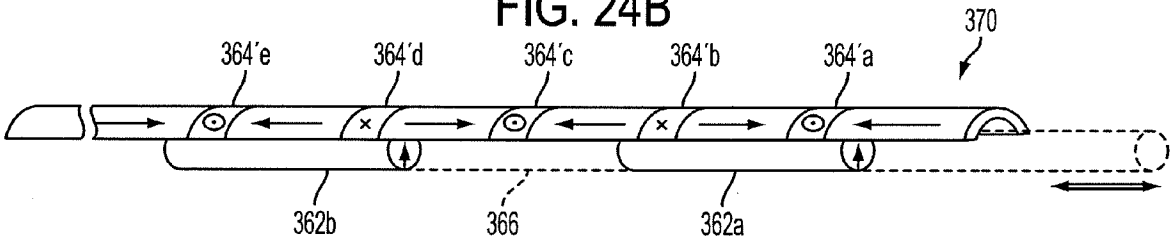
FIG. 25 shows a modification of the configuration of FIG. 23, in which the stationary component is replaced by a semi-annular cylinder array which is similar to the array shown in FIG. 3J according to an embodiment of the present invention.

FIG. 25 shows a modification of the configuration of FIG. 23, in which the stationary component 360 is replaced by a semi-annular cylinder array 370 which is similar to the array shown in FIG. 3J. In FIG. 25 as a non-limiting example, an extended version of the moving component of the configuration of FIG. 23 is shown. As a result, as can be seen in FIG. 25, the moving component comprises of two magnetic elements 362*a* and 362*b*.

Figure 26:
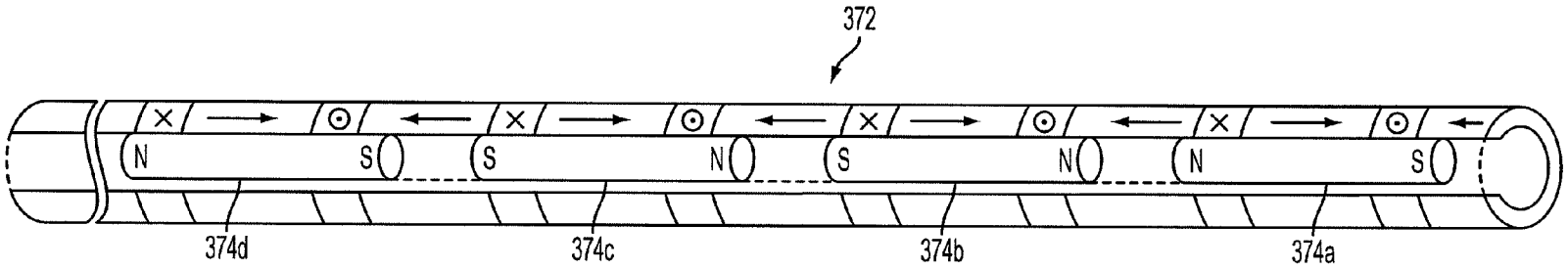
FIG. 26 is a partial perspective view of a configuration in which the stationary component includes a hollow tubular array which is similar to the array shown in FIG. 3G according to an embodiment of the present invention.

Another family of the configurations for reciprocating motion may include configurations in which the magnetic elements of the moving component can be arranged such that the magnetization direction of these magnetic elements can be substantially parallel to the path of motion. FIG. 26 provides an example for these types of configurations. FIG. 26 is a partial perspective view of a configuration in which the stationary component comprises of a hollow tubular array 372 which is similar to the array shown in FIG. 3G. The moving component comprises of four axially magnetized cylinders (374*a*, 374*b*, 374*c*, 374*d*) which are positioned in a longitudinally equidistant manner relative to each other. The spatial relation between each magnetic cylinder relative to the stationary array 372 is similar to the respective relation in the configuration of FIG. 23 and is not repeated here. FIG. 26 shows a preferable arrangement of the magnetization directions of the magnetic cylinders, such that the magnetization direction of magnetic cylinders 374*a* and 374*d* is an identical direction which is opposite to that of the identical magnetization direction of magnets 374*b* and 374*c*. The longitudinal distance between each two succeeding magnetic cylinder is selected such that minimizes or prevents the magnetic interaction between each two succeeding magnetic cylinders.

Figure 27:
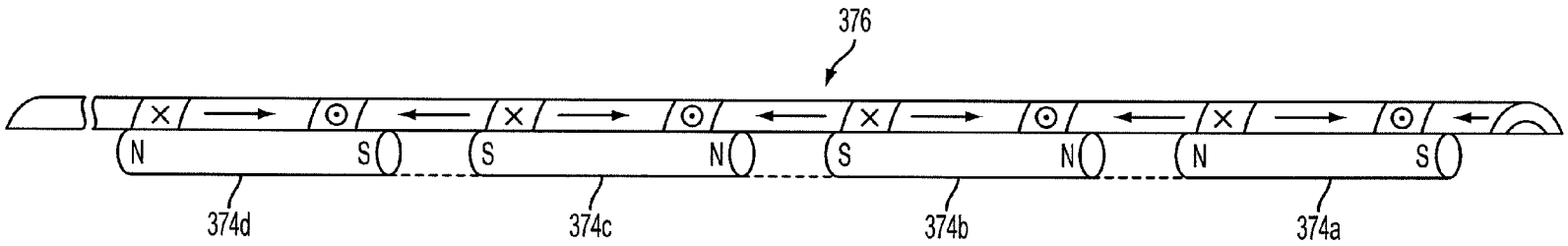
FIG. 27 shows a modification of configuration of FIG. 26, in which the stationary component is replaced by a semi-annular cylinder array according to an embodiment of the present invention.

FIG. 27 shows a modification of configuration of FIG. 26, in which the stationary component 372 is replaced by a semi-annular cylinder array 376 which is an array (similar to array shown in FIG. 3J) formed by cutting the stationary array 372 of FIG. 26 by a plane passing through the longitudinal axis of the array 372.

Another family of the configurations for reciprocating motion includes configurations in which the stationary components comprise an array similar to the arrays shown in FIG. 3R or FIG. 3S. For example, in configurations of FIGS. 23, 24A, 24B, and 26 it is possible to replace the stationary components of these configurations by an array similar to the array of FIG. 3R. to form modified configurations (not shown) in which the spatial relation of the stationary and moving components are similar to the respective configurations of FIGS. 23, 24A, 24B, and 26. In a similar manner, and as another example, in configurations of FIG. 25 or 27 it is possible to replace the stationary components of these configuration by an array such as the array of FIG. 3S.

In the configurations described thus far, the direction of translational motion of the moving component was generally parallel to or along the longitudinal direction of the stationary component. However, it should be noted that motion in a direction perpendicular to the longitudinal axis of the stationary component is also possible. In general, the positional change of the moving component can be either parallel or perpendicular to the longitudinal axis of the stationary component. The latter motion can be between (at least) two spaced apart paralleled stationary arrays or just relative to one stationary array.

Exemplary Embodiments Having Rotary Motion

The exemplary configurations described thus far can be modified such that positional change of moving component can be achieved through a rotary type of motion. Generally, in these groups of configurations the structural shapes of both the stationary and moving components can undergo a rotary transformation. In other words, the structural shapes of components are adopted to conform to a rotary path of motion.

There are many possibilities for arrangement of stationary and moving components relative to one another. However, in the following, for sake of brevity and without limitation, only some examples which are generally rotary versions of the previously described configurations for reciprocating motion will be presented. It should be noted that for each configuration there are many alternative polarity arrangements. The selected polarity arrangement in each of the following exemplary configurations is only one example of various possibilities of polarity arrangements and should not be construed as a limitation.

Figure 28:
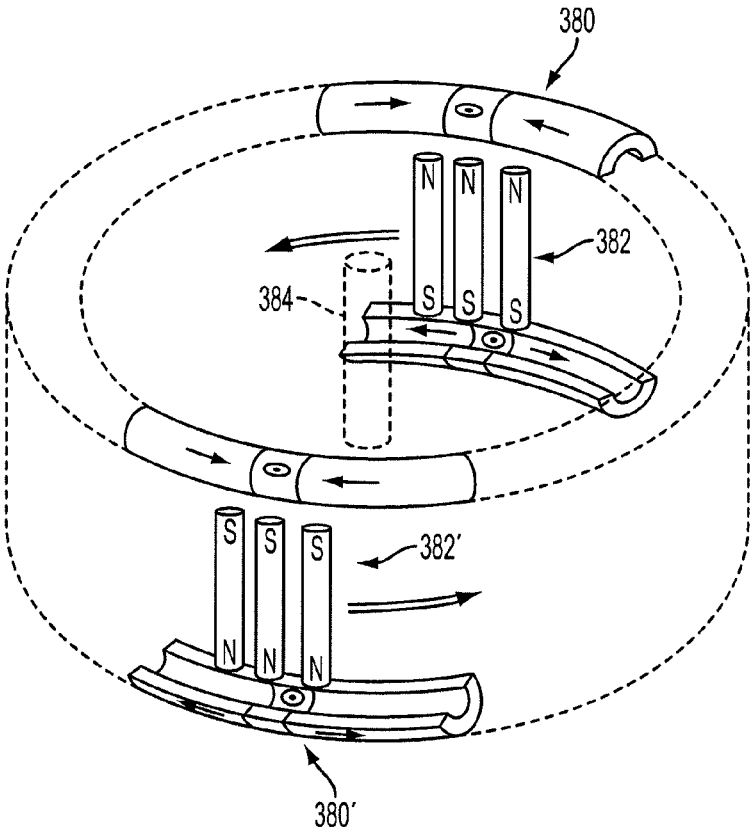
FIG. 28 shows a partial perspective view of a rotary version of the configuration of FIG. 12 according to an embodiment of the present invention.

FIG. 28 shows a partial perspective view of a rotary version of the configuration of FIG. 12. The shape of each array of the stationary component of FIG. 12 is modified to a hollow semi-annular torus array (380, 380') to conform for a rotary motion. The arrays (380, 380') facing one another through the respective recessed portions and are positioned in a mirror image relation relative to one another, such that having a common central axis.

The moving component comprises of magnetic cylinders (382, 382') positioned in a rotationally symmetric manner around a rotary shaft 384. The complementary shape relation and the spatial position of the polar ends of the magnetic cylinders relative to the arrays (380, 380') is similar to that of the magnetic cylinders in the configuration of FIG. 12. The shaft 384 has a rotational axis which is coincident with the common central axis of the arrays (382, 382'). The magnetic cylinders (382, 382') are connected by a connection means (not shown) to the rotary shaft (384) enabling a rotary positional change for the magnetic cylinders. The shaft and connection means are preferably made from non-magnetic materials. The cylinders are separated from the stationary arrays (380, 380') by a uniform gap which allows a rotary motion of the cylinders and a magnetically interactive relation between the cylinders and the arrays.

Figure 29A:
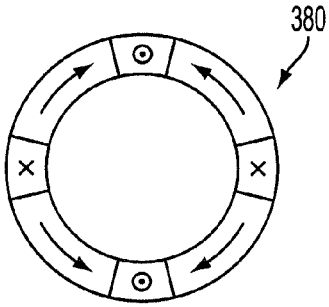
FIGS. 29A and 29B show plan view of polarities of an entire circular path of arrays of FIG. 28 according to an embodiment of the present invention.
Figure 29B:
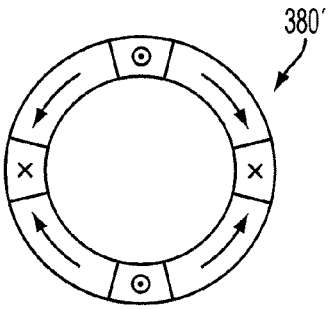

The polarity arrangement of the cylinder polar ends and the stationary array is similar to the polarity arrangement described in connection with the configuration of FIG. 12. Plan views of the polarities of the entire circular path of the arrays 380 and 380' are shown in FIGS. 29A and 29B, respectively (not to scale, the magnetic cylinders of FIG. 28 are not shown). The rotary motion of cylinders exposes the stationary component to a varying magnetic field which causes a periodic change in magnetic field strength of the polar areas of each array and simultaneously magnetic forces influencing the rotation of cylinders substantially are cancelled.

Alternatively, in the configuration of FIG. 28, the stationary component instead of forming the entire circular path may only form a portion of the path, such as an arc-like magnetic interaction path. In this case preferably two identical arc-like portions can be positioned diametrically at opposite sides of the circular path in a symmetric manner (not shown).

It should be noted that in the configuration of FIG. 28, other polarity arrangements, or other number of cylinders and/or the period lengths of the arrays are possible, and the selected polarity arrangement or numbers of cylinders or array period length is just a non-limiting example.

Figure 30:
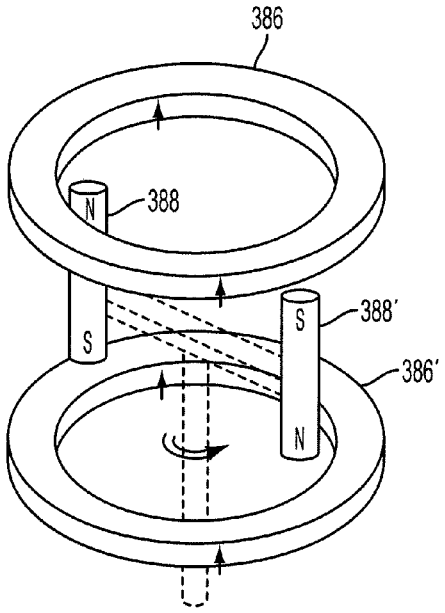
FIG. 30 shows an example of another configuration in which the spatial arrangement of the configuration is similar to the configuration of FIG. 28 according to an embodiment of the present invention.

Alternatively, in the configurations of FIG. 28 the arrays of the stationary components can be replaced by a pair of magnetic elements. FIG. 30 shows an example of this type of configuration in which the spatial arrangement of the configuration is similar to the configuration of FIG. 28. The stationery component comprises of a pair of flat annular ring magnets (386, 386') which are axially magnetized and positioned relative to one another such that the magnetization direction of both rings are directed in the same direction. The moving component comprises of a pair identical magnetic cylinders (388, 388') positioned in diametrically opposite sides relative to the stationary component in a similar spatial and polarity manner as that of the cylinders (382, 382') in FIG. 28. Alternatively, each of the annular ring magnets (386, 386') instead of being flat can have a curved surface with a surface curvature similar to that of the stationary component (380, 380') in FIG. 28.

Figure 31:
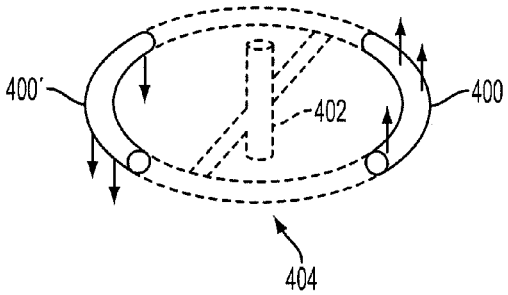
FIG. 31 shows the moving component of the configuration of FIG. 28 can be replaced by a circular ring-shaped structure according to an embodiment of the present invention.

Alternatively, the moving component of the configuration of FIG. 28 can be replaced by a circular ring-shaped structure 404 shown in FIG. 31. The ring-shaped structure includes two arc-shaped magnetic elements 400 and 400'. The arc-shaped elements (400, 400') are connected to each other and to a rotary shaft 402 to form the circular shaped ring 404 which is rotationally symmetrical. The two arc-shaped portions (400, 400') are positioned symmetrically on the opposed diametrical side of the ring 404. The shaft and connection means are made preferably from rigid non-magnetic materials. The arc-shaped magnetic elements (400, 400') are axially magnetized and have an anti-parallel magnetization direction relation relative to each other.

Figure 32:
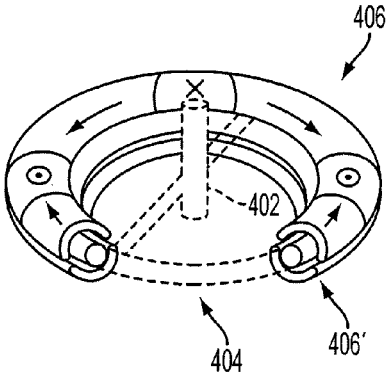
FIG. 32 is a partial perspective of the configuration which includes the moving component shown in FIG. 31 according to an embodiment of the present invention.

FIG. 32 is a partial perspective of the configuration which includes the moving component 404. As can be seen in FIG. 32 the stationary components comprises of two hollow semi-torus magnetic arrays (406, 406') having a polarity pattern similar to that of the stationary arrays (380, 380') in FIG. 28. The size of the ring 404 is such that it can fit in an aligned and symmetrical manner in the annular recessed portion of each array (406, 406') of the stationary component and being separated by a uniform gap. The gap size is a magnetically interaction distance allowing a rotary motion and a magnetic interaction between the ring 404 and the stationary arrays (406, 406'). The rotary shaft 402 has a rotational axis coincident with central axes of the ring 404 and the stationary arrays (406, 406').

The rotary motion of the ring 404 exposes both arrays (406, 406') to a changing magnetic field which causes a periodic change in strength of the magnetic field pattern of each array and a simultaneous cancellation of magnetic forces influencing the rotation of the ring 404.

Figure 33:
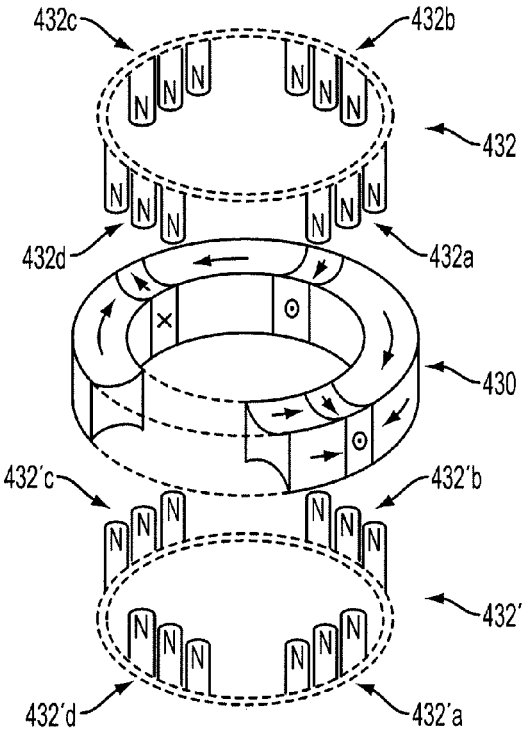
FIG. 33 is a partial exploded view of a configuration which is a rotary version of the configuration shown in FIG. 15 according to an embodiment of the present invention.
Figure 34:
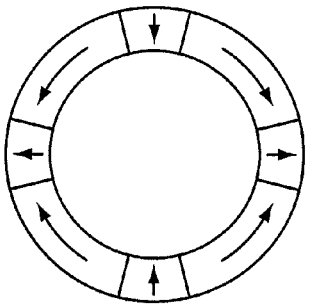
FIG. 34 shows a plan view of the polarity arrangement of the stationary component of FIG. 33 according to an embodiment of the present invention.

FIG. 33 is a partial exploded view of a configuration which is a rotary version of the configuration shown in FIG. 15. As can be seen in FIG. 33 the stationary component 430 is a curved circular version of the stationary component 336 of FIG. 15. The circular stationary component 430 is sandwiched between two cylinder sets (432, 432') which are rotationally symmetric. Each cylinder set comprises of four cylindrical groups (set 432: 432*a*, 432*b*, 432*c*, 432*d*; and set 432': 432'*a*, 432'*b*, 432'*c*, 432'*d*). The polarity arrangement and positions of cylinder sets (432, 432') relative to the stationary array 430 is similar to the related arrangement shown in FIG. 15. Two cylinder sets (432, 432') are connected to a rotary shaft (not shown) by a connection means forming a unitary structure of cylinders capable of a rotary motion. The shaft has an axis of rotation which is coaxial with the central axis of the stationary component 430. Both the connection means and the shaft are made preferably from non-magnetic materials. FIG. 34 shows a plan view of the polarity arrangement of stationary component 430.

Rotary motion of the unitary cylinder sets (432, 432') causes magnetic interactions between the cylinders and the stationary component 430. These magnetic interactions create a plurality of magnetic interaction forces which substantially cancel each other and simultaneously produce a change in the pattern of magnetic field strength of the stationary component.

Figure 35:
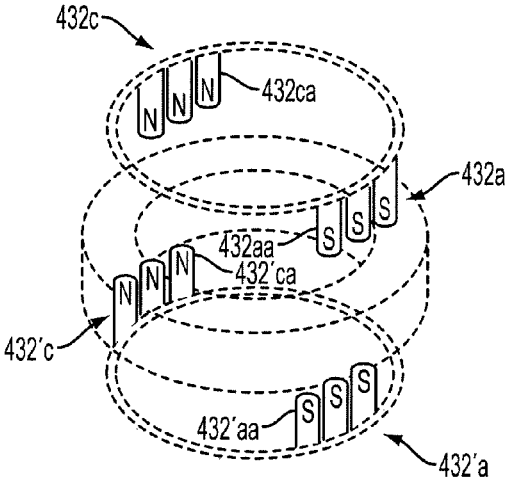
FIG. 35 shows a moving component may comprise of two diametrically mirror-imaged cylinder groups according to an embodiment of the present invention.

It should be noted that the selected number of cylinder sets, or the number of cylinder groups in each set, or the number of cylinders in each cylinder group, in the configuration of FIG. 33 is for illustration and can be a more or less number. As a first example, the moving component may only comprise of one cylinder set (either 432 or 432') in which one cylinder set may interact with only one interaction side of the stationary array 430. As a second example, the moving component may comprise of two diametrically mirror-imaged cylinder groups on each set (for example, first set: 432*a*, and 432*c*; second set: 432'*a*, 432'*c*) which is shown in FIG. 35. As can be seen in FIG. 35, the magnetization direction of the cylinder groups in each cylinder set may have an anti-parallel relation to one another. As a third example, in the moving component of FIG. 35, the number of cylinders in each cylinder group can be only one cylinder, such as the first cylinder of each group (432*aa*, and 432*ca*, 432'*aa*, 432'*ca*).

Figure 36A:
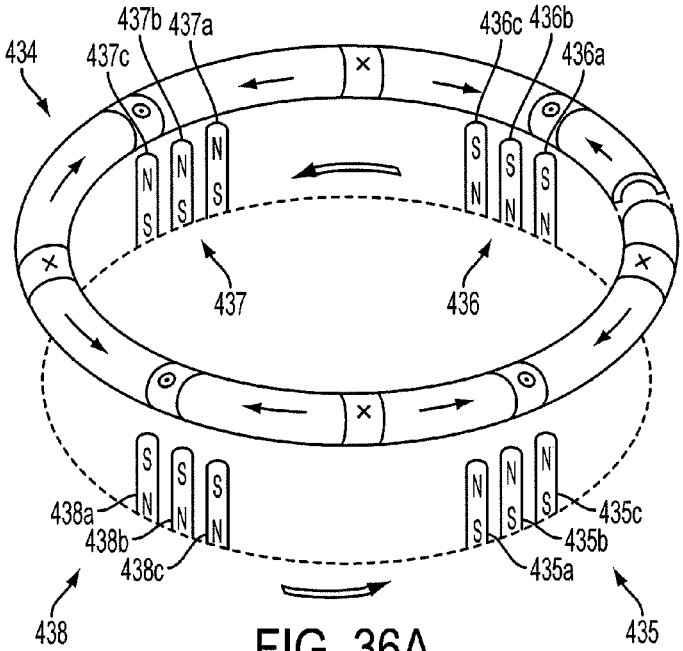
FIG. 36A shows a rotary version of the configuration in FIG. 17 according to an embodiment of the present invention.

FIG. 36A shows a rotary version of the configuration in FIG. 17. In a similar fashion of the spatial and the polarity arrangement of the magnetic elements of the configuration shown in FIG. 17, the configuration of FIG. 36A includes a sequence of successive period lengths of the array 434 that are exposed to a sequence of successive alternative polarities of the magnetic elements of the moving component. Magnetic elements of the moving component comprising of four identical magnetic cylinder sets (435, 436, 437, 438) which are connected to a rotary shaft (not shown) by a connection means forming a unitary structure of cylinders capable of a rotary motion. The shaft has an axis of rotation which is coaxial with the central axis of the stationary array 434. Both the connection means and the shaft are made preferably from non-magnetic materials.

The separation distance between neighboring polar ends of the magnetic cylinders having opposite polarities (such as 436*c* and 437*a*) can be selected such that minimizing or preferably preventing the magnetic interaction between immediate neighboring cylinders with opposite polar ends. The rotary motion of cylinder sets can produce a periodic change in strength of the magnetic field pattern of the array 434 and a simultaneous cancellation of magnetic forces influencing the rotation of the moving component.

It should be noted that in the configuration of FIG. 36A, selection of the number of successive period lengths of the array 434, or the number of sets or magnetic cylinders in a set is for illustration and a more or less number of period lengths, sets, or magnetic cylinders can be used in the moving component. For example each set may comprise of one magnetic cylinder, or four sets of cylinders can be replaced by four identical magnetic elements which can be positioned in the same spatial and polarity arrangement as that of each set in FIG. 36A. Furthermore, the shape of magnetic elements of the moving component is not limited to the cylindrical shapes magnetic elements shown in FIG. 36A.

As a non-limiting example, the selected magnetic element can be a curved magnetic block which is the rotary version of the magnetic block 358 shown in FIG. 21. The curved magnetic block, which is a section of an axially magnetized hollow cylindrical magnet, has a length, curvature, a thickness, and a magnetization direction along the length of the block. Two parallel arc-like faces perpendicular to the magnetization direction of the block forming the pole faces of the block. Each arc-like pole face has a radial thickness and each face defines an opposite polarity of the curved magnetic block. Preferably, the length of the block can have a similar size as of the length of the magnetic cylinders, respectively. The curved blocks can be positioned relative to a length period of an array in a similar spatial and polarity arrangement of the respected group of to-be-replaced cylinders. The curvature radius and the thickness of the magnetic block are selected such that to conform to the shape of the recessed curved surface of the stationary component 434 such that the confronting parts of the block and the recessed part of the stationary component 434 having preferably a complementary shape relation relative to one another.

It should be noted that the distance from end to end of the arc-shaped polar face of a curved block is equal to the respective similar distance of the magnetic group which is a distance from the first to the last cylinders within each cylinder group. This distance is generally is a predetermined size that spans at least a portion of (or at least one polar area of) the array such that there is a sufficient separation space between the succeeding magnetic blocks (to minimize or prevent magnetic interaction between the succeeding blocks).

Figure 36B:
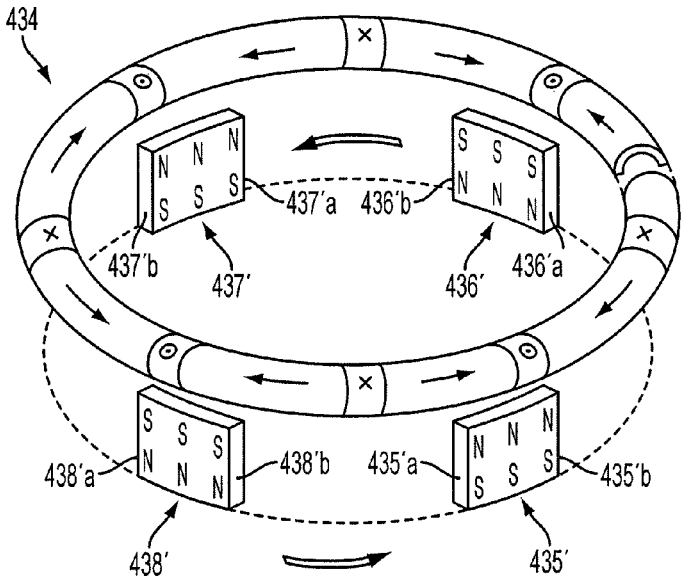
FIG. 36B shows another configuration similar to the configuration of FIG. 36A according to an embodiment of the present invention.

As a non-limiting example, FIG. 36B shows a configuration similar to the configuration of FIG. 36A in which the group of magnetic cylinders 435, 436, 437, and 438 are replaced by four identical curved magnetic blocks 435', 436', 437', and 438', respectively. The spatial and magnetic polarity relation of the curved blocks (435', 436', 437', 438') and the array 434 (in the configuration of FIG. 36B) is similar to the spatial and magnetic polarity relation of the respective groups of cylinders (435, 436, 437, 438) and the array 434 (in the configuration of FIG. 36A), respectively. The surface curvature and thickness of the curved magnetic blocks (435', 436', 437', 438') are such that the confronting parts of the block and the recessed part of the stationary component 434 preferably having a complementary shape relation relative to one another. The separation distance between the succeeding block side faces (such as side faces 438'*b* and 435'*a* of the succeeding blocks 438' and 435') is a distance minimizing or preferably preventing magnetic interaction between the succeeding blocks (such as 438' and 435').

Figure 37:
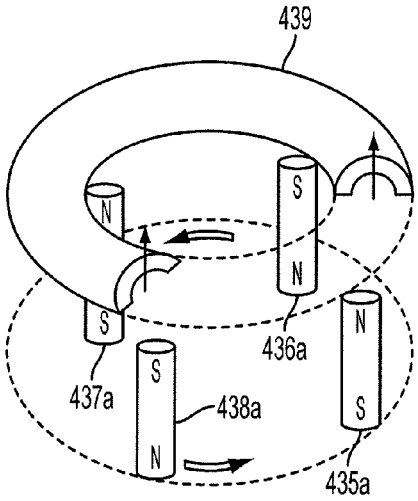
FIG. 37 shows an example of a configuration similar to the configuration of FIG. 36A in which a stationary component is replaced by a magnetic element which is a curved circular shell magnet having similar surface curvature as that of the stationary component in FIG. 36A according to an embodiment of the present invention.

Alternatively, in the configurations of FIG. 36A, the array 434 of the stationary components can be replaced by a magnetic element. FIG. 37 shows an example of this type of configuration in which the stationary component 434 is replaced by a magnetic element 439 which is a curved circular shell magnet having similar surface curvature as that of the stationary component 434. The circular shell magnet 439 has an axial magnetization direction. The moving component comprises of four magnetic cylinders (435*a*, 436*a*, 437*a*, 438*a*) which are similar to, and positioned relative to the stationary component 439 in a similar spatial and magnetic polarity manner of (and are identified by the same reference numbers of) the cylinders (435*a*, 436*a*, 437*a*, 438*a*) of the moving component of the configuration of FIG. 36A.

Figure 38:
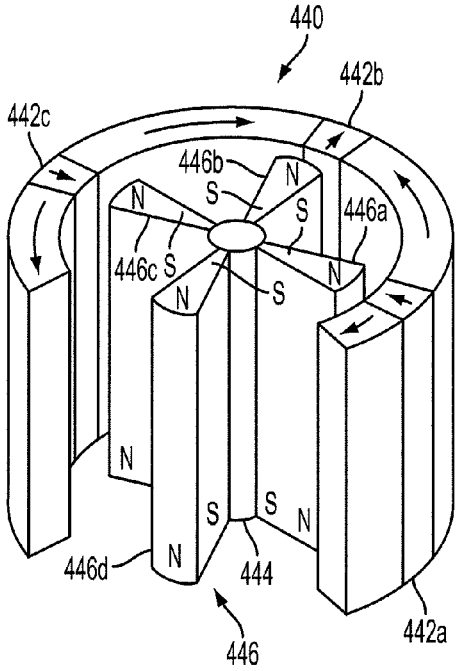
FIG. 38 shows a partial perspective view of a configuration which is a rotary version of the planar configuration described in connection with FIG. 19 according to an embodiment of the present invention.

The magnetic interaction areas of a stationary or a moving component in a configuration can be extended to produce a configuration in which at least one of its components may include a closed-loop magnetic structure which sometimes can be a curved multi-polar array. FIG. 38 provides a simplified example for this type of configuration.

Figure 39:
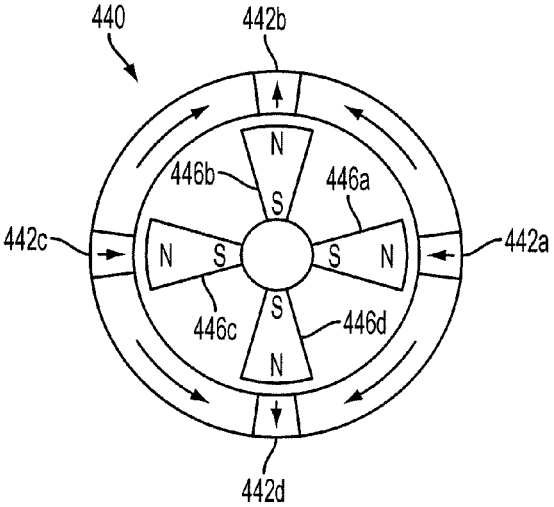
FIG. 39 shows an axial cross-sectional view of the configuration of FIG. 38 according to an embodiment of the present invention.

Configuration shown in FIG. 38 is a partial perspective view of a configuration which is a rotary version of the planar configuration described in connection with FIG. 19. FIG. 39 shows an axial cross-sectional view of the configuration of FIG. 38. As can be seen in FIGS. 38 and 39, the stationary component comprises of a hollow cylindrical array 440 which is the rotary form of the planar array 350 in FIG. 19, which is wrapped symmetrically around a longitudinal axis of a cylinder to form the hollow cylindrical shaped array 440 having four polar bands (442*a*, 442*b*, 442*c*, 442*d*). The polar bands extend on the cylindrical surfaces of the array 440 in a column-like manner parallel to the longitudinal axis of the hollow cylinder. Configuration includes a rotational shaft 444 having an axis of rotation coincident with the longitudinal axis of the hollow cylinder array 440. The shaft 444 is made from magnetically responsive materials such as iron.

The moving component 446 comprises of four identical magnetic blocks (446*a*, 446*b*, 446*c*, and 446*d*). Each block has a width extending radially relative to the shaft 444, and a thickness that progressively varies along the width. The blocks are magnetized in the width direction such that smaller and larger thickness faces provide the south and north polar ends of the magnetic blocks, respectively. The magnetic blocks are connected to the shaft 444 from the sides of smaller thickness faces such that four blocks forming a unitary symmetric structure in which blocks are mutually perpendicular to each other and the free ends of the blocks having identical north polarities. The free north polar ends of four blocks are positioned in an aligned manner at a uniform interaction distance relative to each polar band (442*a*, 442*b*, 442*c*, 442*d*) of the hollow cylindrical array 440. The size of each free polar end of the magnetic block is such that allows a magnetic interaction with at least a portion of, or at least one of, (or preferably about one of) a corresponding vertical polar band of the array 440. The rotation of the magnetic blocks produces a similar magnetic behavior described in connection with other rotary configurations.

Figure 40A:
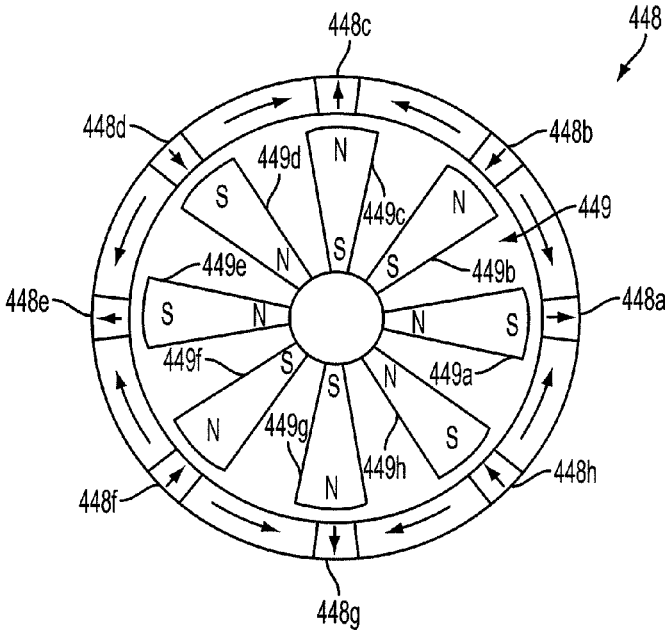
FIG. 40A shows an axial cross-sectional view of a configuration which is a modification of the configuration of FIG. 38 according to an embodiment of the present invention.

FIG. 40A shows an axial cross-sectional view of a configuration which is a modification of the configuration of FIG. 38. The stationary component of the configuration of FIG. 40A comprises of an eight-polar array 448. The moving component comprises of eight identical magnetic blocks having similar structure of the magnetic blocks of the moving component 446 in FIG. 38. As an example of many possibilities for the polarity arrangement, FIG. 40A shows a different example of the polarity arrangement between the moving and the stationary component. The polarity arrangement shown in FIG. 40A includes a sequence of successive polar bands (448*a*, 448*b*, 448*c*, . . . ) of the stationary array 448 which are exposed to a sequence of successive alternative polarities of the polar ends of the magnetic blocks (449*a*, 449*b*, 449*c*, . . . ) of the moving component 449. As can be seen in FIG. 40A the free ends of the magnetic blocks of the moving component 449 include a sequence of successive opposite polarities. The configuration size is selected such that preferably these types of opposing neighboring polarities are separated by a sufficient distance such that it minimizes or prevents the magnetic interactions of the neighboring opposing polarities of the moving component.

Figure 40B:
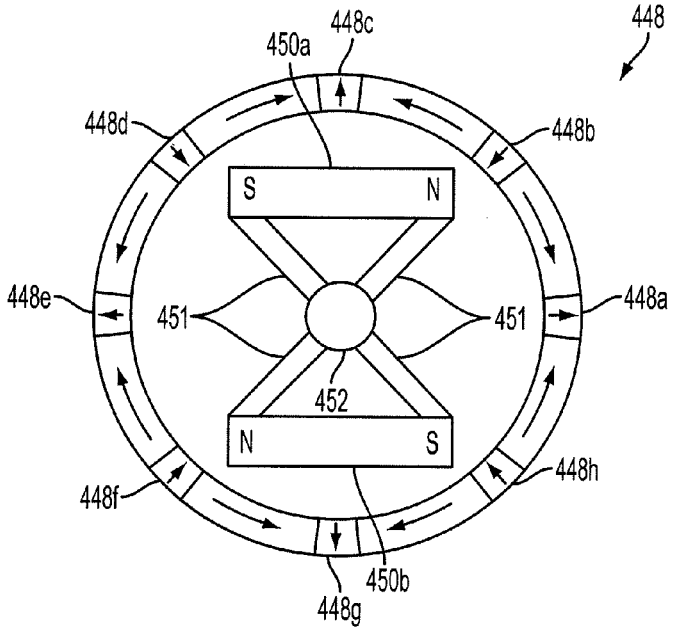
FIG. 40B is an axial cross sectional view showing a modification of the moving component of the configuration of FIG. 40A showing another example of many possibilities of the polarity arrangement between the moving and the stationary component according to an embodiment of the present invention.

FIG. 40B is an axial cross sectional view showing a modification of the moving component of the configuration of FIG. 40A showing another example of many possibilities of the polarity arrangement between the moving and the stationary component. The moving component includes two identical rectangular-shaped magnetic blocks 450*a* and 450*b*. Each magnetic block having a length, height, and thickness. Each magnetic block is magnetized along the length dimension such that two parallel faces perpendicular to the magnetization direction forming the pole faces of the block. Each pole face defines an opposite polarity of the magnetic block. The magnetic blocks are positioned within the hollow region of the stationary component 448 such that the magnetic blocks having anti-parallel magnetic relation relative to one another, and such that the free polar ends of each block are equidistance from, parallel to, and within the identical magnetic interaction vicinity of the identical polarities of polar bands of the stationary component 448. The positioning of the blocks within the stationary component 448 is such that in the axial cross sectional view of the configuration the blocks appear like a pair of parallel identical chord-like shape within the circular shape of the stationary component 448. The blocks are connected to a preferably non-magnetic shaft 452 by rigid non-magnetic connection means 451 such that as a collective whole provides a symmetrical (rotationally balanced) moving component capable of a rotary motion about the central axis line of the stationary component 448.

The configuration size is selected such that preferably the opposing neighboring polarities of the magnetic blocks are separated by a sufficient distance such that it minimizes or prevents the magnetic interactions of the magnetic blocks with one another.

Figure 41A:
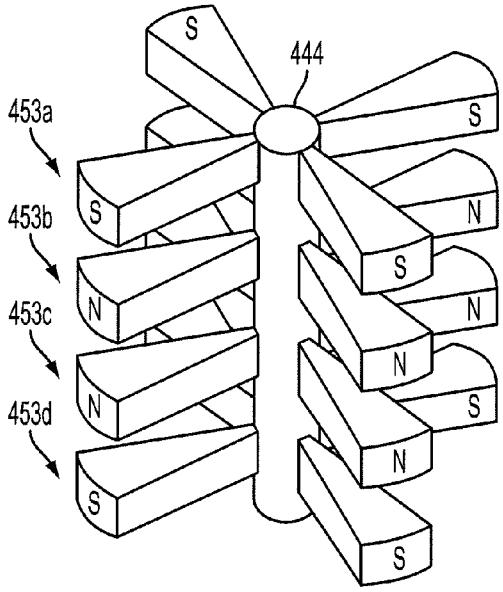
FIGS. 41A and 41B show alternative rotary components each having a different polarity arrangement according to an embodiment of the present invention.
Figure 41B:
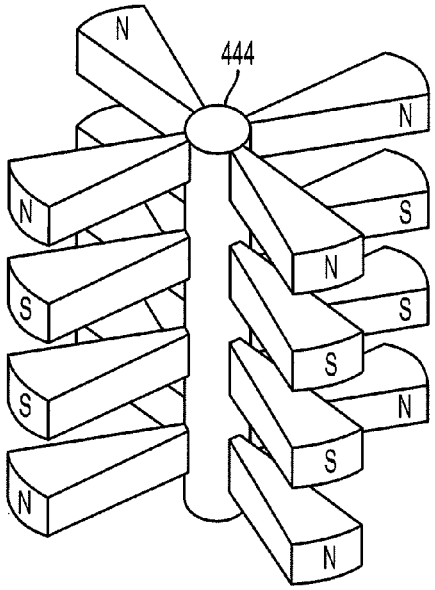

It should be noted that there are many possibilities for the polarity arrangement of the moving component 446 in the configuration of FIG. 38. For example and without limitation, FIGS. 41A and 41B are alternative rotary components each having a different polarity arrangement. Each of these alternative rotary components can replace the rotary component 446 in the configuration of FIG. 38. Each alternative rotary component, shown in FIG. 41A or 41B, comprises of four identical, planar magnetic structures (453*a*, 453*b*, 453*c*, 453*d*) in which each planar structure includes four identical magnetic blocks which are configured in a similar manner of the magnetic blocks of the moving component 446 of the configuration of FIG. 38. As can be seen in FIGS. 41A-41B, the magnetic blocks of each planar structure (453*a*, 453*b*, 453*c*, 453*d*) have identical polarities at the free ends and are mutually perpendicular to each other to form a plus-like (+) sign shape as a whole. The magnetic blocks of the neighboring planar structures (453*a*, 453*b*, 453*c*, 453*d*) positioned preferably in an equidistant and aligned manner relative to one another to form four columns of magnetic blocks. The free ends of magnetic blocks in each column forming a polarity pattern which is the repeated identically in all columns. As can be seen in FIG. 41A the polarity arrangement of the free ends of magnetic blocks in each column (in a top to bottom direction of each column) is S-N-N-S polarity pattern. In a similar fashion, FIG. 41B shows the polarity arrangement pattern for the free ends of magnetic blocks of four identical columns is N-S-S-N polarity pattern. In a similar manner of the rotary component 446 of the configuration of FIG. 38, the magnetic blocks of the rotary components of FIGS. 41A and 41B are connected to the shaft 444 to form a rotationally symmetric moving structure.

Figure 42:
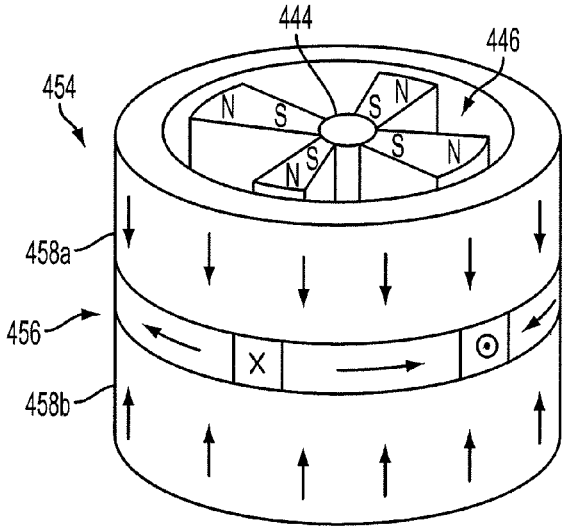
FIG. 42 shows a modification of the configuration of FIG. 38, in which the stationary component includes an alternative array structure according to an embodiment of the present invention.

FIG. 42 shows a modification of the configuration of FIG. 38, in which the stationary component includes an alternative array structure. As can be seen in FIG. 42, stationary component 454 comprises an annular array 456 which has a similar magnetic polarity arrangement as of the stationary component 440 in FIG. 38. The annular array 456 forming a band which is sandwiched in a symmetrical manner between two opposing axially magnetized rings (458*a*, 458*b*). The annular array 456 and axially magnetized rings (458*a*, 458*b*) are extended in the periphery of the stationary array 454 such that central axes of the annular array 456 and the rings (458*a*, 458*b*) being coincident with the rotational axis of the shaft 444.

Figure 43:
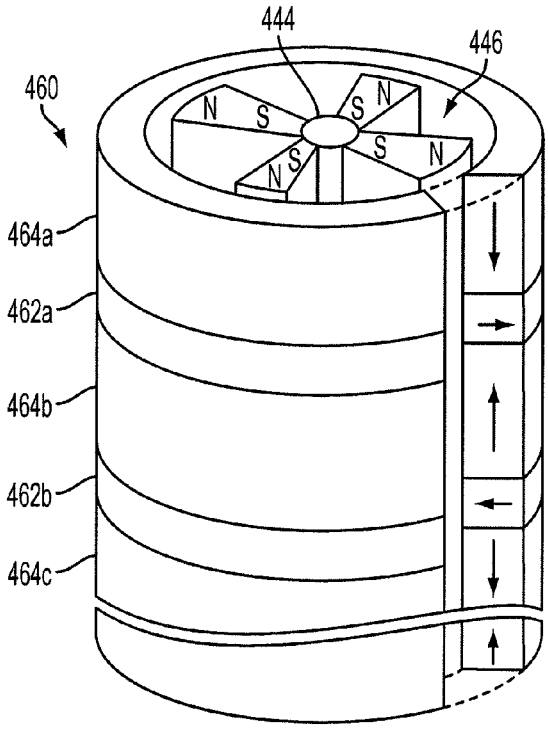
FIG. 43 shows another modification of the configuration of FIG. 38, in which the stationary component includes an array structure which is similar to the array shown in FIG. 3R according to an embodiment of the present invention.

FIG. 43 shows another modification of the configuration of FIG. 38, in which the stationary component includes an array structure which is similar to the array shown in FIG. 3R. As can be seen in FIG. 43, stationary component 460 comprises a plurality of radially magnetized magnetic rings forming polar bands (462*a*, 462*b*, . . . ) that are sandwiched between opposing axially magnetized rings (464*a*, 464*b*, 464*c*, . . . ). The polar bands (462*a*, 462*b*, . . . ) and the axially magnetized rings (464*a*, 464*b*, 464*c*, . . . ) are extended in the periphery of the stationary array 460 such that central axes of the polar bands (462*a*, 462*b*, 462*c*, . . . ) and the rings (464*a*, 464*b*, 464*c*, . . . ) being coincident with the rotational axis of the shaft 444.

Figure 44:
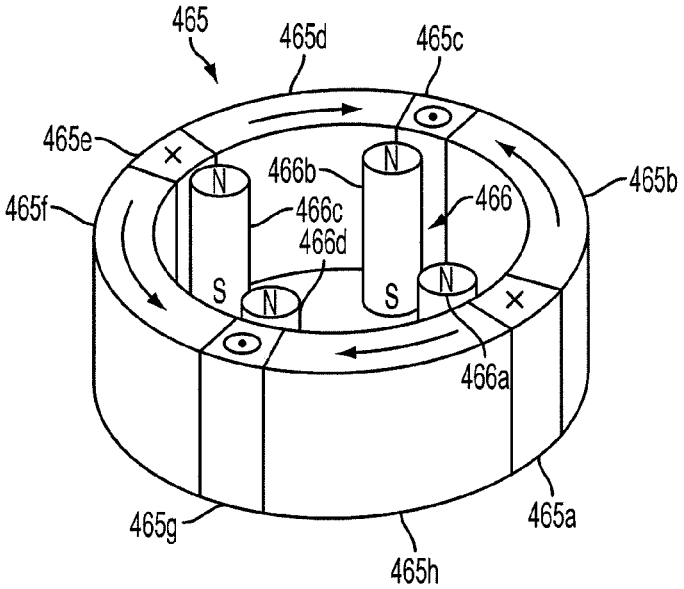
FIG. 44 shows a configuration in which its stationary component includes a closed loop Halbach shell having four elongated poles extended parallel to the longitudinal axis of the shell according to an embodiment of the present invention.

FIG. 44 shows a configuration in which its stationary component comprises of a closed loop Halbach shell 465 having four elongated poles (465*a*, 465*c*, 465*e*, 465*g*) extended parallel to the longitudinal axis of the shell. The moving component 466 comprises of four identical axially magnetized magnetic cylinders (466*a*, 466*b*, 466*c*, and 466*d*). The diameter and the height of magnetic cylinders (466*a*, 466*b*, 466*c*, and 466*d*) substantially match the respective sizes of the elongated poles (465*a*, 465*c*, 465*e*, 465*g*) of the shell 465.

The magnetic cylinders are positioned within the hollow region of the shell 465 in an aligned manner parallel to, and at an identical magnetic interaction distance from the respective elongated poles (465*a*, 465*c*, 465*e*, and 465*g*) of the shell 465. All the magnetic orientations of the cylinders (466*a*, 466*b*, 466*c*, and 466*d*) are in the same direction. The magnetic cylinders are connected (using a non-magnetic connection means) to a non-magnetic rotatable shaft (not shown) extending on the central axis of the shell 465. A rotary motion of cylinders about the central axis of the shell produces a substantial cancellation of the forces inhibiting the motion of the moving component and simultaneously changing the magnetic strength of the polar ends of the shell 465. In a similar manner, the spatial arrangement of the above configuration can be extended to other multi-polar hollow shells having an axial Halbach type of magnetic distribution.

It should be noted that in the exemplary configurations in which the stationary component is a closed-loop Halbach shell, generally for illustration purpose an ideal Halbach structure of the stationary shell component is shown in which the direction of the magnetization varies continuously. For example, in the shell 465 in FIG. 44, the magnetization direction of the shell magnetic elements of 465*b*, 465*d*, 465*f*, and 465*h* varies in a continuous manner as is shown by the curved arrows of the magnetization directions in the curved magnetic elements of 465*b*, 465*d*, 465*f*, and 465*h*. However, it should be realized that in practice the structure of an ideal Halbach cylindrical shell is approximated by using a plurality of segmented magnetic elements (which are usually wedge-shaped) such that the magnetization direction of magnetic segments varies from one segment to the next in discrete increments, in contrast to a continuous variation manner in an ideal Halbach magnetic shell.

Figure 45A:
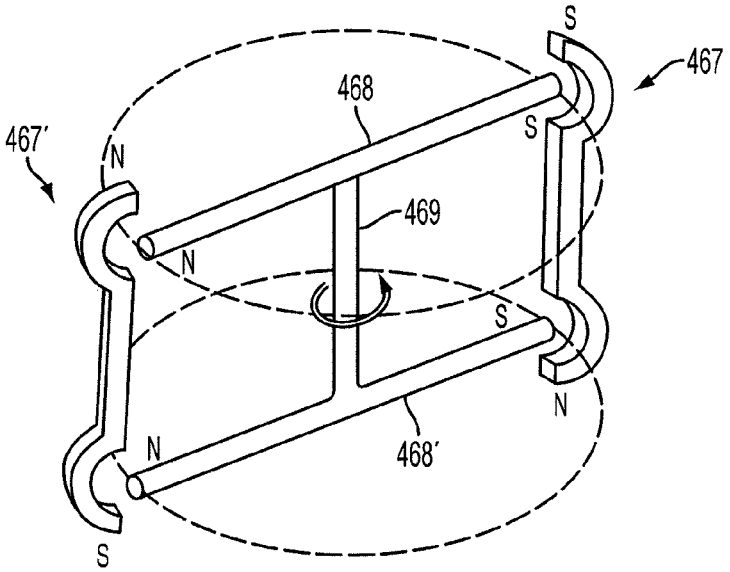
FIG. 45A shows another example of a configuration for rotary motion according to an embodiment of the present invention.

FIG. 45A shows another example of a configuration for rotary motion. The stationary component comprises of two identical half-dumbbell magnetic elements (467, 467') each having a structure similar to that shown in FIG. 1J. Each half-dumbbell magnet comprises of two half-ring portions defining an upper and a lower polar end and an elongated rod shaped portion connecting the two half-ring portions. The magnetization direction of each half-dumbbell magnets is along the longitudinal direction of the structure.

The half-dumbbell magnets (467, 467') are positioned spaced apart at preferably a non-magnetic interaction distance from each other in an aligned and mirror image relation relative to one another such that the recessed part of the half ring portions are directed toward each other.

The moving component comprises of two identical elongated magnetic rods (468, 468') which are longitudinally magnetized. The magnetic rods 468 and 468' extended respectively between the upper and lower recessed polar ends of the half-dumbbell magnets (at identical magnetic interaction distances in a symmetric manner) such that the longitudinal axis of each rod is coincident with symmetric axis line of the mirror imaged half rings. The magnetic rods are secured to a non-magnetic shaft means 469 in a rotationally balanced manner. The length and diameter of the rods is selected such that during rotation, the moving component preferably can pass non-contactly through the recessed part of the respective half ring portions of the stationary component. Preferably, the polar ends of the magnetic cylinders and the recessed portions of the half-dumbbell magnets have a complementary shape relation relative to each other.

As a rotational motion brings each polar ends of the magnetic rods (468, 468') to a magnetically interactive distance of the half rings of the half-dumbbells (467, 467'), the magnetic interactions produce attractive and repulsive forces of substantially equal magnitude such that cancel each other out and also produce a change in the magnetic strength at the polar ends of the half-dumbbells (467, 467'). As a result of the cancellation of the repulsive and attractive forces, the magnetic field strength of the polar ends of the dumbbell magnets (467, 467') can be readily changed with a minimum driving force.

Figure 45B:
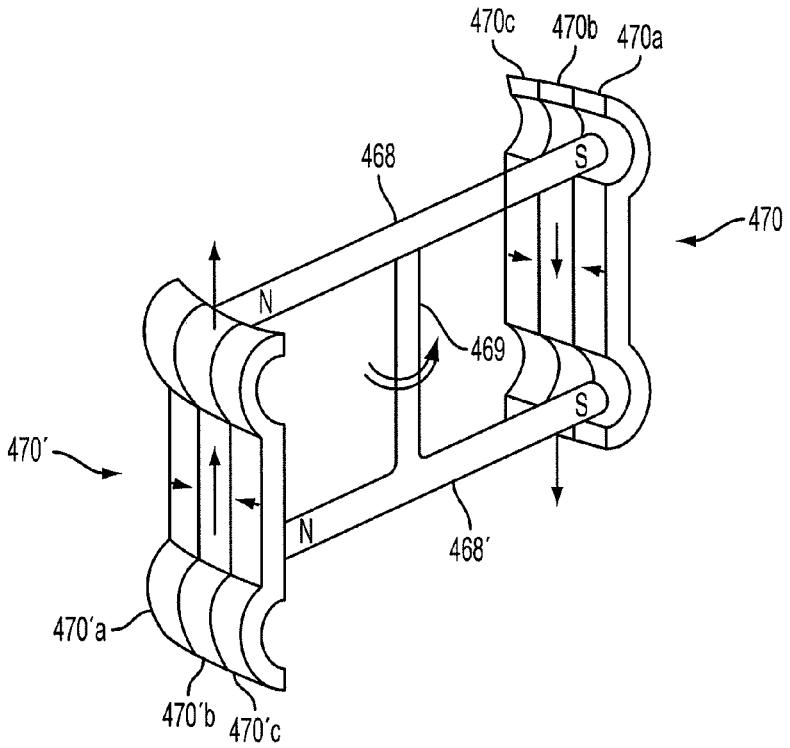
FIG. 45B shows an example of a configuration in which each Halbach structure includes a central half-dumbbell magnet which is sandwiched between two identical abutting half-dumbbell magnets according to an embodiment of the present invention.

Alternatively, in the configuration of FIG. 45A the stationary component can be replaced by a pair of Halbach structures. FIG. 45B shows an example for this type of configuration in which each Halbach structure (470, 470') comprises of a central half-dumbbell magnet (470 *b*, 470'*b*) which is sandwiched between two identical abutting half-dumbbell magnets (470 *a*, 470*c*; 470'*a*, 470'*c*). The central half-dumbbell magnets (470 *b*, 470'*b*) are structurally and magnetically similar to that of the half-dumbbell magnets (467, 467') of the configuration of FIG. 45A. The abutting half-dumbbell magnets (470 *a*, 470*c*; 470'*a*, 470'*c*) are structurally similar to the central half-dumbbell magnets (470 *b*, 470'*b*), however, are magnetized through thickness such that in combination with the central half-dumbbell magnets (470 *b*, 470'*b*) producing a curved array which is a Halbach structure having a shape similar to a half-dumbbell magnet.

Figure 46:
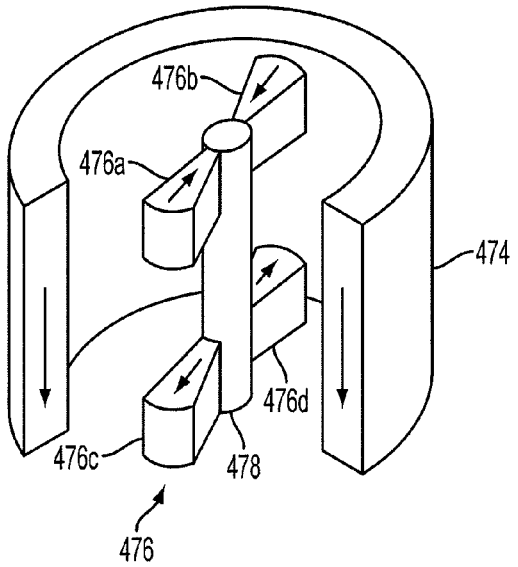
FIG. 46 is a partial perspective view of a configuration, in which the stationary component includes an elongated hollow magnetic cylinder which is axially magnetized according to an embodiment of the present invention.

It should be noted that the closed-loop array 440 of the stationary component in FIG. 38 may also be replaced by a simple magnetic element. FIG. 46 provides an example for these types of configurations. FIG. 46 is a partial perspective view of a configuration, in which the stationary component comprises of an elongated hollow magnetic cylinder 474 which is axially magnetized. The moving component 476 includes four identical elongated magnets (476*a*, 476*b*, 476*c*, 476*d*), each magnetized in longitudinal direction of the magnet. The polar ends of the magnets are connected to an iron-type rotatable shaft 478 in a symmetrical, coplanar, and mirror image manner forming a paralleled pairs of upper and a lower magnet. Each pair of upper (476*a*, 476*b*) or lower (476*c*, 476*d*) magnets have identical polarities at free polar ends of the pair. Each two (upper and lower) mirror-imaged magnets (476*a* and 476*c*; 476*b* and 476*d*) positioned on the same side of the shaft 478 have an anti-parallel magnetization relation. The separation distance between upper and lower magnets is such that it minimizes the magnetic interaction between two opposing free ends of the upper and lower magnets.

It should be noted that in the exemplary rotary configurations generally the positional order of the moving and stationary components, in a radial direction relative to the axis of rotation, were closer and farther, respectively. However, this positional order of the moving and stationary components is for illustration purpose and should not be construed as a limitation because it is possible that this positional order of components can be reversed to an "inside-out" configuration structure. In a reversed positional order, the moving component will be positioned (in a radial direction relative to the axis of rotation) farther away than the stationary component such that it will rotate around the stationary component.

Exemplary Embodiments Having Spinning Motion

The rotary motion of the moving component in a configuration can be extended to a spinning motion. In these types of configurations the moving component can comprise of magnetic elements or arrays. However, for brevity and without limitation in the following simplified configurations, only examples of configurations with a moving component that includes simple magnetic elements such as transversely magnetized rings or cylindrical rods are provided.

Figure 47:
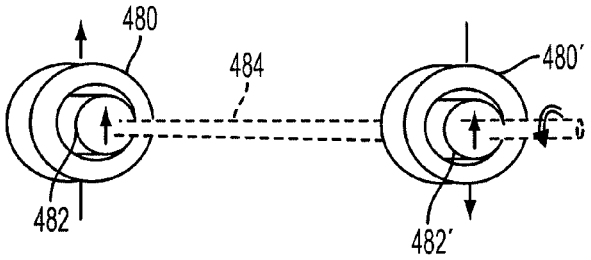
FIG. 47 shows a simplified basic structure of a spinning configuration according to an embodiment of the present invention.

FIG. 47 shows a simplified basic structure of a spinning configuration. The stationary component comprises of a pair of identical magnetic rings 480 and 480' which are transversely (diametrically) magnetized. The positional and magnetic relation between the two rings (480, 480') is similar to the rings 270*a* and 270'*a* in FIG. 4 and is not repeated here. The magnetization direction of two rings (480, 480') is anti-parallel relative to one another.

The moving component comprises of two identical transversely (diametrically) magnetized magnetic disks 482 and 482'. Each disk is positioned within the circular opening of a respective ring in a coaxial and symmetric manner and being separated from the ring opening by a uniform annular gap. Preferably, the gap size is small enough to allow a spinning motion of the disk within the opening of the associated ring. The magnetization directions of both disks are parallel and in the same direction. The thickness of each disk and its associated ring can be the same or different; however, in a non-limiting manner, preferably the thickness of each disk can be slightly less than the thickness of the ring. The disks are connected to one another by a rigid non-magnetic means 484 enabling both disks to spin in the same direction as a unitary moving component.

As a result of magnetic interactions between the disks and associated rings, during a spinning motion of the disks; at any given position in the motion path, two disks can experience substantially identical opposing magnetic forces which substantially cancel each other effects. As a result, the spinning motion of the disks can be achieved requiring minimum energy input. A continuous spinning of the disks can alter the strength of the magnetic field of the rings in a periodical manner.

Alternatively, identical disks (482 and 482') in the configuration of FIG. 47 can be replaced by a pair of identical inner magnetic rings such that combination of each outer magnetic ring (480, 480') and each associated inner magnetic ring forming a ball-bearing like magnetic structure having concentric outer and inner rings (not shown). The identical inner rings are diametrically magnetized and can be positioned in the same spatial and magnetic orientation manner as of the disks 482 and 482'.

Figure 48:
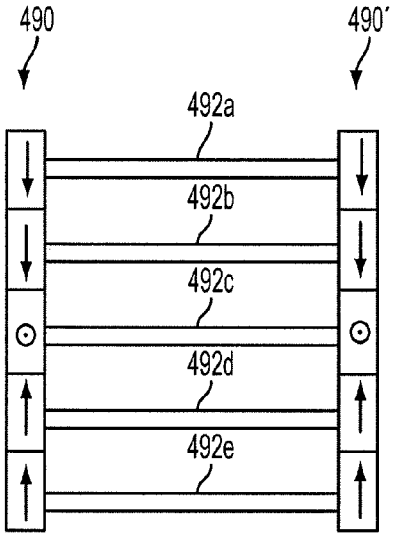
FIG. 48 shows a front view of a configuration including a pair of stationary chain arrays according to an embodiment of the present invention.
Figure 49:
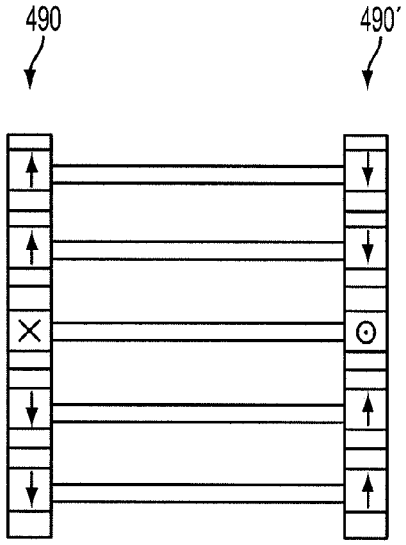
FIG. 49 is a cross sectional view of the arrays of FIG. 48 by a plane passing through the longitudinal axes of the chain arrays to show the magnetization directions of the magnetic disks according to an embodiment of the present invention.

The basic spinning structure described in the configuration of FIG. 47 can be extended to many configurations. For example and without limitation, FIG. 48 shows a front view of a configuration comprising a pair of stationary chain arrays (490, 490'). The spatial relation of the chain arrays (490, 490') is similar to the corresponding arrays in the configuration of FIG. 8. Each chain array (490, 490') includes 5 rings in which each ring is associated with a magnetic disk in the same manner of the configuration of FIG. 47 such that a group of 10 identical (transversely magnetized) magnetic disks forming the moving components of the configuration of FIG. 48. In FIG. 48 only the magnetization direction of the rings of the arrays is shown. FIG. 49 is a cross sectional view of the arrays of FIG. 48 by a plane passing through the longitudinal axes of the chain arrays (490, 490') to show the magnetization directions of the magnetic disks.

Each pair of mirror-imaged positioned disks is connected to one another through a rigid non-magnetic connection means (492*a*, 492*b*, 492*c*, 492*d*, 492*e*) in which all the connection means are preferably identical. A spinning motion of the disks may change the magnetic field strength of the chain arrays (490, 490') and simultaneously may, at least partially, cancel magnetic forces inhibiting the spinning motion of the disks.

As can be seen in FIGS. 48 and 49, the magnetization directions of the disks and the associated rings of the arrays 490 and 490' having an anti-parallel relation relative to each other, resulting a reverse magnetic effect on the strength of the magnetic field of chain arrays 490 and 490'. For example, in array 490 the magnetization direction of the disks and the associated rings are in the opposite direction, consequently the disks having a minimizing or reducing effect on the strength of the magnetic field of the array 490. However, in the array 490' the magnetization directions of the disks and the associated rings are in same direction; as a result, disks having a supporting or augmenting effect on the strength of the magnetic field of the array 490'. In general, the magnetization directions of the disks selected such that the resulting magnetic effect on the magnetic field strength of one array can be the reverse of the other array.

Figure 50:
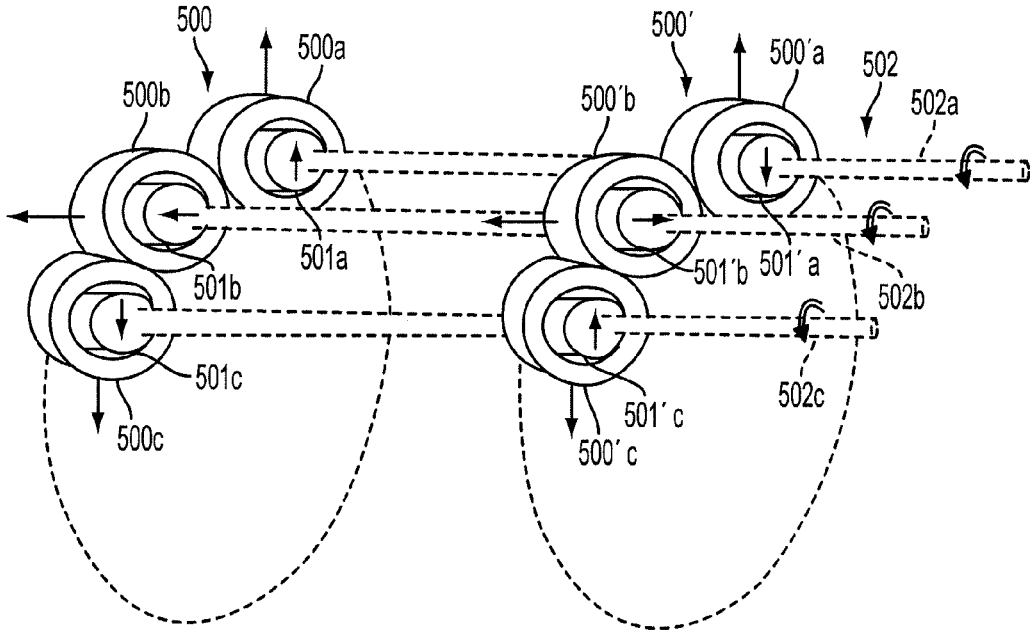
FIG. 50 shows a partial perspective view of a pair of circular dipoles (similar to the array shown in FIG. 3M) positioned spaced apart at a distance minimizing (or preferably preventing) magnetic interaction between arrays according to an embodiment of the present invention.

The structure form of FIG. 48 can be extended to any pairs of identical magnetic arrays (or magnetic elements) which are positioned spaced, mirror-imaged, and parallel relative to one another at a separation distance which minimizes or preferably prevents magnetic interaction between arrays (or magnetic elements). For example and without limitation, FIG. 50 shows a partial perspective of a pair of circular dipoles 500 and 500' (similar to the array shown in FIG. 3M) positioned spaced apart at a distance minimizing (or preferably preventing) magnetic interaction between arrays. Each ring of each dipole array (500 and 500') is associated with an inner magnetic disk (501*a*, 501*b*, 501*c*, . . . ; 501'*a*, 501'*b*, 501'*c*, . . . ) such that for each disk in one array (500) there is another mirror-imaged disk in the other array (500'). Eight rigid non-magnetic connection means (502*a*, 502*b*, 502*c*, . . . ) which are preferably identical, connects the mirror-imaged disks to one another.

A simultaneous spinning of the disks may produce a similar magnetic behavior exhibited by other configurations characterized by at least a partial cancellation of the forces inhibiting the motion of the moving component and simultaneously changing the magnetic strength of the dipole array. The structure of the configuration of FIG. 50 can be extended to many other closed-loop configurations, including various configurations which are similar to Mandhalas structures. The magnetic behavior of this type of configurations can have many applications including medical diagnosis devices such as NMR based devices.

Figure 51:
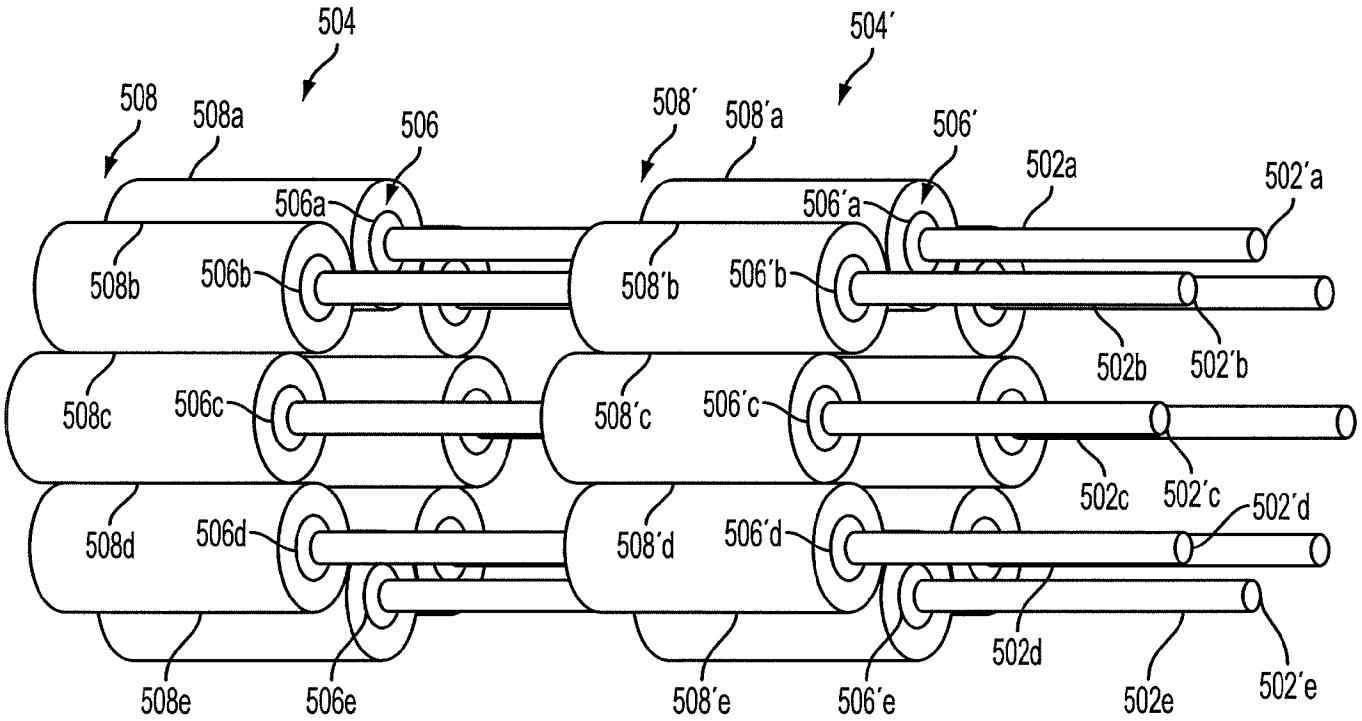
FIG. 51 is a modification of the configuration of FIG. 50 in which each ring and its associated disk are replaced by a shell structural unit according to an embodiment of the present invention.

FIG. 51 is a modification of the configuration of FIG. 50 in which each ring and its associated disk are replaced by a shell structural unit (hereinafter "shell structural unit"), which includes an outer cylinder shell and inner cylinder rod, to form a pair of elongated dipoles 504 and 504'. In each shell structural unit, the cylindrical outer shell and inner cylinder rod are respectively an elongated form of a ring and its associated disk in the configuration of FIG. 50. The outer shell and the associated inner rod of each shell structural unit have similar magnetic and positional relation as that of the rings and the associated disks in the configuration of FIG. 50.

Figure 52A:
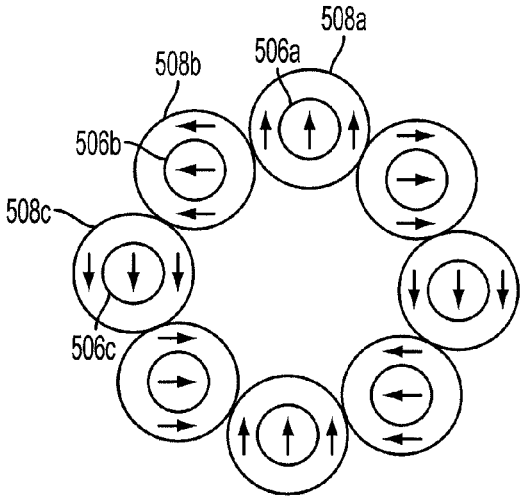
FIGS. 52A and 52B show axial cross sections of arrays of FIG. 51 showing the magnetic orientations of outer shells and cylinder rods in each shell structural units of the arrays according to an embodiment of the present invention.
Figure 52B:
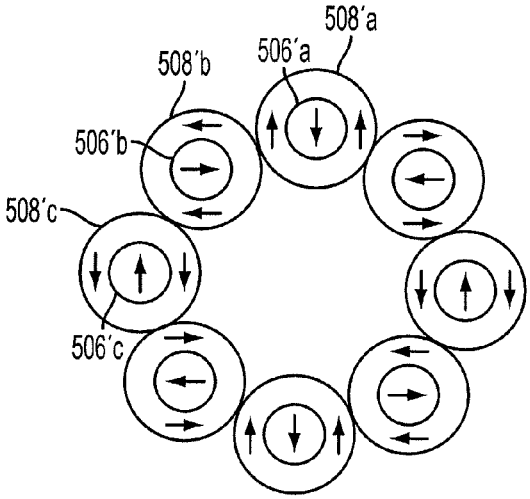

FIGS. 52A and 52B are axial cross sections of the arrays 504 and 504' showing the magnetic orientations of outer shells and cylinder rods in each shell structural units of the arrays. The small inner circles (506*a*, 506*b*, 506*c*, . . . ; 506'*a*, 506'*b*, 506'*c*, . . . ), represent the magnetic cylinder rods. The arrows inside the small inner circles indicate magnetic orientation of the magnetic rods. Each larger circle (508*a*, 508*b*, 508*c*, . . . ; 508'*a*, 508'*b*, 508'*c*, . . . ) enclosing the small inner circle represent the outer shell of each shell structure unites. The Parallel arrows on the opposed outer sides of each small inner circle represent the magnetic orientation of the outer shell of each shell structural unit. In general, FIGS. 52A-52B show that magnetic rods of the array 504 having a reverse magnetic orientation relative to the corresponding magnetic rods of the array 504'.

Figure 53A:
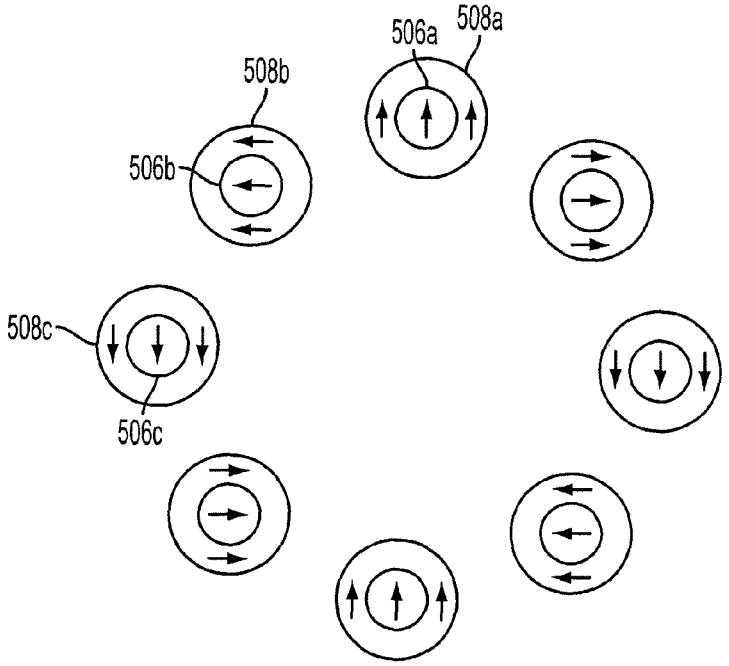
FIGS. 53A-53B show an axial cross section of arrays in which the pairs of the shell structural units are positioned at equal angular distance in a mangle configuration according to an embodiment of the present invention.
Figure 53B:
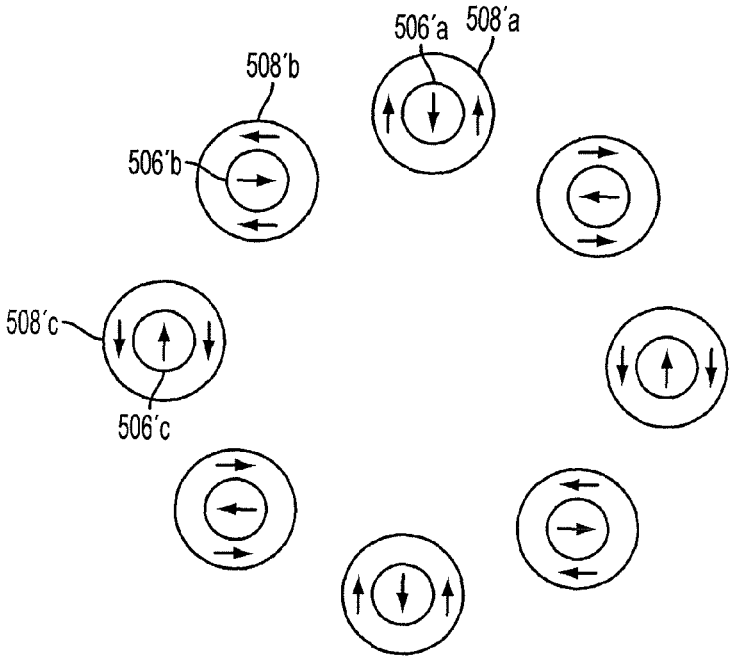
Figure 54A:
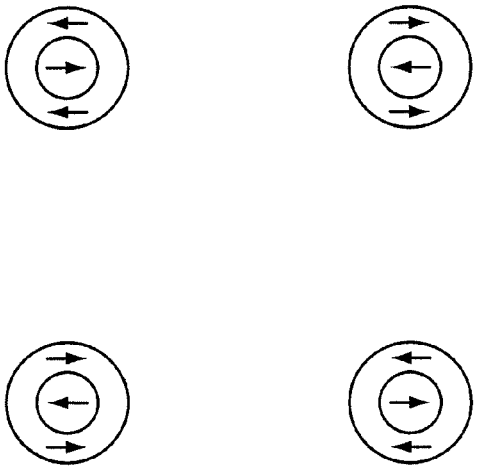
FIGS. 54A-54B show an axial cross section of a mangle configuration in which each mangle array having four pairs of shell structural units according to an embodiment of the present invention.
Figure 54B:
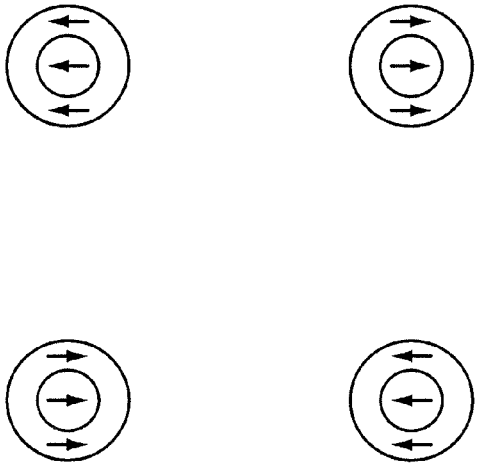

Alternatively in the configuration of FIG. 51 which comprises of eight pairs of mirror-imaged shell structural units, the pairs of the shell structural units can be positioned spaced apart at equal magnetic distance from each other to form a circular symmetric pattern of a mangle-type configuration. FIGS. 53A-53B show an axial cross section of array 504 and 504' in which the pairs of the shell structural units are positioned at equal angular distance in a mangle configuration. The selected number of shell structural unit pairs shown in FIGS. 53A-53B is for illustration and more or less number of the shell structural unit pairs can be used in a mangle configuration. For example, FIGS. 54A-54B show an axial cross section of a mangle configuration in which each mangle array having four pairs of the shell structural unit.

A simultaneous spinning of the inner rods in the configuration of FIG. 51, or in the mangle configurations of FIGS. 53A-54B, produces a similar magnetic behavior exhibited by the other spinning configurations characterized by at least a partial cancellation of the forces inhibiting the motion of the moving component and a change in the magnetic field strength pattern of the stationary arrays.

As a further modification of the configuration of FIG. 48, the structure of this configuration can be extended to a pair of identical daisy-like arrays (see FIG. 3L) which are positioned mirror-imagedly parallel to each other at a distance which minimizes or preferably prevents magnetic interaction between arrays (not shown) to produce a strong magnetic field change in the central ring portion (ring 180 in FIG. 3L) of the daisy configuration. This type of configurations may have various applications such as magnetic lifting devices.

Figure 55:
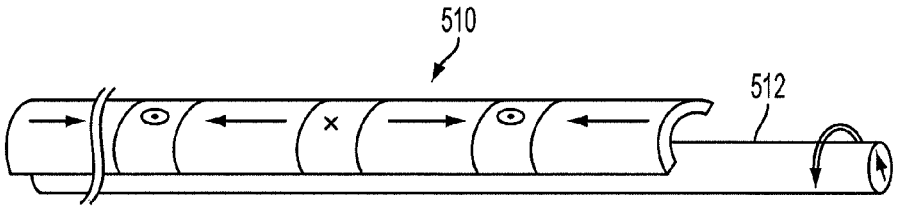
FIG. 55 is a spinning version of the configuration shown in FIG. 17 according to an embodiment of the present invention.

FIG. 55 is a spinning version of the configuration shown in FIG. 17. The stationary component comprises of a semi-annular cylinder array 510 (such as array shown in FIG. 3J). The moving component comprises of a transversely magnetized cylindrical magnetic rod 512 (hereinafter "rod"). The rod 512 is positioned at the recessed side of the array 510 at a magnetically interaction distance such that the longitudinal axes of both rod and array can be paralleled or coincident. As whole, the rod and array form a symmetrical structure. Preferably, the diameter of the rod 512 is less than the inner diameter of the recessed side of the array 510 such that the rod can be coaxially positioned within the elongated recessed portion and be separated by almost negligible gap from the recessed portion. The rod 512 can have preferably smaller length than array 510 such that each end of the rod can be smaller than the length of the array by about a size of structural diameter of the array 510 (for illustration purpose the length of the rod 512 in FIG. 55 is exaggerated to be longer than array 510). Furthermore, the selected length of the rod should be such that the selected length can span preferably at least two (or any even number of more than two) period length of the array. Spinning motion of the rod 512 around its longitudinal axis can cause a plurality of magnetic interactions between the rod 512 and the array 510 such that the magnetic forces resulting from the interactions can be, at least partially, cancelled, and simultaneously magnetic field pattern of the array can be changed. As a result of at least a partial cancelation of the magnetic forces influencing the spinning of the rod forces, the spin motion of the rod can be continued requiring a minimum input energy.

As another alternative of the configuration shown in FIG. 55, the spinning structure can be extended to other configurations such as the configurations shown in FIGS. 14 and 25 in which motion of the moving components in FIG. 14 or 25 can be a spinning motion to produce a change in the strength of the magnetic field distribution of the stationary arrays of these configurations while simultaneously causing at least a partial cancellation of the forces influencing the spinning motion of the rods As another alternative of the configuration of FIG. 55, the spinning structure can be extended to other configurations in which the structure of the stationary component is a tubular shaped array such as configurations of FIGS. 23, 24A, and 24B. In these alternative configurations, the spinning motion of the moving component causes a periodic change in the strength of the magnetic field distribution of the polar areas of the stationary array and a simultaneous cancellation of magnetic forces influencing the spin of the moving component.

Figure 56:
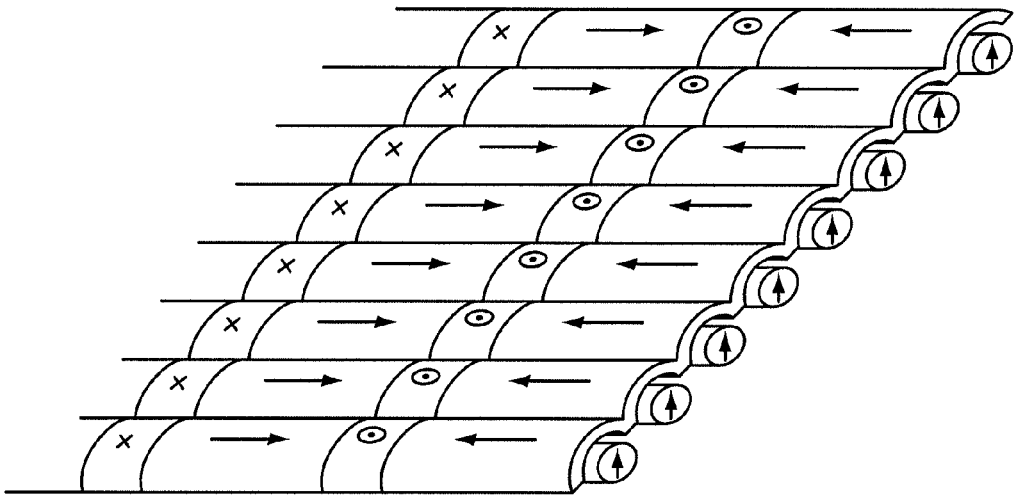
FIG. 56 shows a planar extension of the structure of FIG. 55 according to an embodiment of the present invention.

Alternatively the structure of the configuration of FIG. 55 can be extended to higher dimensions such as planar surfaces or closed-loop surfaces such as hollow cylindrical surfaces. For example, a planar extension of the structure of FIG. 55 can be seen in FIG. 56. Stationary component comprises of a series of spatially repeating identical arrays which are connected to each other forming a planar surface. Each repeating array is associated with a rod (transversely magnetized cylindrical rod) in a similar structural and magnetic manner as described in connection to the configuration of FIG. 55. All rods magnetically and structurally are substantially identical. The magnetization direction of all rods preferably is parallel and in the same direction. The equal distance between the neighboring rods can be selected such that to minimize or prevent the magnetic interaction between the neighboring rods. As a result, a less number of rods that is shown in the FIG. 56 may be used. All rods have preferably equal length. The selected length of the rods should preferably be such that the length can span at least an even number of two or more of the period length of the array. The length of each rod is preferably less than the length of longitudinal recessed parts of the stationary array and is selected in a similar manner described for the rod 512 in FIG. 55. The position of the rod in each recessed longitudinal cavity should be such that preferably both ends of each rod having identical distances from the corresponding ends of the respective longitudinal recessed portions of the array to prevent the end-effects (which will be described later in the disclosure). When rods having a shorter length than the associated recessed portion of the array, then the rods may be extended (using identical rigid non-magnetic connection means) to a mechanism (will be described later in the disclosure) for a synchronized spinning motion of the rods.

A synchronized simultaneous spinning motion of the rods, preferably in the same direction, can produce a change in the magnetic field distribution of the planar array and simultaneously the forces influencing the spinning motion of the rods can be, at least partially, cancelled.

Figure 57:
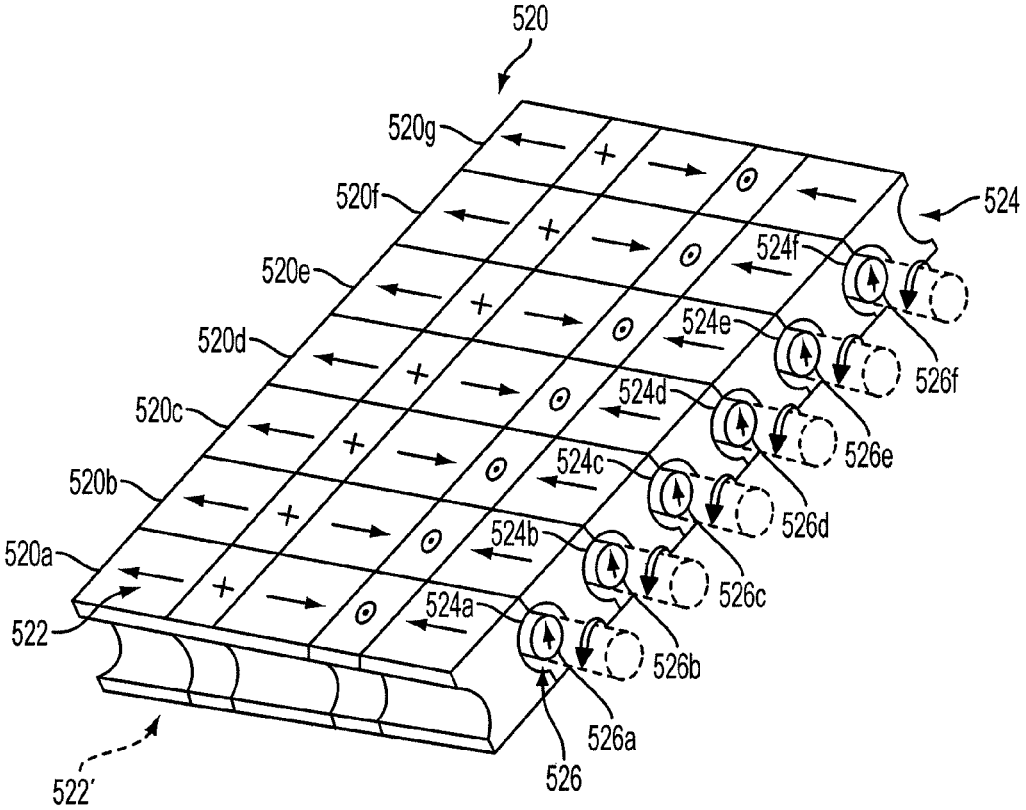
FIG. 57 shows another example of a two dimensional planar extension of spinning configurations according to an embodiment of the present invention.

FIG. 57 shows another example of a two dimensional planar extension of spinning configurations. As can be seen in FIG. 57, the stationary component 520 comprises of a plurality of identical arrays (520*a*, 520*b*, 520*c*, . . . ) in which each array is similar to the stationary array 336 of the configuration shown in FIG. 15. The arrays (520*a*, 520*b*, 520*c*, . . . ) are positioned in an spatially repeating manner side by side to form a two dimensional symmetrical structure having two opposing flat surfaces (522, 522') sandwiching a number of identical, aligned, elongated hollow tubular cavities (524*a*, 524*b*, 524*c*, . . . ) in-between.

The moving component comprises of a number of identical cylinder rods (transversely magnetized) (526*a*, 526*b*, 526*c*, . . . ) having slightly smaller diameter than the diameter of the hollow tubular cavities such that each rod can be positioned inside each elongated hollow cavity (524*a*, 524*b*, 524*c*, . . . ) and have a uniform annular gap around the rod. The gap between each rod and its associated hollow cavity is of a size that allows rotation of the rods around its longitudinal within the hollow cavity. Therefore, the gap size can be relatively small such that the diameter of cavity can be substantially equal the diameter of the magnetic cylinder. The positioning of each rod in each elongated tubular cavity is in a coaxial, concentric, and aligned manner such that each tubular cavity (524*a*, 524*b*, 524*c*, . . . ) and its respective rod (526*a*, 526*b*, 526*c*, . . . ) have a common longitudinal axis and the rod can spin freely around its longitudinal axis within each tubular cavity.

The magnetization direction of all rods is preferably parallel and in the same direction. The length of each rod is selected in a similar manner to the corresponding rods described in FIG. 56. As a whole, the rods and the flat structure of array 520 form a symmetrical body in which all rods can spin preferably in the same direction in a synchronized manner. The rods may be extended, using identical rigid non-magnetic connection means (shown in dotted lines), to a mechanism (will be described later in the disclosure) for a synchronized spinning motion of the rods.

A simultaneous synchronized spinning of the rods within the tubular cavities can produce a change in strength of the magnetic field distribution pattern of each opposite flat surfaces (522, 522') of the arrays and also causes at least a partial cancellation of magnetic forces influencing the spinning of the rods.

Figure 58:
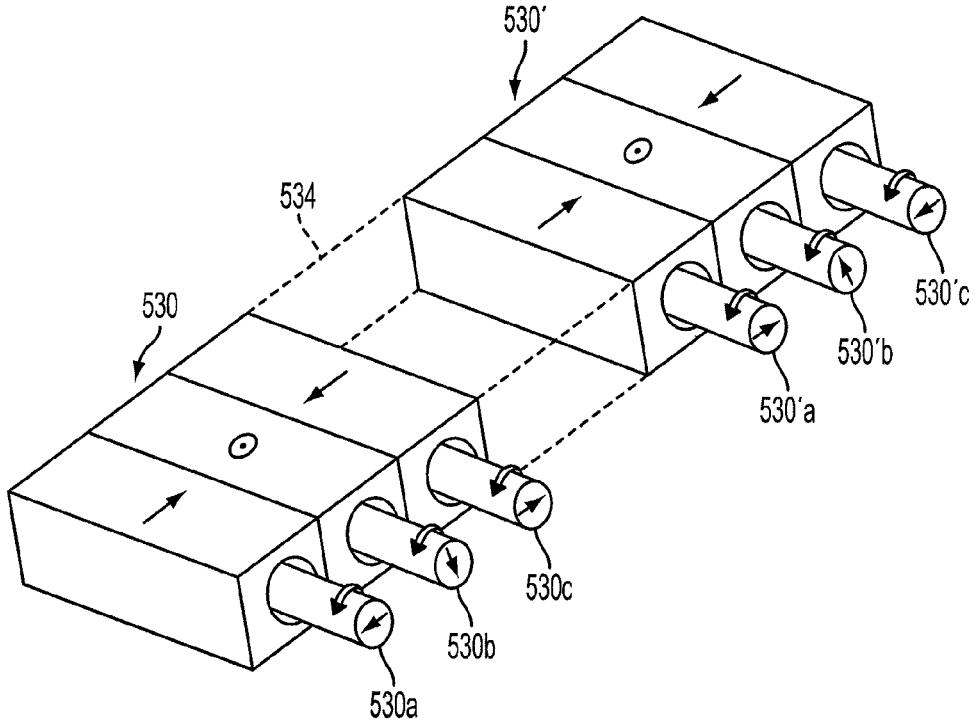
FIG. 58 shows another planar configuration for spinning motion according to an embodiment of the present invention.

FIG. 58 shows another planar configuration for spinning motion. The stationary component comprises of a pair of identical magnetic arrays (530, 530') positioned spaced apart in a mirror image manner. The separation distance between two arrays (530, 530') is a distance sufficient enough to minimize or prevent magnetic interactions between two arrays. Each array comprises of three identical magnetic blocks each having a length, a width, and a thickness. Each magnetic block comprises a hollow cylindrical cavity extended symmetrically along its length dimension such that the cavity and the block forming a common longitudinal symmetric axis.

The moving component comprises of six identical magnetic rods (530*a*, 530*b*, 530*c*; 530'*a*, 530'*b*, 530'*c*) which are transversely magnetized. Each rod is positioned within a cavity of an associated magnetic block in a similar manner described in connection to the configuration of FIG. 57. In the array 530, the magnetic orientation of rods within the cavities of the array 530 is such that each rod and its associated magnetic block have an anti-parallel magnetic orientation relation. However, in the array 530' each magnetic rod and its associated magnetic block have a common magnetic orientation relation which is directed in the same direction. A synchronized spinning motion of the magnetic rods can change the magnetic strength profile of the planar arrays and simultaneously the magnetic forces influencing the spin of the rods at least partially cancel each other.

Figure 59A:
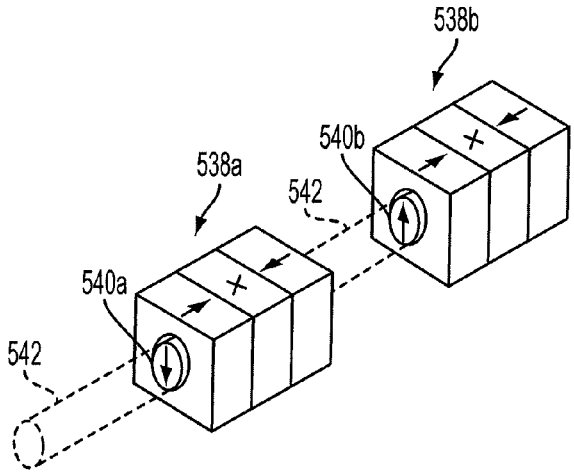
FIG. 59A shows a modification of FIG. 58 according to an embodiment of the present invention.

A modification of the configuration of FIG. 58 can be seen in FIG. 59A in which each magnetic block of the array has an identical cavity extended symmetrically along the thickness dimension of the block such that cavities of all blocks as a whole forming a hollow cylindrical cavity which is extended symmetrically within each array.

The moving component comprises of two identical magnetic rods (540*a*, 540*b*) which are transversely magnetized. Each rod is positioned within the hollow cylindrical cavity of each array in a similar manner described in connection to the configuration of FIG. 58. The magnetic orientation of each rod within each array is such that both rods having an anti-parallel magnetic orientation relation relative to one another.

The rods are connected to one another by a rigid non-magnetic means 542 to form a unitary moving component. A spin motion of the rods can change the magnetic strength profile of the planar arrays (538*a*, 538*b*) and simultaneously the magnetic forces influencing the spin of the rods at least partially cancel each other. It should be noted that the extent and the number of hollow cylindrical cavity in the configuration of FIG. 59A is for illustration and other extent of and/or the number of hollow cylindrical cavities in a configuration can be utilized. For example, a cavity can be extended at least partially in a geometrical dimension of a configuration, or a plurality of cavities can exist in a selected extension direction such that these cavities can be parallel to each other and each can be associated with a respective magnetic rod in a similar manner shown in FIG. 59A.

In general, as can be seen in the configurations of FIGS. 58 and 59A, in any configuration which comprises a combination of two identical mirror-imaged stationary arrays, positioned at a substantially non-magnetic interaction distance relative to one another, the corresponding magnetic rods in both arrays have a reverse magnetic orientation relation.

Figure 59B:
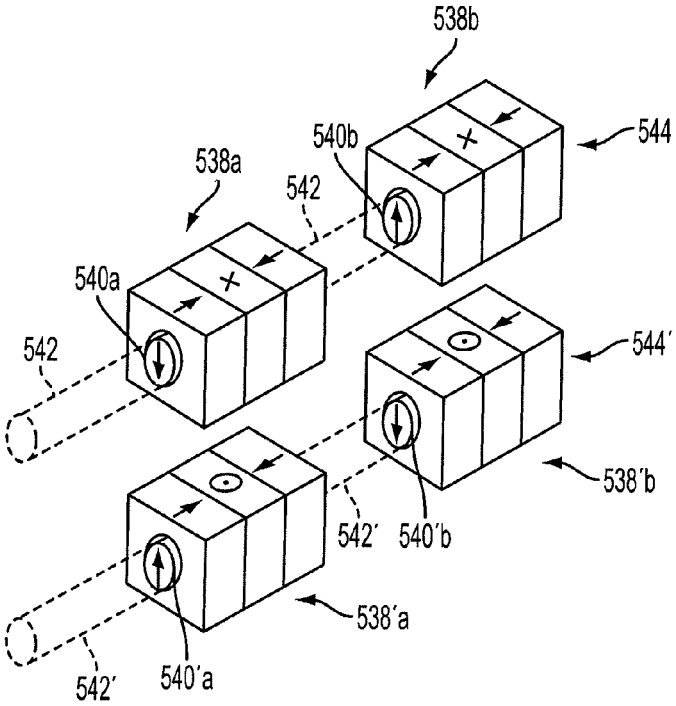
FIG. 59B shows two configurations each similar to the configuration of FIG. 59A according to an embodiment of the present invention.

FIG. 59B shows two configurations (544, 544') each similar to the configuration of FIG. 59A, therefore similar reference numbers of FIG. 59A are used for the configurations 544 and 544'. The configurations (544, 544') are positioned at a predetermined distance and in a mirror image relation relative to one another such that the strong side of arrays of one configuration is facing the strong side of the other configuration in a face to face relation. In the position of the arrays (538*a*, 538*b*; 538'*a*, 538'*b*) shown in FIG. 59B, there is a strong magnetic field between arrays 538*a* and 538'*a*; in contrast the magnetic field between arrays 538*b* and 538'*b* is weakened. A synchronized rotation of 180 degrees of the rods (540*a*, 540*b*; 540'*a*, 540'*b*) can reverse the above magnetic field strength pattern. By a continuous synchronized spin motion of the magnetic rods one may achieve producing a periodically changing strong magnetic field between the opposed confronting faces of each mirror imaged arrays with a minimum energy input. The predetermined distance between arrays can be based on the application needs such as for example sufficient space for placing coils (for example for production of electricity) or space for NMR-based applications such as sufficient space in MRI based applications.

Figure 60:
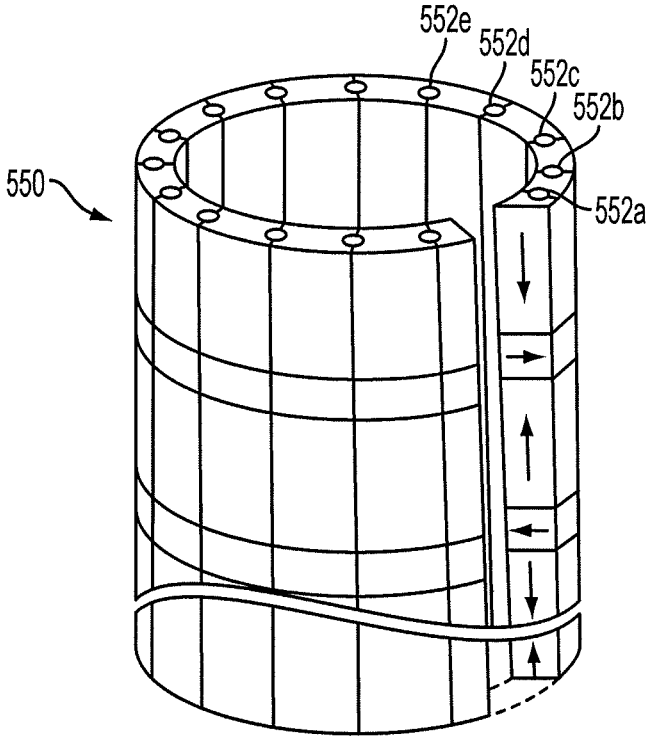
FIG. 60 shows a closed loop formation of the planar array of the configuration of FIG. 57 which is rolled into a hollow tubular shell structure according to an embodiment of the present invention.
Figure 61:
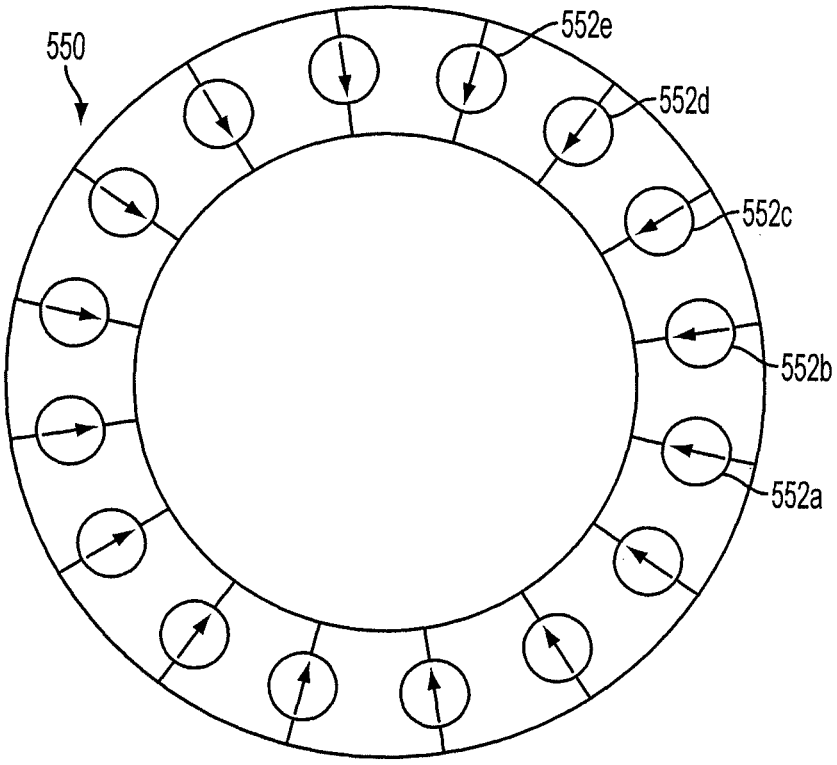
FIG. 61 shows an axial cross section of the configuration of FIG. 60 showing the magnetic orientations of the rods which are radially directed toward the central axis of the tubular shell according to an embodiment of the present invention.

The surface curvature of the planar array of the configuration of FIG. 57 can be changed to form a closed-loop configuration. For example, configuration of FIG. 60 is a closed loop formation of the planar array 520 of the configuration of FIG. 57 which is rolled into a hollow tubular shell structure 550. As can be seen in FIG. 60, there is a plurality of equally spaced, longitudinally extended identical magnetic rods (552*a*, 552*b*, 552*c*, . . . ) each associated with a hollow cylindrical cavity within the shell structure. The spatial and magnetic relation of the rods (552*a*, 552*b*, 552*c*, . . . ) and the array 550 are similar to the corresponding rods (526*a*, 526*b*, 526*c*, . . . ) and array 520 in the configuration of FIG. 57. FIG. 61 is an axial cross section of the configuration of FIG. 60 showing the magnetic orientations of the rods which are radially directed toward the central axis of the tubular shell 550.

The tubular structures such as the shell structure 550 shown in FIG. 60 can be extended to the stationary arrays of the previously described rotary configurations such that a stationary array of a rotary configuration can be converted to a tubular shell structure. The converted tubular shell structure may comprise a plurality of equally spaced cylindrical hollow cavities and associated magnetic rods which are positioned in a similar fashion shown in the configuration of FIG. 60.

Figure 62:
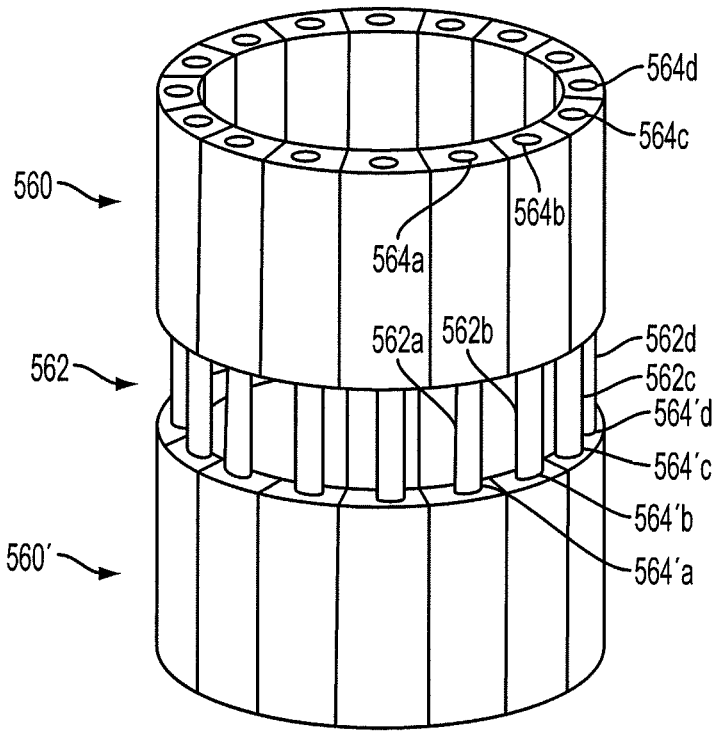
FIG. 62 shows two identical shell structure arrays in which each shell structure array is a converted form of an array similar to the stationary array of the configuration of FIG. 38 according to an embodiment of the present invention.

It should be noted that any pair of converted tubular shell structures can be positioned spaced apart in a mirror-imaged relation in a similar manner that is shown in the configurations of FIGS. 51, 58 and 59. For example, FIG. 62 shows two identical shell structure arrays (560, 560') in which each shell structure array is a converted form of an array similar to the stationary array 440 of the configuration of FIG. 38. Each shell structure (560, 560') comprises of plurality of wedge-shaped magnetic elements in which each magnetic element having a cylindrical cavity which is associated with a magnetic rod (564*a*, 564*b*, 564*c*, . . . ; 564'*a*, 564'*b*, 564'*c*, . . . ). The corresponding mirror-imaged magnetic rods (564*a*, 564'*a*; 564*b*, 564'*b*; 564*c*, 564'*c*; . . . ) of each two arrays (560, 560') are connected to each other by identical non-magnetic rigid connection means (562*a*, 562*b*, 562*c*, . . . ) forming elongated unitary magnetic rods capable of a simultaneous spinning motion within the cavities of both arrays (560, 560'). The separation distance between two arrays (560, 560') preferably is a distance minimizing or preferably preventing magnetic interactions between two arrays.

Figure 63A:
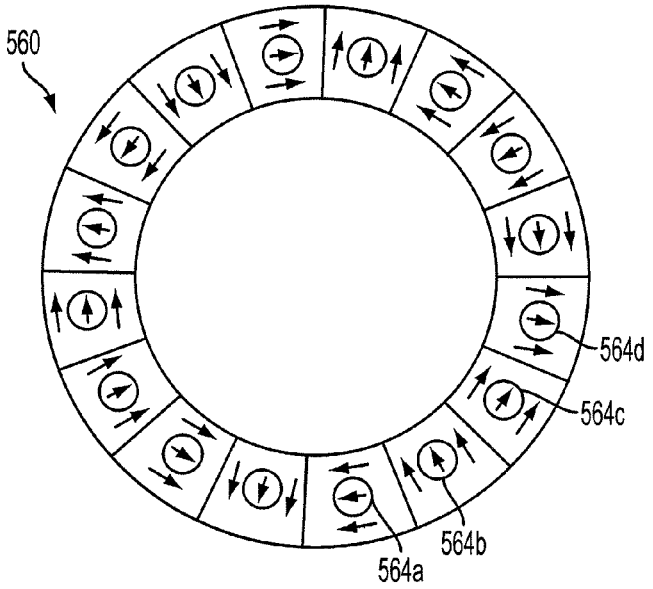
FIGS. 63A and 63B are axial cross sections of arrays of FIG. 62 showing magnetic rods of the arrays have a reverse magnetic orientation relative to corresponding magnetic rods of the arrays according to an embodiment of the present invention.
Figure 63B:
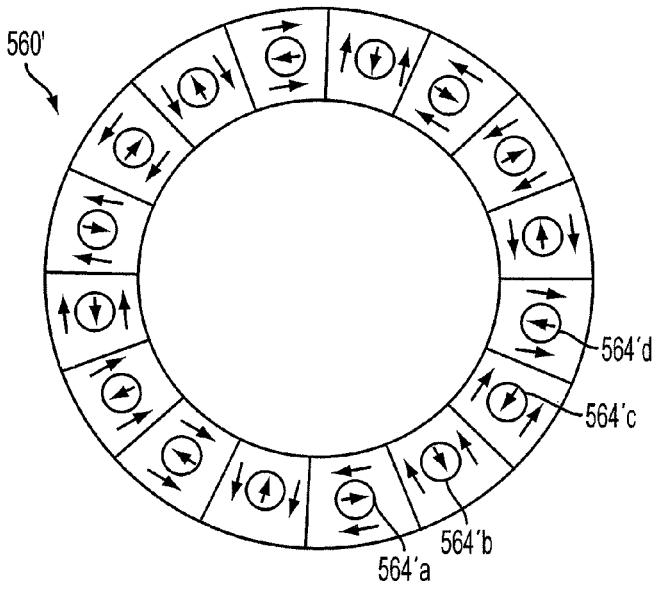

FIGS. 63A and 63B are axial cross sections of the arrays 560 and 560' showing magnetic rods of the array 560 having a reverse magnetic orientation relative to the corresponding magnetic rods of the array 560'. The small inner circles (564*a*, 564*b*, 564*c*, . . . ; 564'*a*, 564'*b*, 564'*c*, . . . ) represent the magnetic cylinder rods. The arrows inside the small inner circles indicate magnetic orientation of the magnetic rods. Parallel arrows on the opposed outer sides of each small inner circle represent the magnetic orientation of the wedged shaped magnetic elements of the arrays 560 and 560'.

It should be noted that the end regions of the stationary components in some of the exemplary configurations in this disclosure may have a non-uniform magnetic field distribution which is known as end-effects. A positional change and simultaneous interactions of the moving component with different interaction regions of the stationary component, including end regions, generates a plurality of magnetic forces resulting from the magnetic interactions. Generally, these interaction forces may cancel each other; however, because of the end-effects in the end interaction region of the stationary component, some interaction forces may be developed which cannot cancel the interaction forces of the other interaction regions.

In order to minimize or prevent the influence of the magnetic end-effects, the moving component may be sized such that the end portion of the moving component are not too close to the corresponding end portion of the stationary component. For example in the configuration of FIG. 57, the lengths of the magnetic cylinder rods (526*a*, 526*b*, 526*c*, . . . ) can be selected such that to be shorter than the corresponding length of the cylindrical cavities (524*a*, 524*b*, 524*c*, . . . ). Alternatively, in the configuration of FIG. 57, the longitudinal length of each identical array (520*a*, 520*b*, 520*c*, . . . ) and its associated rod (526*a*, 526*b*, 526*c*, . . . ) can be elongated to an extension long enough to minimize the influence of the end-effects.

As a preferable alternative method to prevent the end-effects influence, a pair-wise configuration method can be used. This method involves positioning a pair of identical configurations spaced apart in a mirror image relation relative to one another such that each two corresponding mirror-imaged magnetic elements (or arrays) of the moving components can have an anti-parallel magnetic orientations. The separation between pair of configurations is preferably a distance large enough to minimize or prevent magnetic interaction between the mirror-imaged components of two identical configurations.

For example, as shown in FIG. 58, the pair of the identical stationary arrays 530 and 530' are mirror-imaged relative to one another and positioned at a distance 534 which minimizes magnetic interaction between stationary arrays 530 and 530'; and each two corresponding mirror-imaged magnetic rods (530*a*, 530'*a*; 530*b*, 530'*b*; 530*c*, 530'*c*) having an anti-parallel magnetic orientation relation relative to one another.

Configuration of FIG. 62 provides another example for these types of pair-wise configurations. As can be seen in FIG. 62, the pair of the identical stationary arrays 560 and 560' are positioned in a mirror-image manner at a magnetic interaction minimizing (or preferably preventing) distance from one another; and each two corresponding mirror-imaged magnetic rods (564*a*, 564'*a*; 564*b*, 564'*b*; 564*c*, 564'*c*; . . . ) having an anti-parallel magnetic orientation relation relative to one another. The moving component in these pair-wise configurations can be connected to one another to form a unitary moving component providing a simultaneous uniform motion for the entire pair-wise configuration.

Figure 64:
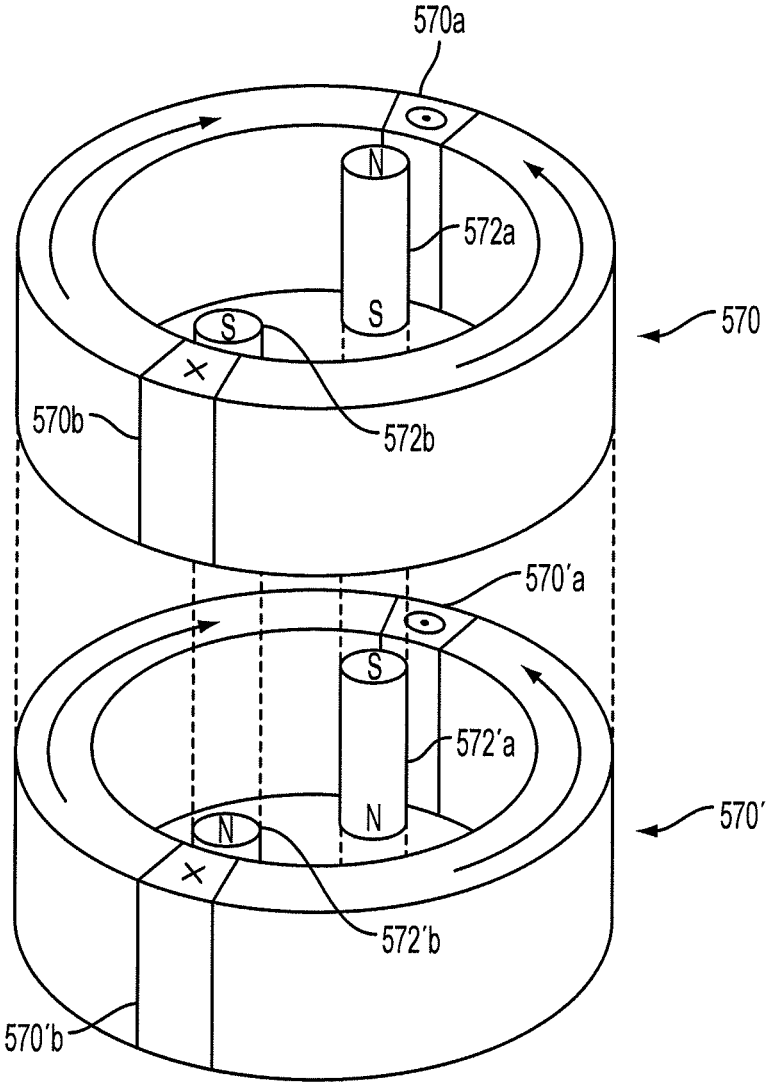
FIG. 64 shows a pair-wise configuration in which the stationary component comprises of two identical dipole shells in which each shell is a hollow cylindrical shaped magnetic structure with an axial Halbach type of magnetic distribution according to an embodiment of the present invention.

The pair wise configuration can be applied to create an extended family of configurations. In the following a simplified non-limiting example is provided. FIG. 64 shows a pair-wise configuration in which the stationary component comprises of two identical dipole shells (a first shell 570 and a second shell 570') in which each shell is a hollow cylindrical shaped magnetic structure with an axial Halbach type of magnetic distribution. Each dipole shell includes two elongated poles (570*a*, 570*b*; 570'*a*, 570'*b*) extended parallel to the longitudinal axis of the shell. The shells (570, 570') are positioned spaced apart in an aligned manner such that having a common longitudinal axis, and such that the magnetization direction of the respective elongated poles of the shells extends longitudinally in a collinear and in the same direction. The separation distance between two shells is a distance minimizing or preferably preventing magnetic interactions between two shells.

The moving component comprises of four identical axially magnetized magnetic cylinders (572*a*, 572*b*; 572'*a*, 572'*b*). The diameter and the height of magnetic cylinders substantially match the respective sizes of the elongated poles (570*a*, 570*b*; 570'*a*, 570'*b*) of the shells. In the first shell 570, each magnetic cylinder (572*a*, 572*b*) is positioned within the hollow region of the shell parallel to, and at an identical magnetic interaction distance of, and in an aligned manner relative to a respective elongated pole of the shell such that having a similar magnetic orientation as of the respective pole. In the second shell, magnetic cylinders (572'*a*, 572'*b*) are positioned in the same spatial manner as of the first shell, however each cylinder having an anti-parallel magnetic orientation relative to the respective elongated pole of the second shell 570'. The magnetic cylinders (572*a*, 572*b*; 572'*a*, 572'*b*) are connected to a (preferably non-magnetic) rotatable shaft (not shown) extending on the common axis of the shells by a non-magnetic connection means (not shown) such that providing a unitary moving component. A rotary motion of cylinders about the common longitudinal axis of the shells produces at least a partial cancellation of the forces inhibiting the motion of the moving component and simultaneously changing the magnetic strength of the polar ends of the shells. In a similar manner spatial arrangement of the above pair-wise configuration can be extended to other multi-polar closed loop hollow shells having an axial Halbach type of magnetic distribution.

It should be noted that there are many mechanisms known in the art for providing a simultaneous and synchronized spinning of the magnetic disks or the rods of the configurations for the spinning motion. Just as an example and without limitation, an orienter means such as a mechanical orienting means (such as for example using gear means) can be coupled to an arrangement of the plurality of spinning disks or rods such that it can provide a controllable simultaneous spinning of the disks. The arrangement of the spinning disks or rods can be any spatial pattern such as a linear or circular or planar, or a cylindrical surface pattern.

Figure 65:
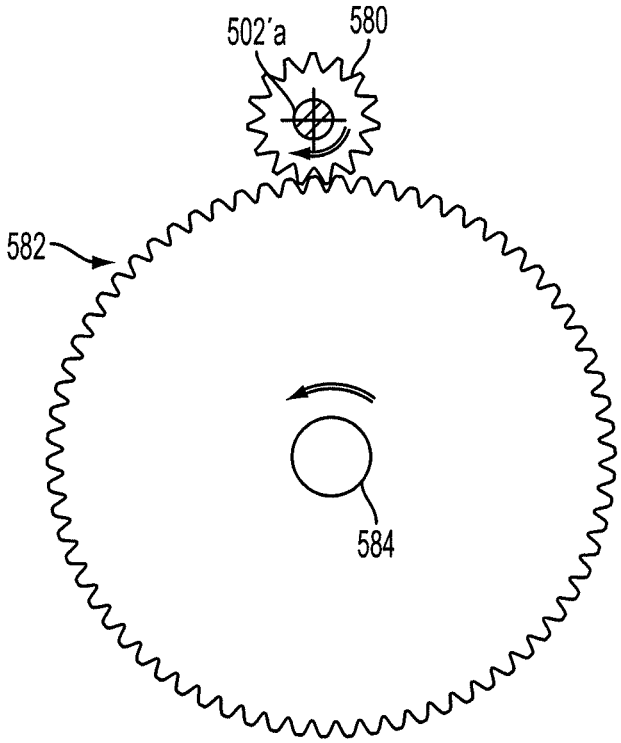
FIG. 65 shows a partial axial plan view of the configuration of FIG. 51 showing a peripheral gear which is fixed coaxially to an end portion of a connection means according to an embodiment of the present invention.

For a more specific example, suppose in the configuration of FIG. 51, one extends equally all the identical non-magnetic connection means (502*a*, 502*b*, 502*c*, . . . ) to a preferably non-magnetic distance from the configuration such that the free ends (502'*a*, 502'*b*, 502'*c*, . . . ) of the connection means form a circle. One may coaxially fix a peripheral gear to each free end (502'*a*, 502'*b*, 502'*c*, . . . ) of the connection means. For example, FIG. 65 is a partial axial plan view of the configuration of FIG. 51 showing a peripheral gear 580 which is fixed coaxially to the end portion 502'*a* of the connection means 502*a*. Similarly, other free end portions (502'*b*, 502'*c*, . . . ) can be fixed coaxially to other identical peripheral gears (not shown) such that all identical peripheral gears form a circular pattern of gears positioned at equal angular distances on the periphery of a circle. At the center of this circle, one may position a central gear 582 (attached to a preferably non-magnetic rotatable shaft 584 at the center of the circle) such that the central gear is capable of mechanically engaging with all peripheral gears to simultaneously spin all gears in a uniform and controllable manner. Preferably, all gears and related rotary support structure (not shown) are made from rigid non-magnetic materials.

It should be noted that in all configurations with a rotary or spinning motion, the selected direction of motion of the moving component was only for illustration. Generally, the selected direction of motion can be in either direction of clockwise or counterclockwise.

Alternative Configurations

As will be appreciated by those skilled in the art, configurations for changing the strength of magnetic field, using different kinds of motions for positional change of the moving component, are not limited to the configurations described thus far. In general, in order to simplify the description of the previous exemplary configurations, a selected number of identical shapes of magnetic arrays/elements, which have a simple structure, have been used. However, configurations may comprise different numbers or shapes of magnetic arrays and/or elements; or a positional change of the moving component of a configuration may include a different type of motion that described thus far, or may include more than one type of motion; or a moving component of a configuration may comprise one or more arrays instead of magnetic elements; or a configuration may be structured in a particular way because of a specific application purpose; or any combinations of the above. Furthermore, it is possible to convert substantially any magnetic elements or structures to a configuration comprising a stationary and a moving component such that the configuration can have a magnetic behavior similar to the exemplary configuration described in this disclosure (i.e., change of the magnetic strength with minimum energy input). It would be impractical to provide detail examples for all of the above alternative configurations. However, it is suffice to outline some simplified non-limiting examples.

The selected number of magnetic elements or arrays in the configuration described thus far was for illustration, and a more or less numbers of magnetic elements/array in a configuration is possible. For brevity a fast look at the less numbers is considered here which signifies that the configurations described in the disclosure can achieve the magnetic behavior of the configuration (changing the magnetic field strength of at least a polar area of the stationary component with a minimum energy requirement) using much less magnetic elements and/or arrays that described and/or shown in the disclosure.

For the sake of clarification and without limitation, two examples are provided in the following to show that exemplary embodiments can be possible with a minimum number of magnetic elements/arrays. It should be noted that for each previously described configuration there are various other modified versions that can be configured to have a minimum number of magnetic elements/arrays and the following descriptions are only non-liming examples. As the first example, in the configuration shown in FIG. 4, if the lower cylinders 276 and 278 are removed then the remaining configuration can be an example of a configuration having a less number of magnetic elements. As the second example, in the configuration shown in FIG. 15, the cylinder set may only comprise of 334*a*, 334'*a*, 334*d*, and 334'*d* magnetic cylinders.

It should be noted that for any given exemplary configurations there are many other modifications such that having functional similarity relative to the given configuration. That is, one may replace at least some of the magnetic elements of one or both components of a configuration with other magnetic elements (which have a different shape but a similar magnetic behavior) such that the original magnetic behavior of the configuration is not altered. One may use magnetic elements of various shapes to modify the shape of an exemplary magnetic configuration without altering its magnetic behavior.

A wide range of possibilities for the shape of magnetic elements will be discussed later in the disclosure. However, here it is suffice to provide simplified non-limiting examples.

Figure 66:
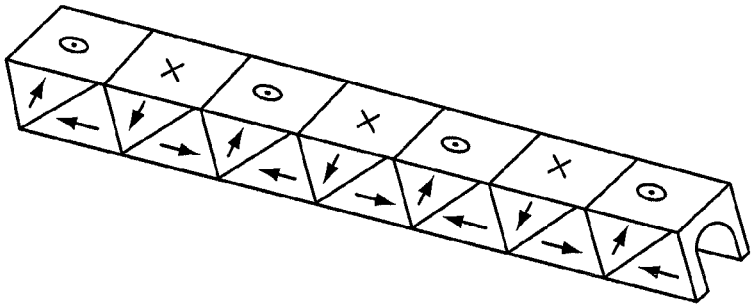
FIG. 66 shows an array which is a modified version of the stationary array shown in FIG. 55 according to an embodiment of the present invention.
Figure 67:
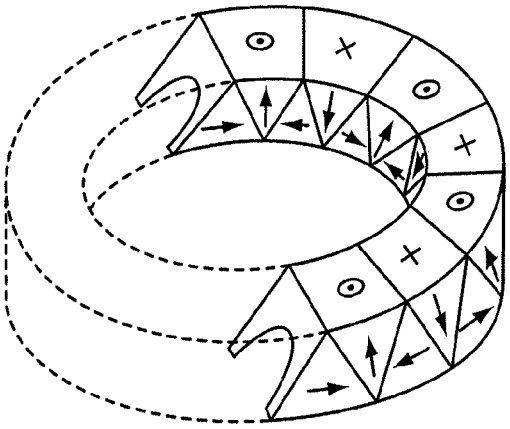
FIG. 67 shows a partial perspective of a magnetic component which is a modified version of the stationary arrays shown in FIG. 36A according to an embodiment of the present invention.

As an example of using different shapes of magnetic elements in the components of a configuration, FIG. 66 shows an array which is a modified version of the stationary array 510 shown in FIG. 55. The array of FIG. 66 is similar in function to the array 510. However, it differs from the array 510 in that a different shape of magnetic elements is used in the array structure. As another example, FIG. 67 shows a partial perspective of a magnetic component which is a modified version of the stationary arrays 434 shown in FIG. 36A.

Figure 68:
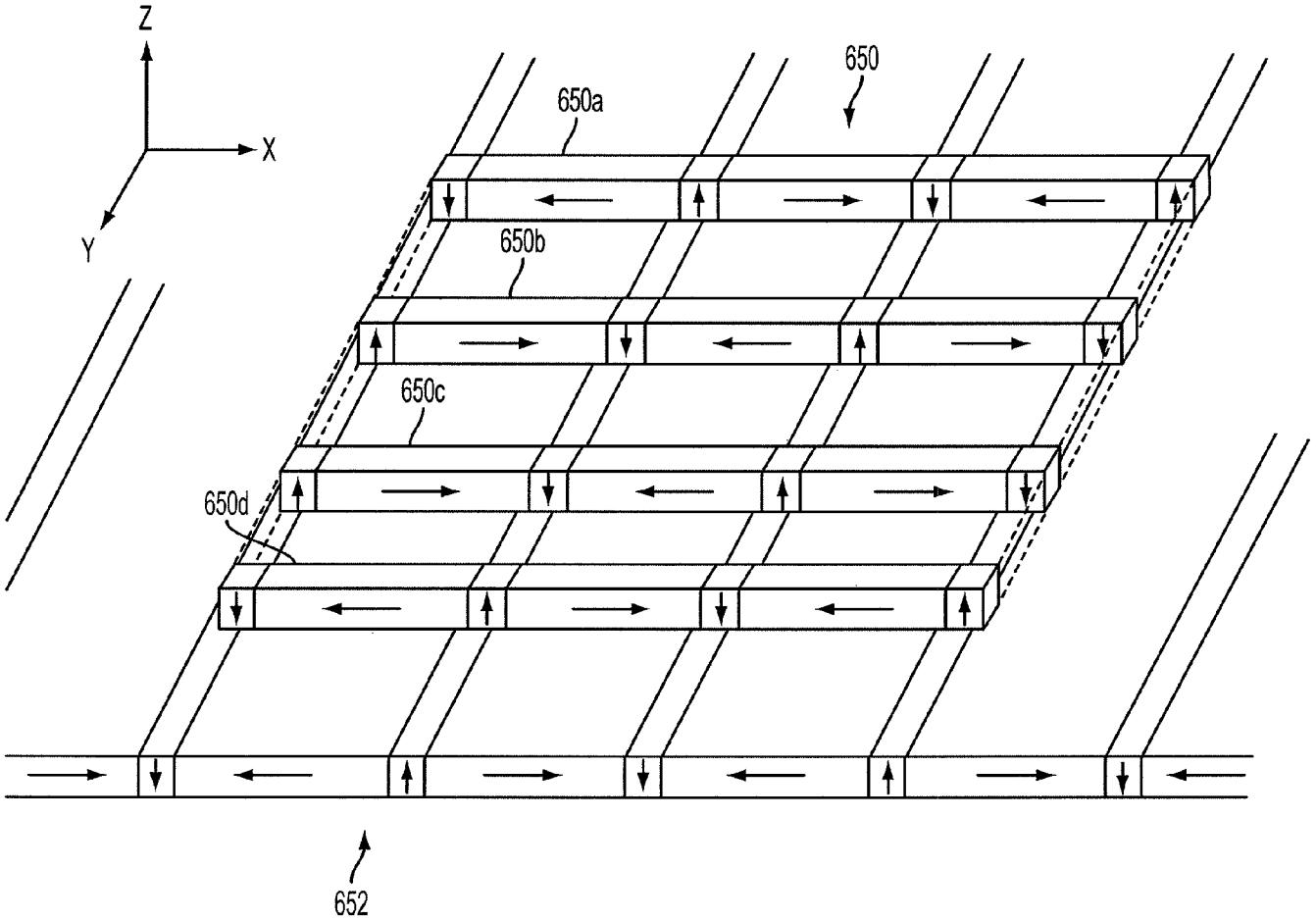
FIG. 68 shows a magnetic configuration having a similar stationary component as of the configuration shown in FIG. 19 according to an embodiment of the present invention.

In contrast to the configurations described thus far in which the moving component generally comprised of magnetic elements, there are configurations in which the moving components may comprise arrays or a combination of arrays and magnetic elements. As a non-limiting example FIG. 68 shows a magnetic configuration having a similar stationary component as of the configuration shown in FIG. 19, however in FIG. 68 the moving component comprises of four parallel rows of arrays (650*a*, 650*b*, 650*c*, and 650*d*). As can be seen in FIG. 68 the arrays (650*a*, 650*b*, 650*c*, 650*d*) having identical structure, positioned uniformly spaced apart and extending in rows parallel to X-axis in an aligned and coplanar manner. The uniform separation distance between each two neighboring rows is sufficient enough to minimize or preferably prevent the magnetic interaction between neighboring rows of the arrays. All rows (650*a*, 650*b*, 650*c*, and 650*d*) are connected to one another through non-magnetic means to form a unitary rectangular planar structure 650 having an X and Y extension direction parallel respectively to the X and Y extension of the plane of the stationary component 652. Two magnetic interaction planes of the array rows 650 and the stationary component 652 are positioned such that facing one another in a parallel manner and at a magnetic interaction distance.

The unitary planar structure 650 (while maintaining a uniform magnetic interaction distance from, and being parallel to, the plane of the stationary component 652) can move in any direction on the plane of the stationary component 652 as long as the X-axis extension of the unitary planar structure 650 remains parallel to the X-axis extension of the plane of the stationary component 652.

Figure 69:
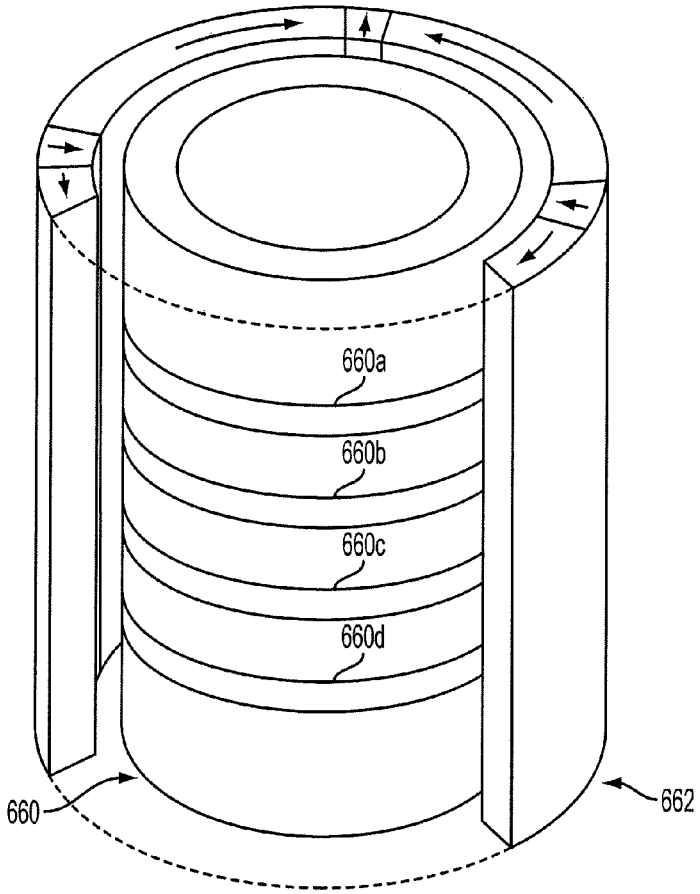
FIG. 69 shows an example of a rotary version of the configuration of FIG. 68 according to an embodiment of the present invention.

Alternatively, the stationary and moving components of the configuration shown in FIG. 68 can be modified for a rotary motion. For example, the components may form a closed-loop configuration such as two coaxial concentric hollow cylinders. FIG. 69 shows an example of a rotary version of configuration of FIG. 68 in which the planar arrays (650, 652) of the moving and stationary components are wrapped symmetrically around a rotary axis parallel to the Y-axis to form respectively a moving component 660 and a stationary component 662 of a configuration for rotary motion. The annular ring arrays (660*a*, 660*b*, 660*c*, 660*d*) are, respectively, the rotary forms of the corresponding array rows (650*a*, 650*b*, 650*c*, 650*d*) in FIG. 68.

Annular array rings (660*a*, 660*b*, 660*c*, and 660*d*) are positioned preferably at equidistant manner and connected to each other with a nonmagnetic connection means to form a unitary moving component 660 having a hollow cylindrical shape. The moving component 660 is connected to a rotary shaft (not shown) having a rotational axis which is coaxial with the central axes of both moving and stationary components (660, 662). The connection means and the shaft are made from rigid non-magnetic materials.

FIGS. 70A-70D show axial cross sectional view of the cylindrical shaped components of the configuration by planes passing through the respective annular rings (660*a*, 660*b*, 660*c*, 660*d*) showing the polarity arrangement of the stationary and moving components relative to one another.

It should be noted that the selected number of annular rings in the configuration in FIG. 69 is for illustration and a more or less number of the annular rings may be used. For example, the moving component may only comprise of two annular rings (660*a* and 660*b*).

In the exemplary configurations shown in FIGS. 68 and 69, a positional change of the moving component exposes the arrays of the stationary component to a variation of magnetic field which produces a change in the strength of the magnetic field distribution of the array of the stationary component and simultaneously produces at least a partial cancellation of magnetic forces inhibiting the motion of the moving component.

It should be noted that in the configuration of FIG. 69, a reciprocating motion of the moving component 660 is also possible. For example, the stationary component 662 can be extended along the longitudinal axis of the configuration to an extension length long enough so that in which the moving component can have a reciprocating motion along the longitudinal axis of the configuration.

Alternatively, the rotary version of the of the configuration in FIG. 68 can be formed by wrapping the planar arrays of the moving and stationary components (650, 652) around the X-axis direction such that the X-axis direction in FIG. 68 can be a line coaxial or parallel to the central axis of the resulting hollow cylinders (not shown).

Figure 71:
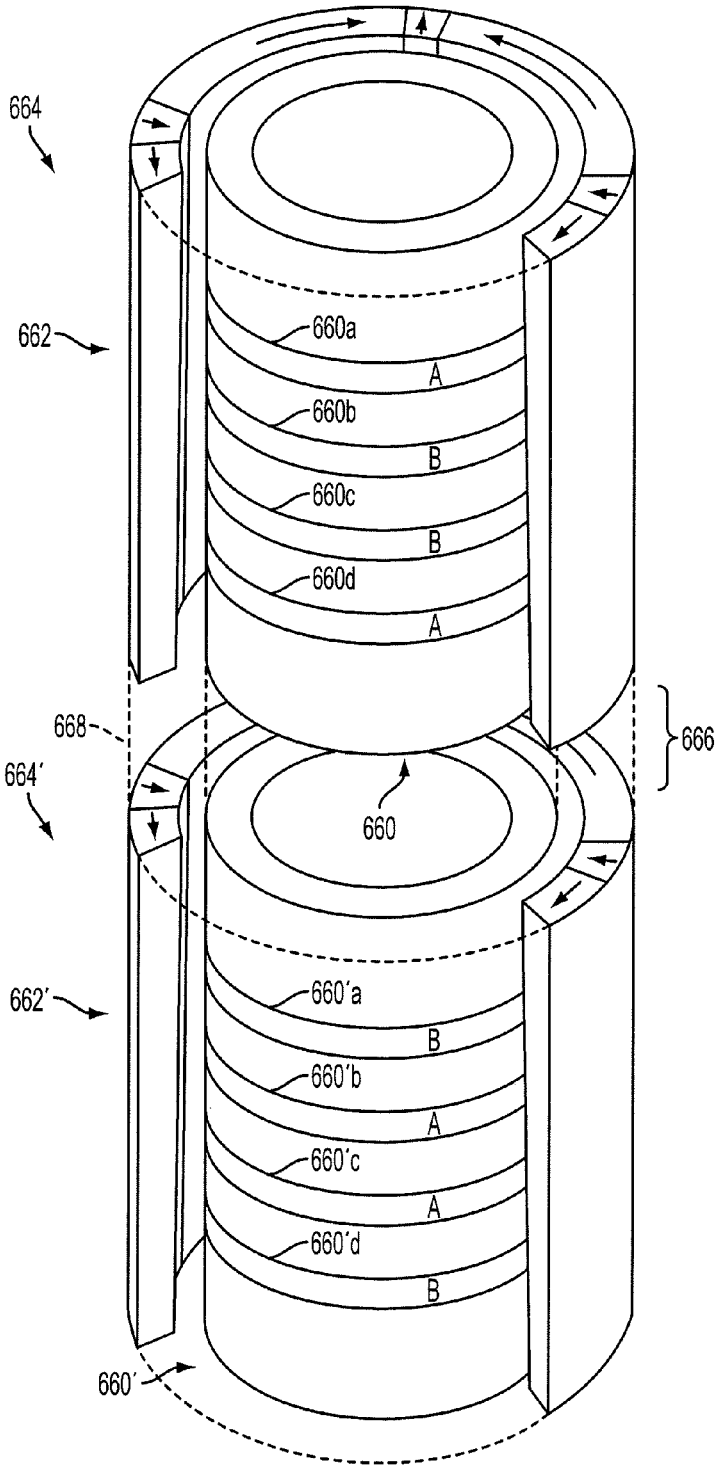
FIG. 71 shows a pair of identical configurations (each having a structure similar to the configuration of FIG. 69) according to an embodiment of the present invention.

To prevent the influence of the end-effects in the configurations of FIG. 68 or 69, the pair-wise configuration method that described earlier in the disclosure can be used. For example, FIG. 71 shows a pair of identical configurations 664 and 664' (each having a structure similar to the configuration of FIG. 69; as a result, components of the configuration of 664 are identified by the same reference numbers used in the configuration of FIG. 69) positioned spaced apart in a mirror-imaged relation relative to one another. The separation distance 666 between two configurations 664 and 664' is a distance large enough to minimize or preferably prevent the magnetic interaction between two configurations 664 and 664'.

The moving component 660 of the configuration 664 includes four annular ring arrays (660*a*, 660*b*, 660*c*, and 660*d*) each with a polarity pattern that is shown in FIGS. 70A-70D.

Figure 70A:
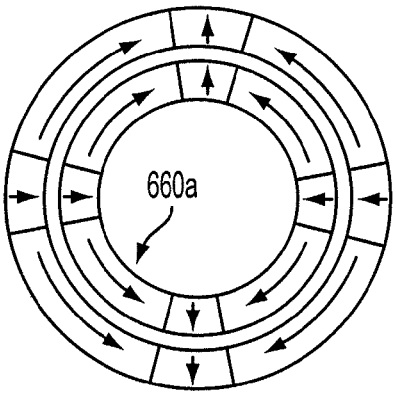
FIGS. 70A-70D show axial cross sectional view of the ring shaped polar areas of the configuration of FIG. 69 according to an embodiment of the present invention.
Figure 70B:
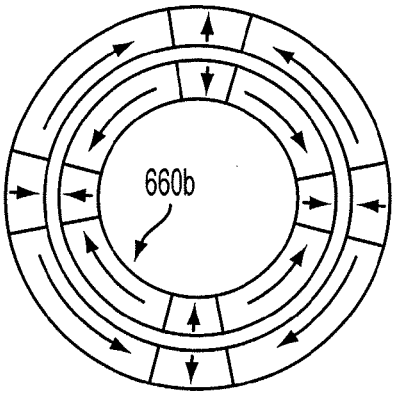
Figure 70C:
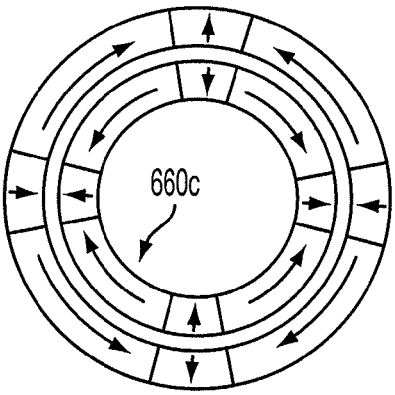
Figure 70D:
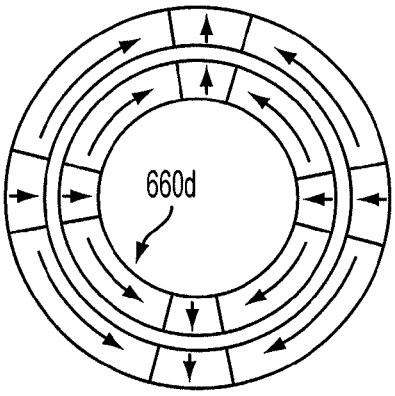

As can be seen in FIGS. 70A-70B all the annular rings (660*a*, 660*b*, 660*c*, 660*d*) have two polarity pattern types which are reverse of one another and are represented by the patterns shown in FIGS. 70A and 70B. In FIG. 71 the polarity types of each annular array is indicated by "A" or "B" that corresponds to the polarity patterns shown in FIGS. 70A and 70B, respectively.

The moving component 660' of the configuration 664' includes four annular ring arrays (660'*a*, 660'*b*, 660'*c*, 660'*d*) which are the corresponding mirror-image of the ring arrays (660*a*, 660*b*, 660*c*, 660*d*), respectively. As can be seen in FIG. 71, the polarity types of each two corresponding mirror-imaged rings (660*a*, 660'*a*; 660*b*, 660'*b*; 660*c*, 660'*c*; 660*d*, 660'*d*) in the configurations of 664 and 664' are reversed relative to one another. In other words, each two corresponding magnetic elements of the mirror-imaged rings have an anti-parallel magnetic orientation relation relative to one another. The relation between the two structures 664 and 664' defines a translational symmetry relation (which will be explained later in the disclosure). The moving components (660, 660') of the pair-wise configurations (664, 664') are connected to one another by rigid non-magnetic materials 668 to form a unitary moving component providing a simultaneous uniform motion for the entire pair-wise configurations.

In a similar manner, the above pair-wise method for the elimination of end-effects can be applied to other configurations. In general, the method involves positioning of a pair of configurations spaced apart in a mirror-image relation such that each corresponding mirror-imaged array/magnetic elements of the moving components can have an anti-parallel magnetic orientation relation. The separation distance between two mirror-imaged configurations can be any desired distance that minimizes or preferably eliminates the magnetic interaction influence of two configurations relative to one another.

In the configurations described thus far, positional change of the moving components generally comprises of a linear or rotary type of motion. However, the positional change of the moving components may comprise any other suitable motion for which some non-limiting examples are provided herein.

As a first example, positional change can be an oscillatory type motion. In the oscillatory motion the moving component can move bi-directionally along a constrained motion path. Preferably, in an oscillatory motion configuration, the extension of the stationary component may be limited to the constrained motion path and other portions of the magnetic elements or arrays of the stationary component (which are not involved in the magnetic interaction in the path of the moving component) can be removed.

As a second example, the positional change of the moving component can be extended to other types of motion such as a rolling-like motion in which for example the moving component may roll over a surface comprising the stationary component (not shown).

Figure 72:
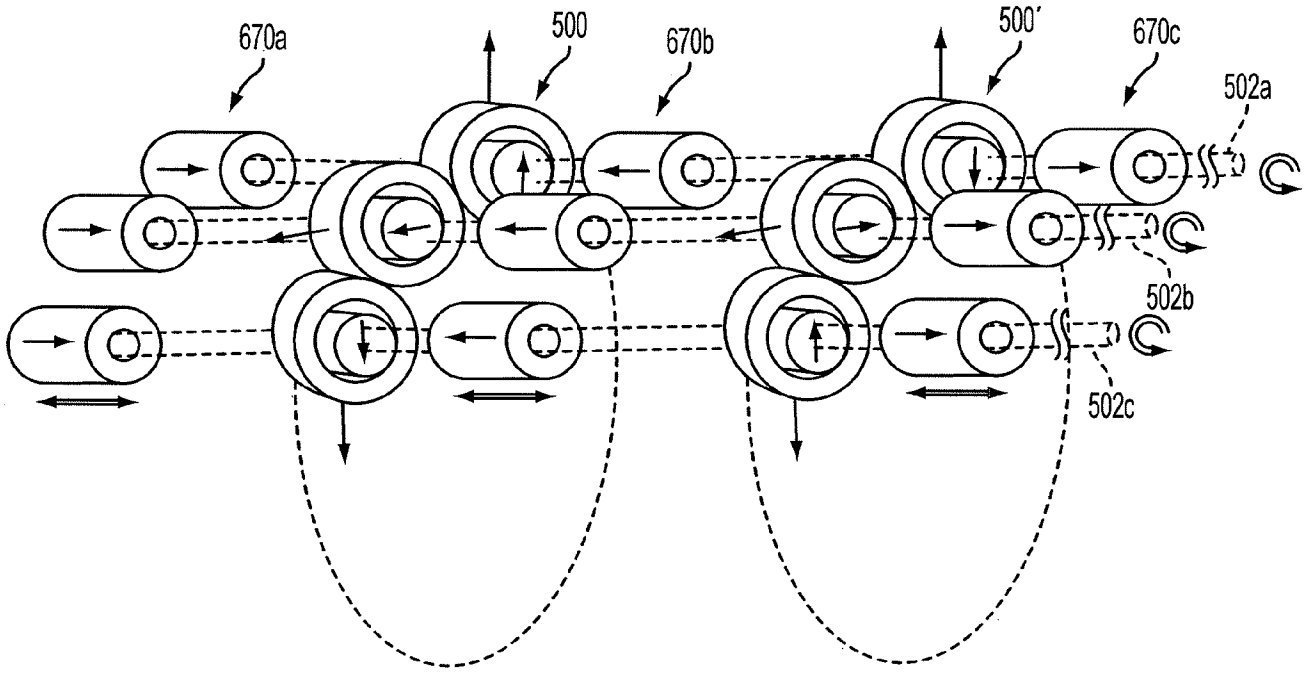
FIG. 72 shows a configuration which is a combination of the configuration of FIG. 50 and a reciprocating cylindrical structure for a simultaneous reciprocating and spinning motions according to an embodiment of the present invention.

As a third example, the positional change can be a combination of different types of motions, such as a linear and a rotary type of motions. As a more specific example, the moving component of a reciprocating configuration (such as configuration of FIG. 7) can be modified and combined with the structure of a closed-loop configuration (such as the dipole configuration of FIG. 50) to assemble a configuration for a dual reciprocating and spinning motions. FIG. 72 shows a configuration which is a combination of the configuration of FIG. 50 (the same reference numbers of FIG. 50 are used in the configuration of FIG. 72) and a reciprocating cylindrical structure (which is configured similar to the moving component of the configuration of FIG. 7) for a simultaneous reciprocating and spinning motions.

The reciprocating cylindrical structure comprises of 24 identical hollow magnetic cylinders which are axially magnetized. The inner diameter of the hollow cylinders is selected such that each identical connection means (502*a*, 502*b*, 502*c*, . . . ) can be positioned coaxially within each hollow magnetic cylinder such that allowing both a reciprocating motion of the cylinder and also a spinning motion of the associated disks. The magnetic cylinders form three sets (sets: 670*a*, 670*b*, 670*c*; each set comprises of eight magnetic cylinders) of identical hollow magnetic cylinders positioned relative to the stationary dipole structures 500 and 500' in a similar spatial manner of the moving magnetic cylinders and the stationary component of FIG. 7. The magnetic cylinders are connected to each other through rigid non-magnetic connection means (not shown) allowing a unitary reciprocating motion of the magnetic cylinders relative to the stationary dipoles 500 and 500'. Alternatively, in the configuration of FIG. 72, a less number of cylinder sets can be used such as only sets 670*b* and 670*c*.

By a combination of synchronized reciprocating and spinning motions in a controllable manner, it is possible to produce a magnetic field strength (in the dipoles 500 and 500') that can be changed from a minimum to a maximum magnitude. In other words, the magnetic field strength within each dipole (500 and 500') can be changed substantially from an "ON" to an "OFF" condition.

Figure 73:
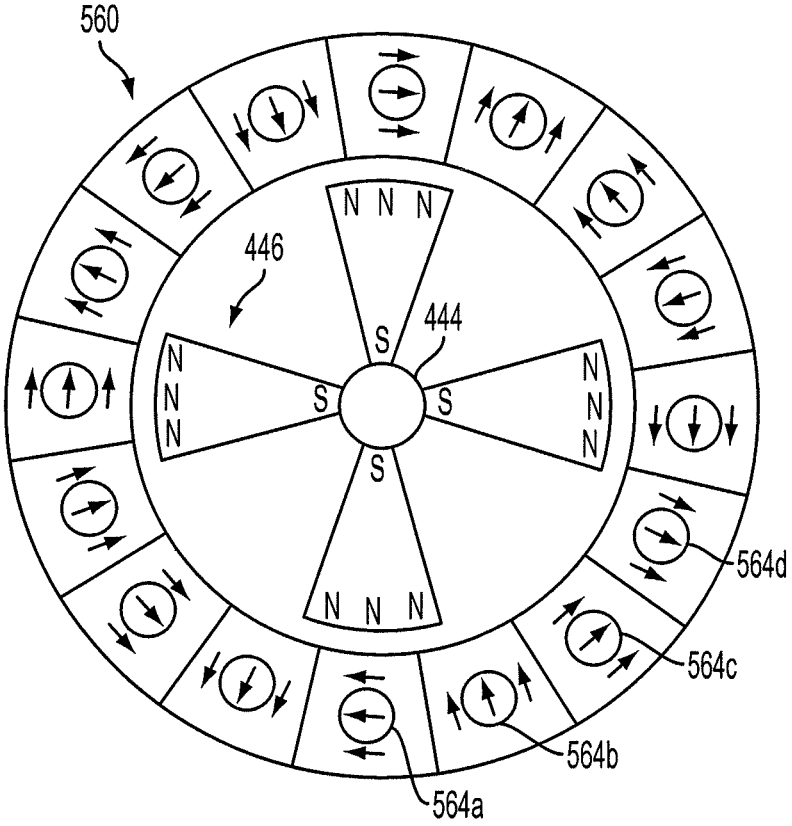
FIGS. 73 and 74 show axial cross sections of arrays of a pair wise configuration for a simultaneous rotary and spin motions according to an embodiment of the present invention.
Figure 74:
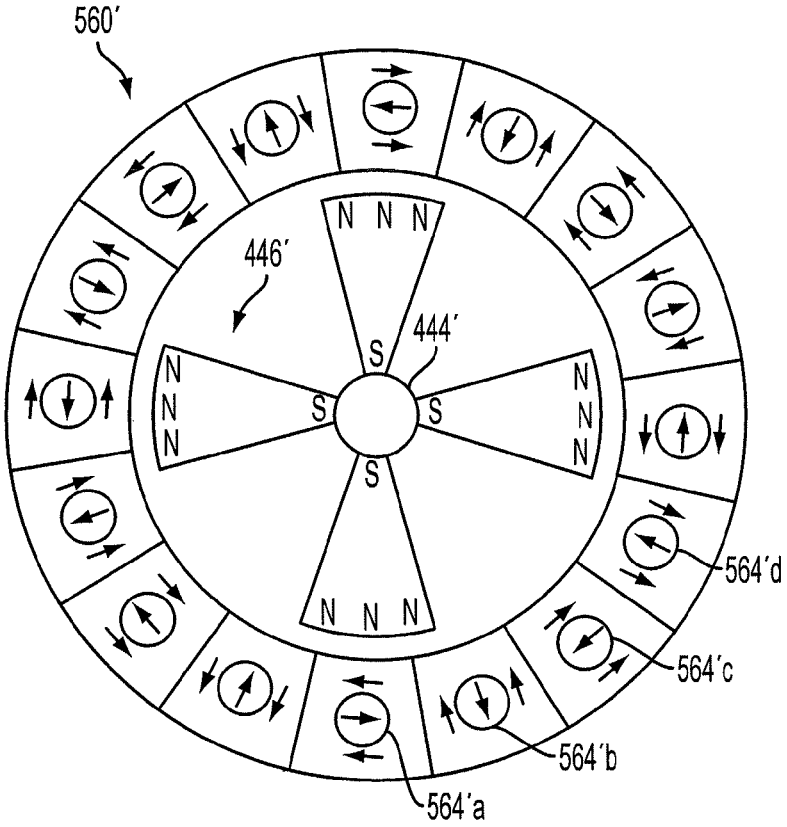

As another non-limiting example of a configuration with a combined motion, in the configuration of FIG. 62 one may include a rotary structure (similar to the rotary component 446 in FIG. 38) in each array 560 and 560' to have a configuration capable of a dual rotary and spinning motion. FIGS. 73 and 74 are axial cross sections of the arrays 560 and 560' showing that arrays 560 and 560' having a rotary structure 446 and 446', respectively. The rotary structures 446 and 446' are identical and positioned in a mirror image relation relative to one another. The spatial relation of each rotary structure (446 or 446') relative to the respective array (560 or 560') is similar to the spatial arrangement between the rotary component 446 and the stationery component 440 in the configuration of FIG. 38. As can be seen in FIGS. 73 and 74, rotary structure 446 and 446' attached to rotary shafts 444 and 444', respectively. The rotary shafts 444 and 444' are rotatably connected to one another (not shown) to form a unitary rotary component capable of providing a rotary motion of the rotary structures (446 and 446') within the tubular shells of both arrays 560 and 560'.

The rotary motion of the unitary rotary component and the spinning motion of the magnetic cylinder rods (within the radial width of the tubular shell of arrays 560 and 560') can be synchronized such that the rotary and spinning components can simultaneously interact with the polar area of the arrays 560 and 560' such that simultaneously increase or decrease the strength of the magnetic field of a given polar area of the arrays in a manner that the field strength of the given polar area can change periodically from a minimum to a maximum magnitude.

As another non-limiting example of a combined motion, in the configuration of FIG. 69, the stationary component 662 can be extended along the longitudinal axis of the configuration to an extension length long enough for a combined rotary and reciprocating motion. In the longitudinally extended configuration (not shown), the moving component 660 can have simultaneously a combined rotary and reciprocating motion such that (in a combined reciprocating-rotary motion) a given magnetic element of the moving component 660 can have a helix-like path of motion.

A similar combined reciprocating-rotary motion is also possible for other configurations such as for example the configurations of FIGS. 23 through 25 in which the moving component may have a combined rotary and reciprocating motion. As another example, in the configuration of FIG. 38 the stationary component 440 can be extended along the longitudinal axis of the configuration to an extension length long enough for a combined reciprocating-rotary motion. In this longitudinally extended stationary component (not shown), depending on the application purpose, any moving components similar to 446 in FIG. 38 or similar to the moving components shown in FIGS. 40A-B, 41A-B or any modification or combinations of these moving components can be used. However, a preferable structure of the moving component may comprise a magnetic structure comprising the magnetic blocks such as 453*a* or 453*b* shown in FIG. 41A.

In contrast to configurations which may use a combination of different types of motions, there are other configurations in which the components may not have any motion (in other words, the components have a static relation relative to one another such that the velocity of the motion of one component relative to the other component can be substantially zero). For example, these configurations may be assembled only for producing a stronger magnetic field. These configurations may be comprised of a primary and secondary component (similar to any exemplary configurations described in the disclosure) in which both components have a stationary relation relative to one another. The components of these configurations can be assembled preferably in an abutting manner or with a minimum possible gap between components to enhance the strength of magnetic field of the configuration.

In general, depending on the application, the relation between a primary and secondary components of a magnetic configuration relative to each other can be static (i.e., stationary or motionless) or dynamic (i.e., having a motion in which the velocity of the motion can be any predetermined value based on the application need). In other words, in a field system the velocity of the relative movement of one component relative to the other component can range from substantially zero to a predetermined value. In a dynamic magnetic relation, configuration comprises a moving component which may have a motion that can be linear or non-linear. Furthermore, the motion can be gradual, incremental, or continuous. If the type of application is to control or adjust the strength of the magnetic field, then a gradual or incremental motion can be used. If application is based on a continuous variation of the magnetic field strength then a continuous motion can be used. In general, the magnitude of the velocity of the relative movement can have a wide range of a substantially zero value (i.e., two components being motionless relative to one another, that is, having a static relation relative to one another) to any desirable value based on the application need.

It should be noted that in general any magnetic element or structure can be converted to a configuration which can comprise a stationary and moving component and can have a magnetic behavior similar as that of the configurations described thus far (i.e. change of magnetic field with minimum energy input). In the following, first conversion of a simple one piece magnetic structure, that can be a magnetic element or array, will be described; then the conversion of magnetic structures having two separate parts (a stationary and a moving part) will be presented.

Figure 75A:
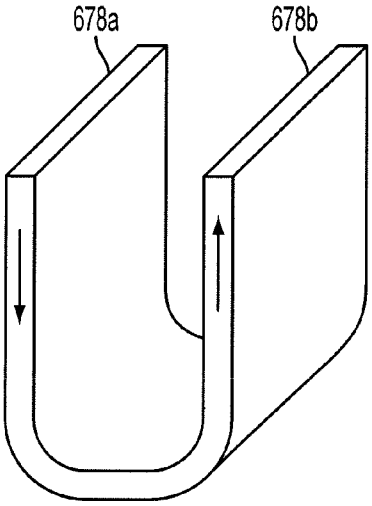
FIG. 75A shows a horseshoe magnet which includes a pair of flat arms according to an embodiment of the present invention.
Figure 75B:
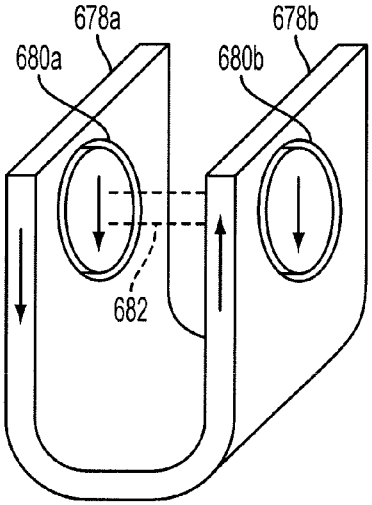
FIG. 75B shows a converted form of the horseshoe magnet in which a pair of identical disk-shaped portions is cut in the flat arms according to an embodiment of the present invention.

As a starting point, and as a non-limiting example, conversion of a horseshoe-like magnet will be considered. For example, FIG. 75A shows a horseshoe magnet which includes a pair of flat arms (678*a*, 678*b*) which are spaced apart in a parallel manner and have equal magnetic strength at poles. FIG. 75B shows a converted form of the horseshoe magnet in which, using an imaginary cutting device, a pair of identical disk-shaped portions (680*a*, 680*b*) are cut in the flat arms (678*a*, 678*b*). Each disk and its respected cavity (resulting from the cut) are located in the close vicinity of the polar ends of the horseshoe such that the pair of disks or the respective cavities on both flat arms having a common central axis and being aligned and mirror image relative to one another. The disks are separated from the remaining portion of the respective flat arms of horseshoe by a uniform annular gap allowing a positional change of each disk within its respective cavity. One of the disk (680*b*) is rotated 180 degrees about the common central axis within its respective cavity such that the disk 680*b* and polar end of the flat arm 678*b* having a reversed magnetic orientation relative to one another. The two disks can be connected to one another by a non-magnetic connection means 682 such that producing a unitary disk structure capable of a spinning motion about the common central axis of, and within the respective cavities of, the cuts. The location and the size of the disks are selected such that the spin of the disks can create a magnetic field change in the polar ends of the horseshoe magnet.

In a magnetic behavior manner which is similar to that of the configuration of FIG. 47, the spinning motion of the disks creates a periodically changing magnetic field at the polar ends of the horseshoe magnet while requiring a minimum energy for the spinning motion. In the above example, the remainder of the magnet (after the cuts are made) and unitary disk structure can be considered the stationary and moving components of the converted configuration, respectively.

In the above example, the major steps of conversion includes cutting a pair of identical shaped portions of the magnetic structure and reversing the magnetic orientation of one of the cut portions relative to the other. Before proceeding to other non-limiting conversion examples, some general statements can be made which apply to all of the conversion examples. One may cut at least a pair, or any number of pairs, of cut portions in corresponding identical structural areas of a magnetic structure. The cuts can be along any direction of the structure, however preferably the direction can be parallel to, or more preferably on and along of, at least one axis-wise geometrical directions of the structure, such as a length-wise, width-wise, depth-wise, or any combinations of these directions. The pairs of cuts may have various shapes and/or cut depths. In other words, each pair of cuts may have identical shapes and cut depths which can be different or the same as that of other pairs. For example, each pair of cuts may extend along the entire or at least a part of any of the axis-wise directions mentioned in the above.

In general, the shapes, sizes, depths, and location of the cuts can be selected such that an identical positional change of the cut portions within the respective cavities of the cuts can produce a change in the strength of at least a part of the magnetic field distribution of the stationary magnetic structure (which is the remaining part of the original magnetic structure after the cuts are made). All of the cuts are made such that producing a uniform gap between the cut portion and immediate region of the magnetic structure surrounding the cut, the gap is preferably small enough such that allowing a positional change of the cut portion relative to the magnetic structure. In general, a cut portion and the remaining magnetic element (which has a void region resulting from the cut) having a complimentary shape relation relative to one another. In a preferable complimentary shape relation, the cut portion and the respective void region can have a common central axis in which the cut portion may have a motion which can be respectively a reciprocating or rotary motion, along or about the common central axis.

Each pair of identical cut portions (after reversal of the magnetic orientation of the cuts relative to one another) can be connected to one another through a rigid non-magnetic connection means. All the cut portions may be extended beyond the outer surface of the original magnetic structure using preferably identical rigid non-magnetic means. These non-magnetic extensions can be used for a suitable positional change (such as a spin or a translation motion) of the cut portions. Alternatively, each or at least one pair of the cut portions can be replaced with other structurally similar or identical magnetic portions having a different magnetic property, such as for example having more or less magnetic strength than the original cut portions.

In some of the following figures of the exemplary configurations, for clarity of the illustration, the non-magnetic extensions, or connection means, or sometimes the rotatable shaft means are not shown. In general, all the converted configurations can have a magnetic behavior similar to that of the other configuration described in the disclosure (i.e. a change in the strength of at least a portion of the magnetic field of the configuration requiring minimum energy input).

Figure 76A:
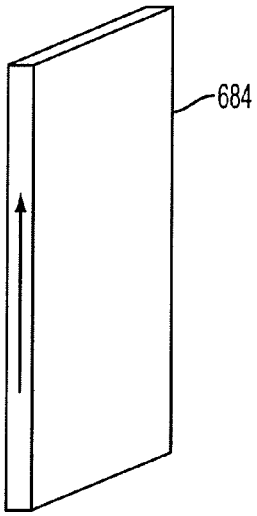
FIG. 76A shows an example of a rectangular magnetic block having a length, width and thickness according to an embodiment of the present invention.
Figure 76B:
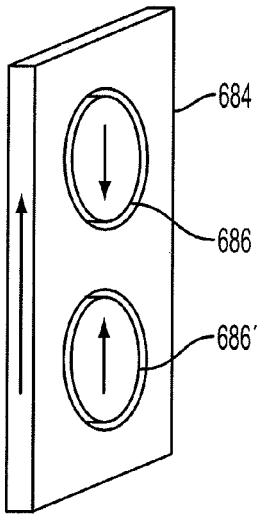
FIG. 76B shows the rectangular magnetic block of FIG. 76A after a conversion according to an embodiment of the present invention.

The above conversion method can be extended to various other magnetic elements. FIG. 76A shows a non-limiting example of a rectangular magnetic block 684, having a length, width and thickness. The block is magnetized in the length direction. FIG. 76B shows the rectangular magnetic block after the conversion. As can be seen the cuts include a pair of disk shaped cut portions (686, 686') which are cut all the way through the thickness of the block in the identical vicinity of the polar areas of the block. The size and the location of the disks can be such that a synchronized spinning of the disks (686, 686') about a common central axis of each disk and its respective cavity can create a magnetic field change at the polar ends of the rectangular magnet. In general, location, shape, size, depth, and number of identical cut portions in a magnetic element such as the above rectangular magnet can be selected such that a synchronized spinning of the disks can create a magnetic field change at the polar ends of the rectangular magnet while requiring minimum energy input.

Figure 77A:
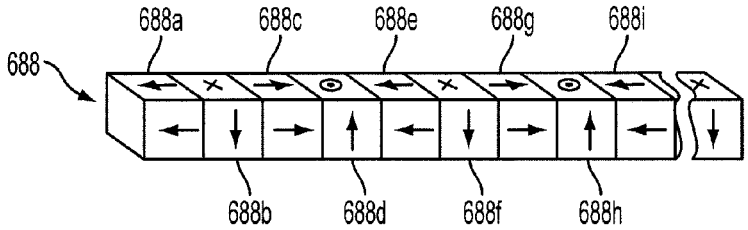
FIGS. 77A-D are perspective views of a linear Halbach array showing examples of a pair of cut portions in the array according to an embodiment of the present invention
Figure 77B:
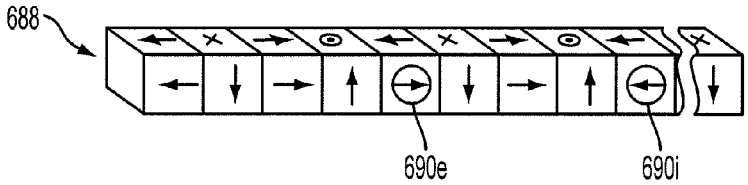
Figure 77C:
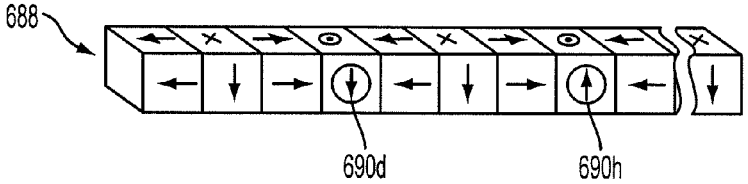
Figure 77D:
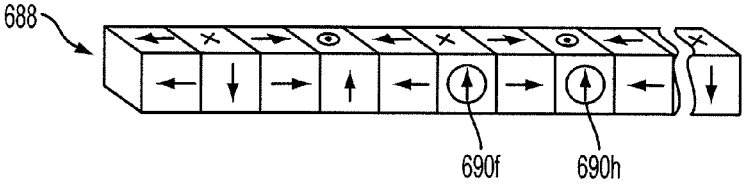

In a similar manner, the above conversion method can be extended to magnetic structures such as for example Halbach-type structures. As non-limiting examples, in the following the conversion of simple structures of a linear and a closed-loop Halbach array will be described. FIGS. 77A-D are perspective views of a linear Halbach array 688, which show some non-limiting examples of a pair of cut portions and the polarity relation between the cut portions relative to one another. In general, it is preferable that the cut portions can be cut in a direction perpendicular the magnetization direction of the magnetic elements of the array. Further, it is also preferable that the pair of cut portions being cut such that the cuts (or the resulting voids) having a symmetrical relation relative to the remaining portion of the magnetic element through which the cuts are made. As can be seen in FIGS. 77B-D, the pair of the cut portions (690*e*, 690*i*; 690*d*, 690*h*; 690*f*, 690*h*) are identical, having cylindrical shapes, positioned within the void region of the cuts, and having a complimentary shape relation relative to the respective magnetic elements (688*e*, 688*i*; 688*d*, 688*h*; 688*f*, 688*h*) through which the cut are made. As can be seen in FIGS. 77B-C when two magnetic elements (688*e*, 688*i*; 688*d*, 688*h*) through which the cuts are made, having the same magnetization direction relative to one another, then the polarities of their cut portions (690*e*, 690*i*; 690*d*, 690*h*) oriented in a reverse direction relative to one another. In contrast, as can be seen in FIG. 77D, when the magnetization directions of the two magnetic elements (688*f*, 688*h*), through which the cuts are made, are in a reverse direction relative to one another, then the polarities of their cut portions (690*f*, 690*h*) are in the same direction relative to one another. In short, either the magnetic elements (in which the cuts are made) or the cut portions should have a reverse magnetic relation relative to one another.

In general, a linear Halbach array can include multiple pairs of the cut portions which can be a combination of cut portions similar to those shown in FIGS. 77B-D. The cut portions can be attached to a rigid non-magnetic connection means (not shown) for a spin motion of the cut portions within the respective cut voids. A simultaneous spin motion of the cut portions, within the respective cut voids, can produce a change in the magnetic field of the array (at the polar areas in the vicinity of the cut portions) while requiring minimum energy input.

Figure 78A:
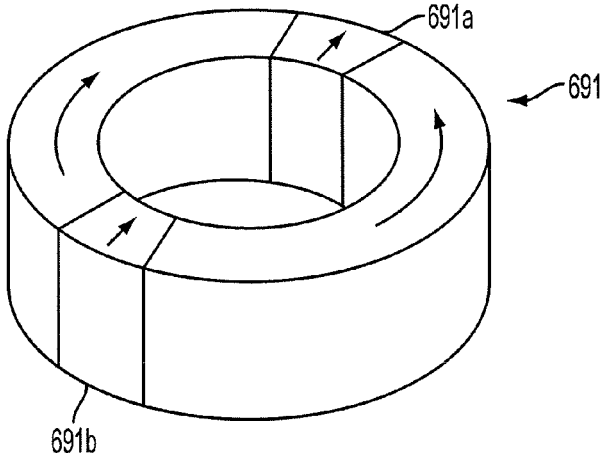
FIG. 78A is a perspective view of a dipolar magnetic cylinder structure according to an embodiment of the present invention.
Figure 78B:
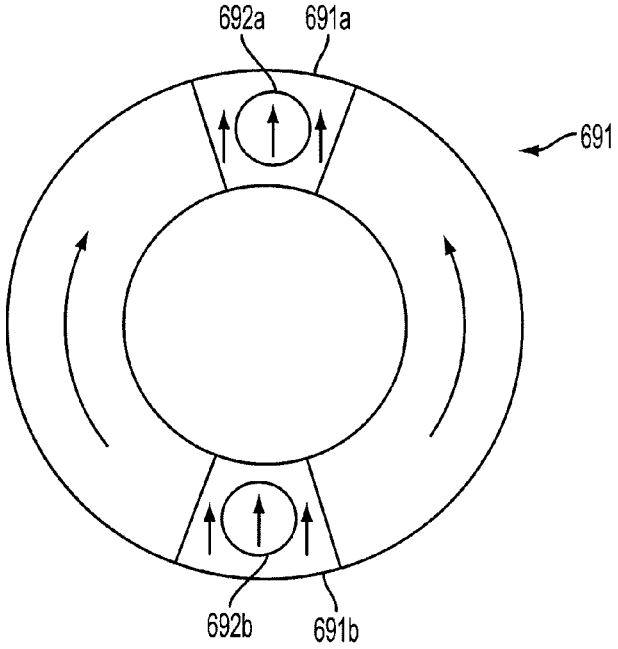
FIG. 78B shows axial cross sections of the dipolar magnetic structure of FIG. 78A after a conversion according to an embodiment of the present invention.

FIG. 78A is a perspective view of a dipolar magnetic cylinder structure 691, and FIG. 78B shows axial cross sections of the magnetic structure after the conversion. The magnetic dipolar structure 691 is a hollow cylindrical shell having a Halbach-type of magnetic field pattern in the radial direction. The shell 691 includes two elongated parallel poles 691*a* and 691*b*. The cut portions include two identical elongated rods (692*a*, 692*b*) located at two identical polar areas of the poles (691*a*, 691*b*) of the shell structure. The direction of and the depth of the cuts are respectively parallel to, and at the entire length of, the longitudinal extension of the elongated parallel poles (691*a*, 691*b*). The rods (692*a*, 692*b*) are positioned within the respective cut cavities such that having a reverse magnetic orientation relative to one another. A simultaneous spin motion of the rods can produce a change in at least one portion of the magnetic field distribution of the dipolar structure while requiring minimum energy input.

Figure 79A:
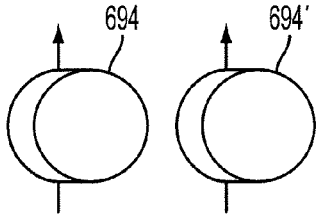
FIG. 79A shows a pair of diametrically magnetized disks having a parallel and identical direction of magnetic orientation according to an embodiment of the present invention.
Figure 79B:
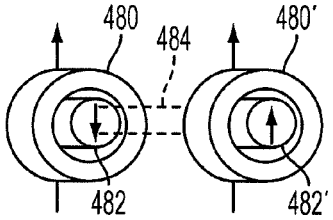
FIG. 79B shows a converted form of the disks of FIG. 79A according to an embodiment of the present invention.

In a similar manner, the above conversion method can be extended to a pair of any identical magnetic elements or structures. The conversion method is similar to the pair-wise magnetic structure described earlier in the disclosure. For example FIG. 79A shows a pair of diametrically magnetized disks (694, 694') having a parallel and identical direction of magnetic orientation. The disks having an identical predetermined thickness which is substantially less than the diameter of the disks. The disks (694, 694') are positioned in an aligned face to face relation (at a separation distance in which the disks have minimum, or preferably no, magnetic interaction) relative to one another. FIG. 79B shows a converted form of the disks which is similar to the configuration of FIG. 47 (therefore, the same reference numbers of FIG. 47 are used in FIG. 79B).

Conversion method includes: cutting two smaller disks (482, 482') at identical central areas of the larger disks (694, 694'), positioning the smaller disks such that having a reverse magnetic orientation relative to one another, and connecting the smaller disks by a rigid non-magnetic means 484. The conversion produces a magnetic configuration which is similar to (and has a similar magnetic behavior as that of) the configuration of FIG. 47. As can be seen the remainder of the larger disks (after cutting of the smaller disks) forming a pair of rings 480 and 480'. It should be noted that in the converted configuration, the reversal of the magnetic orientation is such that either the magnetic element of the stationery component (rings 480 and 480') or the magnetic element of the moving component (smaller disks 482 and 482') having a reversed magnetic orientation relative to one another.

In general, in any structure of a pair-wise configuration, the magnetic orientation of the corresponding magnetic elements of either the stationary or moving components is reversed relative to one another such that the corresponding magnetic elements of either the stationary component (which in the above example are identical rings 480 and 480') or the moving component (which in the above example are identical smaller disks 482 and 482') can have a reverse magnetic orientation relative to one another. In other words, in a pair-wise configuration, corresponding magnetic elements in one component having a magnetic orientation relationship which is opposite relative to the same relationship in the other component.

In general, the pair-wise conversion method can be extended to any Halbach-like or a non-Halbach-like magnetic structures. For brevity, in the following some simplified Halbach-like structures are presented. The non-limiting examples of the simplified Halbach-like structures include linear, planar, and closed-loop type of structures.

FIGS. 58 and 59A (described earlier in the disclosure) are non-limiting examples of a pair-wise magnetic structures in a linear array extension. It should be noted that any pair of cut portions can have any shapes including cuts having irregular geometrical cross section; in that case the motion of the moving component can be a translational type such as a reciprocating motion.

Figure 80:
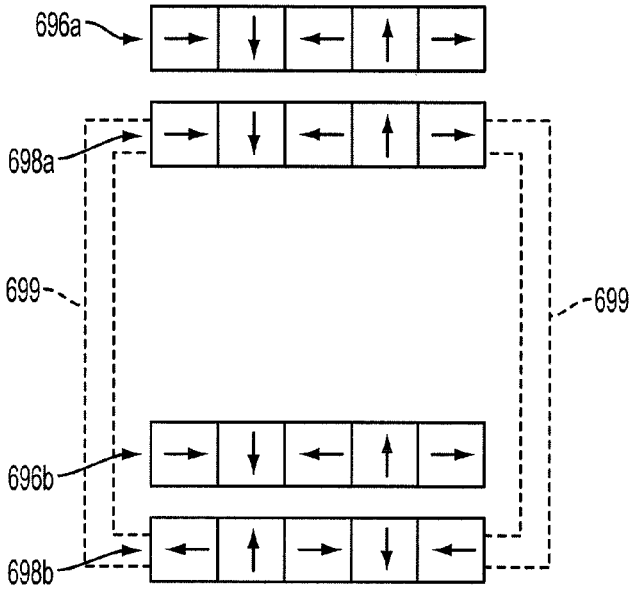
FIG. 80 provides an example of cutting through the entire thickness of a planar array according to an embodiment of the present invention.

In a pair-wise conversion of a planar magnetic structure, pairs of cuts can be in the identical areas of the thickness of the planar array in any desirable directions (which can be preferably an axis-wise direction of the structure as shown in FIGS. 58 and 59A) and/or through the entire thickness of the planar structure such that producing a pair of two oppositely facing parallel planar surfaces. FIG. 80 provides an example of cutting through the entire thickness of a planar array. Stationary component comprises of a pair of identical planar structures 696*a* and 696*b*. The identical magnetic pattern of each planar structures of the stationary component is similar to that of the planar structure 350 shown in FIG. 19; however, the planar structure can have other magnetic patterns for magnetic field production including various Halbach-like planar field patterns such as for example a checkerboard-like magnetic pattern. The moving component comprises of a pair of identical planar structures 698*a*, 698*b* which have a reverse magnetic relation relative to one another.

In the converted configuration of FIG. 80, the moving component can have a motion parallel to and at a magnetic interaction vicinity of the stationary component. Alternatively the motion of the moving component can be in a direction perpendicular to the plane of the stationary component such that the moving component can have a reciprocating type of motion toward and away from the stationary component.

In the configuration of FIG. 80 based on the application needs, the conversion may also include at least one or more pairs of cut portions within the planar thickness of the stationary component (for example in a similar fashion shown in FIG. 57 or 58 for a spinning motion of the cut portions). In that case, the positional change of the moving component preferably can be reciprocating motion toward and away relative to the stationary component. In the resulting configuration (not shown) one may synchronize the reciprocating motion of the moving component and the spinning motions of the cut portions such that to produce a substantially "ON" and "OFF" change in the magnetic field distribution in at least a region of the planar magnetic surfaces of the stationary component.

In a similar manner one may convert any closed-loop magnetic shell structure to a configuration for changing magnetic field requiring minimum input energy. The closed-loop shell structure can be any types of magnetic hollow structure of any geometrical shape such as for example cylinder-like or sphere-like hollow structures having a radial or axial magnetic field distribution. In magnetic structures having Halbach-like distribution pattern, the pattern of field distribution can range from a dipolar-like pattern (which are generally used in NMR-based applications including MRI related applications) to a vast forms of other field distributions of interest which are based on specific application needs such as for example helical-like forms of magnetic field distributions. In general, depending on the shape of the structure the cut portions can be within the shell wall thickness (for example the cut portion can be elongated cut portions at any desirable directions and/or depths) and/or at least a part of the entire layer of the shell wall. In case of a layer-like cut portion, the layer of cut portion will have a common central axis with the remaining layer of the looped structure and will be capable of a motion which depending on the geometrical shape of the shell can be a rotary or translational or a combination of these motions.

Figure 81A:
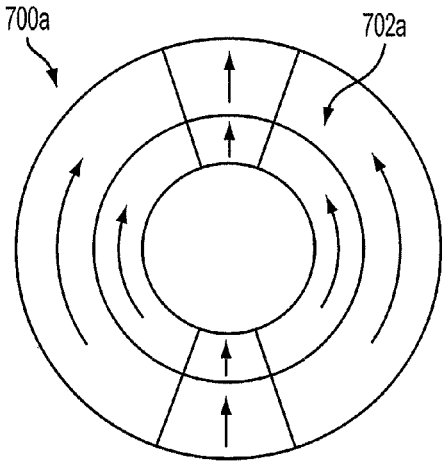
FIGS. 81A and 81B show axial cross sections of a pair of magnetic structure of a converted configuration in which each member of the pair of uncut original structure is similar to the shell structure of FIG. 78A according to an embodiment of the present invention.
Figure 81B:
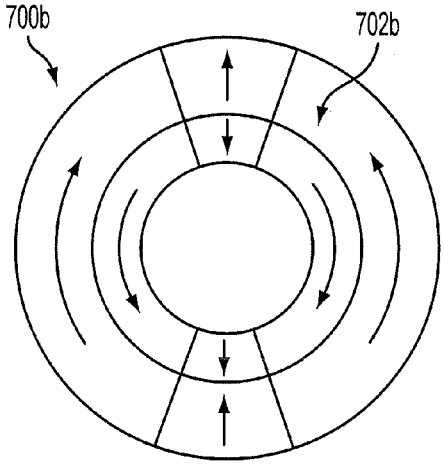

FIGS. 81A and 81B show axial cross sections of a pair of magnetic structure of a converted configuration in which each member of the pair of uncut original structure is similar to the shell structure of FIG. 78A. As can be seen, identical cutting of the pair of shells produces two coaxial outer and inner shell layers (700*a*, 702*a*; 700*b*, 702*b*) in which the outer layers (700*a*, 700*b*) can act as the stationary component; and the inner layers (702*a*, 702*b*) can be connected to each other by non-magnetic means (not shown) to act as a unitary moving component. In general, in a similar manner shown in FIGS. 81A and 81B, the layers of cuts in a radial direction can be inner, middle, or outer layers such that the moving component can be selected as the inner, middle, or outer layers, respectively.

Figure 82A:
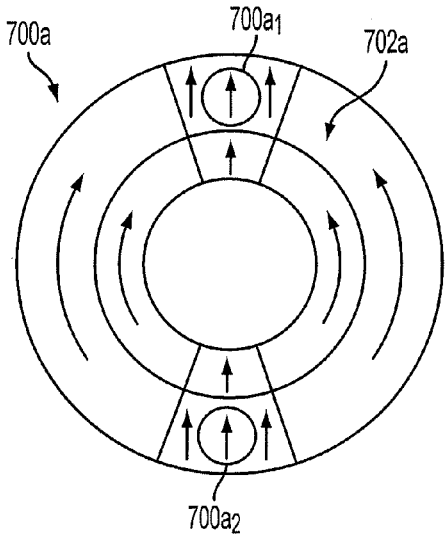
FIGS. 82A and 82B show additional cut portions which are elongated cylindrical shaped rods in the stationary component of the converted configuration of FIGS. 81A and 81B according to an embodiment of the present invention.
Figure 82B:
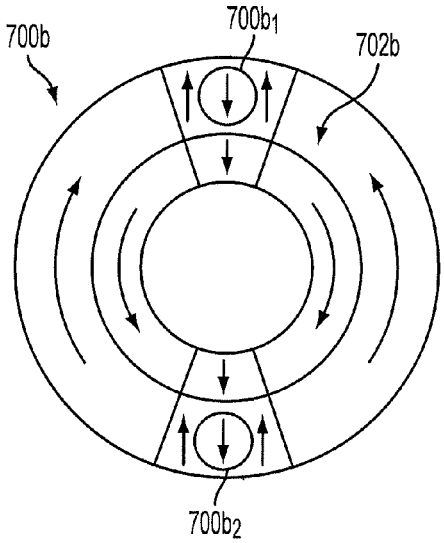

It should be noted that in a converted loop-shaped structure, the cuts may include a combination of both elongated rod-like and layer-like portions in the shell wall. For example the configuration of FIGS. 82A and 82B is the same as the configuration of FIGS. 81A and 81B, except the configuration of FIGS. 82A and 82B includes additional cut portions which are elongated cylindrical shaped rods (700*a*1, 700*a*2; 700*b*1, 700*b*2) in the stationary component of the converted configuration. By synchronizing the spinning motion of the elongated rods (700*a*1, 700*a*2; 700*b*1, 700*b*2) and the rotary motion of the shell layers (702*a*, 702*b*), one may provide a magnetic field which can be changed substantially in an "ON" and "OFF" manner.

Conversion of a pair of identical hollow shell structures each having an axial magnetic field distribution may include an identical cutting of each shell wall by a cutting plane perpendicular to the longitudinal axis line of the magnetic shell structure. The cut portions on the central axis direction of the shell can include a pair of the ends or middle parts of the shell walls.

Figure 83:
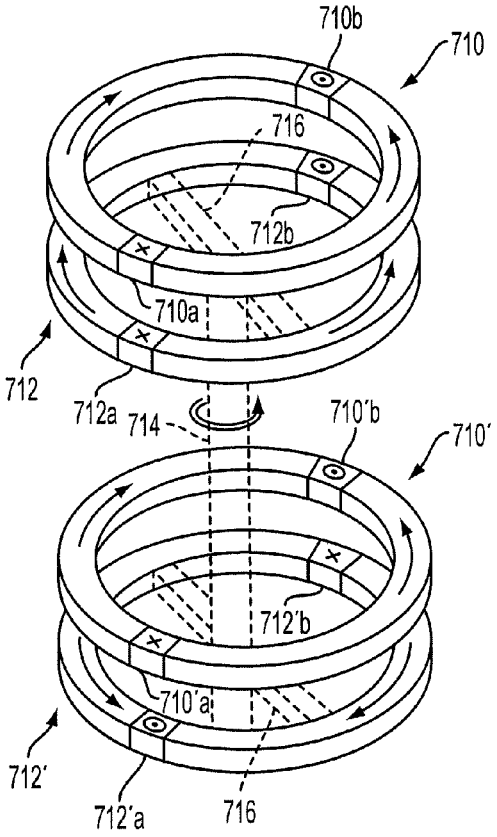
FIG. 83 shows a pair-wise converted configuration in which the stationary and moving components each comprising a pair of Halbach dipole shells according to an embodiment of the present invention.

FIG. 83 shows a pair-wise converted configuration in which the stationary and moving components each comprising a pair of Halbach dipole shells (710, 712; 710', 712'). Each shell is a hollow cylindrical Halbach array having an axial magnetic field distribution. Each dipole shell includes two poles (710*a*, 710*b*; 712*a*, 712*b*; 710'*a*, 710'*b*; 712'*a*, 712'*b*) extended parallel to the central axis of the shell. As can be seen in FIG. 83, in the moving component (712, 712'), the magnetic orientations of the corresponding magnetic elements are reversed relative to one another. The pair of moving shells 712, 712' are connected to a rotatable shaft 714 by a connection means 716 (the connection means and the shaft are preferably from rigid non-magnetic materials) forming a unitary moving component capable of a rotary motion about a common central axis of the shells, or alternatively a reciprocating motion towards and away relative to the stationary component (710, 710'). It should be noted that the selected number of poles in any magnetic shell structure in the above exemplary examples is just for illustration and other number of poles in each shell structure are possible.

Figure 84:
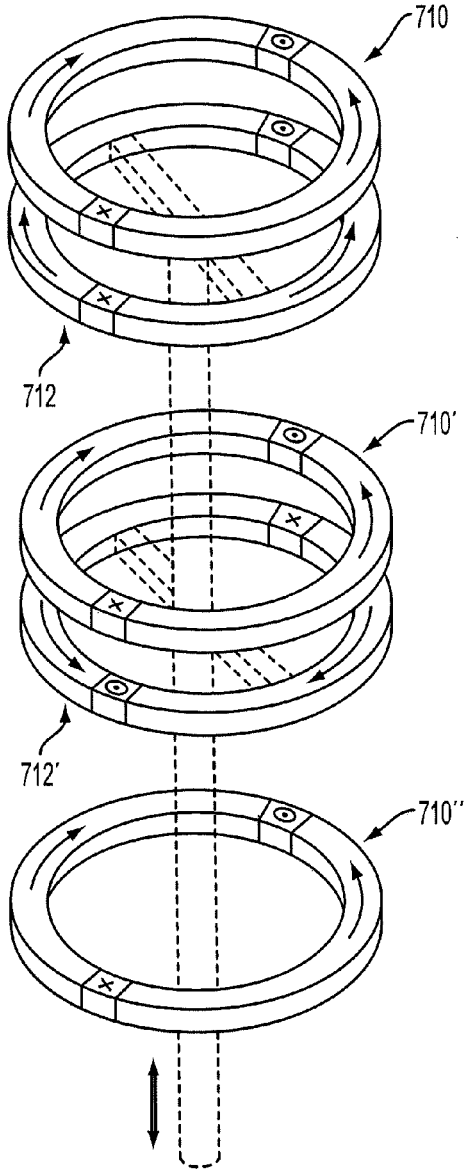
FIG. 84 shows a stationary component includes an additional stationary part according to an embodiment of the present invention.

A modification of the stationary component of the configuration of FIG. 83 can be seen in FIG. 84 in which the stationary component includes an additional stationary part 710" (which can be considered as the third cut portion that is identical and have the same polarity direction as of the cut portion 710). The stationary part 710" is placed in a coaxial relation relative to stationery parts 710 and 710' below the position of stationary part 710' at a distance equal the distance between 710 and 710'. As a result of this modification, the moving component will be capable of a reciprocating motion between the stationary parts (710, 710', 710").

It should be noted that the use of terms "cut" (or any "cut" related terms) in the above conversion examples was to facilitate the description of the conversion method of the magnetic structures such that as if the modifications were the result of a cutting action. This manner of modification which will be called hereinafter "cutting like conversion means" is an easy way for describing the conversion modifications in a configuration. However it should be noted that the necessary modifications for the conversion of a given magnetic structure can be achieved using any known means in the art in which these means are not limited by the constraints imposed by the "cutting like conversion means" described in the above. In fact, the "cutting like conversion means" is a special case of a broad pair-wise modification manner which is outlined below.

In general, any magnetic structure (or any pair of magnetic structures) can be converted to a magnetic configuration in which the strength of at least a portion of the magnetic field pattern of the configuration can be changed with a minimum energy requirement, if the following structural and magnetic relationships can be established:

Structurally, within a magnetic structure one may provide a first structural part comprising a stationary and a moving member, and then using at least one of the structural symmetry relations (which will be described next in the following) one may provide a second structural part within the magnetic structure comprising a second stationary and moving members such that the first and second structural parts can be considered a pair in which there is a correspondence respectively between the stationary and moving members of the first and second structural parts. Sometimes, the first and second structural parts can be two separated spaced apart structures forming a pair-wise magnetic structure.

The structural symmetry relations can include a translational symmetry, a bilateral symmetry, or a rotation symmetry. A simple way to describe the above symmetric relations is to consider two identical magnetic structures which are spaced apart at a distance "D" which is a distance to minimize or preferably prevent a magnetic interaction between two magnetic structures. The symmetry relation between two magnetic structures relative to one another can be: a translational symmetry relation when one of the structures can be coincident with the other structure after a linear translation (a linear positional shift) corresponding to "D"; or can be a bilateral (or mirror, or reflection) symmetry relation when two structures being mirror image of one another relative to a mirror plane which perpendicularly passing through the midpoint of "D"; or can be a rotation symmetry relation when a rotation of less than 360 degrees of one structure about an axis can coincide it to the other structure Magnetically, when there is a translational symmetry between two structures, then the corresponding members of either the moving or the stationary pair members will have a reverse polarity relation relative to one another; or when there is a bilateral symmetry (mirror symmetry) between two structures, then the corresponding moving and the stationary pair members will have a mirror image relation relative to one another. In other words in a mirror symmetry relation each corresponding member of the two structures are structurally and magnetically mirror image of one another.

When there is a rotational symmetry between two structures, then the corresponding members of either the stationary or the moving pairs will have either a reverse or a mirror image polarity relation relative to one another. In general, examples of the structural and magnetic relation of the rotational symmetry can be seen in the rotary configurations. For example, in the structure of the configuration of FIG. 44 each identical polar areas of the stationary or moving component (such as 465*a* and 465*e* or 466*a* and 466*c*) have a rotational symmetry relative to one another as each two identical polar areas can be coincident with each other after a rotation of 180 degrees relative to the central axis of the Halbach shell 465.

In general, in each of the above structural and magnetic relation, the magnetic interaction between the stationary and moving pairs produces a plurality of magnetic interaction forces such that sum of these forces and/or sum of their related torques acting upon the moving component can be substantially zero. In other words, in a preferable configuration, the arrangement of the field sources and the components relative to each other is such that there are equilibrium conditions for the interaction forces and their resulting torques.

One may use more than one structural symmetric relation in a configuration. In other words, in some configurations, it is possible that the structural parts of the components of a configuration (such as in the configuration of FIG. 51) may comprise a combination of the at least one or more of the above symmetric relations.

Generally in any of the above symmetrical relations, the pair of identical structures can be spaced apart at the distance "D" at any selected direction. However in the translational and also in the mirror symmetry relation, the pair of the structures can be preferably spaced apart such that having a common axis such as a common central axis relative to one another. FIGS. 85-90 provide some non-limiting examples of the pair of structures having a common central axis.

For example, in some embodiments a first component may include a first pair of corresponding members of at least one field source and a second component may include a second pair of corresponding members of at least one second field source. The corresponding members of the first and second pairs may be spaced apart in a symmetry relation manner at a separation distance to substantially prevent a field interaction therebetween. The symmetry relation may include at least one of: a bilateral symmetry such that the corresponding members of at least the first pair and second pair are mirror images of one another relative to a mirror plane which is perpendicularly bisecting the separation distance, a translational symmetry such that the corresponding members of at least the first pair and second pair can be coincided to one another after a linear translation equal to the separation distance, or a rotational symmetry such that the corresponding members of at least the first pair and second pair can be coincided to one another after a rotation of less than 360 degrees relative to an axis of rotation, or any combination thereof.

At least one of the first or second pairs of corresponding members may define a pair of Halbach arrays. The pair of Halbach arrays may define at least one pair of corresponding openings for a mating relation with the second pair of corresponding members. The corresponding members of the first and second pairs may respectively form a first and a second pair of Halbach arrays.

The first pair of Halbach arrays may have at least partial complementary shape relations relative to the corresponding members of the second pair. The first pair of Halbach arrays may have mating relations relative to the corresponding members of the second pair. The corresponding members in at least one of the first pair of corresponding members or the second pair of corresponding members may have a reverse polarity relation relative to one another, and the corresponding members in the other of the first pair of corresponding members or the second pair of corresponding members have an identical polarity relation relative to one another.

Figure 85:
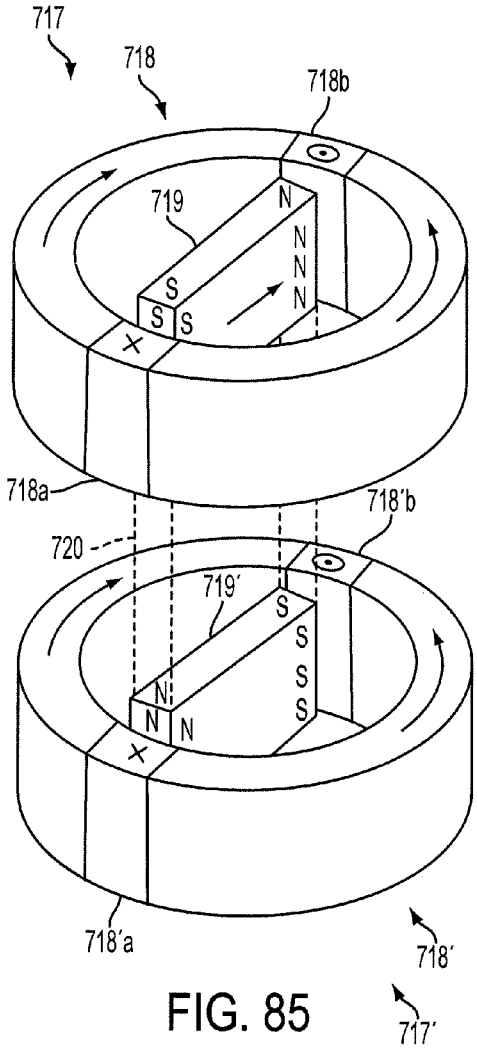
FIG. 85 shows a pair-wise configuration comprising of two identical magnetic structures having a translational symmetry relation relative to one another according to an embodiment of the present invention.

FIG. 85 shows a pair-wise configuration comprising of two identical magnetic structures (717, 717') having a translational symmetry relation relative to one another. The separation distance between the two magnetic structures is a distance which preferably prevents the magnetic interaction between the structures.

Each structure (717, 717') is comprised of a stationary (718, 718') and a moving part (719, 719') which will be described in detail later. However, it should be noted that in a translation symmetry, the size, shape, and orientation of every elements of a geometric structure is preserved because in a translation of a structure at a fixed distance every elements of the structure can be moved the same distance and in the same direction. Therefore, one may describe the pair-wise configuration of FIG. 85 as a configuration in which a pair of stationary (718, 718') and a pair of moving structural parts (719, 719') having a translational symmetry relation relative to one another. In a similar manner, this fashion of description can be applied to the pair of magnetic structures in any other symmetrical relations (such as bilateral, or rotational), as in any symmetric relation the pair of two structures have the capability of being coincident to one another. Meaning that all the corresponding members of the structure elements remain unchanged. Considering that the two structures (717, 717') in the configuration of FIG. 85 are identical, in the following one of the structures (717) will be described which can be applied equally to the other magnetic structure (717').

The stationary part of the magnetic structure 717 is a dipole shell 718 having a hollow cylindrical shape with an axial Halbach type of magnetic distribution. The dipole shell 718 includes two elongated poles (718*a*, 718*b*) extended parallel to the longitudinal axis of the shell.

The moving structure of the magnetic structure 717 is a rectangular magnetic block 719 having a height, a length, and a thickness. The magnetic block is magnetized along the length dimension such that two parallel faces perpendicular to the magnetization direction forming the pole faces of the block. Each pole face defines an opposite polarity of the magnetic block. The height and thickness of the magnetic block 719 substantially match the corresponding height and thickness sizes of the elongated poles (718*a*, 718*b*) of the shell. Each magnetic block is positioned between two elongated poles (718*a*, 718*b*) of the shell 718 such that the polar faces of the block 719 being aligned with the elongated poles (718*a*, 718*b*) of the shell 718. The length of the block is a size allowing the polar faces of the block to be equidistantly within a magnetic interaction vicinity of the elongated poles (718*a*, 718*b*) of the dipole shell 718.

As can be seen in FIG. 85 while the dipole shells (718, 718') having an identical polarity relation relative to one another, the pair of magnetic blocks having a reverse polarity relation relative to one another. The pair of magnetic blocks are connected (using a non-magnetic connection means) 720 to form a unitary moving component such that being rotationally balanced and capable of a rotary motion about the common central axis of the shells (718, 718'). A rotary motion of the unitary magnetic blocks substantially cancels the forces inhibiting the motion of the unitary moving component and simultaneously changing the magnetic strength of the polar ends of the shells. In a similar manner, the spatial arrangement of the above configuration can be extended to other multi-polar hollow shells having an axial Halbach type of magnetic distribution.

Figure 86:
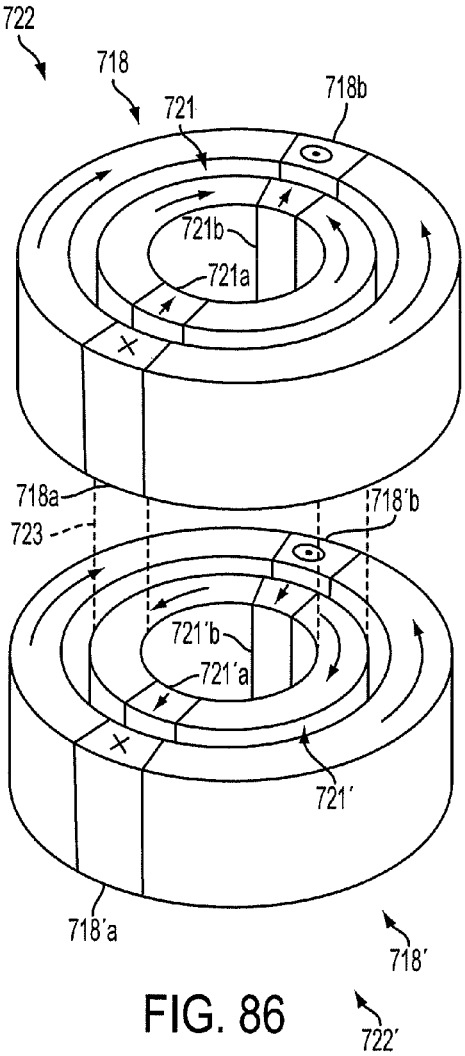
FIG. 86 shows a modification of the pair-wise configuration of FIG. 85 in which the pair of magnetic blocks is replaced with a pair of dipole shells according to an embodiment of the present invention.

FIG. 86 is a modification of the pair-wise configuration of FIG. 85 in which the pair of magnetic blocks (719, 719') are replaced with a pair of dipole shells (721, 721') to form a configuration comprising of two identical magnetic structures (722, 722') in which each structure comprises of two concentric shells. For example, the structure 722 comprises of an outer 718 and an inner, 721 dipoles. The inner dipole shells (721, 721') having a similar structure as that of the outer shells (718, 718') except having a radial magnetic distribution. In each of the magnetic structures (722, 722'), the elongated poles having a parallel and aligned relation relative to one another. For example, in the concentric shells 722, the two elongated poles (721*a*, 721*b*) of the inner dipole shell 721 extended parallel to, and aligned with, the respective elongated poles (718*a*, 718*b*) of the outer shells (718). The inner dipole shells (721, 721') are connected to one another through a rigid non-magnetic means 723 to form a unitary moving component.

It should be noted that in a pair-wise configuration in which the translational symmetry relation between a pair of structures is such that the pair of structures having a common central axis (such as the configurations of FIGS. 85-86), then generally, the strong sides of the pair of Halbach structures will be in the same axial direction relative to one another. However, when the pair of structures (which have a common central axis) having a mirror image symmetry relation relative to one another, then the strong sides of the pair of Halbach structures will be in the opposite axial direction relative to one another. The configurations shown in FIGS. 87 and 88 provide non-limiting examples.

Figure 87:
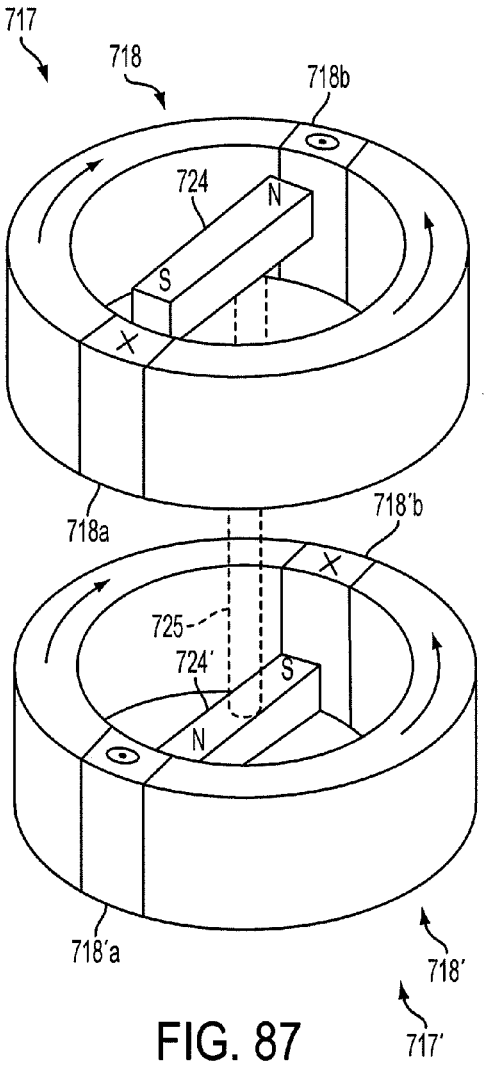
FIG. 87 shows a pair of structures having a mirror symmetry relation relative to one another according to an embodiment of the present invention.

A modification of the configuration of FIG. 85 can be seen in FIG. 87 in which the pair of structures (717, 717') having a mirror symmetry relation relative to one another. The configuration of FIG. 87 differs from the configuration shown in FIG. 85 in that the direction of the strong sides of the closed loop Halbach structures (718, 718') are at the opposite axial direction (i.e., on the uppermost and lowermost of the longitudinal dimension of the pair-wise configuration of FIG. 87) relative to one another. Generally, in a pair-wise configuration, it is preferable that the magnetic pair members of the moving component being positioned in the vicinity of the strong sides of the closed loop Halbach structures. As a result, although the pair of magnetic blocks (724, 724') in the pair-wise configuration of FIG. 87 can be identical to that of the blocks (719, 719') in the FIG. 85, however preferably, the magnetic blocks (724, 724') can be sized and positioned such that to have magnetic interaction with the uppermost and lowermost of the pair-wise configuration (i.e., at the vicinity of the strong sides of the closed loop Halbach structures) of FIG. 87. In a similar manner of the configuration of FIG. 85, the pair of magnetic blocks (724, 724') is connected to one another by a non-magnetic means 725 to form a unitary moving component.

Figure 88:
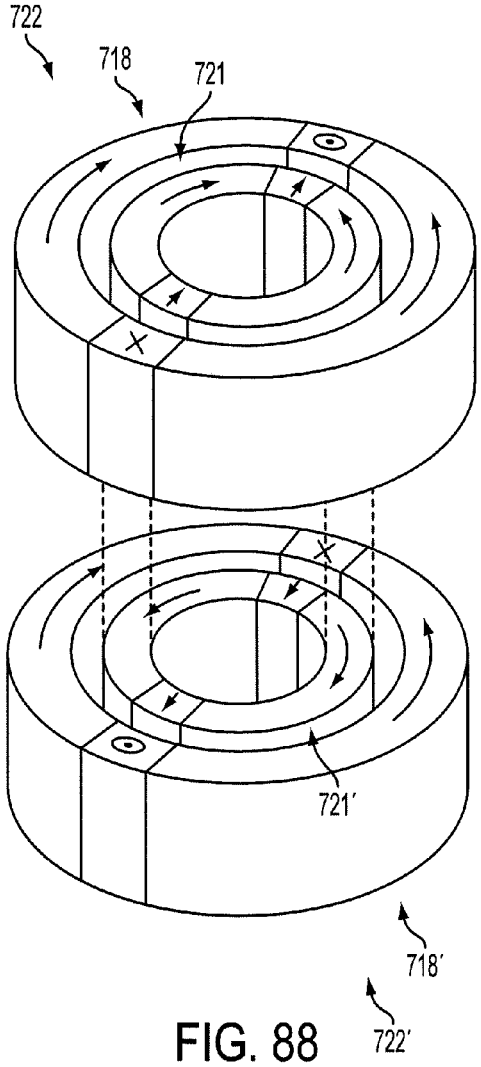
FIG. 88 shows another pair of structures having a mirror symmetry relation relative to one another according to an embodiment of the present invention.

As another example, a modification of the configuration of FIG. 86 can be seen in FIG. 88 in which the pair of structures having a mirror symmetry relation relative to one another. The configuration of FIG. 88 differs from the configuration shown in FIG. 86 in that the direction of the strong sides of the closed loop Halbach structures are at the opposite axial direction relative to one another.

Figure 89:
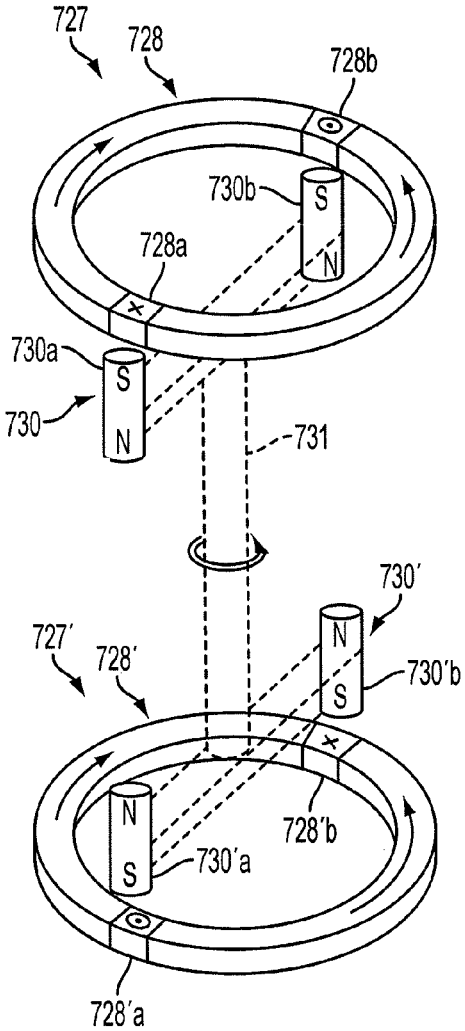
FIG. 89 shows a pair-wise configuration including a pair of identical magnetic structures having a mirror symmetry relation relative to one another according to an embodiment of the present invention.

As a further example of mirror symmetry relation in a pair-wise configuration, FIG. 89 shows a pair-wise configuration comprising of a pair of identical magnetic structures (727, 727') having a mirror symmetry relation relative to one another. The separation distance between two structures is a distance which preferably prevents magnetic interactions between the pair members of the magnetic structures.

The first pair member structure 727 comprises of a stationary 728 and a moving 730 structural parts. The stationary part 728 is a dipole shell having a similar structure as that of the dipole shell 718 in FIG. 85. The moving parts 730 is a pair of identical magnetic cylinders (730*a*, 730*b*) which are longitudinally magnetized, parallel, and have the same polarity direction relative to one another. The magnetic cylinders facing the respective poles (728*a*, 728*b*) of the stationery dipole 728 at a uniform magnetic interaction distance in an aligned manner such that the magnetization directions of the polar areas of each magnetic cylinder and the respective pole of the dipoles 728 are extended relative to one another in a collinear manner.

The second pair member structure 727' is identical to that of the magnetic structure of 727. As can be seen in FIG. 89 the polarity direction of the corresponding stationary parts (728, 728') and the moving parts (730, 730') are mirror image relative to one another. The moving parts (730, 730') are connected to one another by a rigid non-magnetic connection means 731 to form a unitary moving component (in a rotationally balanced manner) such that can have a rotary motion about the common central axis of the shells (728, 728'). A rotary motion of the unitary magnetic cylinders substantially cancels the forces inhibiting the motion of the unitary moving component and simultaneously changing the magnetic strength of the polar ends of the shells. In a similar manner, the spatial arrangement of the above configuration can be extended to other multi-polar hollow shells having an axial Halbach type of magnetic distribution.

Figure 90:
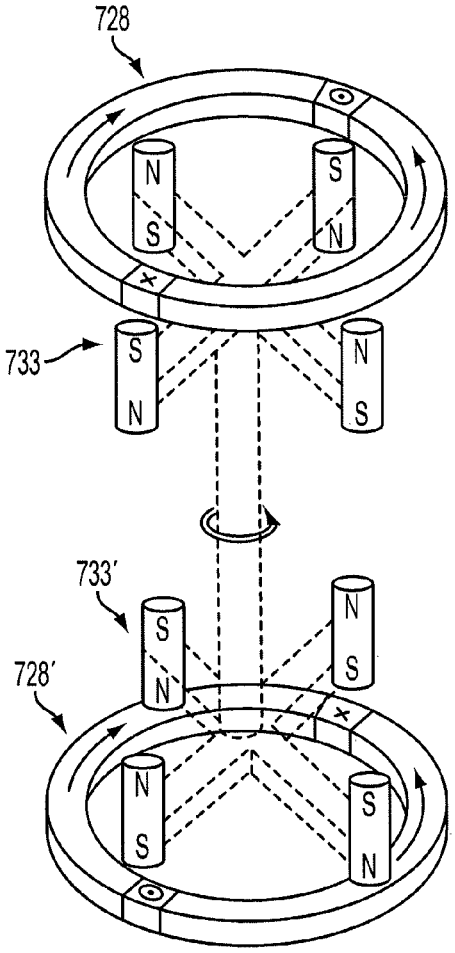
FIG. 90 shows a modification of the moving component of the configuration of FIG. 89 according to an embodiment of the present invention.

FIG. 90 shows a modification of the moving component of the configuration of FIG. 89 in which the moving component is replaced by eight identical magnetic cylinders such that each stationary dipole pair member (728, 728') magnetically confronting a group of four magnetic cylinders. Each group of four cylinders (first group: 733, second group 733') includes two pairs of magnetic cylinders that have a reverse magnetic polarity relation relative one another. The position and spatial relation of each pair of magnetic cylinders relative to the stationary dipole parts (728, 728') is similar to that of the pairs of magnetic cylinders in FIG. 89.

In general, one may use at least one of (or a combination of) the above described symmetrical (bilateral, translational, and rotational) and magnetic relations manner to convert any magnetic structure or any pair of magnetic structures to a configuration in which interactions between the moving and stationary components produce substantial cancellation of the magnetic interaction forces and a change in at least a portion of the magnetic strength pattern of the stationary component.

Figure 91:
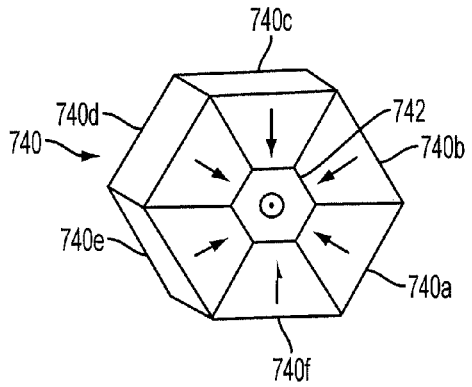
FIG. 91 shows a hexagon shaped Halbach structure according to an embodiment of the present invention.

As a further non-limiting example of the conversion of a magnetic structure, let's consider a magnetic polygon structure 740 shown in FIG. 91 which is a hexagon shaped Halbach structure without any moving part. As can be seen in FIG. 91 the hexagon shaped Halbach structure 740 comprising six identical trapezoid-shaped magnetic elements (740*a*, 740*b*, 740*c*, . . . ) surrounding a central hexagon-shaped magnet 742 (which can be called inner hexagon) which is positioned in a symmetrical manner at the central area of the Halbach structure. The thickness of all magnetic elements (742; 740*a*, 740*b*, 740*c*, . . . ) can be identical such that as a whole providing a uniform planar structure. The magnetization direction of each trapezoidal magnetic element (740*a*, 740*b*, 740*c*, . . . ) is perpendicular to the parallel sides of each trapezoid and directed toward the central magnet 742. The magnetization direction of the central magnet is through its thickness such that the central magnet 742 defines the polar area of the Halbach structure 740.

To provide a moving part, one may use the "cutting like conversion means" to provide a cut portion in a selected part of the Halbach structure which preferably the selected part can be the polar area of a Halbach hexagon (i.e. inner hexagon 742 of the Halbach structure 740). In that case, the inner hexagon 742 can be cut and separated (by a uniform gap) from its immediate surroundings of trapezoidal magnetic elements (740*a*, 740*b*, 740*c*, . . . ) of the Halbach hexagon 740 such that to form a movable inner hexagon. For example the movable inner hexagon can have a reciprocal motion on and along the central axis of the Halbach hexagon. In such modified Halbach hexagon, which can be called first modified hexagon Halbach structure, the separated inner hexagon 742 and the remaining portion of the hexagon (i.e., the trapezoidal shaped magnetic elements 740*a*, 740*b*, 740*c*, . . . ) respectively can be the moving and stationary part of the first modified hexagon Halbach structure.

Figure 92:
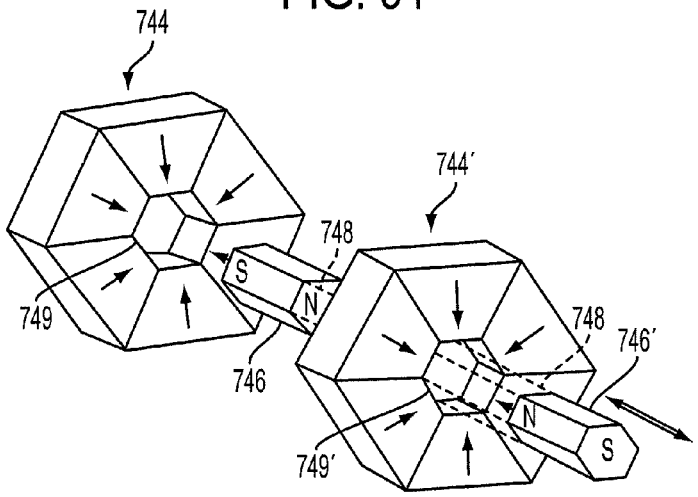
FIG. 92 shows an example of a pair-wise structure in which two identically modified Halbach hexagons have a translational symmetry relation relative to one another in which the pair of structures is positioned spaced apart and aligned such that having a common central axis according to an embodiment of the present invention.

In a similar manner one may produce a second modified hexagon Halbach such that the first and second modified hexagon structures can be considered a pair of identical structures for assembling a pair-wise structure. FIG. 92 shows an example of a pair-wise structure in which two identically modified Halbach hexagons 744 and 744' having a translational symmetry relation relative to one another in which the pair of structures are positioned spaced apart and aligned such that having a common central axis. The separation distance between the modified Halbach hexagons 744 and 744' can be a distance which preferably prevents magnetic interaction between two Halbach hexagons (744, 744'). The magnetization directions of the movable inner hexagons (746, 746') are reversed relative to one another. Both movable inner hexagons (746, 746') are connected to one another by a rigid non-magnetic means 748 (shown in dotted lines) such that providing a unitary moving component capable of a reciprocal motion on and along the common central axis of the Halbach hexagons (744, 744'). As can be seen in FIG. 92, the cut portions (movable inner hexagons 746 and 746') and the void region (the empty void volume 749 and 749' resulting from the cut) having a complementary shape relation in which the all through openings of the empty regions (749, 749') can receive the complementary shape of the movable inner hexagons (746, 746') for a reciprocating motion within the openings. In a magnetic behavior similar to that of other configuration in the disclosure, a reciprocal motion of the moving component toward, and at a magnetic interaction vicinity of, the Halbach structures can produce a change in the strength of the magnetic field pattern of the Halbach hexagons (744, 744') while requiring minimum energy input.

It should be noted that the dimensions of the each Halbach structure pair members (744, 744') in FIG. 92 can be of any desired extent based on the application needs. For example, in some applications (such as cases described in the following) the axial dimension of each structure (i.e., the distance between the parallel polygonal faces of each structure) can be an elongated one.

Figure 93A:
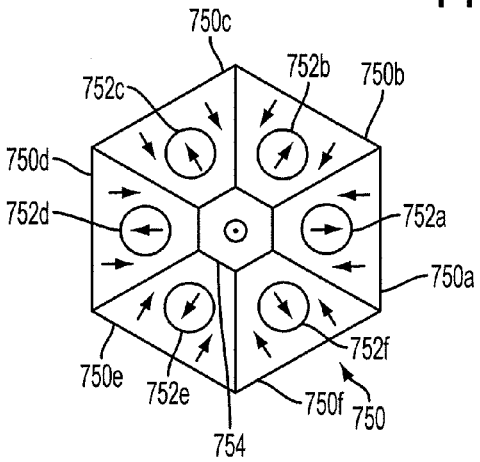
FIGS. 93A and 93B are plan views of pair members of a pair-wise structure having similar structures as that of the configuration of FIG. 92 except the configuration of FIGS. 93A-B include the cut portions in the trapezoidal magnetic elements of the Halbach structures according to an embodiment of the present invention.
Figure 93B:
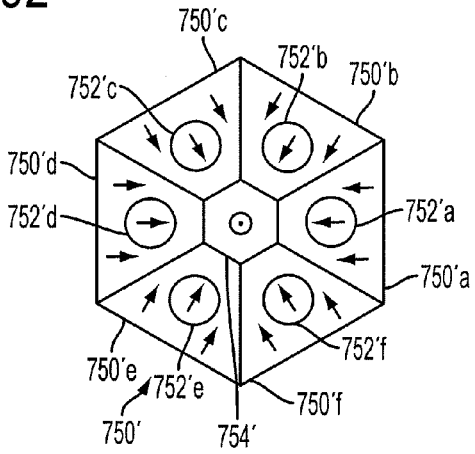

Alternatively, in the pair-wise structure of FIG. 92, the conversion can include at least one pair of cut portions in the identical areas of the trapezoidal magnetic elements of the Halbach hexagon in which the cut portions can preferably include central areas of the trapezoidal magnetic elements of each Halbach hexagons. For example, FIGS. 93A and 93B are plan views of the pair members (750, 750') of a pair-wise structure having similar structures as that of the configuration of FIG. 92 except the configuration of FIGS. 93A-B include the cut portions in the trapezoidal magnetic elements of the Halbach structures. As can be seen in FIGS. 93A and 93B each of the corresponding pairs of the trapezoidal magnetic elements (750*a*, 750'*a*; 750*b*, 750'*b*; 750*c*, 750'*c*; . . . ) includes a corresponding pair of cut portions (752*a*, 752'*a*; 752*b*, 752'*b*; 752*c*, 752'*c*; . . . ) which have a reversed magnetic orientation relative to one another. All pairs of cut portions (752*a*, 752'*a*; 752*b*, 752'*b*; 752*c*, 752'*c*; . . . ) having an identical circular cross sections, and members of each pair are connected to one another by non-magnetic means (not shown) for a spinning motion about a common central axis of each corresponding pair of trapezoidal magnetic elements (750*a*, 750'*a*; 750*b*, 750'*b*; 750*c*, 750'*c*; . . . ). A synchronized spinning motion of all pairs of the cut portions (which are considered the moving component of the configuration) can produce a change in the magnetic field pattern of the Halbach hexagons while requiring minimum energy input.

As can be seen in FIGS. 93A-B, in the conversion of the pair-wise structures (750, 750'), the polar areas (754, 754') can remain in their original uncut positions. In that case, by controlling the synchronized motion of the moving component, one can produce a very high or very low magnetic strength change at the polar areas (754, 754') of the configuration which may have many applications including magnetic lifting devices.

Alternatively, in the pair-wise configuration of FIGS. 93A-B, one may remove the polar areas (754, 754'). That is, the polar areas 754 and 754' can be cut (in a manner similar of the inner hexagons 746 and 746' in FIG. 92) such that the cut portions (i.e., the central polar areas 754, 754' of each hexagons 750 and 750') can be removed to provide a pair of empty voids (i.e., similar to the void regions 749, 749' in FIG. 92) in the polygon structures 750 and 750'. In the resulting magnetic configuration (not shown) a synchronized spin motion of the moving component (752*a*, 752'*a*; 752*b*, 752'*b*; 752*c*, 752'*c*; . . . ) can produce a variable magnetic field within the void regions of the polygon structure (750, 750') which can change from a high intensity magnetic field to a minimum intensity such that a controllable synchronized spin motion can change the magnetic field intensities of the void regions in the pair-wise structures substantially in an "ON" and "OFF" manner. This type of change in the magnetic field can have many applications including NMR-based applications such as MRI related applications. Other preferable applications can include production of electricity in such case one may position bundles of coils within the void region such that the coils can be exposed to the changes of magnetic field strength, thereby producing electricity.

The above manner of conversion of a hexagon magnetic structure 740 in FIG. 91 to pair-wise magnetic configurations, as are shown in the exemplary configurations of FIGS. 92, 93A-B, can be extended to other similar magnetic structures such as any closed loop magnetic structures, or preferably any Halbach-like structures having a multi-angular shape such as polygons.

In summary, and in a broad generalization, one may apply at least one of the above described symmetrical (bilateral, translational, and rotational) and magnetic relations to produce a pair-wise configuration from any given magnetic structure. Therefore, one may convert every, or substantially every, magnetic structures for field production (known in the arts or currently in the process of improvement or development, or expected to be improved/developed) to a configuration for changing magnetic field requiring minimum energy input.

In the configurations described thus far, for ease of the description, the configurations configured in a simplified manner such that the attractive and repulsive forces can be generally equal in number and magnitudes. However, configurations can be configured such that in a configuration these forces can be unequal in number and can have different magnitudes. The configuration of FIG. 94 provides a simplified non-limiting example.

Figure 94:
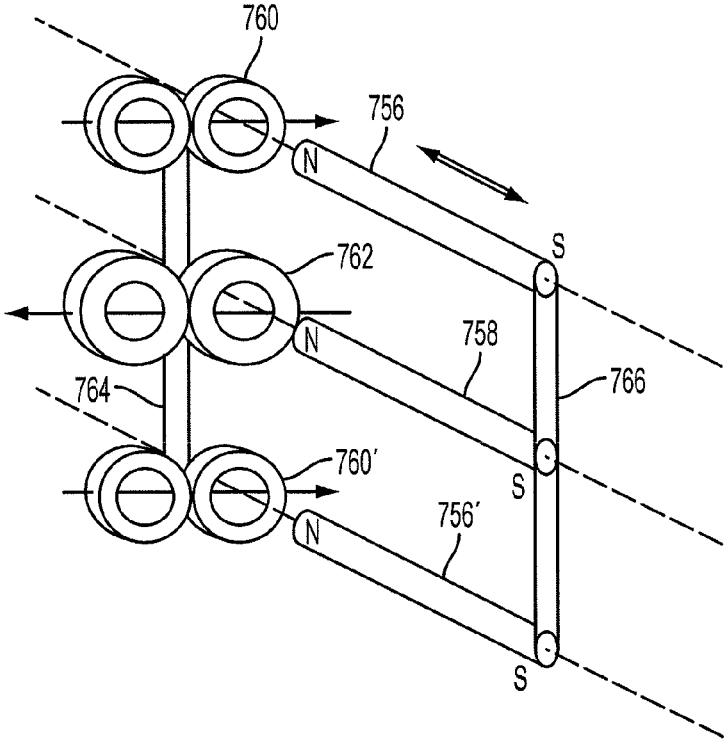
FIG. 94 shows a reciprocating configuration with a stationary component that includes three 8-shaped magnetic elements positioned equidistantly spaced apart according to an embodiment of the present invention.

FIG. 94 shows a reciprocating configuration with a stationary component that comprises of three 8-shaped magnetic elements (760, 760', 762) positioned equidistantly spaced apart, such that having a parallel and coplanar magnetization direction relative to each other. The separation distance between the 8-shaped magnetic elements is such that it preferably prevents magnetic interaction between the 8-shaped magnetic elements. The 8-shaped magnet of 760 and 760' are substantially identical, however 762 is magnetically different from 760 and 760'. The 8-shaped magnets are connected to each other by non-magnetic means 764.

The moving component comprises three axially magnetized magnetic cylinders 756, 756', and 758 in which cylinders 756 and 756' are substantially identical, however 758 is magnetically different from 756 and 756'. The spatial relations of the cylinders and the rings of the 8-shaped magnetic elements are similar to that of the respective relations shown in the configuration of FIG. 4. The magnetic cylinders are connected to each other by a non-magnetic means 766 to form a unitary moving component. During a reciprocal motion, at a magnetic interaction distance, a magnetic interaction of the magnetic cylinder 758 and the 8-shaped magnet 762 produces an attractive force. However, the other two cylinders 756, 756' and their associated 8-shaped magnets 760, 760' produce two repulsive forces such that both repulsive forces together produce a "resultant repulsive force" which has a magnitude represented by "F". The magnetic properties of the magnetic cylinder 758 and its associated 8-shaped magnet 762 can be selected such that their magnetic interaction produces an attractive force with a magnitude that is substantially equal to "F". Then this attractive force can cancel the "resultant repulsive force" while concurrently there is a change in the magnetic strength of the polar ends of all 8-shaped magnets involved in the magnetic interaction.

Figure 95:
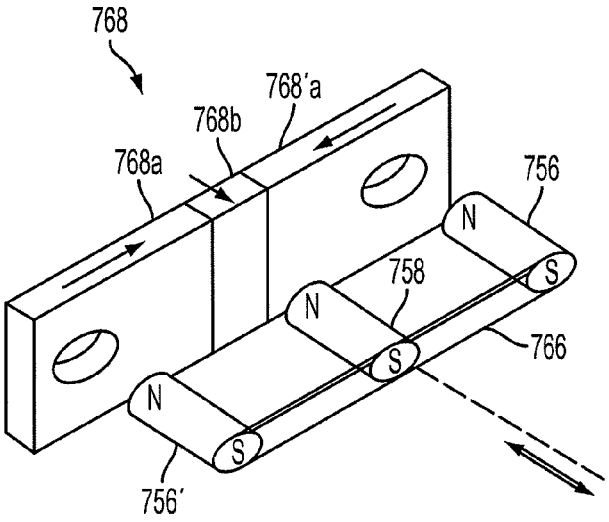
FIG. 95 shows a reciprocating configuration in which the stationary component includes a Halbach array including two identical magnetic elements sandwiching a central polar area according to an embodiment of the present invention.

A modification of the stationary component of the configuration of FIG. 94 can be seen in FIG. 95 showing a reciprocating configuration in which the stationary component includes a Halbach array 768 comprising two identical magnetic elements (768*a*, 768'*a*) sandwiching a central polar area 768*b*. The moving component comprises of three magnetic cylinders having similar structures as of the magnetic cylinders in FIG. 94. One may select the magnetic properties of the magnetic cylinders and the Halbach array 768 such that to produce a similar magnetic behavior as that of the components of the configuration of FIG. 94.

Figure 96:
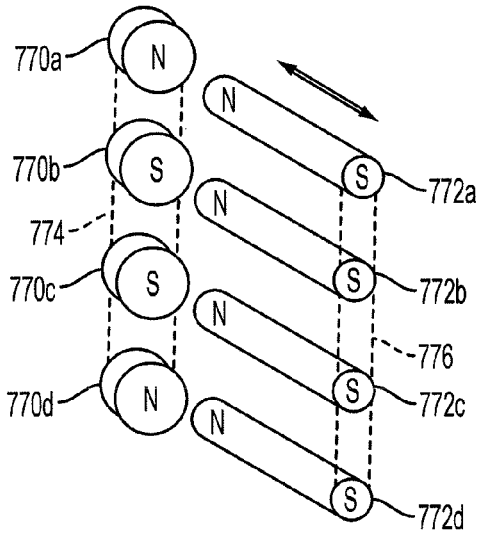
FIG. 96 shows another reciprocating configuration in which the stationary component includes four identical axially magnetized disks according to an embodiment of the present invention.

FIG. 96 shows another reciprocating configuration in which the stationary component comprises of four identical axially magnetized disks (770*a*, 770*b*, 770*c*, and 770*d*). The disks are coplanar and transversely aligned forming a linear extension of disks which includes two end disks (770*a*, 770*d*) and two middle disks (770*b*, 770*c*). The central axes of all disks are coplanar and parallel relative to each other. The disks are positioned equidistantly spaced apart to preferably prevent magnetic interaction between the immediate neighboring disks. The magnetic orientation of the end disks (770*a*, 770*d*) are identical defining a first polarity type. Similarly the identical magnetic orientation of the middle disks (770*b*, 770*c*) defining a second polarity type which is opposite of the first polarity type. The disks (770*a*, 770*b*, 770*c*, and 770*d*) are connected to each other by a non-magnetic means 774.

The moving component comprises of four axially magnetized identical magnetic cylinders (772*a*, 772*b*, 772*c*, 772*d*). The cylinders are positioned equidistantly from the disks in an aligned manner such that the longitudinal axis of each cylinder being coincident with the central axis of a corresponding disk. The magnetic orientations of all cylinders are in the same direction. All magnetic cylinders (772*a*, 772*b*, 772*c*, 772*d*) are connected to each other by a non-magnetic means 776 forming a unitary moving component. During a reciprocating motion of cylinders in the direction of central axes of the disks, at a magnetic interaction distance between the disks and cylinder, there are two substantially identical attractive forces resulting from interaction of the middle disks and the middle cylinders; similarly there two substantially identical repulsive forces resulting from interaction of the end disks and the end cylinders. These attractive and repulsive forces are equal and opposite and therefore cancel each other. Consequently, using a minimum energy input one may produce an intensified magnetic field between the polar area of magnetic disks and the corresponding polar area of the magnetic cylinders.

Alternatively in the configuration of FIG. 96, in a similar manner described for the configuration of FIG. 94, the middle disks (770*b*, 770*c*) and the middle cylinders (772*b*, 772*c*) can be respectively replaced by one disk and one cylinder (not shown) to produce a configuration having a magnetic behavior as that of the configuration of FIG. 94. The magnetic features of the replaced disk and cylinder can be selected such that producing an attractive force which may cancel the identical pair of repulsive forces between the end disks and the respective end cylinders.

It should be noted that in the configuration of FIG. 96 the selected polarity arrangement of the disks (770*a*, 770*b*, 770*c*, 770*d*) and magnetic cylinders (772*a*, 772*b*, 772*c*, 772*d*) is such that to preferably provide equilibrium conditions for the magnetic interaction forces (i.e., such that the sum of the magnetic interaction forces and their associated toques can be substantially zero). In other words, all magnetic interaction forces having a mirror image relation relative to a mirror plane which is bisecting the stationary and the moving component at the midpoint of the longitudinal dimension of the configuration.

Figure 97:
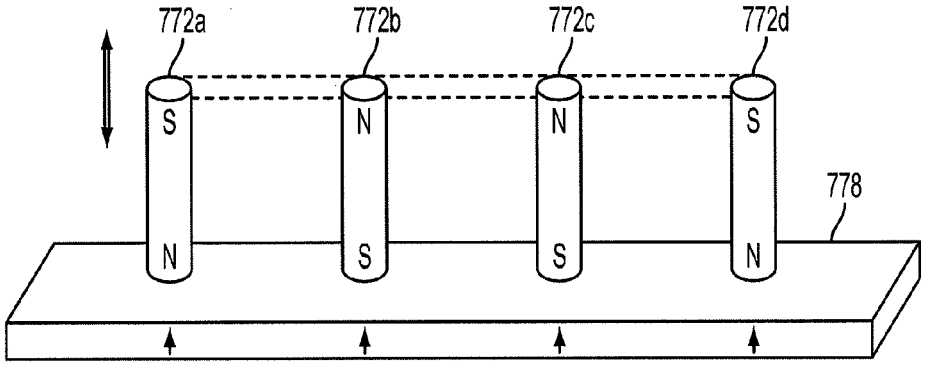
FIG. 97 shows a modification of the configuration of FIG. 96 in which the disks are replaced with a flat rectangular shape magnetic block magnetized through its thickness according to an embodiment of the present invention.

FIG. 97 shows a modification of the configuration of FIG. 96 in which the disks (770*a*, 770*b*, 770*c*, and 770*d*) are replaced with a flat rectangular shape magnetic block 778 magnetized through its thickness. The magnetic orientation of the middle magnetic cylinders (772*b*, 772*c*) are reversed relative to the end cylinders (772*a*, 772*d*) such that the magnetic interaction of all magnetic cylinders with the magnetic block 778 produces magnetic forces that cancel one another (i.e., satisfying the equilibrium conditions).

There are other groups of configurations that, in contrast to the described configurations thus far, can be simpler in structures. Some non-limiting examples of these types of configurations are shown in FIGS. 98A-98L. The components of these simple configurations are arranged in a similar spatial pattern of the previously described configurations. Therefore, for the sake of brevity the spatial arrangement of these simple structures are not repeated here. For example, the stationary and the moving components of the configurations of FIGS. 98A-98J generally have similar spatial relation relative to each other which is similar to that of the configuration of FIG. 4 or 7.

The general conventions described earlier in the disclosure are used in FIGS. 98A-98L. For example, the direction of motion is shown by a double lined arrow, and the preferred line or path of motion is shown by a dashed line. The movement of one component relative to the other component at an interaction distance creates a change in the magnetic strength at the polar ends of the stationary component. Selections of polarity types are only for example and are not limited to the polarities shown in FIGS. 98A-98L. Similarly, selection of motions is only an example and other motions (or direction of motions) are also possible.

Figure 98A:
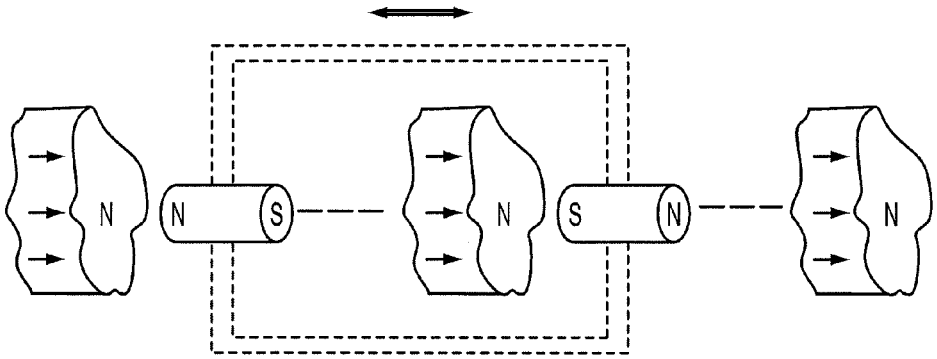
FIGS. 98A-98L show simple magnetic configurations according to an embodiment of the present invention.
Figure 98B:
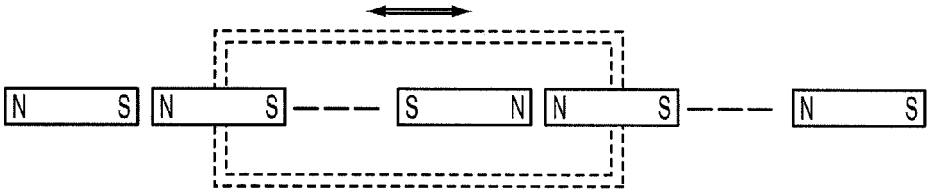
Figure 98C:
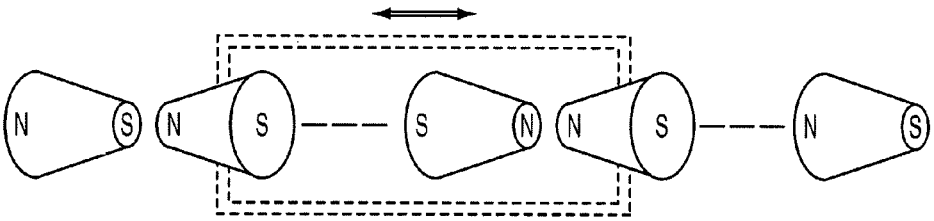
Figure 98D:
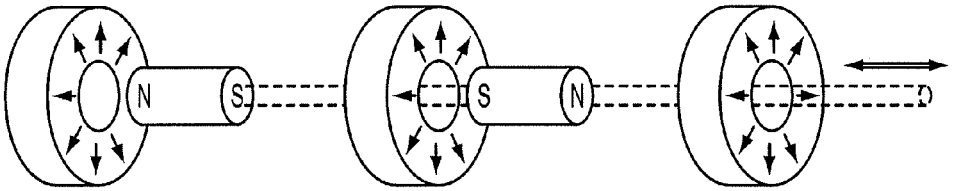
Figure 98E:
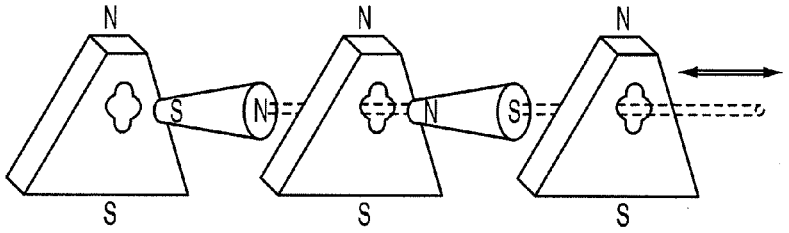
Figure 98F:
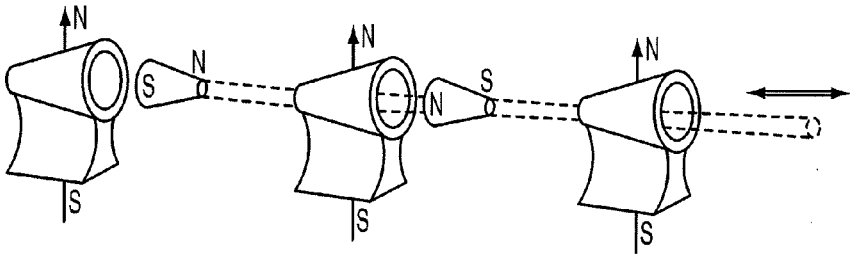
Figure 98G:
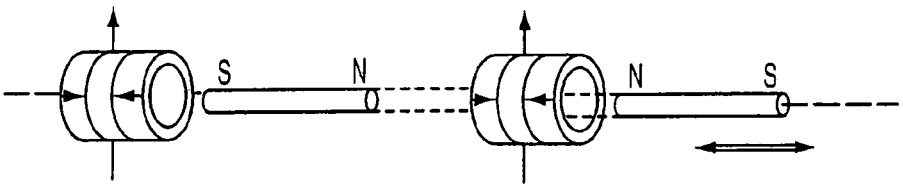
Figure 98H:
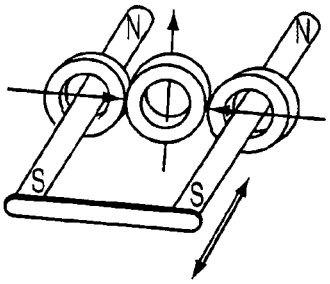
Figure 98I:
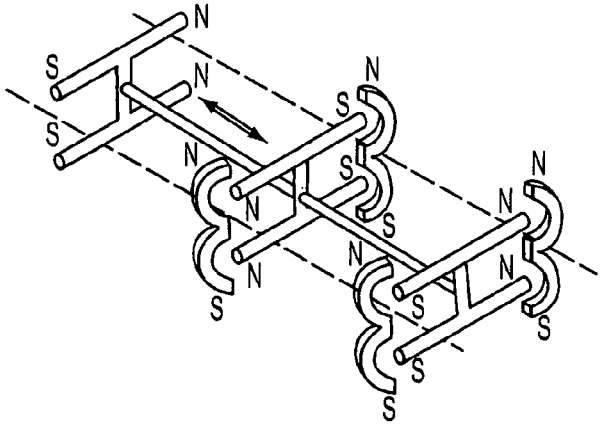
Figure 98J:
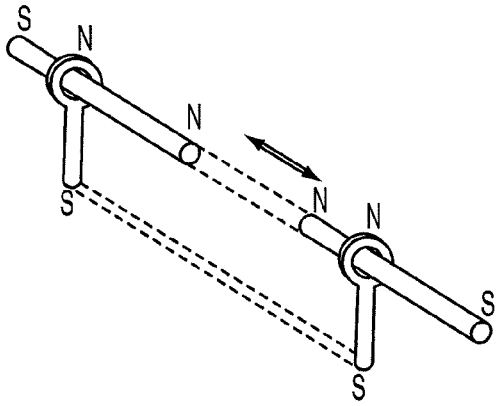
Figure 98K:
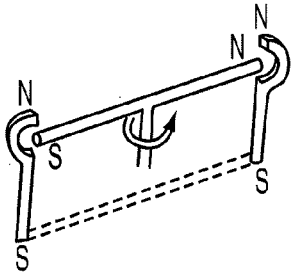
Figure 98L:
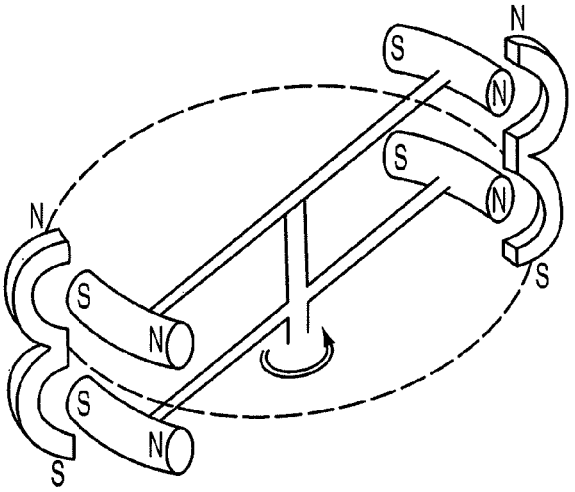

Each of these simple configurations can have many modifications. For example the non-limiting examples of configurations of 98B-98F can be considered some, from virtually numerous, of the modifications of the configuration of FIG. 98A. Generally in the configuration of FIG. 98A, each of the stationary or moving components may have identical magnetic elements including some identical shapes which can be geometrically irregular. As can be seen in FIG. 98A, the magnetic elements of the stationary component include three identical irregular shaped magnets (similarly, the moving component also can have identical irregular shapes, however for illustration purpose identical cylindrical shaped bars are shown). This means a universe of shapes possibilities, and consequently numerous modified configurations for the configuration of FIG. 98A. In some particular modified configurations it is possible that the magnetic elements of both the moving and stationary can have identical shapes for which configurations of FIGS. 98B-C provide two non-limiting examples. In each of the configurations of FIGS. 98B-C the identical magnetic elements are respectively cylindrical and cone shaped magnets. In the configuration of FIG. 98D, the stationary component comprises of three identical radially magnetized rings which can have similar structure as that of ring 200 or 210 shown in FIGS. 3P and 3Q.

Although some stationary or moving components in the reciprocating configurations in FIGS. 98A-J for purpose of illustration include two or more identical magnetic elements. However, it should be noted that, in general, in a simple reciprocating magnetic configuration each component can include only a pair of identical magnetic elements.

It should be noted that all exemplary configurations shown in FIGS. 98A-98L can be used without motion (i.e., there is a magnetic relation between the components of the configuration however the components have no motion relative to one another) for applications that involve enhancing/changing magnetic fields.

It should be noted that in the exemplary configurations of this disclosure, the interaction areas or surfaces of the stationary and moving components are generally separated by a magnetic interaction distance (also referred to as a "gap"). The size of this gap can be relatively small and needs only to be sufficient enough to allow a motion of the components relative to the one another. This gap size sometimes can be almost negligible.

In general, in the configurations of this disclosure the polarities and spatial arrangements of the magnetic elements or arrays of the components of a configuration have been selected such that preferably satisfying the equilibrium conditions of the magnetic interaction forces.

Figure 99:
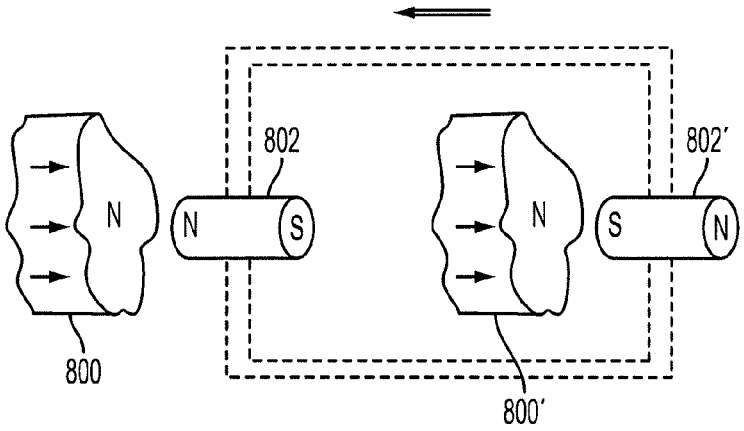
FIG. 99 shows positional relations of component parts relative to each other according to an embodiment of the present invention.

To facilitate the description of the equilibrium conditions, let's consider representative parts of the components of a given magnetic configuration as shown in FIG. 99 in which the positional relation of the component parts relative to each other is similar to that of configuration of FIG. 7. The stationary component parts comprises of two magnetic elements (800, 800') having identical irregular shapes and identical magnetic orientation directions relative to one another. The moving component parts comprises of a pair of magnetic bars (802, 802') having identical shapes and a reverse magnetic orientation directions relative to one another. Therefore, the position of the confronting polar areas of the stationary and moving component parts in FIG. 99 can define two pairs of identical magnetic interaction areas: a first pair (i.e. the confronting polar ends of the stationary component 800, 800'), and a second pair (i.e. the confronting polar ends of the moving component 802, 802'). In each one of the first and second pairs of confronting magnetic interaction areas every magnetic and structural characteristics (size, shape, relative position, corresponding magnetic strength, etc.) are identical (or substantially identical), except the members of the second pair of confronting areas having a reverse polarity relative to the one another. In short, the confronting magnetic interaction areas in FIG. 99 are two pairs of identical interaction areas in which the members of one pair having a reverse polarity relation relative to one another.

Consequently, a simultaneous magnetic interaction between the members of the first and second interaction areas will generate a pair of cancellable opposite forces (COF). That is, two magnetic interaction forces that have equal magnitude and opposite direction (one attractive and the other repulsive) such that cancelling one another.

The magnetic behavior of the representative magnetic interaction areas shown in FIG. 99 is generally an example of a basic pattern which can be repeated in a symmetric manner along the extension of the components in a configuration.

Stating differently, in a configuration comprising of a stationary and a moving component, the extension of the components can be such that when a first pair of identical magnetic interaction areas of the stationary component magnetically confronts a second pair of identical interaction areas of the moving component, the members of either the first or the second pair of identical interaction areas having a reverse magnetic polarity (i.e. reverse magnetic orientation, or reverse magnetization directions) relative to one another. In such magnetic structural arrangement, a simultaneous interaction between the pairs of interaction areas can produce a pair of COF.

Stating broadly, in a given symmetric extension of a stationary component (which generally comprises of a repeating pattern of the interaction areas), one may place identical polar ends of a moving component in a symmetrically confronting manner relative to the identical parts of the repeatable interaction areas of the stationary component such that a magnetic interaction with those identical interaction areas can produces at least one pair COF (that is, magnetic interaction forces that substantially cancel each other). Generally, in such arrangement, the stationary component provides a path of the repeating pattern of the magnetic interaction areas for the moving component such that magnetic interaction of the stationary and moving component can produce one or more pairs of COF.

The path of interaction area can be extended in a symmetric manner at any desired form such as a linear or closed loop. In a linear extension pattern, pairs of COF generally can be distributed in a collinear or in a parallel manner such that having a mirror image manner relation relative to one another. In a closed loop structure, the pairs of COF can be distributed symmetrically parallel to, or perpendicular to the central axis of the closed loop. For example, the pairs of COF can be distributed symmetrically parallel to the axis of, and on the opposed curved surface of, a closed loop such as a cylindrical shell. In a more complex configuration, the pairs of COF can be distributed in both linear and closed loop manner (e.g. the configuration of FIG. 51).

Another way of looking at each pair of COF is to consider the binary nature of the opposing forces in each pair of COF. The pair of cancellable opposite forces in each COF can define a binary-like system of forces in which the sum of each two equal and opposite forces can be substantially zero.

The cancellation of the opposite and equal forces of attractive and repulsive as described in the above defines the requirement of the first equilibrium condition in a configuration. However, in some configurations the pairs of COF can produce at least a torque which can influence the smooth motion of the moving component. In such cases, the second equilibrium condition requires that all torques resulting from the interaction forces (attractive and repulsive forces) acting upon the moving component should also cancel (or substantially cancel) one another. Torques can be created when the interaction forces are not collinear. To understand the second equilibrium condition, the configuration of FIG. 17 can be used as an example. For simplicity let's assume that moving component comprises only of the magnetic cylinder 342*b* and 342*e* such that the resulting interaction forces between the cylinders 342*b* and 342*e* and the stationary component 338 can be respectively an attractive and a repulsive forces. As a result of these attractive and repulsive forces the moving component 344 will experience two opposing forces: first, a pulling force (which is at the confronting polar end of the magnetic cylinder 342*b*); second, a pushing force (which is at the confronting polar end of the magnetic cylinder 342*e*) relative to the stationary component 338. The effect of these two opposing forces of pulling and pushing (acting perpendicularly at the magnetic confronting side of elongated unitary moving component 344) causes a tilting effect (i.e. produces a torque which can be identified as T1) on the moving component, and thereby inhibits a smooth motion of the moving component during its reciprocating motion.

To cancel the effect of the torque T1, there should be another torque (T2) such that having a reverse tilting effect to cancel the effect of T1. As can be seen in FIG. 17 at another interaction areas of the stationary component 338 the magnetic cylinders 342'*b* and 342'*e* are magnetically oriented and positioned such that producing a reverse torque (T2) such that cancelling the effect of the T1. It should be noted that the second equilibrium condition will be maintained at any other interaction areas between the magnetic cylinders and the stationary component during the reciprocating motion of the moving component. In a similar manner, one may add other magnetic cylinders (or generally any other identical magnetic interaction areas) to the moving component as long as at any magnetic interaction position between two components the equilibrium conditions are satisfied.

Stating differently, in FIG. 17 the magnetic cylinders arrangement on the moving component 338 is such that the resulting magnetic interaction forces (between the moving and stationary component) having a bilateral symmetric relation (also called a mirror or reflection symmetry relation) relative to each other. In other words, along the longitudinal extension of the moving component 344, there are a pair of attractive and a pair of repulsive forces, in which each pair of identical forces having a mirror image relation relative to a mirror plane passing through the midpoint of, and perpendicular to, the longitudinal extension of the moving component 344. That is to say, all attractive and repulsive forces in one side of the mirror plane exhibiting identical correspondence (in magnitude, direction, and positional relation) to the magnetic forces on the other side.

This manner of bilateral symmetric relation of magnetic interaction forces will cancel the effect of any torques (which may result from the magnetic interaction forces) that can have a tilting effect on, and thereby inhibiting a smooth motion of, the moving component.

In summary, in a given configuration, the magnetic field interaction between the stationary and moving components produces a plurality of magnetic interaction forces which may create a plurality of torques such that both the magnetic interaction forces and their resulting torques may act upon the movable component. The position and magnetic orientation of the magnetic elements or arrays of the stationary and moving components can be selected such that at any given position of the moving component relative to the stationary component the sum of the magnetic interaction forces and/or the sum of resulting torques can be substantially zero.

As has been shown thus far in this disclosure, and will be explained in more detail later, there are many various shapes for alternative magnetic field sources which creates a vast number of magnetic configurations. The alternative shapes possibilities of the configurations are so extensive that it is impractical to show all shape possibilities in this disclosure. However, any desired shape of the magnetic elements or arrays can be employed in a given configuration as long as the equilibrium conditions are satisfied.

Alternative Field Sources

Figure 100A:
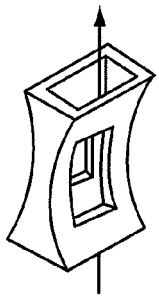
FIGS. 100A-D show some examples of magnetic elements which are a modified form of the magnetic ring in FIG. 1A according to an embodiment of the present invention.
Figure 100B:
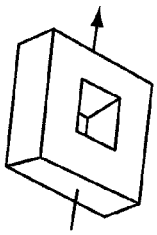
Figure 100C:
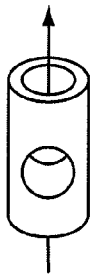
Figure 100D:
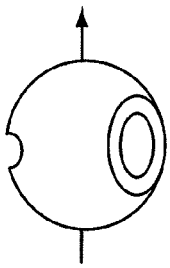

The magnetic field sources used in the exemplary configurations are selected to facilitate the description of the exemplary embodiments. However, it should be understood that the shapes and materials of the magnetic field sources are not limited to those described in this disclosure. For example, the shape of the rings as shown in FIGS. 1A-1L is not limited to an annular or toroidal shape and it can be any segmented or continuous closed-loop shape with a cross-section that can be round or any shape; and it may have a thickness that can be solid or hollow. As non-limiting examples, the shape of a closed-loop magnetic element (or the shape of its cross section) can be circular, elliptical, oval, triangular, square, rectangular, pentagonal, hexagonal, polygonal, or the like (moreover, the shape of the cross section can also include open loop-like forms such as an arc). In addition, in contrast to the flat surfaces of the magnetic elements in FIGS. 1A-1L, the surfaces may comprise any variation in surface continuity and curvature, such as ridges, grooves, bumps, depressions, and a variety of openings of any shapes. As non-limiting examples, each of the magnetic elements shown in FIGS. 100A-D can be a modified form of the magnetic ring 120 in FIG. 1A. The non-limiting example of FIG. 100D indicates that a modified form of a ring can be a hollow egg-shaped shell having two coaxial openings at each end of the shell in which the openings can have identical, or different, sizes. The shapes of the ring-like magnetic elements of FIGS. 1A-1L can be extended to surface structures having holes. As a non-limiting example, the rectangular shaped magnetic element in FIG. 76B can be a modified form of an 8-shaped magnet.

In general, magnetic field sources may be a hollow or solid magnetic body, with a surface curvature of any types, having no opening or at least one opening of any shape. Each opening can be a through hole having opposite open ends, or can be like a recess having only one open end. The openings may be similar or different in shapes and sizes.

The shape variations of the magnetic elements can create a wide range of shape relations between the magnetic elements of the components in a magnetic configuration. A preferred shape relation between the magnetic elements of the stationary and moving components may comprise at least a partial complementary shape relation relative to each other wherein the at least partial complementary shape relation comprises a substantial reverse geometrical shape relation between at least a portion of at least one first field source and at least a portion of at least one second field source such that one portion can be substantially fitted into or received by the other portion. For example, a complementary shape relation may refer to a shape relation between two shapes which are substantially reversed geometrical match of each other such that if for example a surface portion of a stationary magnetic element includes a curved recessed part or at least one opening or a cavity, then the polar area of the corresponding moving magnetic element may include at least a magnetic projection (hollow or solid) which can be, preferably fittingly, a reversed geometrical match for the recessed, opening, or cavity part of the stationary magnetic element.

In some embodiments, a Halbach array has at least a partial complementary shape relation relative to the at least one second field source.

In some configurations, the complimentary shape relation of the magnetic elements (of the stationary and moving component) can be in an externally confronting manner in which the magnetic elements are positioned to interact externally relative to one another. For example, in FIG. 36B the curved magnetic blocks (435', 436', 437', and 438') externally confronting the annular recess surface of the stationary component 434.

In some other configurations, the complementary shape relation of the magnetic elements (of the stationary and moving component) can define a mating relation, wherein at least one first field source defines at least one opening to substantially receive at least a portion of an at least partial complementary shaped field source of at least one second field source. For example, in a mating relationship at least one magnetic element of the stationary component can have an opening to receive at least a portion of a projection, which can be called a male portion, (of the magnetic element of the moving component) in a preferably fitting manner such that allowing a motion of the magnetic projection within the opening. In other words, in a mating relation, the stationary component of a configuration having at least one magnetic field source having at least one opening to receive at least a portion of a complementary shaped magnetic field sources of the moving component for a motion (which can be a reciprocating or a rotary motion within the opening).

In some mating relationships, the opening can be a tubular shaped cavity in which the projection can be positioned coaxially and concentrically in a telescoping-like manner for a motion. The type of motion depends on the cross sections of the magnetic projection and the opening. For example if the cross section is circular (i.e., the opening and projection can be in a coaxial and concentric manner relative to one another) then the motion can be a spin, rotary, or reciprocating one (such as for example, in FIGS. 47, 51, and 72). If the cross section is non-circular such as hexagonal shapes in FIG. 92, then the motion can be a reciprocating type of motion.

In some embodiments, a Halbach array has a mating relation relative to the at least one second field source. A Halbach array may also define a plurality of openings for a mating relation with the at least one second field source of the second component.

The magnetic elements can be made from one type, or can be made from a combination of different types, of magnetic materials known in the magnetic arts. For example, at least a portion of the magnetic elements may be a composite made from different types of magnetic materials. As a non-limiting example, in the dumbbell shaped magnetic element shown in FIG. 1D, the rings and cylinder part of the magnet can be made from a hard and a soft ferromagnetic material, respectively.

The body of magnetic elements may be formed integrally in a unitary fashion, or may be formed from individual units or segments which are connected intimately to one another. Or may be formed from a plurality of segments separated by one or more gaps such that all segments are magnetically connected through these gaps, and as a whole behaves like a unitary magnetic structure.

Thus far in this disclosure, for illustrative purpose, only magnetic field sources are used as the field sources to facilitate the description of the exemplary configurations. However, it is important to realize that the field sources are not limited to the magnetic field sources, and a configuration may comprise other forms of field sources.

In general, the field sources used in a configuration can comprise at least a portion of one of or a combination of more than one of, but is not limited to, the following: a permanent magnet, an electromagnet, an electret, a magnetized ferromagnetic material, a soft magnetic material, a superconductive magnetic material. Furthermore, any new materials or variations of these field sources currently expected to be developed may also be used in a configuration.

As a non-limiting example of using different field sources in a configuration, in the configuration of FIG. 11B the magnetic cylinder 274 can be an electromagnetic means such as a cylindrical electromagnet (i.e., an electromagnet which has a cylindrical core) such that periodically produces polarity changes in at least one of its polar ends (not shown). In that case, in the configuration of FIG. 11B, one of the polar ends of the electromagnetic cylinder 274 can be positioned preferably at a magnetic interaction distance from the associated ring 270'*a* such that a periodical polarity change (i.e., time varying magnetic field changes) of the polar end of cylinder 274 can be translated to a periodical increase and decrease in the magnetic field strength of the polar ends of the ring 270'*a*. In a similar manner, the above described arrangement can be extended to other exemplary magnetic configurations such as configurations in which a first component is a Halbach array that has a mating relation relative to at least one field sources of a second component (such as for example the configurations of FIGS. 9-10). In such configurations, at least one male portion of the mating relation can be a rod-like electromagnet (not shown). In these configurations, it is preferable that both mating portions (i.e., an electromagnetic field source having a cylinder or a rod-like structure and the receiving magnetic body defining at least one opening) being stationary relative to one another (i.e., both the first and second components of the configuration having a static relation relative to one another). Stating differently, in these types of configurations, the relation between the first and second components of a configuration can be a static relation in which the velocity of the movement of one component relative to the other component can be substantially zero.

Applications

The magnetic configurations described in this disclosure lend itself to a variety of applications. In general, applications comprise of any application in which an enhanced or changing magnetic field may be applied or needed.

One of the preferred advantages of the magnetic configurations described in this disclosure is the ability of the magnetic configuration to produce a varying magnetic field at its stationary polar areas by using a minimum amount of energy. This key feature can be applied in a variety of applications including applications which involve conversion of magnetic energy into mechanical force or kinetic energy. In the following, only some non-limiting examples of applications are outlined, however, it should be realized that the possibilities of applications are extensive and are not limited to these examples.

An example of the applications is generation of electricity. In this application, a bundle of coils may be positioned at an intimate proximity of, or preferably at a touching relation of, the polar areas of a stationary component, and thereby exposing the coils to periodical changes of the magnetic field strength. This is in contrast to the conventional electricity production in which the coils are exposed to a moving magnetic field. In comparison with the conventional method of electricity production, application of configurations of this disclosure for generation of electricity has the preferred advantage of producing a varying magnetic field with a minimum usage of energy which is beneficial both for the economic and also the environment.

Another example of applications can be employing a changing magnetic field in the magnetic refrigeration, such as near room temperature magnetic cooling. In these applications the stationary polar areas, with a changing magnetic field, can be positioned in the immediate vicinity of the magnetocaloric bed. In this design improvement, both the polar areas of the stationary component and magnetocaloric bed are static which makes the engineering of heat transfer system much simpler. In addition, the changing of magnetic field strength can be achieved using minimum amount of energy.

The magnetic configurations may also be applied in a wide verity of magnetic based technologies and devices. Some examples of these applications may include, but not limited to, various systems of energy production, conversion, or power generation. In these type of applications, generally changes in the strength of the magnetic field can be converted into energy that can be used to perform useful work, some non-limiting examples include: fluid based power generation (such as hydraulic head, tidal, water flow, and wave based power generation); fuel based power generation (such as fossil fuels, nuclear fuels, etc.); and variety of renewable energy power generation technologies (such as wind, solar, geothermal, bio-fuel, etc.).

Other applications may include various health care or medical related devices including diagnosis devices such as NMR (which for example may use dipolar arrays). Some other example of applications include magneto-mechanical applications (such as magnetic lifting devices, brakes, magnetic holding devices, coupling, magnetic separators, etc.), sputtering devices, acoustic devices, information or telecommunication devices, electrical motors, traveling wave tubes, magnetrons, magnetic focused cathode-ray tubes, ion pumps, cyclotrons, accelerators, and various industrial processes, etc.

In addition to the above macro-scale applications, in a similar fashion the magnetic configurations may have applications in the area of micro and nano-scales magnetic devices including MEMS (Micro-Electro-Mechanical-Systems) devices and various molecule-based magnetic systems. In particular, in micro or nano-scales when there is a need for a strong or changing magnetic field, then the magnetic configurations (or related modifications of these configurations) described in this disclosure can be applicable.

Figure 101:
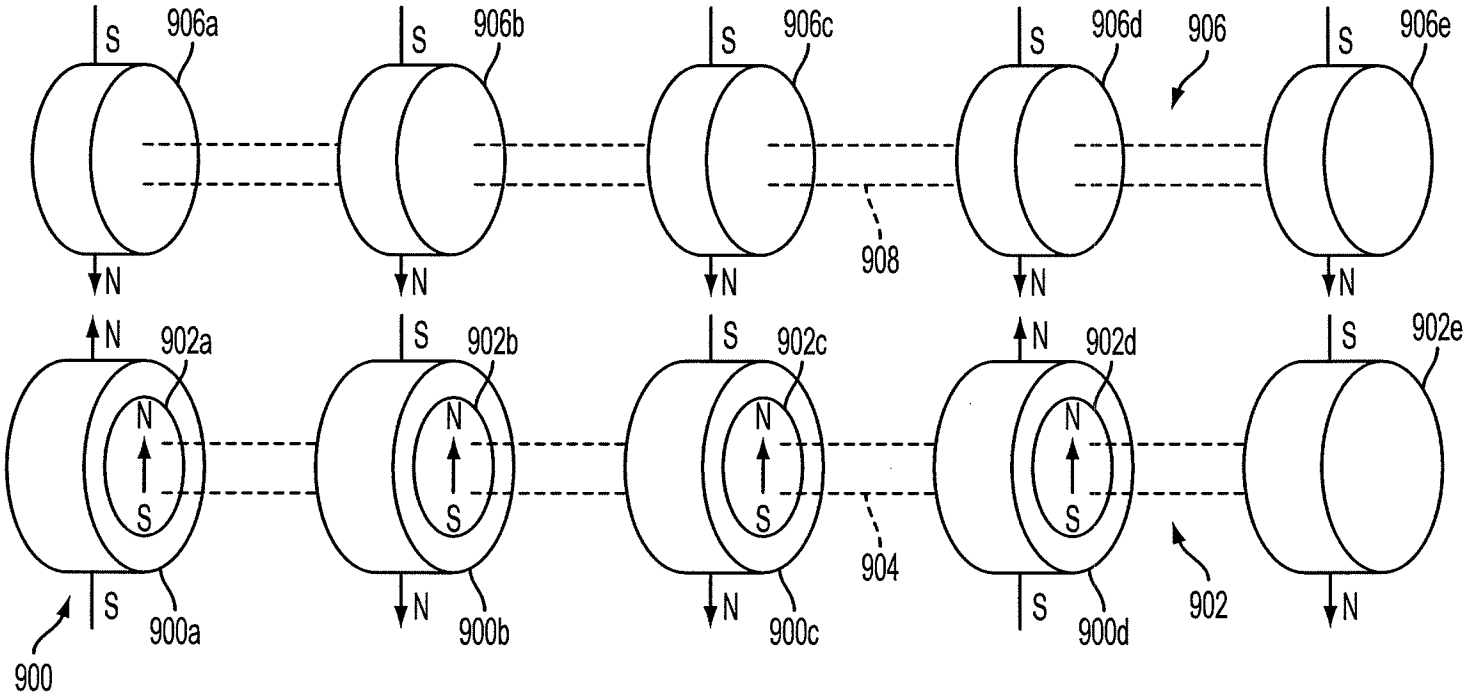
FIG. 101 shows a converting magnetic configuration which includes a stationary, a moving, and a converting component according to an embodiment of the present invention.

The exemplary field configurations (or various modifications of these configurations), can be used to convert change of the field strength into a motion. The following provides a non-limiting example of a field configuration means such as a magnetic configuration means for producing a change in the magnetic field which can be converted to a motion. The field configuration may further include a third component having a plurality of third field sources each having opposite polarities. A relative movement of the third component with respect to the first and second components may produce a field interaction with the first and second components. The plurality of third field sources may be oriented relative to the at least one first and the at least one second field sources such that the field interaction produces a net repulsive force experienced by, and causing a motion of, the third component between a first and a second position. An exemplary converting magnetic configuration is shown in FIG. 101, which comprises of a stationary 900, a moving 902, and a converting 906 components which functions as a third component having a plurality of third field sources.

The stationary component 900 comprises of four identical diametrically magnetized magnetic rings (900*a*, 900*b*, 900*c*, 900*d*) positioned in an aligned manner, equidistantly spaced apart, such that forming a common central axis. Separation distance is a distance minimizing or preferably preventing magnetic interaction between the succeeding magnetic rings. The magnetization directions of all rings are parallel and coplanar. The extension of the rings along the common central axis forms a sequence of (from left to right) first, second, third, and fourth rings (900*a*, 900*b*, 900*c*, 900*d*). Each ring has an upper and a lower polar ends having opposite polarities (North "N" and South "S" polar ends). The magnetic polarity of the upper polar ends of rings in the above left to right sequence is "N-S-S-N".

The moving component 902 comprises of five magnetic disks (902*a*, 902*b*, 902*c*, 902*d*, 902*e*) which are diametrically magnetized. Four of the magnetic disks (902*a*, 902*b*, 902*c*, 902*d*) are identical and each positioned within the central opening of the rings (900*a*, 900*b*, 900*c*, 900*d*) such that each ring is associated with a magnetic inner disk (hereinafter "inner disk") within its central opening in a symmetric ball-bearing-like spatial manner described in connection to FIG. 47. All the inner disks and rings sharing the same common central axis along which the inner disks are located equidistantly forming a succession of (from left to right) first, second, third, and fourth inner disks (902*a*, 902*b*, 902*c*, 902*d*). The fifth inner disk (902*e*, although it is not associated with a ring, however for the ease of the description it can be called the fifth inner disk) is positioned in the same spatial manner of other inner disks (902*a*, 902*b*, 902*c*, 902*d*) such that all five inner disks sharing the same common central axis. The size of the fifth inner disk (902*e*) can be the same as other inner disks (902*a*, 902*b*, 902*c*, 902*d*); however other sizes such as the size of the identical rings (900*a*, 900*b*, 900*c*, 900*d*) can be used as shown in FIG. 101. The separation distance between each two succeeding inner disks is an identical distance (which is the same as of the distance between each two succeeding rings) which is sufficient to minimize or preferably prevent magnetic interaction between each inner disk and the immediate neighboring rings and/or its associated inner disks.

The magnetization directions of all inner disks are parallel with each other, and also parallel to, and coplanar with, the magnetization direction of all rings. Each inner disk has an upper and a lower polar ends having opposite polarities. The polarity of the succeeding (from left to right) upper polar ends of the inner disks are "N-N-N-N-S". In other words, the magnetic orientation of each ring and its associated inner disk relative each other is such that the first and fourth rings (900*a*, 900*d*) have a first identical polarity relation with their associated inner disks (902*a*, 902*d*); and similarly the second and third rings (900*b*, 900*c*) have a second identical polarity relation with their associated inner disks (902*b*, 902*c*) such that the second identical polarity relation is opposite of the first identical polarity relation. All five inner disks are connected to each other by a rigid non-magnetic rotatable connection means 904 to form a unitary structure of the inner disks which is rotationally balanced and can rotate about the common central axis of the inner disks. The magnetic strength of each ring and its associated inner disk can be different or substantially identical. In general, the selected magnetic field is of sufficient strength such that a spinning of the inner disks within the opening of the rings can produce a change in the magnetic strength of the magnetic rings.

The converting component 906 comprises of five magnetic outer disks (906*a*, 906*b*, 906*c*, 906*d*, and 906*e*), a plurality of third field sources, which are diametrically magnetized. The outer disks are arranged in a similar spatial manner of inner disks forming a succession of equidistantly spaced apart disks that share a common central axis. Four of the magnetic outer disks (hereinafter "outer disk") (906*a*, 906*b*, 906*c*, 906*d*) are positioned parallel to, and at an identical magnetic interaction vicinity of, and in an aligned manner relative to the upper polar ends of the rings (900*a*, 900*b*, 900*c*, 900*d*). Both common central axes of the rings and the outer disks (906*a*, 906*b*, 906*c*, and 906*d*) are parallel. The sizes and magnetic strengths of four outer disks (906*a*, 906*b*, 906*c*, 906*d*) confronting the magnetic rings (900*a*, 900*b*, 900*c*, 900*d*) are substantially identical, and can be different or identical to (or preferably slightly less than) the rings.

The manner of selection of the size and magnetic strength of the fifth outer disk 906*e* will be described later. The magnetization directions of all outer disks are identical and parallel with each other; and also parallel to, coplanar with, and in the same direction as the magnetization direction of all rings. Each outer disk has an upper and a lower polar ends having opposite polarities. Magnetic polarities of the lower polar ends of all outer disks (confronting the upper polar ends of the rings) are "N" polarity. In a similar manner of the inner disks, the outer disks are connected to each other with a non-magnetic connection means 908 to form a rotatable unitary structure of the outer disks which is rotationally balanced and can rotate about the common central axis of the outer disks.

In general, the size, thickness, relative separation distances, and magnetic strength of the inner disks (902*a*, 902*b*, 902*c*, 902*d*), rings (900*a*, 900*b*, 900*c*, 900*d*), and outer disks (906*a*, 906*b*, 906*c*, 906*d*) relative to each other can be selected such that a synchronized spinning motion of the inner disks (902*a*, 902*b*, 902*c*, 902*d*) can create a change in the magnetic strength of the rings such that the outer disks (906*a*, 906*b*, 906*c*, 906*d*) can have a magnetic interaction with the rings (900*a*, 900*b*, 900*c*, 900*d*) with a minimum or preferably no magnetic interaction with the inner disks.

If the above magnetic configuration only includes the magnetic rings (900*a*, 900*b*, 900*c*, 900*d*) of the stationary component 900, and the associated inner disks (902*a*, 902*b*, 902*c*, 902*d*) of the moving component 902, then in a magnetic behavior similar to that of other configurations described in the disclosure, a rotary positional change of the moving component relative to stationary component can change the field strength of the polar ends of the rings while rotary positional change of the moving component can be achieved requiring a minimum energy input (also can be called a minimum input force). In other words, there can be a minimum energy input required to provide a rotary positional change of the moving component. This minimum energy input has a magnitude or a value (i.e., this value defines a threshold amount of input energy or driving force above which the moving component can begin a rotational motion) which can be measured and therefore can have a predetermined magnitude.

The magnetic features such as magnetic strengths, separation distance, and size (or a combination of these magnetic features) of the fifth inner and outer disks (902*e*, 906*a*) can be selected such that when facing one another with the like polarities producing a repulsive force which has a magnitude which can be about the predetermined magnitude of the minimum energy input. After selection of suitable fifth inner and outer disks (902*e*, 906*e*), one may select a sufficient separation distance relative to their immediate magnetic neighbors (900*d*, 902*d*, 906*d*) such that the selected distance minimizes or preferably prevents magnetic interaction between the fifth inner and outer disks (902*e*, 906*e*) and the their immediate magnetic neighbors (900*d*, 902*d*, 906*d*).

FIGS. 102A-102D are longitudinal cross section views (by a plane passing through the common central axes of the components 900, 902, 906) of the configuration of FIG. 101; showing (in a front view manner) the changes of the polarities and magnetic strengths of the magnetic elements of the configuration relative to each other as a result of 180 degrees rotation of a component (902 or 906). The solid black and dotted areas on the polar ends of the rings represent respectively an increase and a decrease in the magnetic strength of the polar ends of the rings. For ease of description when referring to the magnetic elements, the order of positional sequence (from left to right: first, second, third, fourth, fifth) of the magnetic elements is used interchangeably with the respective reference numbers of the magnetic elements in FIG. 101.

Figure 102A:
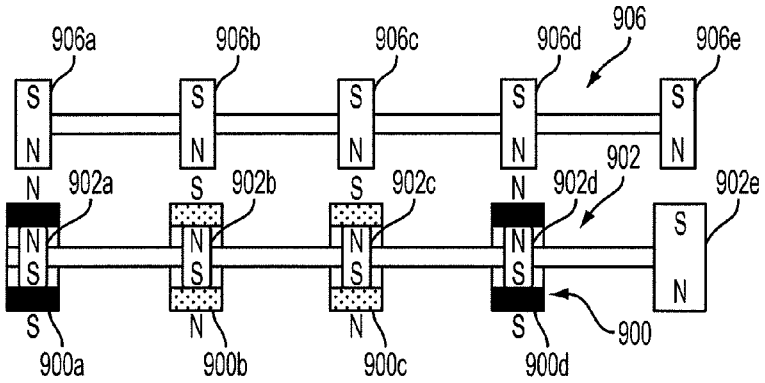
FIGS. 102A-102D show longitudinal cross section views (by a plane passing through the common central axes of the components) of the configuration of FIG. 101 according to an embodiment of the present invention.

FIG. 102A shows the polarities of the magnetic elements of the components (900, 902, and 906) in FIG. 101 relative to each other. The magnetic interaction between the inner disks (902*a*, 902*b*, 902*c*, 902*d*) and the corresponding rings of the stationary component 900 produces a change in the magnetic strength of the of the rings of the stationary component 900 such that the first and fourth rings (900*a*, 900*d*) will have a stronger magnetic fields. Thereby, the magnetic interactions of the first and fourth rings (900*a*, 900*d*) with the like polarities of the respective lower polar ends of the outer disks 906*a* and 906*d* will produce strong repulsive forces. Simultaneously, the magnetic field of the second and third rings (900*b*, 900*c*) will have a weakened magnetic field. Thereby, the magnetic interactions of the second and third rings (900*b*, 900*c*) with the unlike polarities of the respective lower polar ends of the outer disks 906*b* and 906*c* will produce weak attractive forces. The sum of these attractive and repulsive forces is a net repulsive force which is more than the attractive force between the fifth inner and outer disks (902*e*, 906*e*), thereby causing a rotation of 180 degrees (which can be called incremental angular rotary motion) of the converting component 906.

Figure 102B:
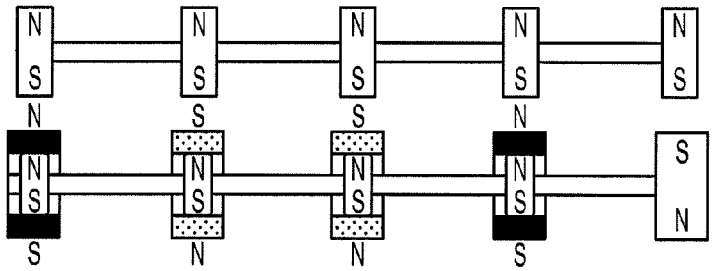

FIG. 102B shows the polarity changes of the configuration after the rotation of 180 degrees of the converting component 906. As can be seen, strong attractive forces (resulting from the interaction of the first and fourth rings (900*a*, 900*d*) with the first and fourth lower polar ends of the outer disks (906*a*, 906*d*) overcome other repulsive forces such that) producing a net attractive force which acts as a holding force for preventing a rotational position change of the converting component 906. At the same time, the fifth inner and outer disks (902*e*, 906*e*) are facing one another with a like polarity causing a repulsive force which has a magnitude which is about the magnitude of the minimum energy input, and thereby causes a rotation of 180 degrees of the moving component 902.

Figure 102C:
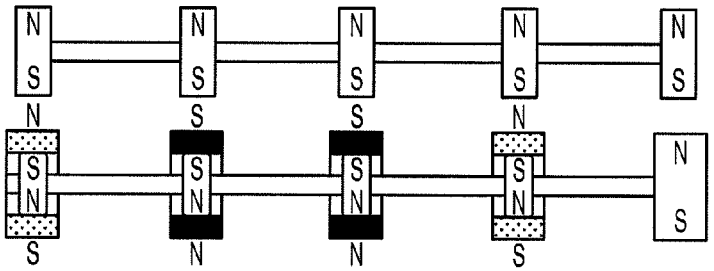

FIG. 102C shows the polarity changes of the configuration after the rotation of 180 degrees of the moving component 902. The rotation of the moving component 902 causes a change in the magnetic strength of the rings polar ends such that the polar ends of the second and third rings (900*b*, 900*c*) have a strengthen magnetic field, while the first and fourth rings (902*a*, 902*d*) have a weakened magnetic field. These stronger and weaker magnetic fields producing respectively stronger repulsive and weaker attractive forces between the rings and the respective confronting polar ends of the outer disks such that the sum of all forces produces a net repulsive force. Consequently, the converting component 906 will experience this net repulsive force which causes a rotation of 180 degrees of the converting component 906.

Figure 102D:
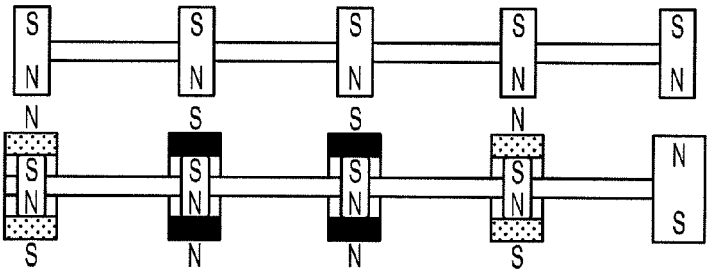

FIG. 102D shows the polarity changes of the configuration after the rotation of 180 degrees of the converting component 906. As can be seen, strong attractive forces (resulting from the magnetic interaction of the second and third rings (900*b*, 900*c*) with the respective lower polar ends of the outer disks (906*b*, 906*c*) overcome all the repulsive forces such that) producing a net attractive force which acts as a holding force for preventing a rotational position change of the converting component 906. At the same time, the fifth inner and outer disks (902*e*, 906*e*) facing one another with a like polarity causing a repulsive force which has a magnitude which is about the magnitude of the minimum energy input, and thereby causes a rotation of 180 degrees of the moving component 902. The resulting polarity changes in the configuration as a result of the 180 degree rotation of the moving component 902 can be the same as shown in FIG. 102A. Thereby, a repetitive pattern of motions will start again as shown and described in connection with FIGS. 102A-102D.

It should be noted that the exemplary polarity arrangement shown in FIG. 101 is only one example from a large number of other polarity patterns that can be utilized in the configuration of FIG. 101. In the same manner described earlier in the disclosure showing various polarity type arrangements for the configuration of FIG. 4 in Table 2; here also one may provide a large number of various polarity arrangements for the configuration shown in FIG. 101; however for the sake of brevity these various polarity arrangements are not shown here. However, based on the exemplary polarity arrangement pattern shown in FIG. 101, a general approach for the polarity arrangement can be outlined in the following.

In general, in any selected polarity arrangement, the polarity pattern is such that when magnetic interaction of the stationary and moving component produces strong and weak magnetic fields at the polar ends of the stationary component, then selected polarities of the respective confronting polar ends of the converting component should be such that the magnetic interactions of the corresponding confronting polar ends of the converting and stationary component produce a net repulsive force urging a motion of the converting component.

Figure 103:
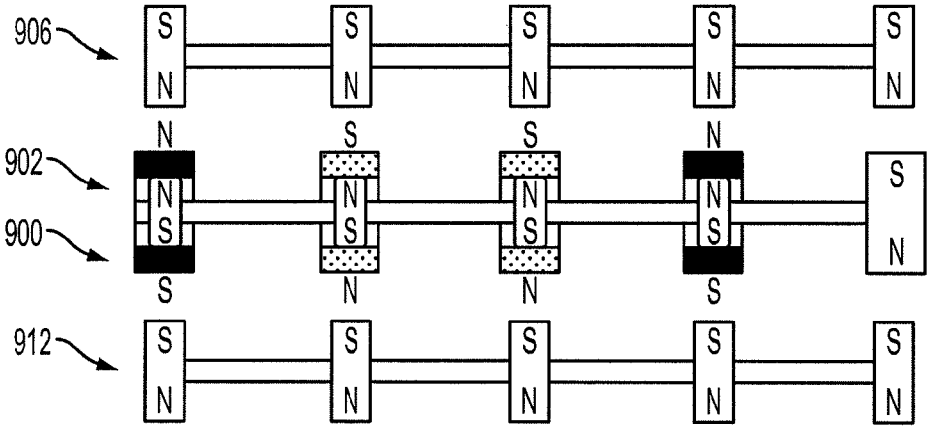
FIG. 103 shows a modified configuration which is similar to FIG. 102A except it shows the addition of a second converting component to the configuration of FIG. 102A according to an embodiment of the present invention.

As a modification of the configuration of FIG. 101, one may use a second converting component which preferably can have an identical structure as that of the first converting component 906 shown in FIG. 101. An example of a modified configuration is shown in FIG. 103, which is similar to FIG. 102A except it shows the addition of a second converting component 912 to the configuration of FIG. 102A. As can be seen in FIG. 103, the second converting component 912 can be placed at a magnetic vicinity of the polar ends of the stationary component 900 such that providing an aligned mirror imaged structure similar to the first converting component 906, except polarities of the outer disks of the second converting component 912 having an anti-parallel relation relative to the polarities of the outer disks of the first converting component 906. The magnetic separation distance between the second converting component 912 and the stationary component 900 can be preferably the same as that of the first converting component 906 such that all components (900, 902, 906, 912) of the modified configuration as a whole forming a coplanar symmetric structure. Magnetic behavior of the second converting component 912 is similar to that of the first converting component 906 as shown and described in FIGS. 102A-102D.

It should be noted that in the configuration of FIG. 101 other magnetic elements can be used. For example instead of using magnetic disks in the moving and converting components, one may use ring-shaped magnetic elements.

It should be noted that in the above converting configuration one may use other magnetic configuration (or a combination of other configurations) described thus far to convert the change in the magnetic field of a configuration into a motion. The selected configurations should be placed relative to each other in a manner similar to the configuration of FIG. 101 described in the above. As a simplified non-liming example, FIG. 104 shows a modification of the configuration of FIG. 101 in which each ring and its associated inner disk are replaced respectively by a tube-like Halbach array and an associated diametrically magnetized cylinder.

The selected Halbach array can be similar to that of FIG. 3E which comprises of three magnetic rings, preferably of identical size, in which one magnetic ring, which is diametrically magnetized, is sandwiched between two other magnetic rings which are axially magnetized, such that all rings having a common central axis and as a whole forming a tube-like Halbach array.

All Halbach arrays (920*a*, 920*b*, 920*c*, and 920*d*) are identical. Similarly, all magnetic cylinders (922*a*, 922*b*, 922*c*, 922*d*) are identical. In each Halbach array and its associated magnetic cylinder, preferably the length of each magnetic cylinder can be approximately equal or can be slightly less than the length of the Halbach array. More preferably, the length of each magnetic cylinder can be a length which is about the thickness of the diametrically magnetized ring of each Halbach array.

Figure 104:
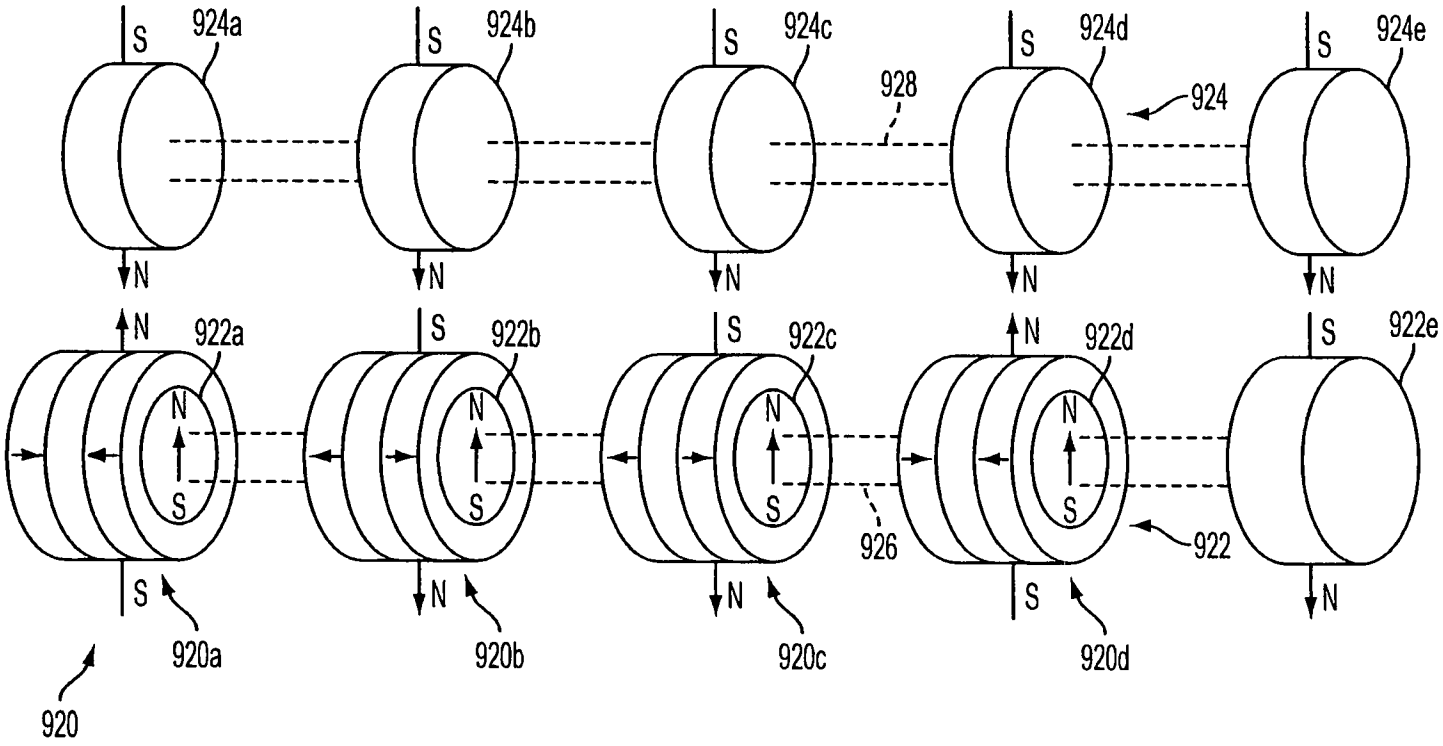
FIG. 104 shows a modification of the configuration of FIG. 101 in which each ring and its associated inner disk are replaced respectively by a tube-like Halbach array and an associated diametrically magnetized cylinder according to an embodiment of the present invention.

In the configuration of FIG. 104 each Halbach array and its associated magnetic cylinder are positioned in a similar spatial and polarity arrangement of the corresponding rings and the associated inner and outer disks shown in FIG. 101 to form a stationary 920, a moving 922, and a converting 924 components. As can be seen in FIG. 104, the strong polar ends sides of the Halbach arrays are confronting the outer disks of the converting component 924 respectively in a similar polarity pattern as that of the upper polar ends of the rings (900*a*, 900*b*, 900*c*, and 900*d*) relative to the outer disks of the converting component 906 in FIG. 101.

In a similar manner of the configuration of FIG. 101, the magnetic cylinders are connected to one another by a rigid non-magnetic connection means 926 to form (in a rotationally balanced manner) a unitary rotatable moving component 922. Similarly the outer disks also are connected to each other by a rigid non-magnetic means 928 to form (in a rotationally balanced manner) a unitary rotatable converting component 928. As can be seen, the lower polar ends of the outer disks of the converting component 924 are facing the polar ends of the tube-like Halbach arrays in a similar manner as shown in FIG. 101. The magnetic behavior of the configuration of FIG. 104 is similar to that of the configuration of FIG. 101 and is not repeated here.

It should be noted that other forms of identical Halbach arrays can be used in a similar manner of the tube-like Halbach arrays in the structure of the stationary component 920 of the configuration of FIG. 104. For example, Halbach structures may have the forms of the Halbach arrays shown in FIG. 59A or 59B.

It should be noted that in the magnetic configuration shown in FIGS. 101 and 104 the components of the configuration may comprise a more or less number of magnetic elements or Halbach arrays. For example in the configuration of FIG. 101, one may remove first and second rings (900*a* and 900*b*) and all the respective inner and outer disks of these two rings (i.e. 902*a*, 902*b*; 906*a*, 906*b*) to have a configuration with a less number of magnetic elements and a magnetic behavior similar to that of the configuration of FIG. 101.

Similarly in the configuration of FIG. 104, one may remove first and second tube-like Halbach arrays (920*a* and 920*b*) and all the respective inner cylinders and outer disks of these two arrays (i.e. inner cylinders: 922*a*, 922*b*; and outer disks: 924*a*, 924*b*) to have a configuration with a less number of magnetic arrays and elements which have a magnetic behavior similar to that of the configuration of FIG. 104.

Figure 105:
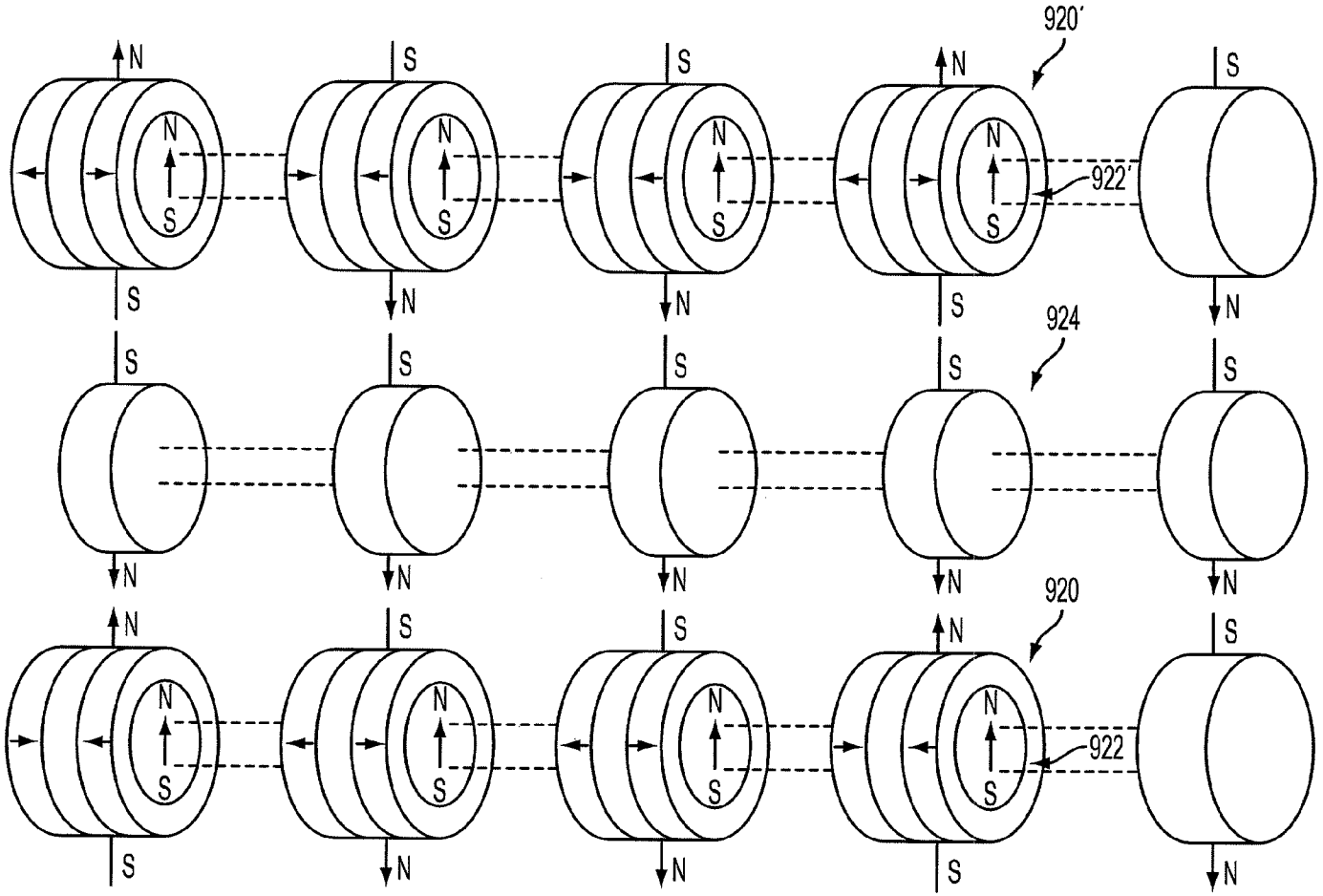
FIG. 105 shows the configuration of FIG. 104 after addition of another similar set of stationary and moving components on the opposite sides of the converting component according to an embodiment of the present invention.

It should be noted that one may provide a two set of similar stationary and moving components on the opposite sides of the converting component to form a symmetrical converting configuration in which the converting component may have a simultaneous magnetic interaction with two sets of the stationary and moving components. As a non-limiting example, FIG. 105 shows the configuration of FIG. 104 after addition of another similar set of stationary and moving components (920', 922') on the opposite sides of the converting component 924.

Figure 106A:
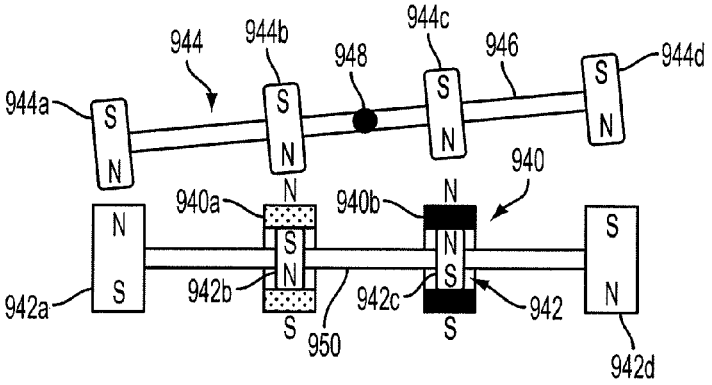
FIGS. 106A-D show a sequence of motions and polarity changes in a converting configuration which is a modification of the converting configuration of FIG. 101 according to an embodiment of the present invention.

FIG. 106A is a cross sectional front view of a configuration which is a modification of the configuration of FIG. 101 in which the change of magnetic strength can be converted to an oscillatory type of motion. As can be seen, the converting configuration comprises three components: a stationary 940, a moving 942, and a converting component 944, which are arranged in a similar structural and spatial manner as that of the components in the configuration of FIG. 101.

The converting component 944 comprises of four upper magnetic disks (944*a*, 944*b*, 944*c*, 944*d*) connecting to each other by a non-magnetic means 946 forming a unitary component capable of a pivoting motion (in a rotationally balanced manner) about a non-magnetic pivoting means 948. The pivot 948 is located at the midpoint of the longitudinal extension of the converting component and has a rotational axis which is perpendicular to the rotational axis of the moving component 942.

At each opposite ends of the longitudinal extension of the converting configuration there is a first and a second pairs of upper and lower confronting magnetic disks (first pair of upper and lower disks: 944*a* and 942*a*; second pair of upper and lower disks: 944*d* and 942*d*) having similar structural and spatial arrangement as that of the fifth outer and inner disks (906*e*, 902*e*) in FIG. 101. All of the confronting lower polar ends of the upper disks (944*a*, 944*b*, 944*c*, 944*d*) of the converting components 944 having north polarities. The upper polar ends of the magnetic rings 940*a* and 940*b* having north polarity. The moving component 942 comprises of two lower magnetic disks (942*a*, 942*d*) and two inner magnetic disks (942*b*, 942*c*) which are connected to each other through non-magnetic means 950 to form a unitary component 942 capable of a rotation (in a rotationally balanced manner) about the common central axis of the connected disks (942*a*, 942*b*, 942*c*, 942*d*). The polarities of the upper polar ends of the succeeding magnetic disks of the moving component (from positional sequence of left to right: 942*a*, 942*b*, 942*c*, 942*d*) are N-S-N-S.

In a similar magnetic behavior that described in connection with FIGS. 102A-D, the changes in magnetic strength of the rings (940*a*, 940*b*) create a sequence of motions and polarity changes in a full 360 degree motion of the moving component which are shown in FIGS. 106A-D.

Figure 106B:
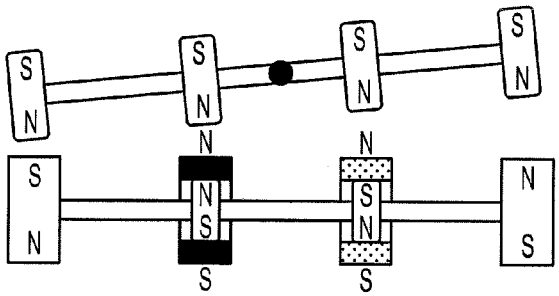
Figure 106C:
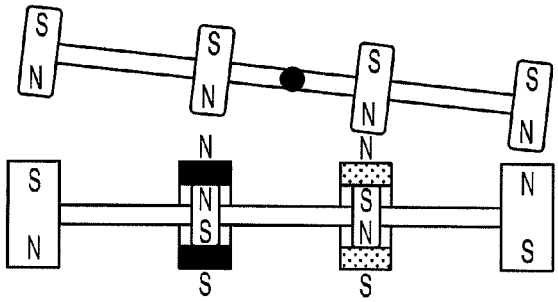
Figure 106D:
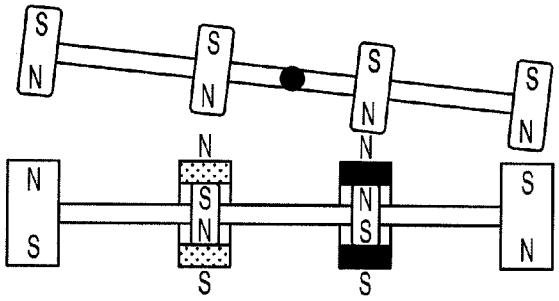

FIG. 106A shows a tilting pivotal motion (in a counter-clockwise direction) of the converting component 944 (as a result of experiencing a net repulsive force at the right side of the pivot 948) which brings the magnetic disk 944*a* to a closer magnetic distance of the first lower disk 942*a*. Consequently, the magnetic disk 942*a* experiences a net repulsive force urging a rotation of the moving component 942 for about 180 degrees. FIG. 106B shows the changes of the polarities of the moving component 942 and the resulting changes of the magnetic strength of the rings (940*a*, 940*b*) after 180 degree the rotation of the moving component. FIG. 106C shows the pivotal motion (in a clockwise direction) of the converting component 944 (as a result of experiencing a net repulsive force at the left side of the pivot 948). The pivotal motion of the converting component 944 brings the magnetic disk 944*d* to a closer magnetic distance of the lower magnetic disk 942*d*. Consequently, the lower magnetic disk 942*d* experiences a net repulsive force urging a rotation of the moving component 942 for about 180 degrees which is shown in FIG. 106D. The resulting magnetic strength change of the rings (940*a*, 940*b*) will cause a pivoting motion of the converting component in the clockwise direction (as a result of experiencing a net repulsive force at the right side of the pivot 948) which brings it to its original position shown in FIG. 106A. The magnetic behavior of the configuration shown in FIGS. 106A-D will be repeated in each full rotation of the moving component. Thereby, a rotary motion of the moving component 942 can be translated to an oscillatory motion of the converting component 944.

It should be noted that in the configuration of FIGS. 106A-D for purpose of illustration only the upper polar ends of the stationery rings and the related converting component is shown. However it should be realized that one may assemble a second converting component (which can be similar to that of the converting component 944) for converting the magnetic strength change of the lower polar ends of the rings (940*a*, 940*b*) of the stationary component 940 such that the configuration can have a pair of converting components at the upper and lower parts of the configuration (not shown).

Figure 107:
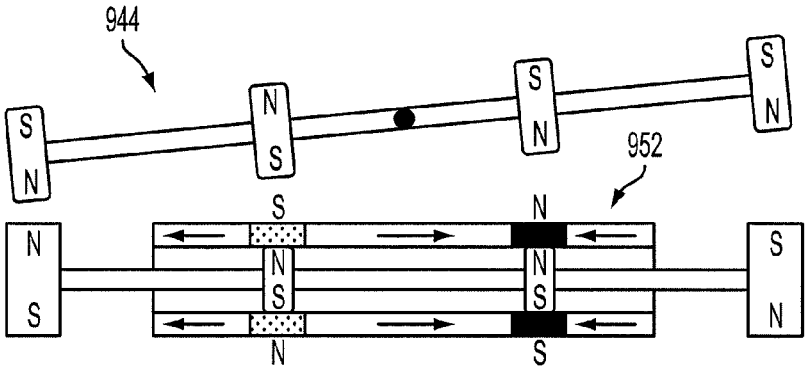
FIG. 107 shows a front view cross section showing magnetic rings in FIG. 106A replaced with a tubular Halbach array according to an embodiment of the present invention.

Alternatively, in the configuration of FIG. 106A, one may replace the magnetic rings (940*a*, 940*b*) with one or more Halbach structures. As a non-limiting example, FIG. 107 is a front view cross section showing that both magnetic rings 940*a* and 940*b* in FIG. 106A are replaced with a tubular Halbach array 952. The array 952 has a similar structure as that of the array of FIG. 3G such that the polar areas 170*a* and 170*b* of the Halbach array of FIG. 3G replacing the magnetic rings 940*a* and 940*b* (of the stationary component 940 in FIG. 106A) in a similar spatial relation that is shown in the configuration of FIG. 106A. The selected polarity arrangement of the components in FIG. 107, is such that to produce a similar magnetic behavior of the configuration of FIG. 106A.

In a similar manner, a converting component similar to the converting components shown in FIGS. 101-106A can be used for converting magnetic field changes of other configurations into a motion. As a non-limiting example, the converting configuration of FIG. 108 comprises of a converting component 960 (which has a similar structure as that of the converting component 944 in FIG. 106A), a stationary component 962, and a moving component 964. The stationary component 962 comprises of two identical circular Halbach arrays (962*a*, 962*b*). Each of the identical Halbach arrays (962*a*, 962*b*) and its inner moving part (964*b*, 964*c*) are respectively similar in structure as that of the stationary and moving components of the configuration in FIG. 40A. The moving component 964 in FIG. 108 comprises of four structurally identical rotary parts (964*a*, 964*b*, 964*c*, and 964*d*) which are positioned in an aligned manner relative to each other such that having a common rotational axis. Each one of the rotary parts comprising of four magnetic blocks which are structured similar to the moving component 449 in FIG. 40A. The rotary parts (964*a*, 964*b*, 964*c*, and 964*d*) are connected to each other by a preferably non-magnetic connection means 966 (shown in dotted lines) such that forming a unitary moving component which is functionally similar to the converting component 942 in FIG. 106A. The selected polarity arrangement of the components in FIG. 108, is such that to produce a magnetic behavior which is similar to that of the configuration of FIG. 106A.

Figure 108:
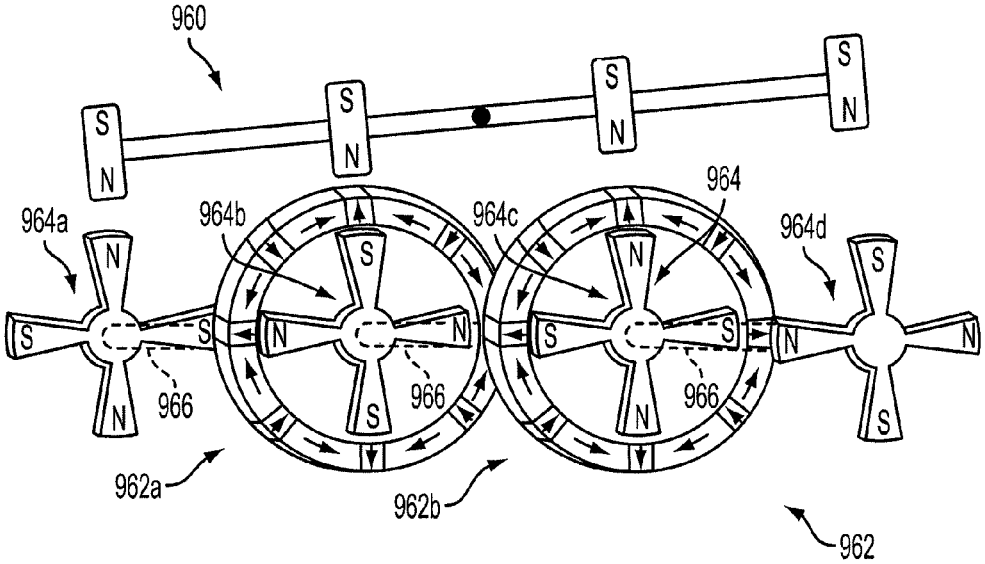
FIG. 108 shows a converting configuration including a converting component (which has a similar structure as that of the converting component in FIG. 106A), a stationary component, and a moving component according to an embodiment of the present invention.

It should be noted that the number of converting component in the configuration of FIG. 108 can be more than one. For example, each corresponding polar areas of the stationary component and the corresponding free ends of the rotary parts (964*a*, 964*b*, 964*c*, 964*d*) may confront a converting component such that the configuration of FIG. 108 can have up to four converting components (not shown) in which the spatial and magnetic relation of each one of four converting components can be similar to the converting component 960 in FIG. 108.

It should be noted that in contrast to other converting configurations (such as the configuration of FIGS. 102A-D, in which one full rotation of the moving component comprises of two incremental angular rotary motion of about 180 degrees), in a converting configuration having a multi-polar stationary and moving component such as in the configuration of FIG. 108, the incremental angular rotary motion of the moving component 964 can be based on the number of the converting components. For example, if one uses four converting components in the configuration of FIG. 108, then incremental angular rotary motion can be 45 degrees.

Figure 109A:
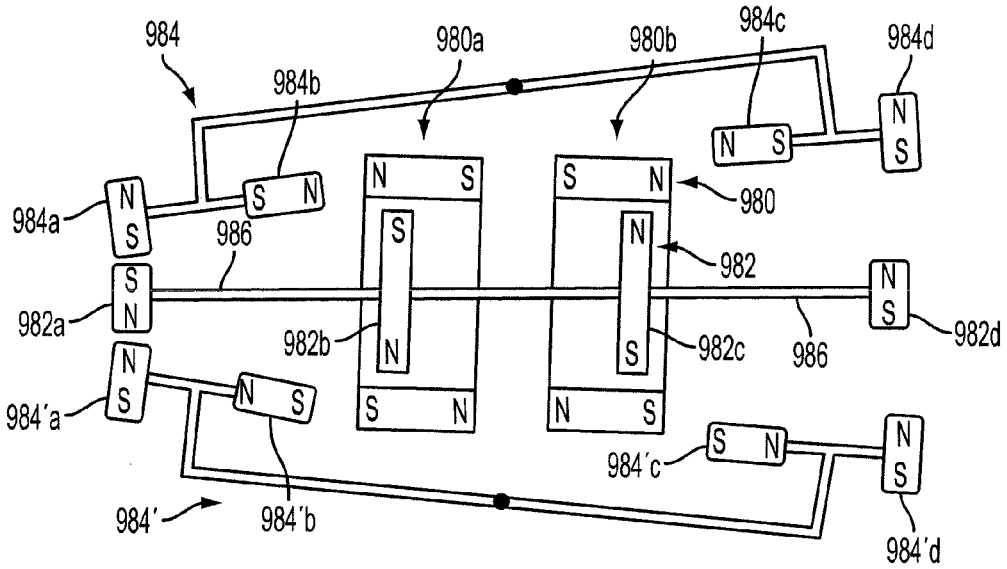
FIGS. 109A-B show the sequence of motion and polarity changes in a converting configuration in first and second positions of the converting component of the configuration.

As another non-limiting example of using converting components in various configurations, FIG. 109A provides a cross sectional view of a converting configuration comprising a stationary 980, a moving 982 and a pair of converting components (984, 984'). The stationary component 980 comprises of a pair of hollow dipole shells 980*a* and 980*b* which are respectively similar in structure to the dipole shells 718 and 718' in the pair-wise configuration of FIG. 87.

The moving component 982 comprises of a pair of magnetic disks (982*a*, 982*d*) and a pair of magnetic blocks (982*b*, 982*c*) in which the pair of magnetic blocks (982*b*, 982*c*) are respectively similar in structure as the magnetic blocks 724 and 724' in FIG. 87. The spatial and magnetic relation of the magnetic blocks (982*b*, 982*c*) and the dipole shells (980*a*, 980*b*) relative to each other is respectively similar to that of the magnetic blocks (724, 724') and the dipole shells (718, 718') in the pair-wise configuration of FIG. 87. The cross sectional view shown in FIG. 109A is by a cutting plane passing through, and bisecting, the poles of the dipole shells (980*a*, 980*b*). A non-magnetic connection means 986 connects the magnetic disks (982*a*, 982*d*) and the magnetic blocks (982*b*, 982*c*) to form the unitary moving component 982 which magnetically acts in a similar manner as that of the moving component 942 in FIG. 106A.

The structure of each of the converting component (984, 984') can be similar to that of the converting component 944 shown in FIG. 106A. However, as can be seen in FIG. 109A, in each of the converting components (984, 984'), two of the outer disks are positioned in a perpendicular manner relative to the other respective outer disks of the converting component. For example, in the converting component 984 the outer disks 984*b* and 984*c* are positioned in a perpendicular manner relative to the outer disks 984*a* and 984*d*, respectively. This positional manner of the outer disks allows a more effective magnetic interaction of the outer disks (984*b*, 984*c*; 984'*b*, 984'*c*) with the polar areas of the dipole shells (980*a*, 980*b*).

Figure 109B:
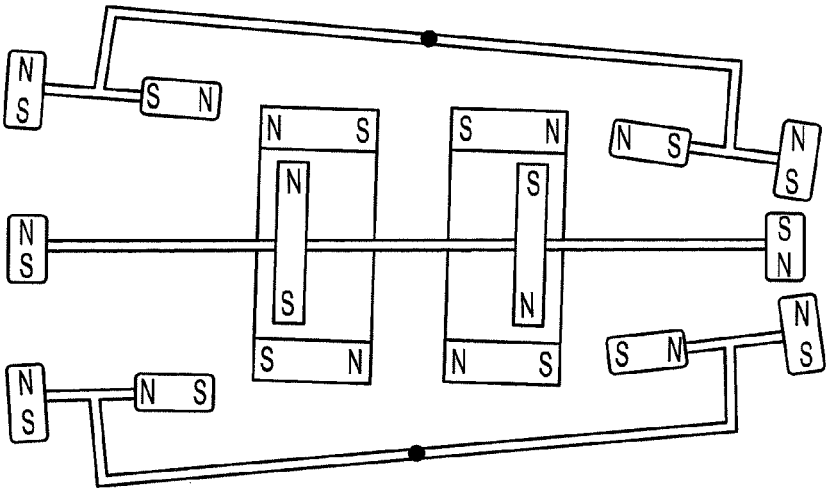

FIG. 109A shows the first position of the converting components (984, 984') in which each converting component (984, 984') is a position similar to that of the converting component 944 in FIG. 106A. FIG. 109B shows a second position of the converting components (984, 984') after 180 degrees rotation of the moving component 982. The second position of the converting components (984, 984') in FIG. 109B is a position which is similar to that of the converting component 944 in FIG. 106C. The magnetic behavior of the converting configuration of FIG. 109A is similar to that of the converting configuration of FIG. 106A and is not repeated here. It should be noted that the selection of a pair of converting components (984, 984') in FIG. 109A is for illustrative purpose, and the converting configuration of FIG. 109A can be possible with one converting component.

In a similar manner, application of converting components (which can be similar or modifications of the converting components shown in FIGS. 101-109A) to transform a configuration into a converting configuration can be extended to various other configurations. In some configuration such as multi-polar closed loop types, one preferably may use a plurality of the converting components such that each corresponding polar areas of the configuration can be arranged in a similar spatial and magnetic relation shown in FIG. 108 or 109A.

It should be noted that the use of magnetic outer or inner disks in the converting configuration in FIGS. 101-109A was for ease of description, and in practice the disks can be replaced by other shapes of magnetic elements which can have a similar magnetic function as of the magnetic disks of the converting configuration.

In summary and stating broadly, a converting configuration can include at least one converting component in which the polarities of the magnetic elements of the converting component are oriented such that the component being capable of a magnetic interaction with magnetic elements of the stationary and moving components of the converting configuration. The result of such magnetic interaction generally is a net repulsive force which is experienced by, and causing a motion of, the converting component between a first and a second position.

It should be noted that in a converting configuration, one may use an energy storing means such as a flywheel (not shown), which can be rotatably mounted around the rotational axis of a movable component. For example, a flywheel can be mounted on the converting component shown in FIGS. 101-105, or on the moving component shown in FIGS. 106A-109A; such that to provide a uniform rotational motion. Preferably the flywheel can be made from non-magnetic materials.

Although the invention has been described with respect to specific embodiments, the details are not to be construed as limitations, for it will become apparent that various embodiments, changes, and modifications may be used without departing from the spirit and scope thereof, and it is understood that such equivalent embodiments are intended to be included within the scope of this invention.

Insofar as the description of this disclosure and the accompanying drawing disclose any additional subject matter that is not within the scope of the claims below, the inventions are not dedicated to the public and the right to file one or more applications to claim such additional inventions is reserved.

The invention claimed is:

1. A field system comprising:

a first component having at least one first field source having opposite polarities; and a second component having at least one second field source having a body having opposite polarities to define a field direction, wherein the body comprising at least one material such that within the at least one material the field direction extending substantially in a single direction, wherein at least one of the first and second components are adapted to be capable of having a movement relative to the other of the components to produce a field interaction therebetween, wherein the field interaction produces a plurality of interaction forces which result in a plurality of torques;

wherein the at least one first and the at least one second field sources are oriented relative to each other such that repelling forces associated with the same polarities of the at least one first field source and the at least one second field source and attractive forces associated with the opposite polarities of the at least one first field source and the at least one second field source substantially cancel each other out such that a sum of the resulting torques is substantially zero at any given time, and wherein the field interaction produces an increase in at least a first field of a plurality of fields associated with the polarities of the at least one first and at least one second field sources and a decrease in at least a second field of the plurality of fields.

2. The field system of claim 1, wherein the field interaction increases at least a field associated with at least one of the polarities of the at least one first field source and decreases at least a field associated with at least another one of the polarities of the at least one first field source.

3. The field system of claim 1, wherein the at least one first and the at least one second field sources have at least a partial complementary shape relation relative to one another, wherein the at least partial complementary shape relation comprises a substantial reverse geometrical shape relation between at least a portion of the at least one first field source and at least a portion of the at least one second field source such that one portion can be substantially fitted into or received by the other portion.

4. The field system of claim 3, wherein the at least partial complementary shape relation defines a mating relation, wherein each first field source of a plurality of the at least one first field source defines at least one opening to substantially receive at least a portion of the at least partial complementary shaped field source of the at least one second field source.

5. The field system of claim 1, wherein the at least one first field source of the first component comprises a plurality of field sources forming a Halbach array.

6. The field system of claim 5, wherein the Halbach array has at least a partial complementary shape relation relative to the at least one second field source.

7. The field system of claim 5, wherein the Halbach array has a mating relation relative to the at least one second field source.

8. The field system of claim 5, wherein the Halbach array defines a plurality of openings for a mating relation with the at least one second field source of the second component.

9. The field system of claim 1, wherein the first component comprises a first pair of corresponding members of the at least one first field source and the second component comprises a second pair of corresponding members of the at least one second field source, wherein the corresponding members of the first and second pairs are spaced apart in a symmetry relation at a separation distance to substantially prevent a field interaction therebetween.

10. The field system of claim 9, wherein the symmetry relation comprises at least one of:

a bilateral symmetry such that the corresponding members of at least the first pair and second pair are mirror images of one another relative to a mirror plane which is perpendicularly bisecting the separation distance;

a translational symmetry such that the corresponding members of at least the first pair and second pair can be coincided to one another after a linear translation equal to the separation distance; or a rotational symmetry such that the corresponding members of at least the first pair and second pair can be coincided to one another after a rotation of less than 360 degrees relative to an axis of rotation.

11. The field system of claim 9, wherein each of the first pair of corresponding members have a mating relation relative to a respective corresponding member in the second pair of corresponding members.

12. The field system of claim 9, wherein at least one of the first or second pairs of corresponding members define a pair of Halbach arrays.

13. The field system of claim 12, wherein the pair of Halbach arrays define at least one pair of corresponding openings for a mating relation with the second pair of corresponding members.

14. The field system of claim 9, wherein the corresponding members of the first and second pairs respectively form a first and a second pair of Halbach arrays.

15. The field system of claim 14, wherein the first pair of Halbach arrays have at least partial complementary shape relations relative to the corresponding members of the second pair.

16. The field system of claim 14, wherein the first pair of Halbach arrays have mating relations relative to the corresponding members of the second pair.

17. The field system of claim 9, wherein the corresponding members in at least one of the first pair of corresponding members or the second pair of corresponding members have a reverse polarity relation relative to one another, and the corresponding members in the other of the first pair of corresponding members or the second pair of corresponding members have an identical polarity relation relative to one another.

18. The field system of claim 1, wherein the relative movement comprises at least one of a reciprocating movement, an oscillatory movement, a rotary movement, a spinning movement, a revolving movement, or a rolling movement.

19. The field system of claim 1, wherein the first and second components defining a static relation relative to one another.

20. The field system of claim 1, wherein the at least one of the first and second field sources comprises at least one of a permanent magnet, an electromagnet, an electret, a magnetized ferromagnetic material, a soft magnetic material, or a superconductive magnetic material.

21. The field system of claim 1, further comprising:

a third component having a plurality of third field sources each having opposite polarities, wherein a relative movement of the third component with respect to the first and second components produces a field interaction with the first and second components;

wherein the plurality of third field sources are oriented relative to the at least one first and the at least one second field sources such that the field interaction produces a net repulsive force experienced by, and causing a motion of, the third component between a first and a second position.

22. A field system comprising a first component having at least one first field source having opposite polarities wherein each first field source of a plurality of the at least one first field source having at least one opening; and a second component having at least one second field source having a body having opposite polarities, to define a field direction, wherein the body comprising at least one material such that within the at least one material the field direction extending substantially in a single direction, wherein at least one of the first and second components having a movement relative to the other of the components to produce a field interaction therebetween, wherein the field interaction produces a plurality of interaction forces which results in a plurality of torques such that both the interaction forces and the resulting torques act upon the movable component;

wherein the at least one first and the at least one second field sources are oriented relative to each other such that the field interaction satisfies requirements that:

at least one of a sum of the interaction forces or a sum of the resulting torques is substantially zero; and the field interaction produces an increase in at least a first field of a plurality of fields associated with the polarities of the at least one first and at least one second field sources and a decrease in at least a second field of the plurality of fields.

23. A method of changing a field strength of at least a portion of at least one field source comprising:

arranging a first component having at least one first field source having opposite polarities relative to a second component having at least one second field source having a body having opposite polarities to define a field direction, wherein the body comprising at least one material such that within the at least one material the field direction extending substantially in a single direction, wherein the arrangement being such that a movement of at least one of the first and second components relative to the other of the components produces a field interaction therebetween; and orienting the at least one first and the at least one second field sources relative to each other such that the field interaction between the first and second components generate repelling forces associated with the same polarities of the at least one first field source and the at least one second field source and attractive forces associated with the opposite polarities of the at least one first field source and the at least one second field source substantially cancelling each other out to result in a sum of the resulting torques being substantially zero at any given time, wherein the field interaction produces an increase in at least a first field of a plurality of fields associated with the polarities of the at least one first and at least one second field sources and a decrease in at least a second field of the plurality of fields.

24. The field system of claim 22, wherein the field interaction increases at least a field associated with at least one of the polarities of the at least one first field source and decreases at least a field associated with at least another one of the polarities of the at least one first field source.

25. The field system of claim 22, wherein the at least one first and the at least one second field sources have at least a partial complementary shape relation relative to one another, wherein the at least partial complementary shape relation comprises a substantial reverse geometrical shape relation between at least a portion of the at least one first field source and at least a portion of the at least one second field source such that one portion can be substantially fitted into or received by the other portion.

26. The field system of claim 25, wherein the at least partial complementary shape relation defines a mating relation, wherein the at least one opening of the plurality of the at least one first field source substantially receive at least a portion of the at least partial complementary shaped field source of the at least one second field source.

27. The field system of claim 22, wherein the at least one first field source of the first component comprises a plurality of field sources forming a Halbach array.

28. The field system of claim 27, wherein the Halbach array has at least a partial complementary shape relation relative to the at least one second field source.

29. The field system of claim 27, wherein the Halbach array has a mating relation relative to the at least one second field source.

30. The field system of claim 27, wherein the Halbach array defines a plurality of openings for a mating relation with the at least one second field source of the second component.

31. The field system of claim 22, wherein the first component comprises a first pair of corresponding members of the at least one first field source and the second component comprises a second pair of corresponding members of the at least one second field source, wherein the corresponding members of the first and second pairs are spaced apart in a symmetry relation at a separation distance to substantially prevent a field interaction therebetween.

32. The field system of claim 31, wherein the symmetry relation comprises at least one of:

a bilateral symmetry such that the corresponding members of at least the first pair and second pair are mirror images of one another relative to a mirror plane which is perpendicularly bisecting the separation distance;

a translational symmetry such that the corresponding members of at least the first pair and second pair can be coincided to one another after a linear translation equal to the separation distance; or a rotational symmetry such that the corresponding members of at least the first pair and second pair can be coincided to one another after a rotation of less than 360 degrees relative to an axis of rotation.

33. The field system of claim 31, wherein each of the first pair of corresponding members have a mating relation relative to a respective corresponding member in the second pair of corresponding members.

34. The field system of claim 31, wherein at least one of the first or second pairs of corresponding members define a pair of Halbach arrays.

35. The field system of claim 34, wherein the pair of Halbach arrays define at least one pair of corresponding openings for a mating relation with the second pair of corresponding members.

36. The field system of claim 31, wherein the corresponding members of the first and second pairs respectively form a first and a second pair of Halbach arrays.

37. The field system of claim 36, wherein the first pair of Halbach arrays have at least partial complementary shape relations relative to the corresponding members of the second pair.

38. The field system of claim 36, wherein the first pair of Halbach arrays have mating relations relative to the corresponding members of the second pair.

39. The field system of claim 31, wherein the corresponding members in at least one of the first pair of corresponding members or the second pair of corresponding members have a reverse polarity relation relative to one another, and the corresponding members in the other of the first pair of corresponding members or the second pair of corresponding members have an identical polarity relation relative to one another.

40. The field system of claim 22, wherein the relative movement comprises at least one of a reciprocating movement, an oscillatory movement, a rotary movement, a spinning movement, a revolving movement, or a rolling movement.

41. The field system of claim 22, wherein the first and second components defining a static relation relative to one another.

42. The field system of claim 22, wherein the at least one of the first and second field sources comprises at least one of a permanent magnet, an electromagnet, an electret, a magnetized ferromagnetic material, a soft magnetic material, or a superconductive magnetic material.

43. The field system of claim 22, further comprising:

a third component having a plurality of third field sources each having opposite polarities, wherein a relative movement of the third component with respect to the first and second components produces a field interaction with the first and second components;

wherein the plurality of third field sources are oriented relative to the at least one first and the at least one second field sources such that the field interaction produces a net repulsive force experienced by, and causing a motion of, the third component between a first and a second position.

44. The method of claim 23, wherein the field interaction increases at least a field associated with at least one of the polarities of the at least one first field source and decreases at least a field associated with at least another one of the polarities of the at least one first field source.

45. The method of claim 23, wherein the at least one first and the at least one second field sources have at least a partial complementary shape relation relative to one another, wherein the at least partial complementary shape relation comprises a substantial reverse geometrical shape relation between at least a portion of the at least one first field source and at least a portion of the at least one second field source such that one portion can be substantially fitted into or received by the other portion.

46. The method of claim 45, wherein the at least partial complementary shape relation defines a mating relation, wherein each first field source of a plurality of the at least one first field source defines at least one opening to substantially receive at least a portion of the at least partial complementary shaped field source of the at least one second field source.

47. The method of claim 23, wherein the at least one first field source of the first component comprises a plurality of field sources forming a Halbach array.

48. The method of claim 47, wherein the Halbach array has at least a partial complementary shape relation relative to the at least one second field source.

49. The method of claim 47, wherein the Halbach array has a mating relation relative to the at least one second field source.

50. The method of claim 47, wherein the Halbach array defines a plurality of openings for a mating relation with the at least one second field source of the second component.

51. The method of claim 23, wherein the first component comprises a first pair of corresponding members of the at least one first field source and the second component comprises a second pair of corresponding members of the at least one second field source, wherein the corresponding members of the first and second pairs are spaced apart in a symmetry relation at a separation distance to substantially prevent a field interaction therebetween.

52. The method of claim 51, wherein the symmetry relation comprises at least one of:

a bilateral symmetry such that the corresponding members of at least the first pair and second pair are mirror images of one another relative to a mirror plane which is perpendicularly bisecting the separation distance;

a translational symmetry such that the corresponding members of at least the first pair and second pair can be coincided to one another after a linear translation equal to the separation distance; or a rotational symmetry such that the corresponding members of at least the first pair and second pair can be coincided to one another after a rotation of less than 360 degrees relative to an axis of rotation.

53. The method of claim 51, wherein each of the first pair of corresponding members have a mating relation relative to a respective corresponding member in the second pair of corresponding members.

54. The method of claim 51, wherein at least one of the first or second pairs of corresponding members define a pair of Halbach arrays.

55. The method of claim 54, wherein the pair of Halbach arrays define at least one pair of corresponding openings for a mating relation with the second pair of corresponding members.

56. The method of claim 51, wherein the corresponding members of the first and second pairs respectively form a first and a second pair of Halbach arrays.

57. The method of claim 56, wherein the first pair of Halbach arrays have at least partial complementary shape relations relative to the corresponding members of the second pair.

58. The method of claim 56, wherein the first pair of Halbach arrays have mating relations relative to the corresponding members of the second pair.

59. The method of claim 51, wherein the corresponding members in at least one of the first pair of corresponding members or the second pair of corresponding members have a reverse polarity relation relative to one another, and the corresponding members in the other of the first pair of corresponding members or the second pair of corresponding members have an identical polarity relation relative to one another.

60. The method of claim 23, wherein the relative movement comprises at least one of a reciprocating movement, an oscillatory movement, a rotary movement, a spinning movement, a revolving movement, or a rolling movement.

61. The method of claim 23, wherein the first and second components defining a static relation relative to one another.

62. The method of claim 23, wherein the at least one of the first and second field sources comprises at least one of a permanent magnet, an electromagnet, an electret, a magnetized ferromagnetic material, a soft magnetic material, or a superconductive magnetic material.

63. The method of claim 23, further comprising:

a third component having a plurality of third field sources each having opposite polarities, wherein a relative movement of the third component with respect to the first and second components produces a field interaction with the first and second components;

wherein the plurality of third field sources are oriented relative to the at least one first and the at least one second field sources such that the field interaction produces a net repulsive force experienced by, and causing a motion of, the third component between a first and a second position.

64. The field system of claim 1, wherein the at least one first field source of the first component comprises a plurality of field sources forming a substantially flat surface.

65. The field system of claim 23, wherein the at least one first field source of the first component comprises a plurality of field sources forming a substantially flat surface.

* * * * *